US010677483B2

(12) United States Patent
Ishibashi et al.

(10) Patent No.: US 10,677,483 B2
(45) Date of Patent: Jun. 9, 2020

(54) WALL, SYSTEM OF HIGHLY CLEAN ROOMS, PRODUCTION METHOD THEREOF AND CONSTRUCTION

(71) Applicants: Akira Ishibashi, Sapporo-shi, Hokkaido (JP); C'STEC CORPORATION, Sapporo-shi, Hokkaido (JP); HIEI KENSETSU CORPORATION, Sapporo-shi, Hokkaido (JP); ISHIBASHI KENCHIKU JIMUSHO CORPORATION, Saga-shi, Saga (JP)

(72) Inventors: Akira Ishibashi, Sapporo (JP); Fusao Ishibashi, Saga (JP)

(73) Assignees: C'Stec Corporation, Sapporo-shi, Hokkaido (JP); Hiei Kensetsu Corporation, Sapporo-shi, Hokkaido (JP); Ishibashi Kenchiku Jimusho Corporation, Saga-shi, Saga (JP); Akira Ishibashi, Sapporo-shi, Hokkaido (JP)

( * ) Notice: Subject to any disclaimer, the term of this patent is extended or adjusted under 35 U.S.C. 154(b) by 1050 days.

(21) Appl. No.: 14/416,300

(22) PCT Filed: Nov. 19, 2013

(86) PCT No.: PCT/JP2013/081096
§ 371 (c)(1),
(2) Date: Jan. 22, 2015

(87) PCT Pub. No.: WO2014/084086
PCT Pub. Date: Jun. 5, 2014

(65) Prior Publication Data
US 2015/0176852 A1 Jun. 25, 2015

(30) Foreign Application Priority Data
Nov. 30, 2012 (JP) ..... 2012-262931
Oct. 29, 2013 (JP) ..... 2013-223958

(51) Int. Cl.
*F24F 7/04* (2006.01)
*F24F 7/06* (2006.01)
(Continued)

(52) U.S. Cl.
CPC ..... *F24F 7/04* (2013.01); *F24F 3/16* (2013.01); *F24F 3/1603* (2013.01); *F24F 7/06* (2013.01); *F24F 7/10* (2013.01); *F24F 13/0227* (2013.01)

(58) Field of Classification Search
CPC .. F24F 7/04; F24F 13/0227; F24F 3/16; F24F 3/1603; F24F 7/06; F24F 7/10;
(Continued)

(56) References Cited

U.S. PATENT DOCUMENTS 3,299,795 A * 1/1967 Araujo Teixeira .... F24F 5/0089 454/185
3,966,407 A * 6/1976 Zuckerberg ..... F24F 3/16 422/4
(Continued)

FOREIGN PATENT DOCUMENTS

JP 2009298907 A 12/2009
JP 2011089651 A 5/2011
(Continued)

OTHER PUBLICATIONS

J. Crank, "The Mathematics of Diffusion," Clarendon Press, 1975 Second Edition; pertinent sections: Chapter 4, section 4.4 and section 1.3. Uploaded as Crank-The-Mathematics-of-Diffusion.pdf (Year: 1975).*
(Continued)

*Primary Examiner* — Avinash A Savani
*Assistant Examiner* — Martha M Becton
(74) *Attorney, Agent, or Firm* — Kilpatrick Townsend & Stockton LLP

(57) ABSTRACT

Provided are a system of highly clean rooms capable of continuously maintaining high cleanliness of air of class 1 or
(Continued)

above and supplying enough oxygen inside the room for several persons to live in and a wall adapted to the structure of such a system.

The system of highly clean rooms 10 is provided with a living space 6 and a space 5 between the roof and the ceiling as subspaces of an enclosed space formed by a room 1*a*. One of the lateral walls of the room 1*a* is constituted of a wall 9 with an internal space 7, which is a hollow wall. The internal space 7 and the living space 6 are in contact via an inner wall 9*a* of the wall 9, and a gas exchange membrane 26 is stretched in the inner wall 9*a*. Furthermore, a gas flow path 24 is provided inside the inner space 7 and the gas flow path 24 allows airtight communication between an opening 23 provided on the lowest part of the internal wall 9*a* and a gas entry opening of a fan filter unit 21 provided on a ceiling wall 2*a* inside the space 5 between the roof and the ceiling.

2 Claims, 68 Drawing Sheets

(51) Int. Cl.
*F24F 7/10* (2006.01)
*F24F 13/02* (2006.01)
*F24F 3/16* (2006.01)

(58) Field of Classification Search
CPC ..... B01D 63/00; B01D 69/00; B01D 69/02; B01D 69/06
See application file for complete search history.

(56) References Cited

U.S. PATENT DOCUMENTS 5,595,658 A * 1/1997 Fritsch ..... B01D 67/0093 210/490
5,799,652 A * 9/1998 Kotliar ..... A61G 10/00 128/200.24
5,846,128 A * 12/1998 Kramer ..... B01D 46/0086 454/229
5,976,220 A * 11/1999 Braun ..... B01D 46/005 55/385.2
6,248,153 B1 * 6/2001 Braun ..... B01D 46/005 55/385.2
7,214,301 B2 * 5/2007 Thorstensen ..... B01D 61/445 204/520
8,017,050 B2 * 9/2011 Freeman ..... B01D 67/0093 210/257.2
8,748,749 B2 * 6/2014 Srinivas ..... G06F 3/041 174/250
8,999,043 B2 * 4/2015 Suzuki ..... B60H 3/06 96/13
9,302,922 B2 * 4/2016 Diallo ..... D01F 1/10
9,956,529 B2 * 5/2018 Song ..... B01D 61/425
10,058,822 B2 * 8/2018 Diallo ..... D01F 1/10
10,245,555 B2 * 4/2019 St. John ..... C02F 1/445
10,301,198 B2 * 5/2019 St. John ..... C02F 1/445
2010/0059433 A1 * 3/2010 Freeman ..... B01D 67/0093 210/321.6
2010/0105309 A1 * 4/2010 Ishibashi ..... B01D 46/0028 454/187
2010/0190950 A1 * 7/2010 Tetsuka ..... B01D 71/44 528/15
2010/0294132 A1 * 11/2010 Ishida ..... B01D 53/228 96/11
2010/0326121 A1 * 12/2010 Ishida ..... B01D 53/228 62/407
2012/0073791 A1 * 3/2012 Dubois ..... B01D 53/228 165/138
2012/0111791 A1 * 5/2012 Freeman ..... B01D 65/08 210/500.34
2012/0297976 A1 * 11/2012 Sano ..... B01D 53/22 95/47
2012/0302427 A1 * 11/2012 Elmouelhi ..... B01J 20/3007 502/5
2013/0056244 A1 * 3/2013 Srinivas ..... G06F 3/041 174/250
2013/0112618 A1 * 5/2013 Diallo ..... B01D 71/76 210/641
2013/0156615 A1 * 6/2013 Puleo ..... A61K 9/0004 417/410.1
2013/0213881 A1 * 8/2013 Diallo ..... D01F 1/10 210/500.23
2014/0165838 A1 * 6/2014 Suzuki ..... B60H 3/06 96/13
2014/0284083 A1 * 9/2014 Srinivas ..... G06F 3/041 174/251
2015/0283512 A1 * 10/2015 Song ..... B01D 61/425 210/490
2016/0243504 A1 * 8/2016 Diallo ..... D01F 1/10
2018/0071693 A1 * 3/2018 Diallo ..... B01D 71/76
2018/0104649 A1 * 4/2018 Govindan ..... B01D 61/022
2019/0046934 A1 * 2/2019 Diallo ..... D01F 1/10

FOREIGN PATENT DOCUMENTS

WO 2008139777 A 11/2008
WO 2012011547 A1 1/2012

OTHER PUBLICATIONS

Ishibashi, Akira, et al.; International Preliminary Report of Patentability for International Application No. PCT/JP2013/081096 dated Jun. 11, 2015, 9 Pages.
C'Stec Corporation et al., International Application No. PCT/JP2013/081096, International Search Report, dated Feb. 4, 2014.
Japanese Application No. 2013-016456, Notification of Reason(s) for Refusal, dated Apr. 9, 2014.

* cited by examiner

WALL, SYSTEM OF HIGHLY CLEAN ROOMS, PRODUCTION METHOD THEREOF AND CONSTRUCTION

TECHNICAL FIELD

The present invention relates to a wall, a system of highly clean rooms, a production method thereof and a construction. More particularly, the present invention relates to, for example, rooms contained in a construction such as a house, a building, etc. in which people do daily life or activity such as sleep, relax, operation, work, etc. The present invention relates to a system of highly clean rooms which can keep the number of inside dust particles such as dust, germs, etc. below a constant value without reducing the ratio of the volume of the life/activity space to the whole building and can realize a clean air environment capable of preventing them from entering from the outside and is preferably used as fields of living, rest, experiment, operation of production and painting, nursing activity, medical or dental treatment, etc., a production method thereof and a construction and a wall suitable for them and their equivalent.

BACKGROUND ART

It may be said that with respect to information processing and communication environment, mankind realized a highly convenient environment never realized from historic times with development of computer technology at present. In other words, it can be said that a stimulating perfect good field for brain was realized. On the other hand, with respect to an environment for body, it cannot be said that modern society is always a good environment due to increase of pollution materials, floating of dust or infectious bacteria in air, etc.

A clean environment exists for large-scale semiconductor manufacture conventionally. However, the clean environment is only for professional use, i.e., for industry. No clean environment for consumer used for general houses has been introduced. Once in the world of computers, personal computers flourished, carrying the banner for "Computer for the rest of us" and drawing the line between the personal computers and the large-scale computer main frame for business. Like this, while the importance of environment increases in twenty-first century, it may be hoped that "clean environment version" of personal computers appears. In fact, a personal clean space, which is the counterpart of just "main frame" as large-scale clean room with the high performance realized in long time ago, will surely become important in the future not only for pure consumer but also for scenes such as hospitals, institutions for the aged, etc. in which it is important to avoid risk of infection. Bringing a clean space in the world of consumer will realize "for all of us" beyond "the rest of us" and is very important. However, at present it is not easy to introduce a personal clean environment into a general living environment, drawing the line between the personal clean environment and the conventional clean room, as described later. It is a matter of great urgency for us to establish the scalable high performance "air environment controlling apparatus" (which can eliminate all airborne matters from dust to microbes, and conversely speaking, control desired matter in an appropriate concentration) corresponding to a vacuum chamber (with respect to controlling gas molecules enclosed in the chamber) that made possible development of science, made industrial technology sophisticated and played a big part. With this, it becomes possible to develop bioscience and make medical treatment and nursing industrial technology high. Particularly, it will become more important in the future to control an air environment for the problem of PM 2.5, further, a microbial environment in a living space.

Let's see conventional general houses. FIG. 1 is a perspective view showing an example. FIG. 2 is a drawing showing a cross section of another example of conventional general houses.

As shown in FIG. 1, a house 500 is provided with a living part 505 surrounded by walls 501 on a base 504 and invasion of wind, rain, dust, etc. is prevented by being formed of a roof 503 so as to cover the upper part of the living part 505. At least one of the walls 501 has a window 502. Furthermore, as shown in FIG. 2, the house 500 is provided with the living part 505 surrounded by the walls 501 on the base 504 and a roof 503 is provided on the upper part of the living part 505 so as to cover the whole of the living part 505 as the same as mentioned above. Two spaces, i.e., a space 507*b* between the roof and the ceiling and a space 507*a* under the floor are provided between the living part 505 and the roof 503 and between the living part 505 and the base 504, respectively. These spaces play a role of, for example, insulation, introduction of outside air, etc.

The living part 505 is constructed by being surrounded by the walls 501. For example, the living part 505 is constructed by being surrounded by the walls 501 as lateral walls, ceiling walls, floor walls, etc. The living part 505 is divided, for example, by a partition wall 501*d* provided inside the living part 505, etc. to form a room 505*a*, a hallway 505*b*, etc. The space surrounded by the room 505*a* is a living space 506. The partition wall 501*d* has a door 508. The living space 506 is partitioned as wide as possible. Outside air is introduced into the living space 506 from the outer space through the space 507*a* under the floor, the space 507*b* between the roof and the ceiling, etc. and the inside of the room and the outer space communicates by air.

Walls for partitioning the living space is now explained. FIG. 3 is a perspective view showing an example of construction of a wall of a conventional general house. FIG. 4 and FIG. 5 are perspective views showing examples of construction of walls of apartment houses, buildings, etc.

As shown in FIG. 3, the wall 501 is reinforced by providing an inner wall 501*a* and an outer wall 501*b* facing each other apart a constant distance and by providing an intermediate pillar 508 in a space sandwiched by the inner wall 501*a* and the outer wall 501*b* and the rest space is almost densely filled with insulator 509. Because the wall 501 has such a structure, its weight can be held down. Also, because the structure of the wall 501 is the filled structure, the strength of the wall 501 can be kept while improving the performance of insulation and soundproof. Furthermore, as shown in FIG. 4, in another example of the wall 501, the insulator 509 is densely filled in a space sandwiched between the outer wall 501*b* constructed by concrete having inside a steel rib 510 and the inner wall 501*a* on which a wallpaper 501*c* is provided. Also, as shown in FIG. 5, in this example, the wall 501 having the steel rib 510 is provided on a floor slab 511 and the wall 501 has a filled structure. As described above, the walls of conventional architectures such as houses, apartment houses, buildings, etc. have generally a filled structure such as a solid wall. On the other hand, a thin inner wall may be provided for the thin outer wall in houses etc. to hold down the weight of a wall made of a single wall. However, heretofore, in order to obtain the strength of the wall and enhance the effect of insulation, soundproof, etc., reinforcement, insulation, etc. are densely filled. Finally, the wall has frequently a multilayer structure and has essentially a filled structure. Conventional hollow walls mainly aim to reduce the weight of the wall as light as possible to reduce the total weight of the upstairs in wooden houses such as tow-story houses, three-story houses, for example. There has been no attempt to hollow the wall and positively use the hollowness to improve cleanliness of the room adjacent to the wall.

Under the circumstances, Ministry of Land, Infrastructure and Transport has proclaimed the promotion of houses utilizing the nature of area to take a step forward from general situation of conventional houses described above. The Forestry Agency also has begun to support building of houses utilizing wood of the concerned area and steered for energy saving houses and long life excellent houses. Genuine walls and Japanese style tiles adequate for climate in Japan and cultivated in history for over one thousand and hundreds of years are positively revaluated. As a standard of long life excellent houses introduced by an accumulation of technology, earthquake-resistance, deterioration-resistance, energy saving the performance and maintenance and keeping measure are mentioned (for example, see non-patent literature 1). According to this, the concept of energy saving and smart houses is presented by respective house makers of Japan (see, for example, non-patent literatures 2 and 3). On the other hand, the importance of houses that can make wind path is pointed out.

However, the concept of smart houses directs mainly to energy management targeting mainly electric power. And the concept of improving wind path lies mainly only presentation in view of air conditioning such as cool breeze control.

Furthermore, the importance of clean environment is increasing more and more in general houses, offices in a building, etc. and the demand for clean environment rises. Its reason is as follows. To take measures against not only pollinosis but also an epidemic of influenza, even if source materials are brought into the house, it is highly necessary to remove and control the source materials.

However, as understood from the above situation, it is not easy to improve the performance of a room revolutionary and essentially. Although it is desired in principle to increase the volume ratio of a room that is a space for living/activity to the whole construction while keeping the rigidity of the room, there exists an air current between the room and the outer space, i.e., an air passage as a mass flow between the inside and outside in conventional constructions. Therefore, cleanliness of the room is basically in equilibrium to that of the outer space. As a result, cleanliness of the room regrettably stays equivalent to that of the outer space or slightly high cleanliness due to removal of exhaust gas, smoke, dust, etc.

Under the circumstances, the above mentioned smart house framework that is an excellent technical idea is apt to be thought dummy. As a result, it is very difficult to improve quality of life. However, it is predicted that the necessity of clean environment increases more and more in Japan in which the ratio of aged persons is increasing and further in each country in the world in the near future and the clean environment is to be urgently introduced.

For example, especially the number of patients suffering from allergy such as asthma, atopic dermatitis, etc. is increasing rapidly in recent years. Allergic asthma due to inflammation of a respiratory tract is considered to be caused by various stimulus such as antigen, germs, etc. that invade from the outside. With respect to the cause of asthma, the possibility that weakness of the barrier function of epithelium cells of the respiratory tract relates to it. The barrier function of the epithelium cells of the respiratory tract is determined by the three dimensional structure of cells and the function of protein connecting cells. If the barrier function is weak, substances are easy to invade from the outside than usual and an inflammation reaction of the epithelium cells of the respiratory tract becomes strong more and more. As the epithelium cells of the respiratory tract of a patient whose barrier function is weak are damaged by frequent infection of virus or inflammation and their restoration is not normally carried out, it is considered that there is a possibility of malfunction of immunity, appearance of irritation to environment matter, and a structure change of the respiratory tract by chronic continuous inflammation of the respiratory tract. As described above, it is important for patients suffering from asthma allergic inflammation of the respiratory tract to suppress various stimulation such as antigen and microbes invading from the outside not only in hospital but also in general life at home as much as possible. In order to realize this, it is necessary to greatly clean air in a living environment. However, a huge sum of money is necessary to attain a goal with existing technology. For example, a clean room of US209D class 1 (ISO class 3) that is used in semiconductor processing, etc. is a highly clean space called a super clean room. It takes a huge sum of money to construct and maintain the system. Such a clean environment is suitable for a medical environment and is expected to prevent air infectious disease such as influenza, etc., to suppress pollinosis, to recover damaged respiratory organs during sleeping in night, etc. It is very important to introduce a clean space into a room of a house, a daily space in which a patient having such a disease lives, to switch on or off the clean environment voluntarily, and further to change on state and off state in a short time scale. If they are realized, the value is very high. However, it is regret to say that they are now impossible.

Further, in recent years, it is an urgent subject to take preventive measures against the spread of pollinosis and an epidemic of SARS or new type influenza and care the environmental weak such as babies and infants, aged persons, etc. Also, recently, the importance of microbe science and the control of microbe and its living environment is recognized more and more (for example, see non-patent literatures 4-6). It becomes important more and more to control not only airborne inorganic and organic dust but also the air environment including a microbial environment in the living space, and it is an urgent subject to realize technology and apparatus that can embodies them.

In such a situation, in order to achieve an aim to improve cleanliness of the living space, it is considered to introduce a so-called clean room. In other words, as described above, in general houses, a room, which is a living space, is formed by surrounding a space with walls, and using the room as the first stage structure, one more nesting room is built in it. With this, for at least the concerned nesting internal space to be improved its cleanliness, it is possible to realize improvement of its cleanliness by existing technology by introducing the construction of the usual clean room.

FIG. 6 is a substitute picture for a drawing showing a conventional typical clean room. FIG. 7 is a cross-sectional view showing the structure of the clean room. As shown in FIG. 6 and FIG. 7, the clean room 600 is a clean room provided with double rooms in which an existing construction 601 is provided as the first stage space and a working room 602 that is a clean room is provided inside the construction 601 as the second stage space in a nesting structure. The working room 602 forms a space without pillars inside by securing a suspended base 604 from a ceiling 603*a* that is the surface of a roof 603 on the side of the internal space of the construction 601 and providing reinforcements on the ceiling 606 of the working room 602. A fan filter unit (hereafter referred to FFU as necessary) 605 is provided on the ceiling 606 of the working room 602. Outside air absorbed from an absorption opening 607 and filtered by the FFU 605 is introduced into the working room 602 that is a clean room from an introduction opening 608. With this, the pressure inside the working room 602 is positive relative to the outside, and air introduced inside the working room 602 from the FFU 605 leaks together with dust inside the room from an exhaust opening 609 to the outside with a relatively low pressure, so that a highly clean environment of about class 1 to 100 is kept inside the working room 602. As described above, the ceiling and the lateral walls on every side of the clean room 600 have a double structure. Although not illustrated here, a higher clean room for semiconductors may make the floor as a double structure and realize higher cleanliness by a laminar flow and at the same time make it possible to place piping or a maintenance space under the floor. In this case, in a parallelepiped room forming the working room 602, all of the six faces of the parallelepiped has a double structure. In the conventional clean room, there exists a huge space between the outside (the first stage) room and the inside (the second stage) room. For the first stage room, there is a large loss of the area and/or volume. However, it is a usual way to use the space between the first stage room and the second stage room as a maintenance space and compensate the loss of the area and/or volume.

As described above, in the conventional clean room, a working room that becomes a clean space is constructed inside the internal space of the construction in a nesting structure. Therefore, there occurs an additional space that persons can enter between the wall of the construction and the wall of the working room. For example, for industry such as a semiconductor factory etc., i.e., for professional use, the space is effectively used as a maintenance space and a working space. However, it is very difficult and not practical to apply the structure of the conventional clean room for consumer use and introduce into a private house or a room of a building to improve cleanliness. Its reason is as follows. If the conventional structure of the clean room is introduced into a general house, the volume ratio of a life/activity space to the whole construction is markedly reduced. For this, considering the situation in Japan that a room of the house is cramp, it is practically impossible to introduce the conventional structure of the clean room into a room of a private house and a building.

Examples of a future house represented by the above smart houses correspond to a simple single structure without a nesting structure that is a double structure constructing a room inside another room like the existing clean room from the aspect of structure. The importance of a clean environment increases more and more in general houses, offices in a building, etc. having only single structure walls as described above. In addition, further difficulty of introducing the above conventional clean room structure into a room of private houses or buildings is that there occurs a pressure difference between the room that has introduced a clean room structure to improve cleanliness and other rooms around the room. This results in a situation that air including dust always leaks from the cleaned room around the room. It seems to be that emission of air inside the room to the outer space does not matter particularly. However, in Japan having the four seasons exhaust of air inside a room to the outer space in summer and winter but spring and autumn means to absorb the same quantity of air from the outer space, so that the cost of keeping room temperature by cooling and heating becomes comparatively high and it becomes difficult to maintain a clean environment. Actually, there exist no general houses with a pressure difference between rooms or between a room and a hallway etc. in the world including Japan. Therefore, it is very difficult to introduce existing clean room technology to incorporate a clean environment into a general house.

Especially, in clean rooms aiming application to industry, there are four general rules. And by obeying the rules a highly clean environment is realized. The four general rules are firstly not bringing into, secondly not generating, thirdly not depositing and fourthly removing.

That is, the first "not bringing into" means that when entering a clean room, for example, materials and equipment are to be brought into the clean room after cleaning them, pressure inside the room is to be controlled, i.e., an air current from the inside to the outside of the room is to be kept, movement of persons in the room is to be accompanied with an air shower, etc. The second "not generating" means that when acting in a clean room, for example, a dustless wear is to be worn, materials and equipment generating easily dust are not to be used, useless movement is not to be carried out, etc. The third "not depositing" means that for example, dust is not to be accumulated by providing a curved part in the junction between the wall and the floor of the clean room, the structure is to be designed so as to be cleaned easily, the structure is to be designed so as not to have unevenness, etc. The fourth "removing" means that for example, obstruction of the air current is to be reduced as much as possible by exhausting air around dust generating parts inside the clean room. Among these general rules, the first, the third and the fourth general rules are effective guidelines directly applicable to not only general living space but also nursing homes, medical and dental treatment rooms, etc. and should be obeyed. However, with respect to obeying the second general rule, because people act essentially with common clothes that are not dust-free wears in the room of houses, hospitals, nursing homes in which persons do daily life/activity such as sleeping, relaxing, working, laboring, etc. and generation of dust inside the room is a very natural result of the daily life and activity, it is practically impossible to suppress it due to direct opposition to improvement of the quality of life. From this, it is fully understood that it is almost completely unreasonable to apply the existing clean room technology simply to rooms of general houses, sickrooms, etc.

The fact that the conventional clean room needs the second general rules, i.e., the conventional clean room is weak in dust generated inside results from that an FFU attached to the clean room filters outside air but never removes dust generated inside. That is, the principle of the existing clean room is based on that clean air obtained by filtering outside air through the FFU is introduced into the clean room, thereby the concentration of dust existing in the clean room is "relatively diluted" by a contribution of the volume of the clean air and resultantly cleanliness inside the clean room is improved. That is, it only improves cleanliness in a very passive way with respect to dust generated inside because the existing clean room does not actively remove dust generated inside. In such a passive way, dust is, so to speak, "still on the loose" in rooms of a general house and a hospital or working rooms of a painting factory in which dust is inevitably generated inside and it is inevitable to exhaust dust together with gases inside and therefore it is quite difficult to improve cleanliness. Furthermore, it is needless to say that such exhaustion causes the outside a lot of trouble. In the sense, the conventional clean room is based on the tacit assumption that the outer space exists as an infinite dump and is not compatible with the twenty first century environmental view of the world that one must act on the understanding that even the earth is a finite system due to rapid expansion of human activity. It is very important to realize a clean environment self-contained without causing the outside a trouble, recognizing that the earth is a finite system.

Under the circumstances, with respect to improvement of cleanliness that is a subject of the conventional clean room, the present inventors proposed a 100% circulation feedback system to rapidly improve cleanliness of a clean room and demonstrated its effectiveness. The 100% circulation feedback system is configured so that an airtight gas flow path for introducing air flowing from a dust filter to an absorption opening of the dust filter is used as a feedback gas flow path and all of gases flowing out flow to an entrance of the dust filter through the feedback gas flow path (see, for example, patent literatures 1, 2 and non-patent literatures 7, 8).

However, all of these clean systems function only after being placed in a room provided in advance. Although cleanliness of these clean systems much improves compared with the conventional clean room shown in FIG. 7, it is used as the so-called desk top type to be used on the desk inside the room. This clean system has "a nesting structure" that it is placed inside the existing structure. Therefore, even though this clean system is scaled up, there still remains the problem that the volume ratio of life/activity space to the whole construction reduces markedly due to "the nesting structure" described above.

As described above, there exists much need for cleaning a room without changing so much from the general private room. That is, it is desired that the form like the clean room for industry is not adopted and the inside of the room is cleaned while avoiding reduction of the living space due to the nesting structure. Under such a need, as available means and the next best thing, the so-called air cleaning device is introduced into rooms of a house, offices of a building, etc. that are daily space and causative agents are removed. However, the conventional room is "a semiopen system" in which the outside space and the room are not completely separated. Or in most of the conventional room, "the semi-open system" picture is a good approximation, taking into consideration the flow rate of the air cleaning device and the ventilation rate of the room. That is, most of air inside the room is changed until the time that dust inside the room is reduced to 1/e (e is a base of a natural logarithm) by the air cleaning device. Furthermore, it is difficult to say that generation of an air current upon opening and shutting of the doorway is optimized. Therefore, the effect of the air cleaning device is limited. Under the circumstances, it is necessary for the environmental weak including persons suffering from the so-called pollinosis and asthma or the drop of the immunity in the situation that needs dialysis etc. to realize a space of higher cleanliness for example, a space with less dust, germs, odor, etc. in future in order to maintain the high quality of life. In order to form such a space, air cleaning by the conventional air cleaning device etc. is insufficient. As described above, although the air cleaning device etc. are surely introduced into the market at present, the home living environment of a quantitative clean environment is not realized at all. In order to cope with medical treatment for the aged, an immunodeficiency disease, etc., it is desired to use a germ-free room (US209D class 100) and further a space and a living environment with a cleanliness of class 1 as needed, while they do not feel at all that they are inside a mechanical-sounding clean room, and for example, the room has almost usual pure Japanese style appearance.

However, it is impossible to realize such a room.

PRIOR ART LITERATURE

Patent Literature

[PATENT LITERATURE 1] Specification of U.S. Pat. No. 4,934,061

[PATENT LITERATURE 2] Specification of U.S. Pat. No. 4,451,492

[PATENT LITERATURE 3] Laid-open publication No. 2006-200111

Non-Patent Literature

[NON-PATENT LITERATURE 1] "Sumai Bunka Shinbun", 21, Mar. 1, 2012, Misawa International Corporation

[NON-PATENT LITERATURE 2] "Sekisui Heim Catalogue", March, 2012

[NON-PATENT LITERATURE 3] "Misawa International Corporation Catalogue home club 1", vol. 234, January, 2012

[NON-PATENT LITERATURE 4] "The great indoors", NewScientist, 13 Jul. 2013, p. 30

[NON-PATENT LITERATURE 5] "Why manners matter", NewScientist, 21 Sep. 2013, p. 28

[NON-PATENT LITERATURE 6] C. Pinke et al., "Insights into the phylogeny and coding potential of microbial dark matter", Nature 499 (2013) 431

[NON-PATENT LITERATURE 7] A. Ishibashi, H. Kaiju, Y. Yamagata and N. Kawaguchi: Electron. Lett. 41, 735 (2005)

[NON-PATENT LITERATURE 8] H. Kaiju, N. Kawaguchi and A. Ishibashi: Rev. Sci. Instrum. 76, 085111(2005)

[NON-PATENT LITERATURE 9] [Searched on Sep. 30, 2012], The Internet<URL:http://www.toyobo.co.jp/seihin/fb/procon/prc_09.pdf

SUMMARY OF INVENTION

Subjects to be Solved by Invention

As described above, the living space having cleanliness of super clean room level and appearance of a quite common room is not realized at present. There is no clean environment system capable of actively removing dust that can keep clean living rooms to be an environment allowing people to live daily and act inside according to conventional customs and keep cleanliness of the inside space of the room to be US209D class 100 or higher, even though dust is generated inside the room, without reducing the ratio of the floor area and volume of the clean living environment space (room) to the whole construction and accompanying exhaustion of dust to the outer space from the clean living room.

That is, there is no clean environment system that can remove dust inside a clean living room without reducing the ratio of the floor area and volume of the clean living room to the whole construction and accompanying exhaustion of dust to the outer space from the clean living room. Furthermore, there is also no clean environment system that can keep rooms to be an environment allowing people to live daily and act inside according to conventional customs and keep cleanliness of the internal space of the rooms to be US209D class 100 or higher, even though dust is generated inside the rooms. Naturally, there is no clean environment system with the both functions conventionally. Therefore, there is a need of improving the performance of walls forming a room toward acquisition of a clean environment without especially changing the thickness of the wall so as not to narrow the room and deteriorating the strength, the soundproofing ability and the insulating ability of the internal structure of the wall.

A clean environment is expected for a medical environment, especially, for prevention of an airborne infectious disease such as influenza etc., control of pollinosis, recovery of damaged respiratory organs, etc. However, the concept of smart houses presented by respective house makers mainly relates to energy management targeting mainly electric power. And the concept of improving corridors of wind relates only to presentation from mainly an air conditioning standpoint such as control of a cool breeze etc. Furthermore, incorporation of a clean room into a room of a general house costs too much and brings a nesting structure into the room, which cannot be tolerated from mechanical-sounding appearance, interior decorations and space. In cases where the structure of the clean room is simply incorporated into general houses, offices of buildings, etc., the volume of the living space reduces due to incorporation of the nesting structure as described above, there occurs the pressure difference between the inside and the outside of the room and thereby unnecessary movement of dust such as collection, emission, etc. of dust results, which is the inconvenience.

That is, as described above, it is not allowed to improve cleanliness of a part as a result of giving the pressure difference between a room of a house and parts other than the room. Its reason is as follows. That is, dust and germs in a room move to other places in the house and cleanliness of the places is deteriorated, so that the peace of persons living and acting inside the places is disturbed. Therefore, in order to avoid such a situation and obtain cleanliness keeping a common room, conventionally air cleaning devices are introduced into the room. However, even though the air cleaning devices are introduced into the room, a marked improvement such as a reduction of dust below thousandth (improvement of cleanliness by three orders of magnitude) to be discussed quantitatively is not realized at all, regardless of indicating a qualitative improvement of cleanliness compared with an ordinary environment (or quantitatively, a reduction of dust by a fraction to tenth).

Furthermore, inner walls constituting a conventional clean room are constructed from smooth resin walls etc. in order to suppress generation of dust inside the clean room. However, it is difficult to apply such a mechanical-sounding room to a room of a general house as it is. That is, incorporation of the clean room structure into rooms of a house, offices of a building, etc. that are daily space and living a stress-free natural daily life are not compatible. As described above, it is not possible to make a living space looking like a common room in appearance a clean environment of the level of a sterile room of a hospital (US209D class 100) to the level of a super clean room of class 1.

Therefore, a subject to be solved by the invention is to realize a daily living space itself as a clean space of class 100 or higher looking like just a common room in appearance without particularly increasing the load of space and structure in the building structure. Another subject is to improve cleanliness of a room of a house without a problem that the pressure difference results between the room and parts of the house other than the room, which is caused by using conventional clean room technology. A further subject is to save "a situation such that generated dust is scattered outside of the room and people living outside the room are troubled" by actively collecting dust generated inside by a fan filter unit attached to the room. Still another subject is to provide a system of highly clean rooms capable of always keeping the high air cleaning ability of, for example, class 1 or higher of a room in which people in Japan and the world live, act and are subjected to treatment and nursing without changing "no pressure difference between the inside and the outside of the room", living customs of conventional houses, and capable of living and acting comfortably and peacefully inside and a production method thereof.

Another subject to be solved by the invention is to provide a construction capable of always keeping a room in which people in Japan and the world live, act or are subjected to treatment and nursing having the high cleaning performance of, for example, class 1 or higher, keeping living customs of conventional houses "no pressure difference between the inside and the outside of the room" and capable of living and acting comfortably and peacefully.

A further subject to be solved by the invention is to provide a wall adapted to the system of highly clean rooms.

The above subjects and other subjects will be apparent from the following statement of this description referring to accompanying drawings.

Means for Solving the Subjects

In order to solve the above subject, a new functional wall is realized and a system of highly clean rooms and a construction based on the wall in which persons can live and act comfortably and peacefully are provided by an equal pressure cleaning technology that is a new technology.

That is, according to the invention, there is provided a wall with an internal space capable of introducing air for a room, comprising:

airways communicating the outside and the internal space, provided on the edge of the wall, at least one of major surfaces forming the internal space being made of a membrane not passing through dust particles but passing through gas molecules.

Furthermore, according to the invention, there is provided a system of highly clean rooms, comprising:

at least one room, at least one of the walls constituting the room being constituted of a wall with an internal space capable of introducing air for a room, airways communicating the outside and the internal space being provided on the edge of the wall, at least one of major surfaces forming the internal space being made of a membrane not passing through dust particles but passing through gas molecules, the room being configured so that the room is provided inside with a living space as an enclosed space, there is no movement of air as an air current between the inside and the outside of the living space, air is introduced into the internal space of the wall from the outside space enclosing the room through the airway of the wall, the room is provided with the first fan filter unit provided with a blow opening so as to supply gases inside the living space, at least one opening corresponding to an absorption opening of the first fan filter unit is provided in at least one of the lateral walls of the room, all of gases flowing inside the living space from the blowing opening pass through the opening and a gas flow path airtightly communicating the absorption opening and the opening and fed back to the first fan filter unit, the room being provided with doorways capable of moving in the living space.

Furthermore, according to the invention, there is provided a construction, comprising:

at least one room, at least one of the walls constituting the room being constituted of a wall with an internal space capable of introducing air for a room, airways communicating the outside and the internal space being provided on the edge of the wall, at least one of major surfaces forming the internal space being made of a membrane not passing through dust particles but passing through gas molecules, the room being configured so that the room is provided inside with a living space as an enclosed space, there is no movement of air as an air current between the inside and the outside of the living space, air is introduced into the internal space of the wall from the outside space enclosing the room through the airway of the wall, the room is provided with the first fan filter unit provided with a blow opening so as to supply gases inside the living space, at least one opening corresponding to an absorption opening of the first fan filter unit is provided in at least one of the lateral walls of the room, all of gases flowing inside the living space from the blow opening pass through the opening and a gas flow path airtightly communicating the absorption opening and the opening and fed back to the first fan filter unit, the room being provided with doorways capable of moving in the living space.

Furthermore, according to the invention, there is provided a system of highly clean rooms, comprising:

at least one room, at least one of the walls constituting the room being constituted of a wall with an internal space capable of introducing air for a room, airways communicating the outside and the internal space being provided on the edge of the wall, at least one of major surfaces forming the internal space being made of a membrane not passing through dust particles but passing through gas molecules, the room being provided inside with an opening for absorbing air inside the room and a blowing opening for returning again all of the absorbed air after cleaning inside the room as a pair.

Furthermore, according to the invention, there is provided a production method of a system of highly clean rooms, comprising;

at least one room, at least one of the walls constituting the room being constituted of a wall with an internal space capable of introducing air for a room, airways communicating the outside and the internal space being provided on the edge of the wall, at least one of major surfaces forming the internal space being made of a membrane not passing through dust particles but passing through gas molecules, the room being configured so that the room is provided inside with a living space as an enclosed space, there is no movement of air as an air current between the inside and the outside of the living space, air is introduced into the internal space of the wall from the outside space enclosing the room through the airway of the wall, the room is provided with the first fan filter unit provided with a blowing opening so as to supply gases inside the living space, at least one opening corresponding to an absorption opening of the first fan filter unit is provided in at least one of the lateral walls of the room, all of gases flowing inside the living space from the blow opening pass through the opening and a gas flow path airtightly communicating the absorption opening and the opening and fed back to the first fan filter unit, comprising;

designing the room by scaling the volume V of the living space and the area A of the membrane of $\{(V/A)/(D/L)\}$ where D is the diffusion constant of oxygen in the membrane of the wall and L is the thickness of the membrane and producing the room.

The room is constituted of an enclosure constituting an enclosed space and its concrete example is a room of a construction etc. The construction may be all rooms supporting human activity such as, for example, detached houses, apartments, condominiums, buildings, hospitals, movie theaters, nursing institutions, schools, preschools, kindergartens, gyms, factories, paint rooms, lacquer rooms, etc. The room can be also applied to, for example, a room inside a mobile body with an internal space. The mobile body may be, for example, cars, especially ambulances, planes, passenger trains, passenger buses, sailboats, passenger boats, etc.

No movement of air as an air current between the inside and the outside of the room means, for example, that the incoming and outgoing air currents for the room are strictly zero during operation of the system of highly clean rooms. However, its meaning is not limited to this and it includes, for example, a case that moves a clean air current with the flow rate much smaller than the flow rate of air subjected to 100% circulation feedback in the highly clean room. Furthermore, no net air current between the inside and the outside of the room includes, for example, that pressure inside and outside of the room are the same.

The doorway is not essentially limited as far as it has a structure capable of moving of persons etc. The doorway preferably has a structure capable of blocking the living space from the outside airtightly by opening and shutting it. Objects moving through the doorway are not limited to persons and they may be, for example, small animals etc. Examples of the doorway are doors, concretely, hinged doors, sliding doors, sliding doors with pocket, glide-side doorways, folding doors, slide shutters, winding-up shutters, etc. The doorway may be automatic or manual.

The wall is not essentially limited as for as it is a wall, a plate, etc. partioning the enclosed space constituting the room and may be, for example, ceiling walls, lateral walls, floor walls, partitions, etc. The structure of the wall is not essentially limited and may be, for example, the single layer structure and multi-layered structure using the same materials, the multi-layered structure using different materials, etc. It is also possible to use a wall that increases the strength by inserting diagonal braces inside or by inserting metal materials having the cross section of U-shape, H-shape or C-shape inside. Materials constituting the wall have preferably rigidity to some extent when the wall is constituted of the materials and they are, for example, concrete, metals, bricks, woods, wood pulp, resin, plaster, glasses, composite materials, etc., but not limited to these. The wall may be, for example, vinyl sheet and tube composite body that can support the structure by sealing air into the body.

Partitions are not essentially limited as far as they are provided so as to partition the inside of the room and they are, for example, ceiling plates, partition walls, etc.

The living space is not limited as far as it is a space isolated from the outer space and it is preferably a space having the size in which living things can live. The living space has more preferably the size allowing persons to live in. The living things are, for example, animals, plants, etc. and concretely, persons, dogs and cats that are small animals, potted plants that are small plants, etc. When the living space is used as, for example, a room for pets in which small animals live, it needs to have the enough volume allowing the small animals to live. In this case, the living space can be used as a small room in which even though small animals such as pets etc. live, there are no odors and floating germs, i.e., a small room that can be provided inside a living room for persons without a harmful influence. The performance of the gas exchange membrane forming a part of lateral walls of the room is set so that the oxygen concentration inside the living space not only always exceeds the value provided by the law so as to allow persons to live but also always keep preferably more than 18%, more preferably 19%. The living space can be constituted so as to have a main room and an anteroom that are independent rooms. The anteroom is a room that persons etc. enter before they enter the main room. The anteroom is an enclosed space capable of moving formed, for example, by providing a partition so as to face with the doorway inside the living space. The partition may be provided with a doorway and persons etc. can move between the living space that is the main room and the anteroom through the doorway. There is no air current moving between the inside and the outside of the anteroom. The anteroom may be provided with the second fan filter unit in which a blow opening is provided so as to send gases inside the anteroom. At least one opening corresponding to an absorption opening of the second fan filter unit is provided on the lower part of lateral walls of the anteroom. And all of gases flowing inside of the anteroom from the blow opening of the second fan filter unit pass through the opening and the second gas flow path communicating the absorption opening of the second fan filter unit and the opening airtightly and fed back to the second fan filter unit. By constituting like this, it is possible to move between the living space and the outside of the room by the doorway and the doorway provided in the partition. The doorway provided in the partition is not essentially limited and can be constituted as the same as the doorway described above. The doorway provided in the partition is preferably a sliding door and at last a part of the doorway is preferably constituted of a membrane not passing through dust particles but passing through gas molecules.

The internal space is not essentially limited as far as it is formed inside the wall. For example, the internal space may be an enclosed space of the single wall (panel) having the hollow structure, an enclosed space formed by sandwiching the outer wall of the room and the inner wall provided inside the room, etc. The internal space may be also formed by additionally providing partitions such as panels etc. inside the room or by using walls provided in the existing room. The wall constituting the internal space is, for example, a hollow wall. The hollow wall is not essentially limited as far as it has a hollow part in at least a part of the wall. For example, the hollow wall preferably has a hollow part capable of moving gases from the upper edge to the edge of the wall at least in a part of the inside of the wall. Or the hollow wall preferably has a duct capable of moving gases from the upper edge to the lower edge of the wall or a hollow part capable of carrying a structure having the function equivalent to the duct. For example, the hollow wall has preferably a piercing part communicating one lateral part of the wall to the other lateral part facing to it. The piercing part is not essentially limited as far as it is provided at least a part of the side of the wall. In cases where the hollow wall has, for example, a parallelepiped shape, the piercing part is preferably provided at the whole of the pair of sides facing each other of the wall. Concretely, the hollow wall is, for example, the one having a cylinder shape and its cross section is preferably rectangular. A wall with inserted braces or a wall enclosing a pillar provided with metal materials having the cross section of U-shape is preferably placed on the lateral walls other than the hollow wall. The hollow wall may be made of a single material or plural materials. In cases where the hollow wall is made of plural materials, for example, it is preferable to provide the outer wall and the inner wall facing each other a constant distance apart and use the space formed by the outer wall and the inner wall as the hollow part. By using the existing walls, it is possible to use the existing room as the system of highly clean rooms without narrowing the living space.

The fan filter unit is a dust filter having a ventilation power. Although the dust filter means a dust filter using filter materials itself, the fan filter unit specifically defines that a ventilation power accompanies the dust filter. Concretely, a ventilation fan is provided outside the dust filter as one body, or a ventilation fan is provided apart from the dust filter on the way of the gas flow path on which the dust filter is placed, which means that the dust filter has a ventilation power by the ventilation fan.

Hereafter, as necessary, an airtight gas flow path for introducing gases flowing from the dust filter into an absorption opening of the dust filter is referred as a feedback gas flow path. Gases flowing in the feedback gas flow path do not essentially generate a macroscopic mass flow passing through the membrane not passing through dust particles 100%. Therefore, it is possible to prevent dust particles from entering inside the room from the outside of the room and cleanliness inside the room does not deteriorate.

The membrane not passing through dust particles but passing through gas molecules is not essentially limited as far as it does not pass through dust particles but pass through gas molecules between spaces separated by the membrane. For example, the membrane not passing through dust particles but passing through gas molecules is preferably possible to exchange gas molecules through the membrane when the pressure difference between spaces separated by the membrane is zero but there is a difference of partial pressure of gas constituents constituting air on both sides of the membrane. From this, the membrane not passing through dust particles but passing through gas molecules may be, for example, a partition not passing through dust particles but passing through gas molecules. Here, "not passing through dust particles" includes not only the case where dust particles cannot pass through completely (100%) but also the case where dust particles cannot pass through not strictly 100% (hereafter the same). More specifically, although the blocking rate (passing rate) is not 100% (0%), the blocking rate of particles having a particle diameter of 10μ or more is at least equal to or larger than 90% (equal to or less than 10%), preferably equal to or smaller than 99% (1%). Concretely, the membrane not passing through dust particles but passing through gas molecules may be, for example, a gas exchange membrane, a planar structure having the two dimensional structure obtained by interweaving the gas exchange membrane, etc. The gas exchange membrane may be preferably, for example, filter materials of a dust filter, shoji paper, nonwoven fabric, shoji paper like membrane having the gas exchange ability or bellows structure obtained by folding these membranes valley-shape or mountain-shape. Materials constituting the gas exchange membrane are preferably made of many network structures, for example, and further they are preferably many piercing holes, cavities, enclosed spaces coexisting. If there is a difference of the concentration of constituent molecules of gases occupying spaces on the both sides separated by the gas exchange membrane, there occurs concentration diffusion so that the concentration on the both sides becomes equal. Concretely, as materials constituting the gas exchange membrane, for example, synthetic fibers such as polyester, acryl, etc., cellulose fibers such as pulp, rayon, etc. can be used. Based on the above action, the gas exchange membrane can converge the concentration of constituent molecules of gases inside the room to almost the same value of that of outside gases through the membrane even though gases do not move as a mass. These breathable materials have breathability (permeability) of 1~100[l/(m$^2$·s)], typically 30·70 [l/(m$^2$·s)]. Its detail will be described later. The two dimensional structure is not essentially limited as far as it is a structure having a two dimensional expanse as a whole. The two dimensional structure is, for example, a structure having a surface expansion structure microscopically and a planar structure as a whole, a structure having a surface expansion structure as a multiple nesting structure such as a zigzag structure etc., etc.

The system of highly clean rooms is not essentially limited as far as it has at least one enclosed space capable of closing. For example, the system of highly clean rooms has preferably the volume allowing small animals to live, more preferably the volume allowing persons to live. For example, in order to always keep cleanliness, the system of highly clean rooms has preferably at least two enclosed spaces capable of closing and, for example, the system is constituted of an anteroom and a main room. The anteroom is, for example, a room that persons etc. directly move from the outside. The main room is provided, for example, adjacent to the anteroom and is a room that persons etc. can move only through the anteroom. The anteroom and the main room are respectively constituted as an enclosed space capable of closing as a room. The anteroom and the main room are provided with a fan filter unit and a feedback flow path. The fan filter unit and the feedback flow path are preferably provided independently in each enclosed space.

With respect to the highly clean rooms of the invention, when the density of dust particles inside the room is denoted as n(t), the desorption rate of dust particles per unit area and unit time is denoted as σ and the dust collection efficiency of a HEPA filter is denoted as γ, in cases where the flow inside the enclosed space is not uniform and it has a location dependence, the density of dust particles n(t) is a function of location and the desorption rate of dust particles per unit area and unit time σ is also considered to be a function of location most generally. In this time, inside the enclosed space V concerned, dust does not generate or disappear. The density of dust particles $n(x_0, t)$ at time t in the position vector $x_0$ inside the enclosed space V changes depending on propagation of the influence of the inside of the enclosed space, i.e., inner walls of the room and satisfy the following differential equation:

$$\frac{dn(\vec{x},t)}{dt} = \int_V G(\vec{x},\vec{x}',t)\sigma(\vec{x}')\delta(\vec{x}-\vec{x}_s')\,d^3\vec{x}' + \int_V G(\vec{x},\vec{x}',t)[-n(\vec{x}',t)]f_{in}\delta(\vec{x}-\vec{x}_{inlet}')d^3\vec{x}' + \int_V G(\vec{x},\vec{x}',t)[(1-\gamma)n(\vec{x}',t)]f_{out}\delta(\vec{x}-\vec{x}_{outlet}')d^3\vec{x}' \tag{1}$$

Here, the vector x's is a position vector corresponding to the inner surface of the enclosed space. Similarly, the position vector corresponding to a part that is the absorption opening of the far filter unit is denoted as $x'_{inlet}$ and the position vector corresponding to a part that is the exhaust opening of the fan filter unit is denoted as $x'_{outlet}$. G(x, x', t) is a propagation function showing that generation or disappearance of dust at the position x' has an influence on the position x mainly with propagation by flow of gases and propagation by diffusion. $f_{in}$ denotes the wind velocity at the absorption opening of the fan filter unit and $f_{out}$ denotes the wind velocity at the exhaust opening of the fan filter unit.

The volume of the clean space, i.e., the enclosed space inside the room is denoted as V, the inner area of the enclosed space is denoted as S, the dust density of the installation environment (i.e., the outside air) the system of highly clean rooms is denoted as $N_0$ and the wind velocity is denoted as F. In cases where air flow inside the enclosed space V caused by the fan filter unit is uniform throughout and it does not have a location dependence, each term of the equation (1) converges respectively to $$G \to \frac{1}{V},\ \int_V \sigma(\vec{x}')\delta(\vec{x}-\vec{x}_s')\,d^3\vec{x}' \to \sigma S, \tag{2}$$

$$\int_V [-n(\vec{x}',t)]f_{in}\delta(\vec{x}-\vec{x}_{inlet}')d^3\vec{x}' \to -\mathrm{nF},$$

$$\int_V [(1-\gamma)n(\vec{x}',t)]f_{out}\delta(\vec{x}-\vec{x}_{outlet}')d^3\vec{x}' \to (1-\gamma)\mathrm{nF}$$

And the equation (1) becomes the following function of only time.

$$V\frac{dn(t)}{dt} = S\sigma - n(t)F + n(t)F(1-\gamma) = S\sigma - \gamma F n(t) \tag{3}$$

Here the solution of the equation is:

$$n(t) = \frac{S\sigma}{\gamma F} + \left(N_0 - \frac{S\sigma}{\gamma F}\right)\exp\left(-\frac{\gamma F}{V}t\right) \tag{4}$$

Therefore, when enough time has passed (t>10V/γF), in the closed circulation system, regardless of the installation environment of the closed circulation system, the following ultimate cleanliness can be obtained, which was shown by the inventor in non-patent literatures 7, 8 etc.

$$n = \frac{S\sigma}{\gamma F} \tag{5}$$

On the other hand, in a conventional clean room, the circulating air flow $F_1$ is filtered every circulation and the air flow $F_2$ introduced as fresh air from the outside is doubly filtered and introduced inside (For simplicity, suppose that the dust collection efficiency is the same and air flow inside the space V is uniform throughout and it does not have a location dependence). Then, $$V\frac{dn(t)}{dt} = S\sigma - n(t)(F_1+F_2) + (1-\gamma)nF_1 + N_0F_2(1-\gamma)^2 = S\sigma - n(t)(\gamma F_1 + F_2) + N_0F_2(1-\gamma)^2 \tag{6}$$

is the equation describing time change of the number density of inside dust.

The solution of the equation is as follows:

$$n(t) = \left\{\frac{S\sigma}{\gamma F_1 + F_2} + \frac{N_0 F_2}{\gamma F_1 + F_2}(1-\gamma^2)\right\} + \left[N_0 - \left\{\frac{S\sigma}{\gamma F_1 + F_2} + \frac{N_0 F_2}{\gamma F_1 + F_2}(1-\gamma^2)\right\}\right]\exp\left(-\frac{\gamma F_1 + F_2}{V}t\right) \quad (7)$$

When the air flow flowing from the chamber concerned is denoted as F ($=F_1+F_2$), the density of dust n after enough time has passed can be expressed in good approximation as follows because $\gamma \sim 1$.

$$n = \frac{S\sigma}{F} + N_0(1-\gamma)^2\frac{F_2}{F} \quad (8)$$

Comparing the equation (5) and the equation (8), it is understood that parameters dominating cleanliness in the invention are completely different from those of the conventional clean unit. The most important element with respect to the performance of the conventional clean unit is the particle collection efficiency $\gamma$ of the filter from the equation (8) and $\gamma$ is desired to be near 1 possibly. This is also apparent from that in a general clean unit, a HEPA filter is preferred than a medium performance filter and an ULPA filter is preferred than the HEPA filter, for example.

As described above, in the existing system, because the removing ability of a filter has a direct influence on the performance of a clean unit, an expensive high performance filter such as ULPA filters, HEPA filters, etc. are used. Because one side of the filter is always in contact with the outside air, the filter is choked. Furthermore, the filter is more easy to be choked in a high dust environment as the performance of the filter is high and the air supply efficiency reduces seriously, the filter is generally exchanged in about 2~3 years. In order to avoid such choking, a prefilter may be placed in the front stage of the filter, but the number of filters increases. Increase of the number of filters not only falls on cost, maintenance, etc. but also increase pressure loss on the absorption side and causes new problems such as increase of power consumption etc.

On the other hand, in the system of highly clean rooms according to the invention, the particle collection efficiency of a filter is not so dominant and generation of rubbish and dust inside the system of highly clean rooms is rather important. Attainable cleanliness inside the system of highly clean rooms of the invention is dominated by only the inside environment of the room and not influenced at all by the installation environment of the system of highly clean rooms as understood from that the density of dust $N_0$ of the outside air does not appear in the equation (5), which is very preferable characteristic. This is an advantage widely different from the conventional clean room and super clean room. That is, the system of highly clean rooms can be applied in any place as far as rain and wind can be blocked such as manufacturing lines, laboratories and general living spaces. Furthermore, as understood from the equation (5), it is a distinctive characteristic that cleanliness hardly deteriorates even though the dust collection efficiency $\gamma$ is not near to 1. Therefore, it is possible to attain good cleanliness even though cheap filters or filters having the photocatalytic function and realize the high performance.

FIG. 25 is a schematic drawing showing a change of the number of dust particles inside the system of highly clean rooms of the invention using a medium performance filter ($\gamma$=0.95) as the dust filter. Because zero count jumps to minus infinity, it is here plotted to 0.01 counts for convenience.

As shown in FIG. 25, after five minutes from the start of operation the number of dust particles inside the room (living space) rapidly decreases below 100 and after about forty minutes from the start of operation the number of dust particles inside the room (living space) decreases below 10. As described above, it was demonstrated that even though a filter not having the dust collection efficiency $\gamma$ near to 1 without limit such as 3 nines, 5 nines filter, etc. represented by HEPA or ULPA is used as the dust filter of the system of highly clean rooms of the invention, cleanliness hardly deteriorates.

It is now considered the case where persons etc. act inside the living space at the oxygen consumption rate B. For simplicity, supposing that air is stirred quickly enough inside the living space and the internal space and gas molecules constituting air inside the both spaces equalize quickly enough, it is possible to neglect space coordinate dependence inside the living space and the internal space. Here, when the volume of oxygen inside the room at time t is denoted as $Vo_2(t)$, the volume of oxygen when the inside of the room is in an equilibrium state with the outer space and there is no oxygen consumption inside the room is denoted as $Vo_2$, the Avogadro number is denoted as $N_0$, the volume of gases per litter at a pressure (~1 atm) that the system is installed is denoted as C, the area of the partition is denoted as A, and the flux of oxygen entering inside the enclosure through the partition is denoted as j, the following equation is satisfied.

$$V_{O_2}(t+\delta t) = V_{O_2}(t) - B\delta t + \frac{CAj}{N_0}\delta t \quad (9)$$

Here, j is given as follows:

$$j = D\nabla\phi \quad (10)$$

Here, $\phi$ denotes the number of oxygen molecules per unit volume inside the enclosure and D denotes the diffusion constant of oxygen in the gas exchange membrane. Supposing that the direction perpendicular to the gas exchange membrane is the x axis, $\nabla$ is a differential operator in the direction of the x axis. In this case, the enclosure means a room or the internal space of the wall. When the volume of the living space is denoted as V and the thickness of the gas exchange membrane is denoted as L, L is smaller than the size of the living space and the thickness of the internal space by about three orders of magnitude or more and presumed to be very thin. Therefore, the equation (9) can be approximated with good accuracy as follows:

$$V_{O_2}(t+\delta t) = V_{O_2}(t) - B\delta t + AD\cdot\frac{\frac{V_{O_2}}{V} - \frac{V_{O_2}(t)}{V}}{L}\cdot\delta t \quad (11)$$

It is to be noted that $Vo_2(t)/V$ is the oxygen concentration at time t and $Vo_2/V=\eta_0$ is the oxygen concentration when the inside of the room is in an equilibrium state with the outside and there is no oxygen consumption inside the room.

From this, the differential equation $$\frac{dv_{O_2}(t)}{dt} = -B + AD \cdot \frac{\frac{V_{O_2}}{V} - \frac{V_{O_2}(t)}{V}}{L} \tag{12}$$

is derived. Although the exact solution of the equation (12) can be obtained immediately, here interest is directed to the solution corresponding to the stationary state after enough time has passed. Therefore, setting the left side=0, the oxygen concentration at time t can be obtained as follows:

$$\frac{V_{O_2}(t)}{V} = \frac{V_{O_2}}{V} - \frac{BL}{AD} \tag{13}$$

Here, when the oxygen concentration inside the room (living space) is requested to be larger than a constant value η, $$\frac{V_{O_2}}{V} - \frac{BL}{AD} \geqq \eta \tag{14}$$

From this, the necessary area A is requested as:

$$A \geqq \frac{BL}{D\left(\frac{V_{O_2}}{V} - \eta\right)} \tag{15}$$

When the oxygen concentration of the outer space is denoted as $\eta_0$,
the equation (15) can also be expressed as follows:

$$A \geqq \frac{BL}{D(\eta_0 - \eta)} \tag{16}$$

With this, it can be understood that there is a lower limit of A to be satisfied as a function of the oxygen concentration η to be satisfied. From the equation (16), obtained is the guideline that A may be small as the consumption quantity of oxygen is small, the gas exchange membrane is thin and the diffusion constant of gas molecules is large.

Generally, given a two dimensional membrane, permeability is defined as the volume of gases passing through the membrane per unit time and unit area when a constant pressure difference (difference of partial pressure) is given between both sides of the membrane and is actually measured. With this, the above constant D can be obtained. For example, permeability of filter cloth, an example of the gas exchange membrane, is known to be 3[l/(dm$^2$·min)]~several tenths [l/(dm$^2$·min)] for the pressure difference of 196 Pa (~200 Pa) (For example, see non-patent literature 9. Here, l is a unit of volume, litter).

A membrane having permeability of about 70[l/(m$^2$·s)] for the pressure difference of 196 Pa was reported as the membrane having high permeability (For example, see patent literature 3). In Japan, the target oxygen concentration is requested by law to be always above about 18% and is desired to be near 20.9% possibly. Shoji paper is considered to have permeability of the same order as the above although its permeability may be different depending on methods of papermaking etc. (More strictly, permeability is measured by JISL1096 permeability A method (Frazir type method), KES permeability testing machine, etc.). And using the above analytical equation, it is possible to determine the area of the membrane not passing through dust particles bus passing through gas molecules that constitutes at least a part of the internal space adjacent to the living space, for example, the gas exchange membrane based on the consumption quantity of oxygen inside the living space and the target oxygen concentration according to the equation (16).

The conventional clean room is passive because dust generated inside the clean room is only push out outside. On the other hand, the highly clean room of the invention can recover cleanliness by actively removing dust generated inside in a short time (for example, within a time of several times of V/γF at most) with the 100% circulation feedback system and keep cleanliness of the living space inside the highly clean room stably. From this, by applying the highly clean room of the invention to a general living space etc. in which generation of dust cannot be avoided in daily life, it is possible to obtain stable high cleanliness inside the living space and realize a system of highly clean rooms with very low running cost.

As a filter used in the fan filter unit, a filter combining a filter with the photocatalytic function with the dust filter or a multi-function filter with the plural functions obtained by adding a function by photocatalyst to the dust filter is effective.

In realizing the multi-function filter, by noting a flow of gases inside the feedback gas flow path and placing decomposition mechanism of organic matter by photocatalyst in the upper stream of the dust filter, it is possible to receive enough irradiation of light and prevent photocatalytic materials from flowing in the clean space.

That is, by using further a multi-function filter having both the dust removing function and the photocatalytic function in a system configured so that it is provided with a feedback gas flow path of the invention and all of gases flowing out flow into the entrance of the dust filter through the gas flow path (hereafter, referred to 100% circulation feedback system), it is possible to reduce the concentration of chemical substances to the utmost limit. This is true because convergence from the equation (1) to the equation (3) for dust, germs, etc. is valid and an equation obtained by replacing n, σ and γ of the equation (3) with the concentration of chemical substances in gases, the generation rate of chemical substances and the decomposition efficiency of chemical substances by photocatalyst, respectively is also valid.

On the other hand, when the photocatalytic function is added to a usual system, air is taken in through a filter from the outside space and emitted to the outside space. Therefore, taken in air passes through the filter only once or several times at most and decomposition of chemical substances etc. by the photocatalytic effect is carried out only by each passage.

In contrast to this, according to the invention, air passes through photocatalytic mechanism repeatedly after taking in by the 100% circulation feedback system, so that it is possible to markedly increase the decomposition efficiency of chemical substances etc. by the photocatalytic effect compared with the conventional example.

When the photocatalytic function is simply added to a dust filter in an air cleaning system provided in a conventional clean room, especially in an air cleaning system provided with a dust filter always being in contact with high dust atmosphere directly, there occurs serious choking in the surface of the dust collection filter on the side being in contact with the high dust atmosphere. The choking of the dust filter hinders enough irradiation of light to the photocatalyst or the choking hinders contact of the photocatalyst with substances to be decomposed essentially, so that the efficiency of photocatalytic action is seriously reduced.

In the 100% circulation feedback system of the invention, because the dust filter is placed in a place separated from the outside space, the dust filter is never in contact with the outside air directly. Furthermore, by incorporating the dust filter into the 100% circulation feedback system, it is possible to make use of a characteristics capable of reducing the number of dust by several orders of magnitude by the circulation corresponding to essentially infinite times, which is a characteristic of the 100% circulation feedback system, and reduce the rate of choking of the dust filter below 1/(several thousands to ten thousand) compared with the prior art. At the same time, this can also solve the problem that the function of decomposition of chemical substances etc. by photocatalyst deteriorates by choking of the filter.

Furthermore, by utilizing that the dust collection efficiency $\gamma$ is not necessarily quite near to 1, which is a characteristic of the invention, it is possible to avoid choking of the dust filter by reducing the value of the dust collection efficiency $\gamma$, or it is possible to use materials having the high functions such as the photocatalytic ability but having difficulty in making the collection efficiency $\gamma$ approach to 1 as the sufficiently high function dust filter in the circulation feedback system of the invention. Therefore, it is possible to obtain both high cleanliness and the decomposition efficiency of chemical substances etc.

Because the condition of the collection efficiency $\gamma$ is loosened, it is possible to realize a low dust environment integrating the decomposition function of chemical substances etc. by the photocatalyst and the dust removing function. The photocatalyst is, for example, titanium oxide, platinum, palladium, etc. The photocatalytic filter is, for example, a paper filter carrying the above photocatalyst, a resin filter carrying the above photocatalyst, a porous photocatalytic ceramic filter made of tungsten oxide etc., etc. Concretely, the photocatalytic filter is a high density filter made of nonwoven fabric (made of polyester, modaacryl, etc.) with penetrated photocatalytic materials such as titania, tungsten oxide, etc. The porous photocatalytic ceramic filter can realize both low harmful chemical substances environment by the photocatalyst and the super clean environment by the dust filter. As described above, it is not necessary to use the tandem arrangement of a HEPA filter and a photocatalytic filter. Therefore, it is possible to make compact the system. Furthermore, it is possible to reduce pressure loss by the filter, improve the efficiency widely, reduce the load of ventilation power and contribute to save of energy.

According to the present system, gases inside the enclosed space are actively passed through the filter having both the dust removing function and the photocatalytic function, it is possible to markedly improve the decomposition efficiency of contamination compared with the case where the photocatalyst is simply used for walls etc. Furthermore, by adding the photocatalytic function to the surface of the dust filter, it is possible to decompose germs, dust, etc. captured by the dust filter into carbon dioxide and water. Therefore, it is not necessary to clean and exchange the dust filter and it is possible to realize the ultimate system in which the dust filter can be used semiparmanently. Especially, according to the highly clean room of the invention, it is possible to realize a germ-free, dust-free and harmful gas-free environment anywhere, for example, in the middle of a city. Therefore, by placing plants such as balmy trees, herb, etc. inside the room, it is possible to realize a forest bath and a rich natural highland air environment at home. Furthermore, it is possible to produce the relaxation effect by introducing aroma intentionally, etc. With these, it is possible to realize an environment contributing to alleviation of symptoms of asthma and treatment of asthma.

The multi-function filter is preferably made by combining the photocatalytic function filter to the dust filter, or by adding the photocatalytic function to the dust filter to obtain a filter having the plural functions. When the photocatalytic function filter is combined with the dust filter, for example, the photocatalytic function filter is preferably provided inside the gas flow path in series with the dust filter. It is also possible to constitute the multi-function filter with only photocatalyst. For example, it is possible to constitute $TiO_2$ made of porous body as a multi-function filter. In realizing the multi-function filter, it is preferably to note a flow of gases inside the feedback gas flow path and constitute the multi-function filter so as to irradiate the photocatalyst provided on the multi-function filter by enough light and prevent photocatalytic materials from flowing in the clean space. More specifically, for example, by placing a photocatalytic function filter in the upper stream of the dust filter, it is possible to obtain the decomposition function of organic matter by receiving enough irradiation of light and prevent photocatalytic materials from flowing in the clean space.

The room may be provided with a local exhaust device having the gas exchange function that exhausts inside air of the living space. The constitution of the local exhaust device is not essentially limited. For example, the local exhaust device is preferably constituted so that the direction of the air current inside the local exhaust device is designed to make the inside air and the outside air of the living space have the common direction of movement. Furthermore, the local exhaust device is preferably constituted so that the inside air and the outside air come in contact with each other via at least one membrane not passing through dust particles but passing through gas molecules, thereby the concentration of molecules constituting the inside air of the living space and the concentration of molecules constituting the outside air approach to the equilibrium state by concentration diffusion of molecules through the membrane not passing through dust particles bus passing through gas molecules and thereafter the inside air of the living space is fed back to the living space. The local exhaust device constituted above is preferable, for example, for reducing a stench and removing harmful smell in sickrooms and nursing rooms, and can realize reduction of the concentration of organic solvent in air in painting factories etc., while the density of dust is suppressed to be very low.

It is also possible to combine a heat pump type air conditioner provided with a heat exchanger with the feedback gas flow path. Furthermore, by placing, for example, ion emission type air cleaning devices inside the highly clean room of the invention, it is possible to heighten drastically the extinction effect of virus etc. by ions such as OH radicals. Conventionally, when the air cleaning device is placed in an environment that is in contact with the outside air having very low cleanliness, generated ions are taken in by large dust, so that it is not possible to show the effect of decomposing small dust, virus, etc. by ions to its abilities. In contrast to this, inside the highly clean room of the invention, the size of existing dust is very small and the quantity of the existing dust is also small. Furthermore, because new dust is not supplied from the outside air inside the highly clean room of the invention, it is possible to show the effect of decomposing small dust, virus, etc. by ions to its abilities. It is also possible to extend the lifetime, etc. of the filter provided inside the ion emission type air cleaning device.

Effect of the Invention

According to the invention, it is possible to realize a daily living space itself as a clean space of class 100 or higher looking like just a common room in appearance within, for example, thirty minutes, essentially in ten minutes without increasing a load of space and structure in the building structure. Furthermore, for example, it is possible to realize US209D class 1 after ten hours from the start of operation of the system. In addition, the system does not suffer the problem that the pressure difference results between a room of a house and parts of the house other than the room, which is caused by using conventional clean room technology and cleanliness of the room can be improved. By actively collecting dust generated inside by the fan filter unit attached to the room, it is possible to save "a situation such that generated dust is scattered outside of the room and people living outside of the room are troubled". It is possible to provide a system of highly clean rooms capable of always keeping the high air cleaning ability of, for example, class 1 or higher of a room in which people in Japan and the world live, act and are subjected to treatment and nursing without changing parameters of the pressure difference of living customs of conventional houses, and capable of living and acting comfortably and peacefully inside.

As described above, while the density of dust particles in the stationary state of the conventional clean room depends on the density of dust particles $N_0$ in the environment and therefore a high quality filter having the dust collection efficiency $\gamma$ that is near to 1 possibly, according to the invention, the density of dust particles n(t) in the stationary state does not depend on $N_0$ (therefore the installation environment is not limited) and $\gamma$ is included in the denomination of the equation of n(t) (therefore it is not important that $\gamma$ is near 1) and therefore it is possible to realize very high cleanliness using a cheap dust filter. Furthermore, according to the invention, because gas constituent inside the room and gas constituent of the installation environment are efficiently exchanged, it is possible to realize a completely closed environment with respect to dust particles and an environment capable of exchanging gas constituent by diffusion.

BRIEF DESCRIPTION OF THE DRAWINGS

FIG. 49B is incorporated into the system of highly clean rooms.

MODES FOR CARRYING OUT THE INVENTION

Modes for carrying out the invention (hereafter referred as "embodiments") will now be explained below.

1. The First Embodiment

Figure 8A:
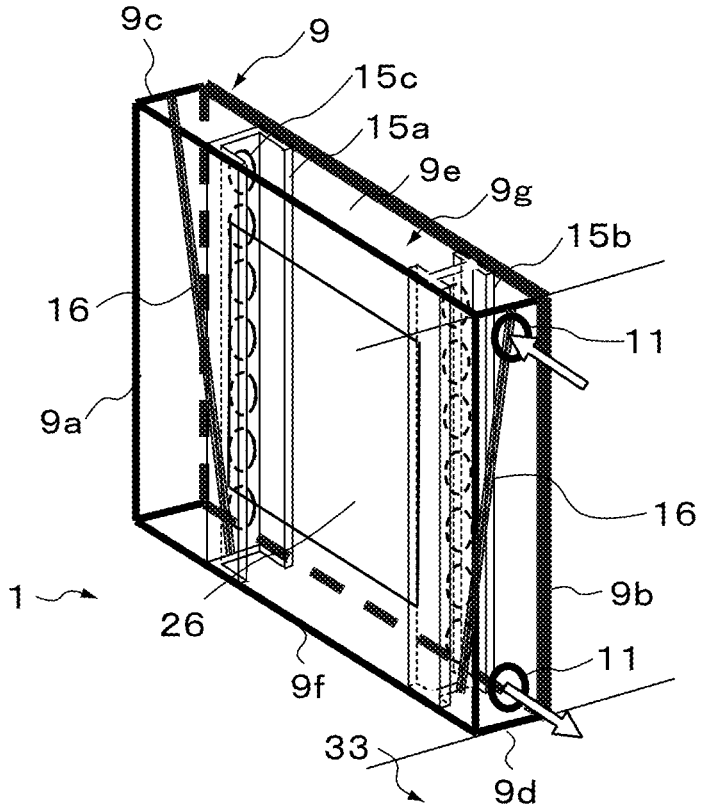
FIG. 8A A perspective view showing a wall according to the first embodiment.
Figure 8B:
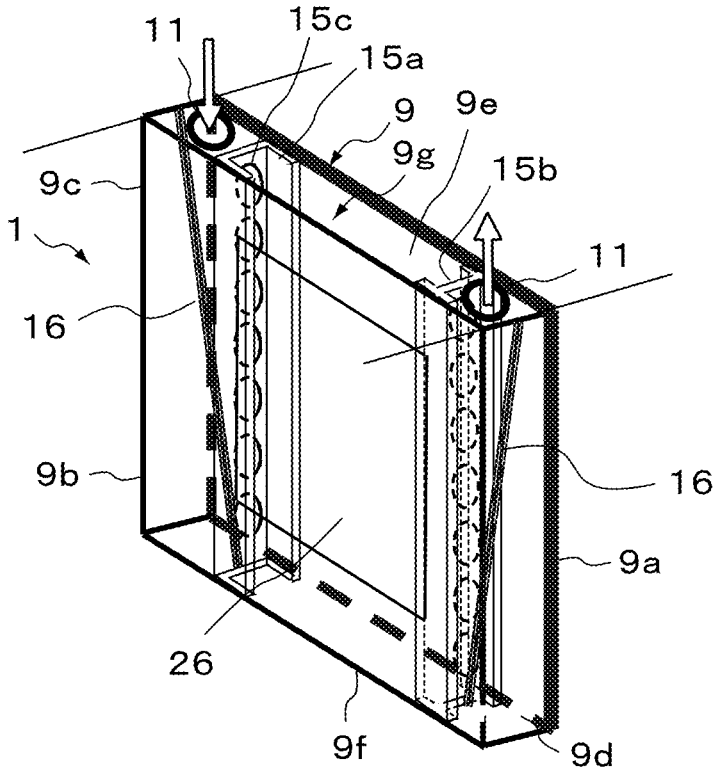
FIG. 8B A perspective view showing the wall according to the first embodiment.

FIG. 8A and FIG. 8B show a wall (partition wall) according to the first embodiment. As shown in FIG. 8A, in the wall 9, an inner wall 9*a* and an outer wall 9*b* are facing each other a constant distance apart, and lateral walls 9*c* to 9*f* are provided so that four openings formed at edge parts of the walls by facing the two walls are closed. Furthermore, a parallelepiped is formed by joining the walls 9*a* to 9*f* closely and an inner space (hollow part) 9*g* is formed inside it. The inner wall 9*a* is provided in contact with a living space of a room 1 that is an enclosed space. The wall 9 is composed of high strength materials, for example, so that the wall 9 encloses the internal space (hollow part) 9*g* that can introduce outside air while the wall 9 as a whole has the robust structure. An airway 11 is provided in both end parts of the lateral wall 9*d* constituting the wall 9. In this case, the airway 11 provided at the upper end part of the lateral wall 9*d* is an introduction opening (inlet) of outside air and the airway 11 provided at the lower end part is an exhaust opening (outlet). At least a part of the inner wall 9*a* is constituted of a gas exchange membrane 26. Provided inside the internal space 9*g* are a C-shape steel 15*a* facing the lateral wall 9*c* each other a constant distance apart and an H-shape steel 15*b* facing the lateral wall 9*d* each other a constant distance apart so that they are sandwiched between the inner wall 9*a* and the outer wall 9*b*. The C-shape steel 15*a* and the H-shape steel 15*b* are provided parallel to the lateral wall 9*c* and the lateral wall 9*d*. The C-shape steel 15*a* and the H-shape steel 15*b* are preferably provided so as to be in contact with the edge part of the gas exchange membrane 26, for example, so that the strength enough to support the room 1 can be obtained. A diagonal brace 16 is provided between the C-shape steel 15*a* and the lateral wall 9*c* so as to connect the upper end part of the lateral wall 9*c* and the lower end part of the C-shape steel 15*a*. A diagonal brace 16 is also provided between the H-shape steel 15*b* and the lateral wall 9*b* so as to connect the upper end part of the lateral wall 9*b* and the lower end part of the H-shape steel 15*b*. With this, the strength enough to support the room 1 can be obtained. A hole 15*c* is provided in the plane of a member in the direction perpendicular to the gas exchange membrane 26 of members composing column materials of the C-shape steel 15*a* and the H-shape steel 15*b* and gases flow freely through the hole 15*c*. By constructing the wall 9 as described above, air is exchanged between the internal space 9*g* that is the internal space of the wall 9 and open spaces of a house such as a hallway 33 etc. adjacent to the lateral wall 9*d* through the airway 11. This air exchange is performed preferably by introducing forcibly outside air (fresh air) from the airway 11 provided at the upper end part of the lateral wall 9*d* and exhausting it from the airway 11 provided at the lower end part of the lateral wall 9*d* by mechanical ventilation, for example. The gas exchange membrane 26 is provided on the inner wall 9*a* being in contact with the living space of the room 1 and air inside the room 1 and gases inside the internal space 9*g* are separated under the state that an air current is not exchanged as a flow. Mass flow by the air current is not directly exchanged between the living space of the room 1 and the internal space 9*g*. When there occurs a difference of the concentration of gas molecules constituting air (oxygen, nitrogen, carbon dioxide, etc.) and trace chemical substances such as ammonia etc. emitted by life and activity of persons between both sides of the gas exchange membrane 26, concentration diffusion occurs, so that the molecules are exchanged through the gas exchange membrane 26 and air inside the room 1 being in contact with the wall 9 can be kept to be an environment suitable for life, activity, etc. of persons. The gas exchange membrane 26 may be replaced by a two-dimensional structure obtained by weaving a gas exchange membrane. As members composing the outer wall 9*b* of the wall 9 supporting the structure of the room 1, for example, high strength materials that are plate materials having enough thickness and strength are preferably used and more preferably, materials added them further with insulating and soundproofing functions are used. By constituting in this way, the wall 9 as a while can obtain the function as the structure having the high insulating and soundproofing performance. On the other hand, two airways 11 are provided in the lateral wall 9*e* that is the upper lateral wall of the wall 9 shown in FIG. 8B. Other than this, the wall 9 shown in FIG. 8B has the same construction as the wall 9 shown in FIG. 8A. By constructing the wall 9 as described above, air can be exchanged between the internal space 9*g* and open spaces of the house such as a space between the roof and the ceiling etc. being in contact with the wall 9*e*.

Here, considered is the area of the gas exchange membrane 26 provided in the inner wall 9*a*. The area of the gas exchange membrane 26 (or the two-dimensional structure) is denoted as A. When the volume of the living space of the room 1 that is an enclosed space is denoted as V, the oxygen consumption rate inside the living space of the room 1 is denoted as B, the volume of oxygen inside the living space of the room 1 when it is in equilibrium with the outer space and oxygen is not consumed inside it is denoted as $Vo_2$, the diffusion constant of oxygen in the gas exchange membrane 26 (or the two-dimensional structure) is denoted as D and the target oxygen concentration inside the living space is denoted as η (η>0.18), the area A of the gas exchange membrane 26 (or the two-dimensional structure) is set so as to satisfy at least $$A \geqq \frac{BL}{D(\eta_0 - \eta)} \tag{16}$$

When the gas exchange membrane 26 is replaced with the two-dimensional structure, for example, if the two-dimensional structure has the folded structure such as zigzag structure (the structure having plural curved surfaces and/or planes), the two-dimensional area after the structure is enlarged and developed is used as the area A. With this, the oxygen concentration of the room 1 being in contact with the wall 9 can be kept to be η or more that is the target value.

According to the first embodiment, the wall 9 is constructed by providing the outer wall 9*b* and the inner wall 9*a* facing each other a constant distance apart, providing the lateral walls 9*c* to 9*f* so as to close their openings and constituting at least a part of the inner wall 9*a* by the gas exchange membrane 26. By composing these walls with high strength materials etc., the wall 9 can have the structure enclosing the internal space (hollow part) 9*g* that can introduce air while it has the robust structure as a whole. Furthermore, by providing the inner wall 9*a* of the wall 9 so as to come in contact with the room 1 forming the living space that is an enclosed space, the wall 9 as a whole can exchange gas molecules without exchanging directly mass flow by the air current while the wall 9 has the function as the structure having enough strength, the insulating and soundproofing performance. More specifically, when there occurs a difference of the concentration of gas molecules constituting air (oxygen, nitrogen, carbon dioxide, etc.) and trace chemical substances such as ammonia etc. emitted by life and activity of persons between both sides of the gas exchange membrane 26, concentration diffusion occurs, so that the molecules are exchanged through the gas exchange membrane 26 and air inside the room 1 being in contact with the wall 9 can be kept to be an environment suitable for life, activity, etc. of persons.

2. The Second Embodiment

Figure 9:
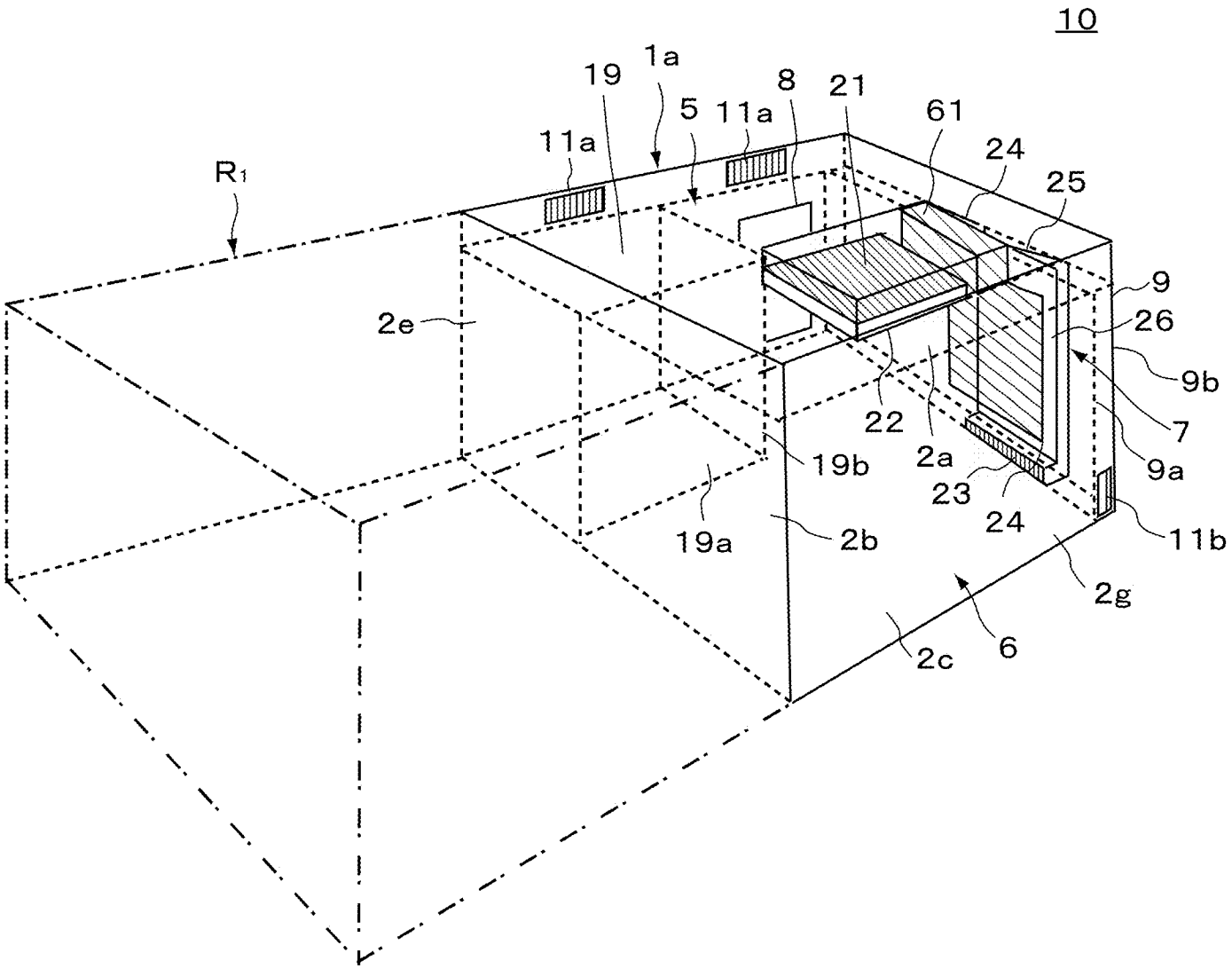
FIG. 9 A perspective view showing a system of highly clean rooms according to the second embodiment.

FIG. 9 shows the system of highly clean rooms 10 according to the second embodiment.

Figure 1:
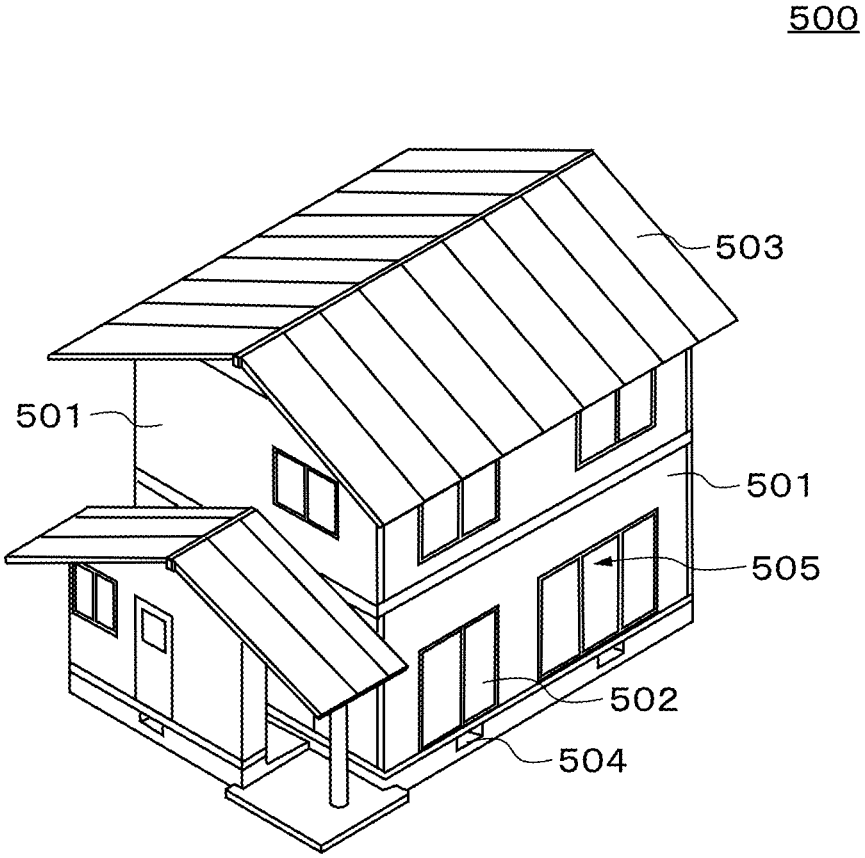
FIG. 1 A perspective view showing a conventional general house.
Figure 2:
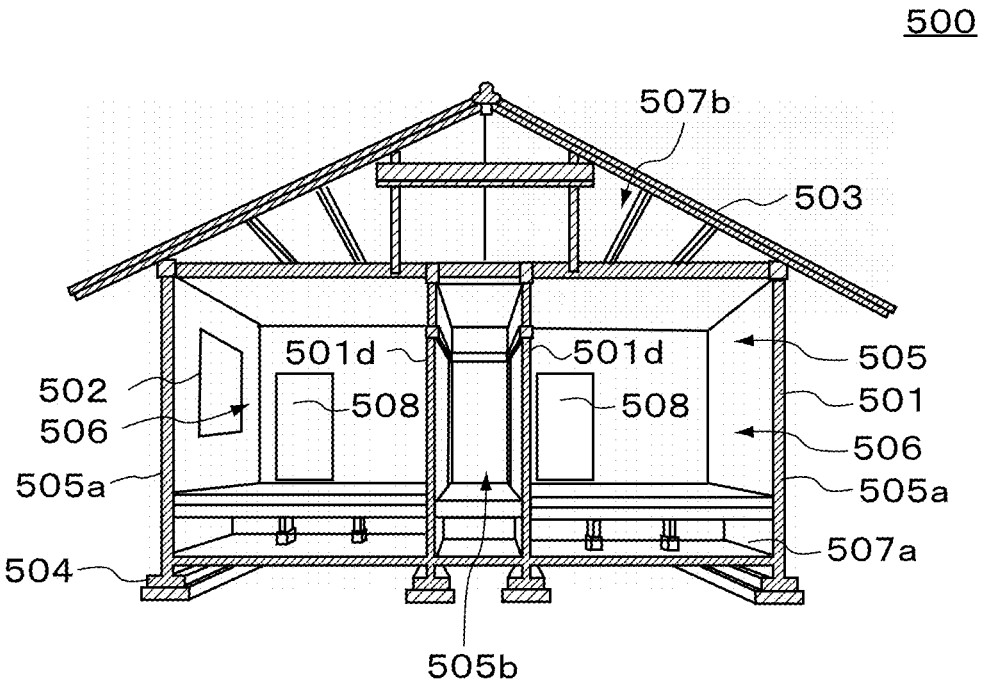
FIG. 2 A perspective sectional view showing a conventional general house.
Figure 3:
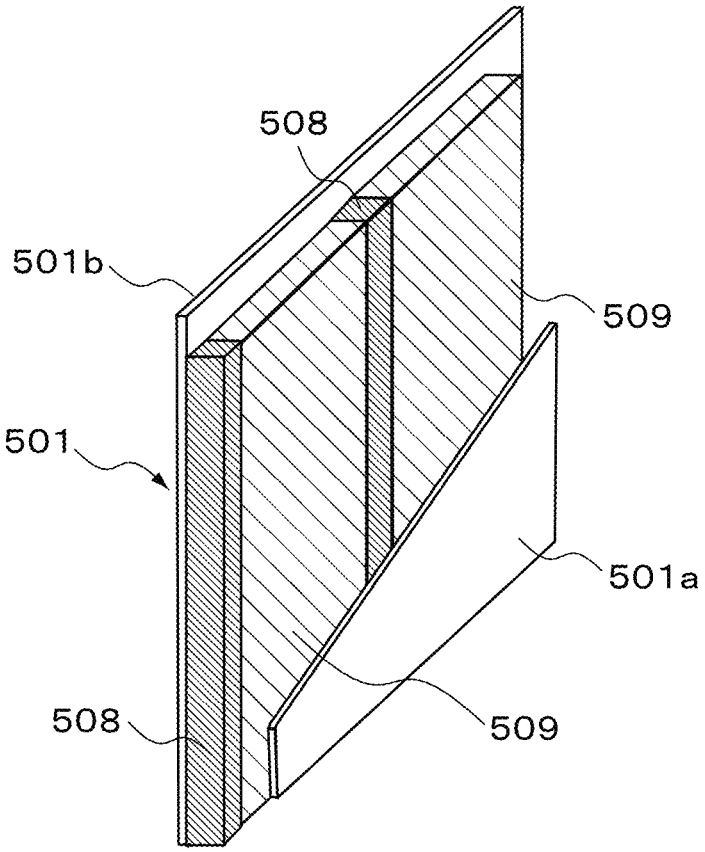
FIG. 3 A perspective view showing a constructing example of walls of a conventional general house.
Figure 4:
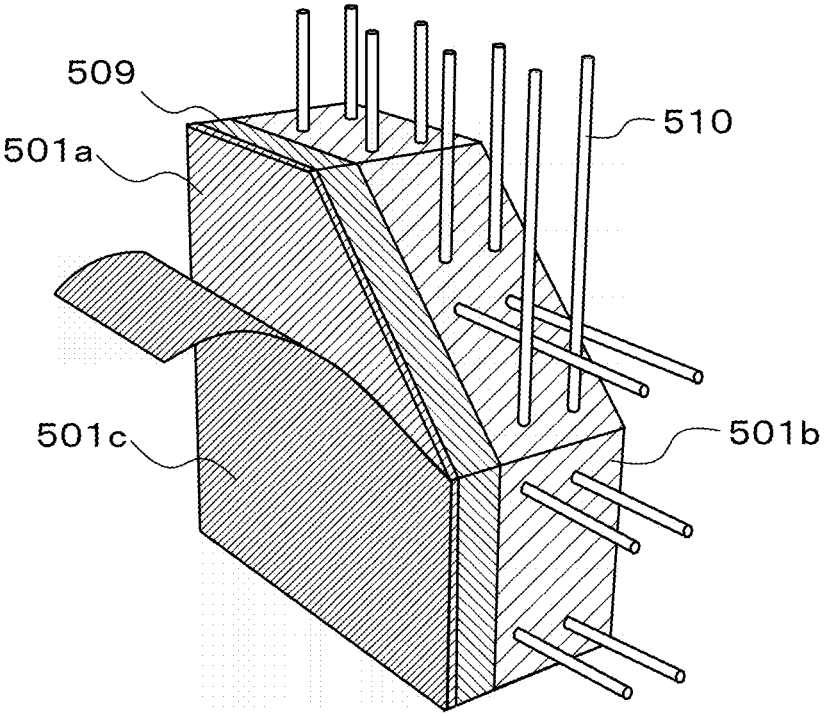
FIG. 4 A perspective view showing a constructing example of walls of a conventional apartment house, buildings, etc.
Figure 5:
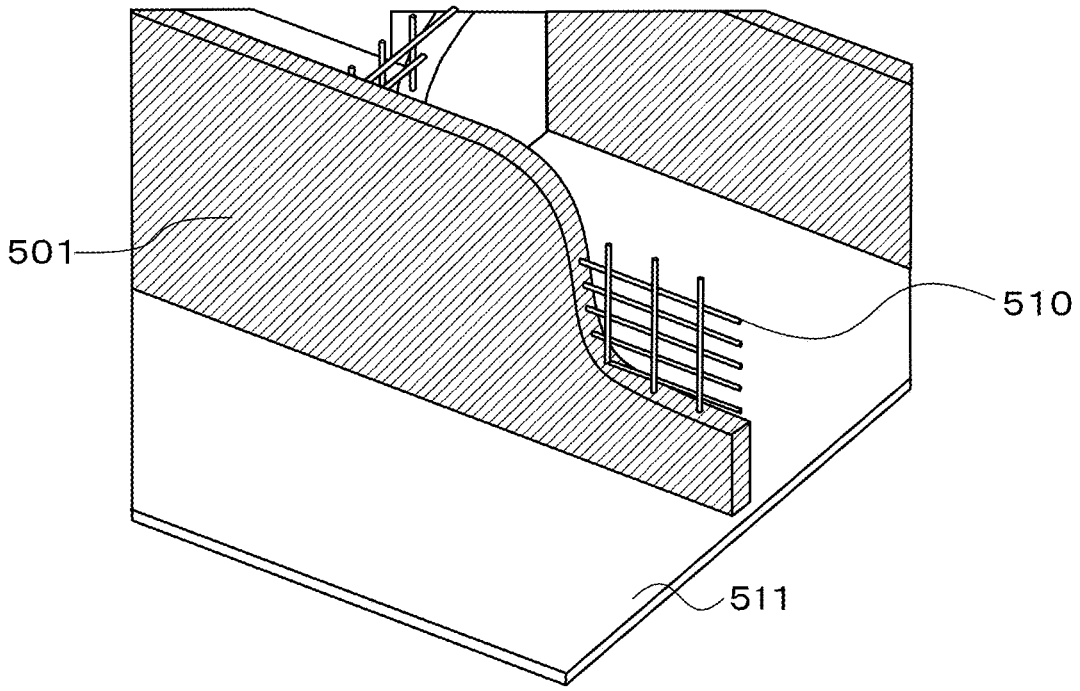
FIG. 5 A perspective view showing a constructing example of walls of a conventional apartment house, buildings, etc.
Figure 6:
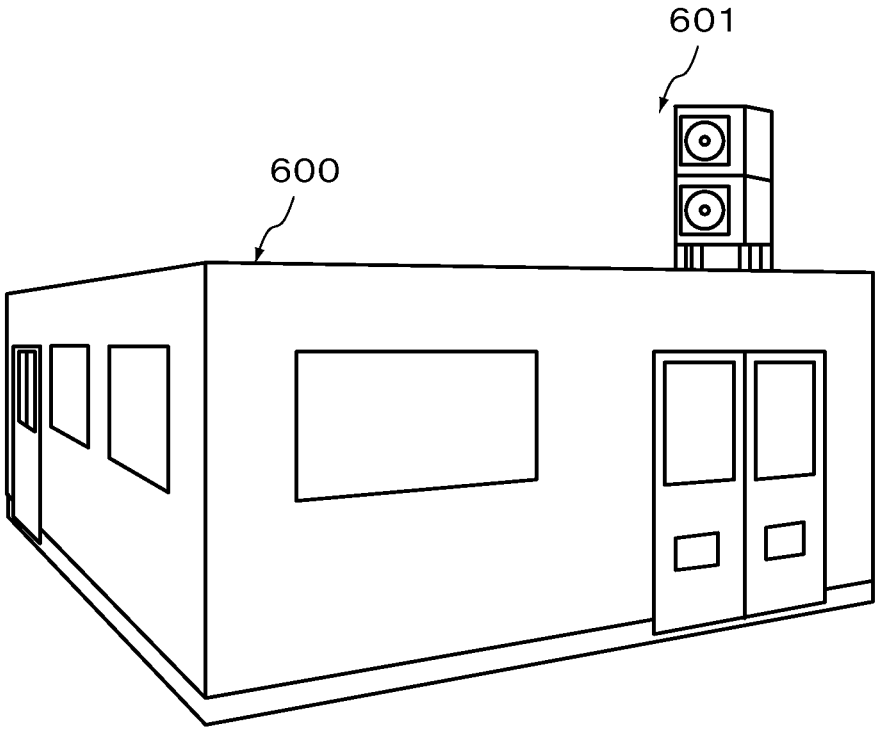
FIG. 6 A substitute picture for a drawing of a conventional clean unit taken by a digital still camera.
Figure 7:
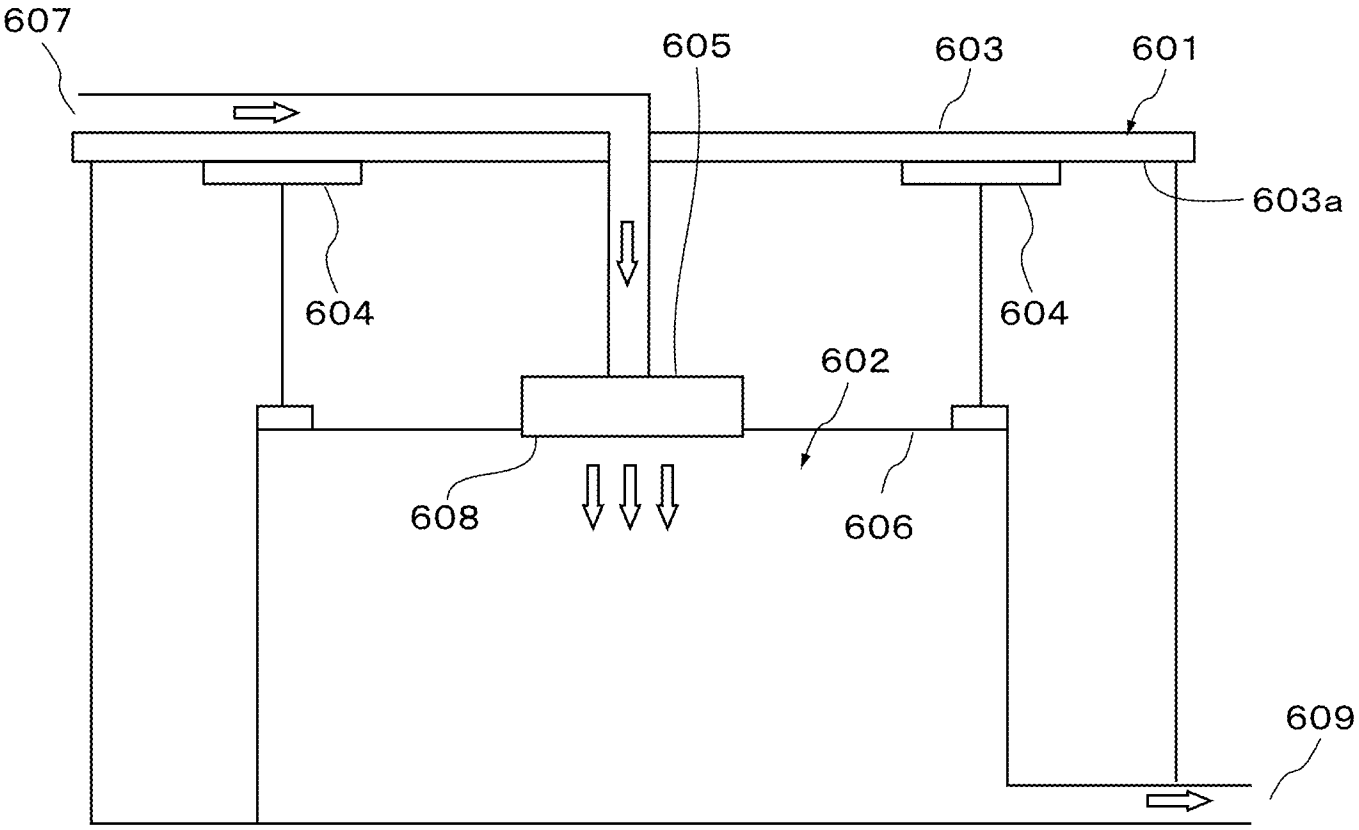
FIG. 7 A cross sectional view showing a conventional clean unit.

As shown in FIG. 9, the system of highly clean rooms 10 is constituted by different two independent rooms adjacent to each other. FIG. 9 shows the constitution of the inside of the room perspectively. With respect to the adjacent rooms, a room 1*a* is provided in the right side of the drawing and a room $R_1$ is provided in the left side of the drawing. In the drawing, the room $R_1$ shown by a dot and dash line is a virtual room and its structure is not limited as far as it has the structure independent from the room 1*a*. In FIG. 2, a broken line shows walls such as partition walls, ceiling walls, etc. and the constitution of the inside of the room 1*a* other than this is shown by a solid line.

The room 1*a* has a parallelepiped shape, is the outermost structure in the system of highly clean rooms 10 and forms an enclosed space. The enclosed space has the living space 6 and the space 5 between the roof and the ceiling as subspaces constituting it. The space 5 between the roof and the ceiling is an internal space formed by the double ceiling. The double ceiling is constituted by the top surface of the room 1*a* and the ceiling wall 2*a* provided so as to face the top surface a constant distance apart. That is, the living space 6 and the space 5 between the roof and the ceiling are separated by the ceiling wall 2*a*. The wall 9 of the lateral walls constituting the living space 6 on the right side in FIG. 9 has the same constitution as the wall 9 shown in the first embodiment and encloses the internal space 7 having the same constitution as the internal space 9*g* of the wall 9 shown in the first embodiment. More specifically, the wall 9 enclosing the internal space 7 by the double wall constituted by the outer wall 9*b* and the internal wall 9*a* provided parallel to each other a constant interval apart. The lateral walls 9*c* to 9*f* constituting the walls shown in FIG. 8A are constituted by the lateral wall 2*e*, the lateral wall 2*c*, the ceiling wall 2*a* and the floor wall 2*g* constituting the room 1*a*. A gas flow path 24 is provided inside the internal space 7 and an opening 23 is provided in at least a part of the inner wall 9*a*. The opening 23 corresponds to an absorption opening of an FFU 21 provided on the plane of the ceiling wall 2*a* on the side of the space 5 between the roof and the ceiling. The plural openings 23 may be provided. The thickness of the internal space 7, here the distance between the inner wall 9*a* and the outer wall 9*b* is preferably 5 cm or more and 40 cm or less, and more preferably 10 cm or more and 20 cm or less. The gas exchange membrane 26 is stretched in the inner wall 9*a* of the wall 9 separating the living space 6 and the internal space 7. The gas exchange membrane 26 is constituted so that dust particles do not pass through but gas molecules pass through. The gas exchange membrane 26 constitutes a part of the inner wall 9*a* that is the partition wall between the living space 6 and the internal space 7. When the living space 6 is of Japanese style or like Japanese-Style room, shoji paper is preferably used as the gas exchange membrane 26. The wall structure having the ability that dust particles do not pass through and gas molecules pass through is obtained by providing an opening communicating the living space 6 and the internal space 7 in the inner wall 9*a* and thereafter the gas exchange membrane 26 is stretched so as to close the opening completely. The gas exchange membrane 26 may be replaced by the two-dimensional structure obtained by weaving the gas exchange membrane. The wall 9 is preferably constituted so that directions of air flowing in the living space 6 and the internal space 7 separated by the inner wall 9*a* of the wall 9 coincide and furthermore velocities of their flow coincide. As the constitution, a fan is preferably provided in the living space 6, for example. By constituting in this way, gas exchange by the gas exchange membrane 26 can be performed smoothly. The living space 6 has a utility space 19 that is an enclosed space surrounded by the lateral walls 2*b* and 2*e* constituting the inner corner on the left side of the room 1*a*, the lateral walls 19*a* and 19*b* facing with these lateral walls and the ceiling wall 2*a*. The utility space 19 is utilized as a lavatory, a bathroom, a sink, etc.

An opening corresponding to a blow opening of the FFU 21 is provided in the ceiling wall 2*a* at the part that the FFU 21 is provided and the blow opening 22 is formed by connecting the opening and the blow opening of the FFU 21 airtightly. The blow opening 22 and the blow opening of the FFU 21 are formed as one body airtightly. Clean gases are supplied to the living space 6 by emitting gas flow from the blow opening of the FFU 21. The FFU 21 may be also installed inside the internal space 7 of the wall 9.

In the internal space 7 formed inside the wall 9, a gas flow path 24 communicating the opening 23 and the gas inlet of the FFU 21 airtightly is provided at the position withdrawn from the plane of the gas exchange membrane 26 by a half of the thickness of the wall 9, for example, a length of 5 cm or more and 10 cm or less. With this, the volume allowing enough gases to exist can be obtained on both sides of the gas exchange membrane 26. The gas flow path 24 has a duct structure having a thickness of 5 cm or more and 15 cm or less and a width of about 90 cm, for example. The opening 23 is an absorption opening for introducing air inside the living space 6 inside the gas flow path 24. All of gases entering from the opening 23 are fed back to the absorption opening of the FFU 21 through the gas flow path 24. Thus, the 100% circulation feedback system is completed. Because the internal space 7 of the wall 9 has two functions of the gas exchange ability and storing of the gas flow path constituting the 100% circulation feedback system, the internal space of the wall 9 can be effectively utilized. The FFU 21 generally may be provided anywhere in the 100% circulation path annexed to the living space 6. The FFU 21 may be provided on the ceiling as described above or stored, for example, inside the wall 9 by placing it on the floor. In this way, as apparent from the situation shown in FIG. 9, extremely clean room system can be constituted without narrowing compared with rooms of the conventional houses.

The space 5 between the roof and the ceiling and the internal space 7 are configured to communicate through an opening provided in the ceiling wall 2*a* constituting the internal space 7. An airway 11*a* is provided in the lateral wall 2*e* being in contact with the space 5 between the roof and the ceiling. The lateral wall 2*e* being in contact with the living space 6 of the room 1*a* has a doorway 8 through which persons can move between the living space 6 and the outside space. For example, persons can move freely between a hallway (not shown) and the living space 6 through the doorway 8. An airway 11*b* is provided in the lateral wall 2*c* being in contact with the internal space 7. The airways 11*a* and 11*b* play a role of an inlet for introducing outside air and an outlet. For example, fresh air flowing from the airway 11*a* is introduced into the internal space 7 of the wall 9 of the room 1*a* through the space 5 between the roof and the ceiling. Via the gas exchange membrane 26, there occur concentration diffusion of carbon dioxide generated in the living space 6 etc. into the internal space 7 and concentration diffusion of oxygen from the internal space 7 of the wall 9 into the internal space 6 in which oxygen is consumed, so that gas exchange is performed. Air after gas exchange is exhausted from the airway 11*b*. Gases and chemical substances generated in the room are also exhausted outside through the internal space 7 of the wall 9. Roles of the airway 11*a* the air way 11*b* as the inlet and the outlet can be exchanged by ventilation mechanism of the whole building. That is, it is possible to introduce fresh air from the outside through the airway 11*b* and exhaust dirty air outside through the airway 11*a*. Furthermore, in cases where plural airways 11*a* are provided, the combination of the inlet and the outlet can be selected as necessarily. This is the same for the airway 11*b*. It is possible to configure so that no opening is provided in the ceiling wall 2*a* and the space 5 between the roof and the ceiling and the internal space 7 do not communicate. As a result, the airway 11*a* and the airway 11*b* can be completely independent.

Regardless of communication between the roof and the ceiling and the internal space 7, gas molecules are exchanged via the gas exchange membrane 26 between the internal space 7 inside the wall 9 and the living space 6. That is, diffusion of oxygen, carbon dioxide, or chemical substance molecules causing life smell occurs through the gas exchange membrane 26 by concentration gradient depending on the concentration difference on both sides of the gas exchange membrane 26, so that air inside the living space 6 can be kept to be suitable for life and activity. When flat shoji paper like two-dimensional membrane (shoji paper) is used as the gas exchange membrane 26, its area is preferably selected to be 135 cm×135 cm, for example. Air is blown downward from the blow opening 22 of the FFU 21 and air is supplied to the living space 6. In this case, air supplied to the living space 6 forces dust in air downward inside the living space 6, and at the same time, air flows into the gas flow path 24 communicating the opening 23 and the absorption opening of the FFU 21 airtightly from the opening 23 provided at the lower part of the inner wall 9*a* of the wall 9 forming the internal space 7, so that all of air is fed back to the FFU 21 through the gas flow path 24. In this way, it is configured that all of gases flowing inside the living space 6 from the FFU 21 is fed back to the FFU 21, so that the 100% circulation flow path is completed. As described above, by constructing at least one of the lateral walls of the room 1*a* by the wall 9 shown in the first embodiment, it is possible to make the internal space 7 enclosed in the wall 9 have the both functions of gas exchange and storing of the gas flow path constituting the 100% circulation feedback system. With this, the space inside the room 1*a* can be effectively utilized, and a super clean environment can be realized very naturally as a room with design like fitting type shoji paper on the lateral wall of the room seen from the inside without narrowing the room compared with the room of the conventional house. By placing lighting devices at the rear of the shoji paper like gas exchange membrane 26 provided on the lateral wall, it is also possible for the wall to play a role of indirect lighting where the wall itself shines. In this case, the wall 9 functions as a three-way highly functional wall.

When it is desired not only to remove dust but also to decompose smell etc., it is better to provide a photocatalyst 61 inside the gas flow path 24. The photocatalyst 61 may be of simple photocatalyst, or the combination of photocatalyst and dust filter. The photocatalyst 61 is provided inside the gas flow path 24, for example. In the embodiment, the photocatalyst 61 is provided in the upper stream with respect to the dust filter of the FFU 21 in a series connection with the fan filter, however its installation mode is not limited to this. Because the photocatalyst 61 is operated in almost dust fee condition in the system of highly clean rooms, the photocatalyst 61 is free from the problem of choking up by dust and it is possible to operate the photocatalyst 61, utilizing only its primary photocatalytic function, so that the photocatalytic function is kept for a very long time. The photocatalytic device is a system having very good compatibility with the 100% circulation system of the present invention as the same as generally used functional devices such as a plasma cluster (registered trademark), an air cleaning device made by Sharp Corporation, nano-e (registered trademark), an air cleaning device made by Panasonic Corporation, etc. Actually, it has been confirmed that high cleanliness above class 100 has been obtained while exhibiting the smell removing function in the structure equivalent to the tent structure (FIG. 67A) to be described later using the FFU with the photocatalytic function made by Eclair Corporation, CADO AP-C100.

According to the second embodiment, because at least one of the lateral walls of the room 1*a* is constituted by the wall 9 shown in the first embodiment, the same advantages as the first embodiment can be obtained. Furthermore, because one internal space has both functions of gas exchange and storing of the gas flow path constituting the 100% circulation feedback system, the space inside the room 1*a* can be effectively utilized and the key part of the system of highly clean rooms can be embedded without narrowing the room compared with the conventional house. Also, because it is necessary to provide only one 100% feedback path, an advantage capable of building the system of highly clean rooms simply and easily with low cost can be obtained. The system of highly clean rooms can be a suitable system when the frequency of going in and out the room 1*a* is small and the stay time inside the living space 6 is long relatively.

3. The Third Embodiment

Figure 10:
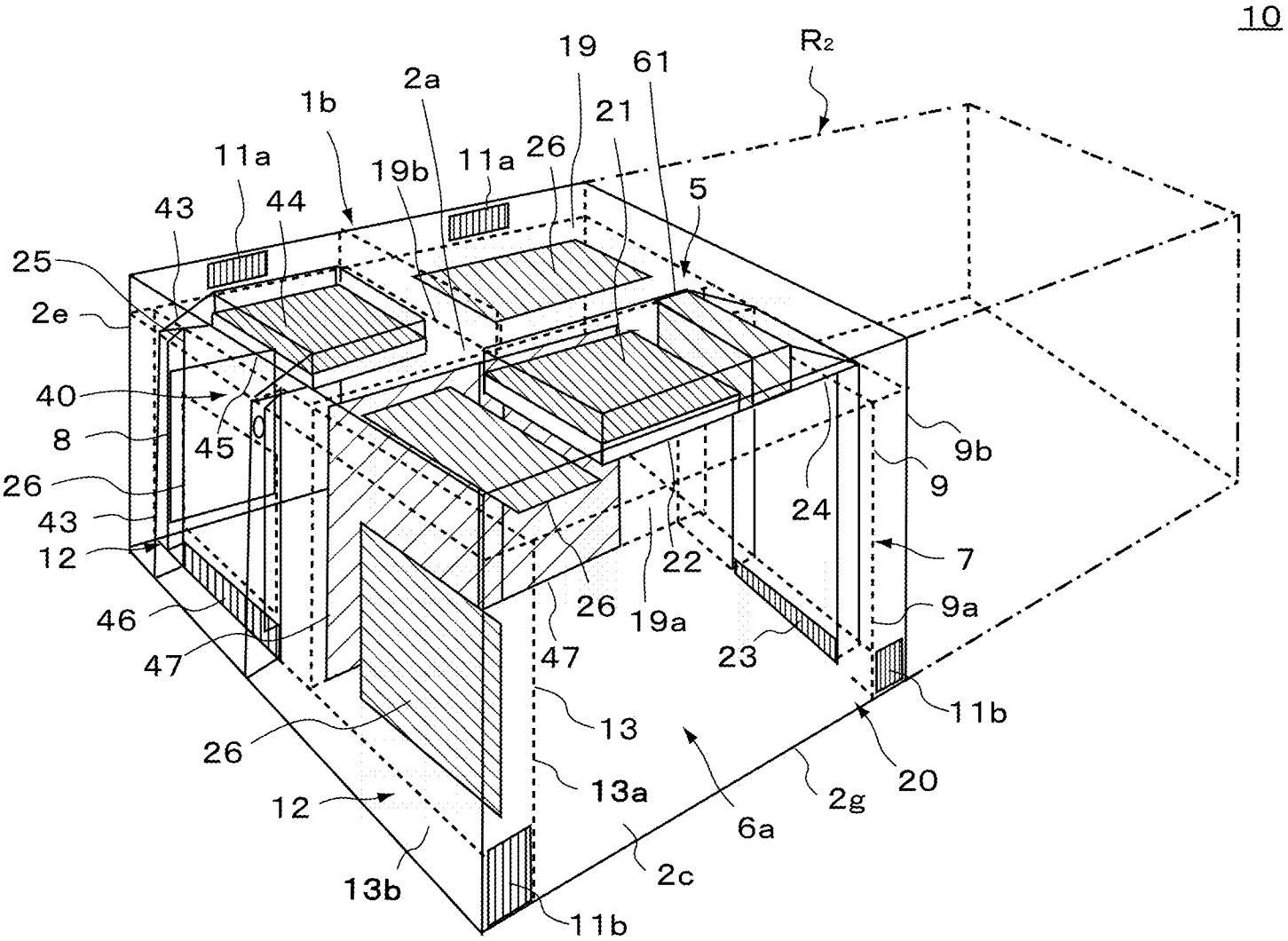
FIG. 10 A perspective view showing a system of highly clean rooms according to the third embodiment.

FIG. 10 shows a system of highly clean rooms 10 according to the third embodiment.

As shown in FIG. 10, in the system of highly clean rooms 10, the room 1*b* of the adjacent rooms is provided in the left side in the drawing and the room $R_2$ of the adjacent rooms is provided in the right side in the drawing. In FIG. 10, the room $R_2$ shown by the dot and dash line is a virtual room and its structure is not limited as far as it has a structure independent from the room 1*b*. In FIG. 10, the broken line shows walls provided inside the room 1*b* such as a partition wall, a ceiling wall, etc. and other structures inside the room 1*b* are shown by the solid line.

With respect to the system of highly clean rooms, a need for obtaining the higher performance than the system of highly clean rooms shown in the second embodiment may be raised. For example, such a system of highly clean rooms is applied to treatment of an immunodeficiency disease in the hospital, more perfect prevention of infectious diseases in the nursing home for the aged, recuperation at home in general homes, etc. In this case, it is necessary to devise not to deteriorate cleanliness of the space at the moment going in and out between the living space 6 served as a sick room or a nursing room and the outdoors or hallways. For this, a further additional structure is introduced while utilizing the structure of the room 1*a* of the second embodiment.

That is, in the room 1*b*, the lateral wall facing the wall 9 that is the lateral wall constituting the room 1*a* shown in the second embodiment is replaced with a wall 13 enclosing the internal space 12 constructed similar to the wall 9. In other words, among the lateral walls constituting the room 1*b*, both walls facing each other on the side without the doorway 8 are constituted by the wall 9 and the wall 13 each enclosing the internal space. Here, the internal space 7 enclosed in the wall 9 and the internal space 12 enclosed in the wall 13 are independent each other. The structure of the wall 13 and the internal space 12 may be similar to the structure of the wall 9 and the internal space 7. The wall on the left side in FIG. 10 of the room 1*b* is constituted by the wall 13 having the same structure as the wall 9 shown in the first embodiment and the wall 13 is constituted by the outer wall 13*b* and the inner wall 13*a*. The wall 13 has the internal space 12, i.e., the second internal space, and the internal space 12 is a space adjacent to the living space 6 via the gas exchange membrane 26. The thickness of the internal space 12 is specifically 5 cm or more and 40 cm or less, and preferably 10 cm or more and 20 cm or less, for example. As described later, because the internal space 12 does not need to store the gas flow path 24 in it, the internal space 12 may be of the thin structure having the thickness of 15 cm and less.

The gas flow path 24 provided inside the internal space 7 may be provided on the inner wall 9*a*. This is because a part of the internal wall 9*a* is not constituted by the gas exchange membrane 26. The wall 9 and the wall 13 themselves may be used as the gas flow path. In cases where the wall itself is used as the feedback path, the airway 11*b* provided in the wall 9 is shut. The thickness of the gas flow path 24 is preferably 5 cm or more and 10 cm or less as described above. It is possible to increase the thickness of the gas flow path 24 to the thickness of the internal space 7 to increase the cross sectional flow rate and increase the conductance of the flow. A part of the inner wall 13*a* of the wall 13 is constituted by the gas exchange membrane 26.

The space 5 between the roof and the ceiling and the internal spaces 7 and 12 constituted by double walls may or may not communicate through the space 5 between the roof and the ceiling each other. Any one of the internal space 7 and the internal space 12 may communicate with the space 5 between the roof and the ceiling. Introduction of outside air into the internal spaces 7 and 12 can be performed as the same as the second embodiment and the combination of the inlet and the outlet of the airways 11*a* and 11*b* are selected for uses as necessary. For example, although two airways 11*a* provided in the lateral wall 2*e* being in contact with the space 5 between the roof and the ceiling are used as a pair of the inlet and the outlet in the room 1*b*, it is possible to use both of the airways 11*a* as inlets and the airway 11*b* in the lower part of the lateral wall is used as the outlet.

An anteroom 40 that is a subspace of the living space 6 is formed by providing a partition so as to face the doorway 8. More specifically, the anteroom 40 is constituted by providing a sliding door 47 so that an opening of the space surrounded by the lateral wall 2*e* of the room 1*b* having the doorway 8, the inner wall 13*a* of the wall 13, the partition 19*b* of the utility space 19 and the ceiling wall 2*a*. The sliding door 47 functions as the partition. The sliding door 47 may be constituted in a part of the partition wall provided so as to close the opening. The space of the living space 6 other than the anteroom 40 constitutes a main room 20. That is, the sliding door 47 has the partition function partitioning the anteroom 40 and the main room 20. The sliding door 47 is provided so that when it is opened, it opens along the lateral wall 19*a* constituting the utility space 19 to prevent generation of unnecessary dead space upon opening and shutting of the sliding door 47. When the sliding door 47 opens, the anteroom 40 and the main room 20 communicate. When the sliding door 47 shuts, the anteroom 40 and the main room 20 are completely isolated. At least apart of the major surface of the sliding door 47 is preferably constituted by the gas exchange membrane 26. As the gas exchange membrane 26, for example, shoji paper, shoji paper like filter cloth or nonwoven fabric filter materials is selected, so that the sliding door 47 is invested with the gas exchange ability while producing Japanese old Shoin construction flavor. In cases where the gas exchange membrane 26 is provided in the sliding door 47, concretely, for example, the sliding door 47 is provided with an opening communicating both sides of it, and the gas exchange membrane 26 is stretched so as to cover the whole of the opening. With this, gas exchange can be performed between the inside and the outside of the anteroom 40 without movement of the air current between the inside and the outside of the anteroom 40.

The wall on the left side in the drawing forming the anteroom 40 is constituted by the wall 13. The gas exchange membrane 26 is stretched on the inner wall 13*a* separating the anteroom 40 and the internal space 12 of the wall 13 and the gas exchange membrane 26 constitutes a part of the inner wall 13*a*. A gas flow path 43 is stored in the internal space 12 parallel to the gas exchange membrane 26 withdrawn from the membrane by a distance of about half of the distance between the inner wall 13*a* and the outer wall 13*b*, i.e., the distance of 5 cm or more and 20 cm or less. The gas flow path 43 communicates airtightly an opening 46 provided at the lowest part of the inner wall 13*a* and a gas inlet of an FFU 44 provided on the ceiling wall 2*a* inside the space 5 between the roof and the ceiling. The FFU 44 is connected to a blow opening 45 so that air is supplied inside the anteroom 40. The gas outlet 45 is constituted as the same as the blow opening 22. The gas flow path 43 is constituted as the same as the gas flow path 24. The gas flow path 43 is constituted, for example, by using a duct having a rectangular cross section or by connecting plural bellows pipes in parallel. The gas flow path 43 is connected to the opening 46 airtightly. Air inside the anteroom 40 is introduced inside the gas flow path 43 through the opening 46, and all of air is returned again inside the anteroom 40 from the blow opening 45.

Furthermore, as a more convenient type, it is possible to omit the gas exchange membrane 26 provided in the inner wall 13 inside the anteroom 40 and to substitute it by the function of the gas exchange membrane 26 (shoji paper) constituting the sliding door 47. The gas flow path 43 has only to be constituted inside the internal space 12 isolated from it. The gas flow path 43 can be realized, for example, by simply connecting the bellows pipes. In the embodiment, although at least a part of the ceiling wall 2*a* constituting the main room 20 and at least a part of the ceiling wall 2*a* constituting the utility space 19 are constituted by the gas exchange membrane 26 to invest the gas exchange ability as much as possible, whether the gas exchange membrane 26 is placed or not, its area, etc. are properly designed and selected according to the consumption of oxygen inside the room.

The operation of the system of highly clean rooms 10 is now described. A person entering through the doorway 8 from the outside space such as the hallway etc. once waits in the anteroom 40 for dozens of seconds to several minutes, for example, thereafter the person enters the main room 20 by opening the sliding door 47. With this, the person can enter the main room 20 without deteriorating cleanliness of the living space at all. On the other hand, when the person leaves the main room 20, he enters the anteroom 40 from the main room 20, shuts the sliding door 47, and thereafter goes out from the doorway 8. With this, he can go out to the hallway or the outdoor without deteriorating cleanliness of the main room 20 at all. Other than the above description are the same as the first and second embodiments.

<Example>

The system of highly clean rooms according to the embodiment can be applied not only to a newly built construction such as a house, a building, etc. but also to reconstruction etc. of the existing construction. In the example, the system of highly clean rooms 10 has been constructed by building in a room of a general house with the mechanism of the system of highly clean rooms.

Figure 11:
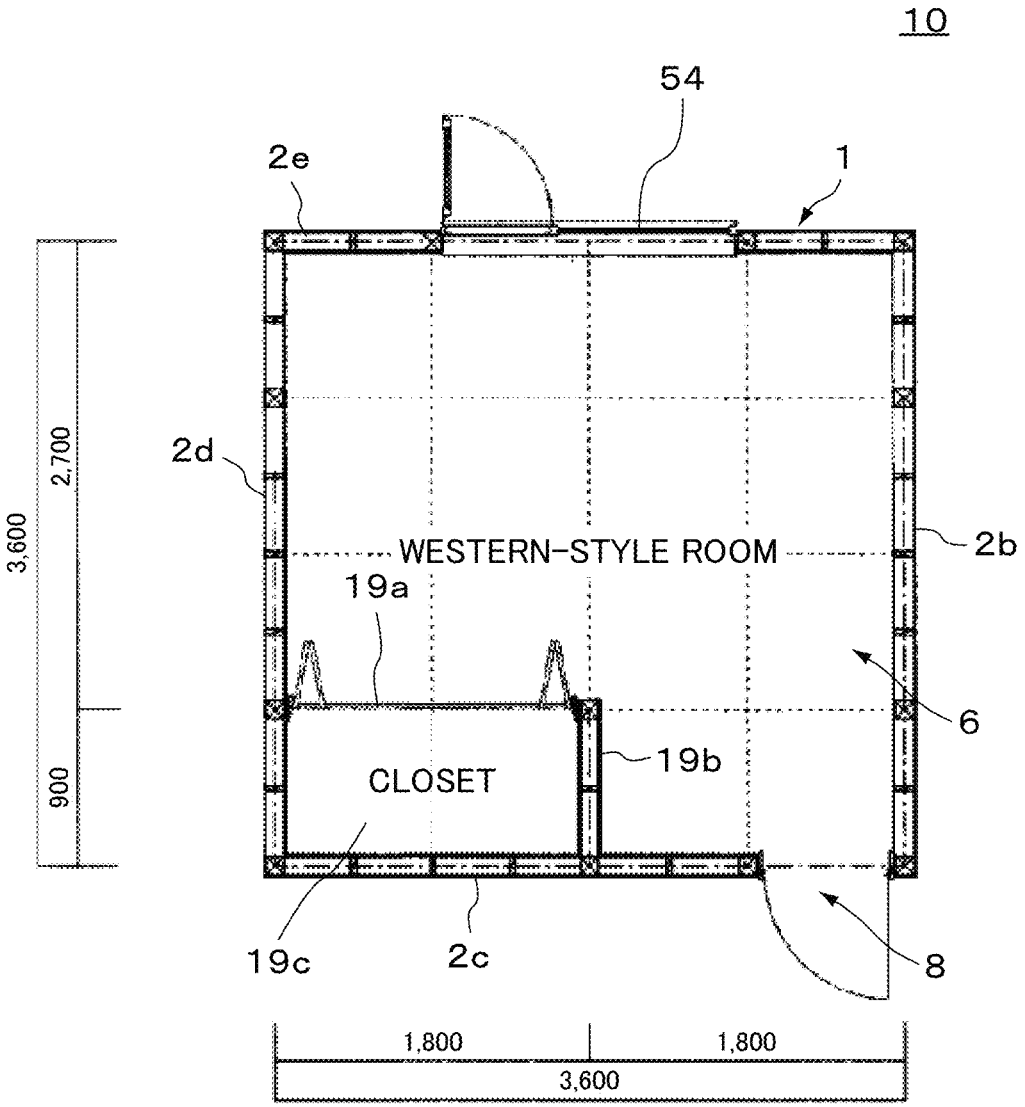
FIG. 11 A top view showing a room before installing a system of highly clean rooms according to the example.

FIG. 11 is a top view showing the room before the mechanism of the system of highly clean rooms is built in.

As shown in FIG. 11, the room 1 has a parallelepiped shape 3600 mm square and about 2300 mm in height. The doorway 8 is provided in the part adjacent to the one corner part of the lateral wall facing the hallway (not shown) of the room 1. On the other corner part of the lateral wall, formed is a parallelepiped storage part 19*c* 1800 mm in width, 900 mm in depth and 2300 mm in height. If this space is regarded as apart corresponding to the utility space 19 in the third embodiment described above, the example can realize the performance as the same as the third embodiment that is a mode applying the system of highly clean environment to a newly built house etc. in a mode applying the system of highly clean environment by reconstructing a room of a general house etc. existing quite common. That is, the room 1 can be regarded to have the storing part 19 as the utility space 19 in a part of the room 1 having the doorway 8 and can be regarded as a space equal to the room 1*a* shown in the second embodiment, for example.

And by reconstructing the room, the constitution of the system of highly clean rooms 10 can be added, and the performance equal to the system of highly clean rooms described in the third embodiment can be realized for the room of a general house etc. existing quite common. Here, the internal constitution of the room 1 is described. On the side facing the side provided with the doorway 8 of the room 1, a window part 54 1690 mm in width and 1170 mm in height is provided. The living space 6 that is a space other than the storing part 19*c* inside the room 1 is constituted by connecting two parallelepiped spaces with different sizes. One of the two parallelepiped spaces is a parallelepiped space surrounded by the lateral wall 19*b* of the storing part 19*c*, parts of the lateral wall 2*b* facing the lateral wall 19*b* each other and a part of the lateral wall 2*c* sandwiched between the lateral wall 19*b* and the lateral wall 2*b* and this space is a space next to the living space 6 from the doorway 8. Concrete size of the parallelepiped space is depth×width×height=900 mm×1800 mm×2300 mm. The parallelepiped space constitutes the anteroom 40 and the internal space 57 after reconstruction described below. The other one of the two parallelepiped spaces is a parallelepiped space surrounded by the lateral wall 2*e*, the lateral wall 19*a* of the storing part 19*c*, apart of the lateral wall 2*d* sandwiched between the lateral wall 2*e* and the lateral wall 19*a* and a part of the lateral wall 2*b* facing the part of the lateral wall 2*d* and this space is a space on the window side of the room 1. Concrete size of the parallelepiped space is depth×width×height=2700 mm×3600 mm×2300 mm. The parallelepiped space constitutes the main room 20 and the internal space 12 after reconstruction described below.

Figure 12:
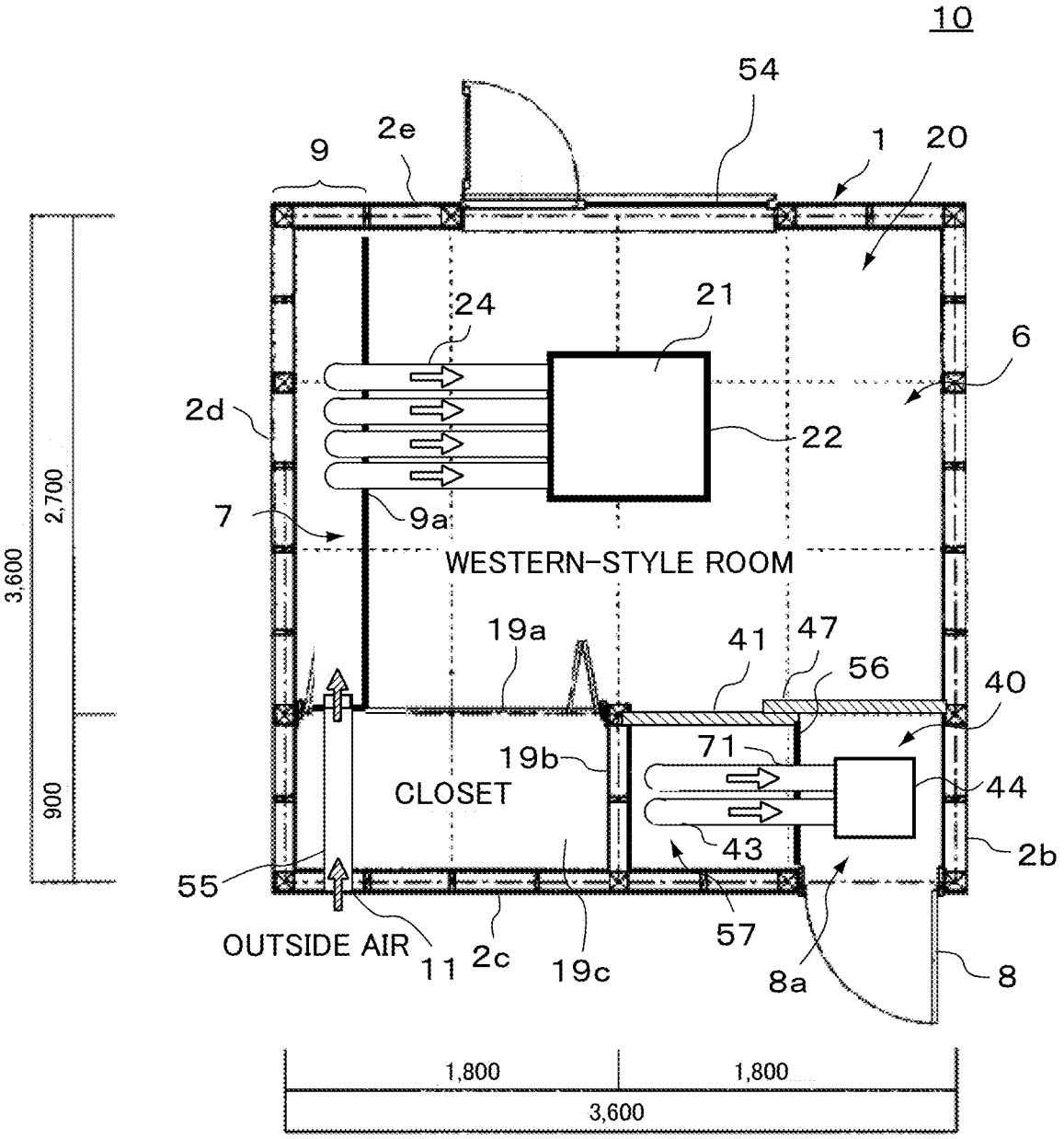
FIG. 12 A top view showing the room after installing the system of highly clean rooms according to the example.
Figure 13:
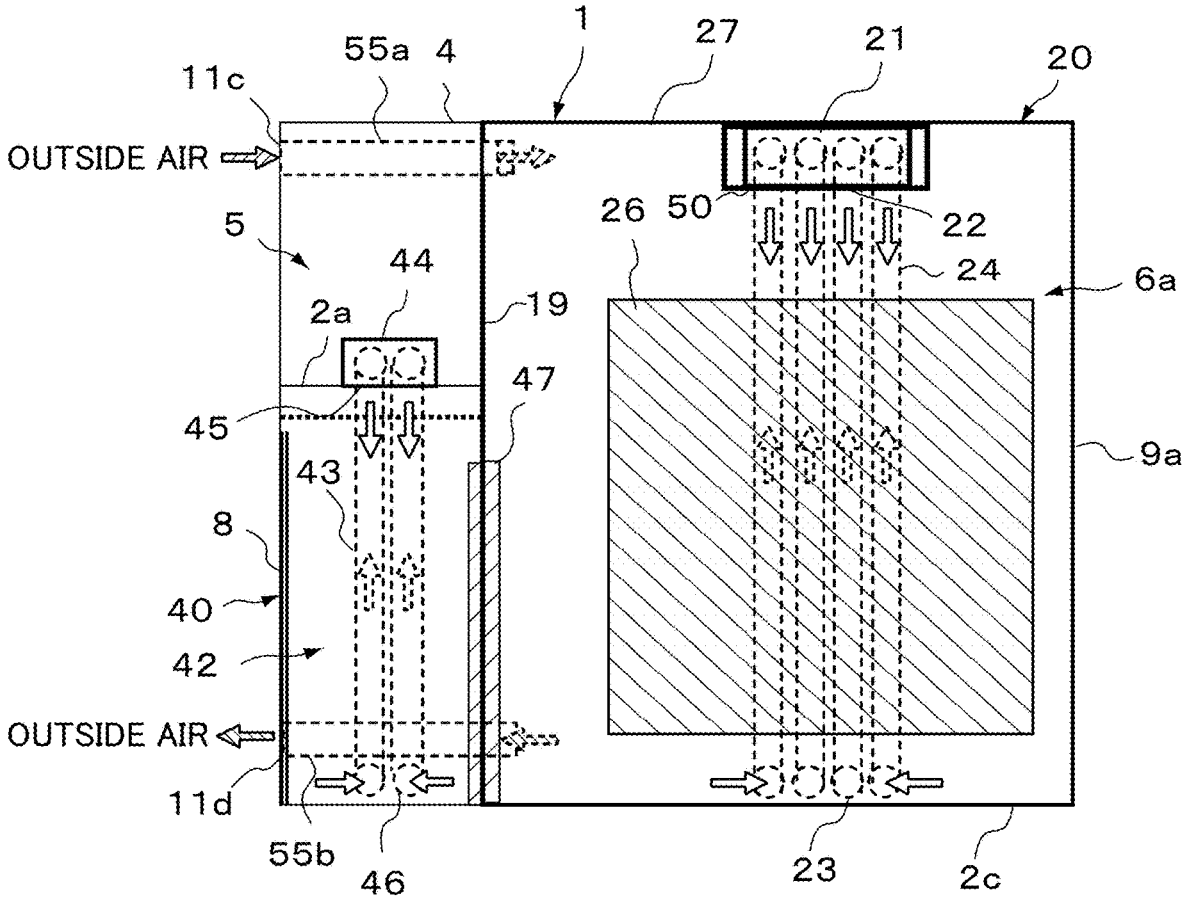
FIG. 13 A longitudinal sectional view showing the room after installing the system of highly clean rooms according to the example.
Figure 14:
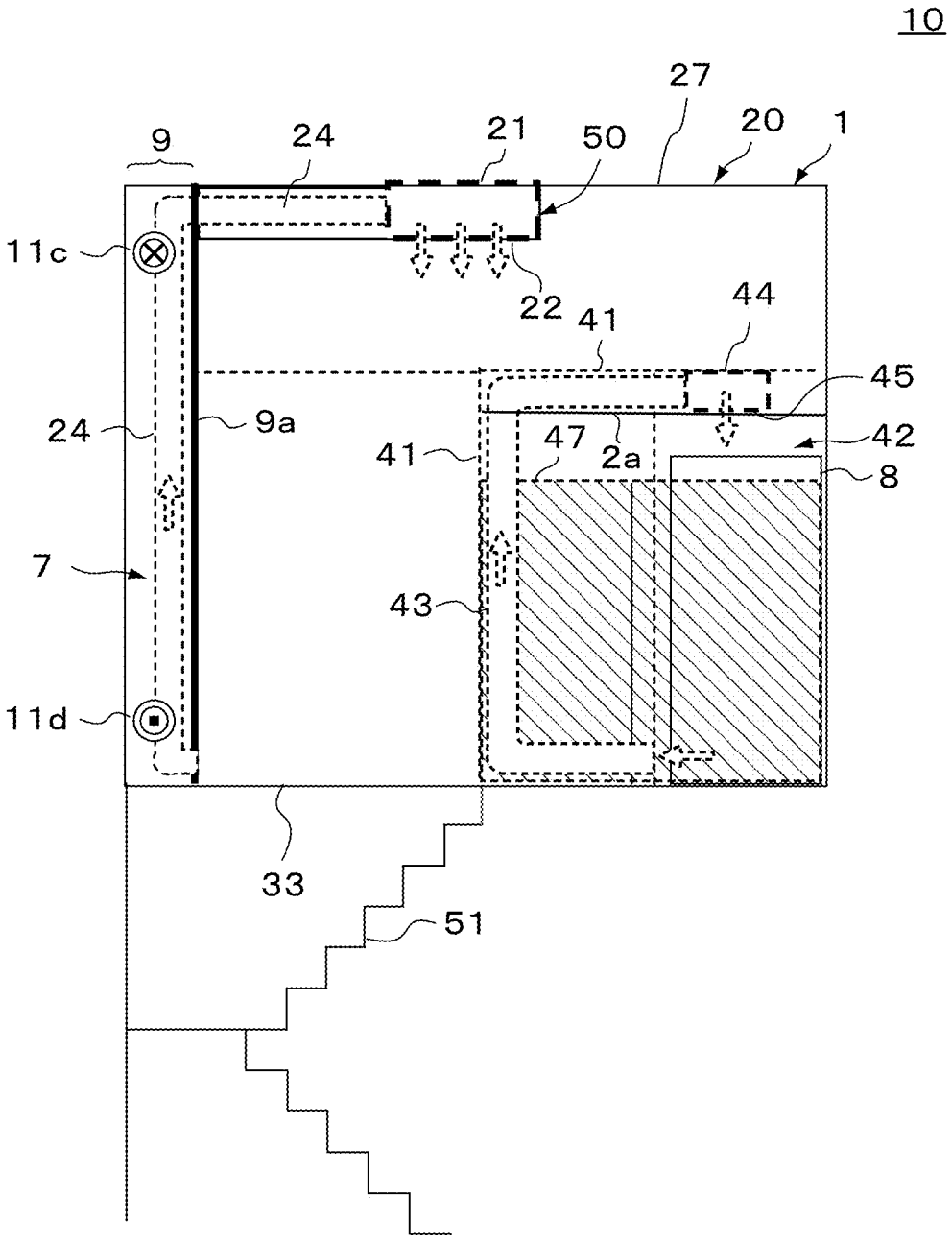
FIG. 14 A perspective view showing the room after installing the system of highly clean rooms according to the example seen from a hallway.

FIG. 12 is a top view showing the room 1 after the mechanism of the system of highly clean rooms was built in. FIG. 13 is a cross sectional view (perspective view) seen from the side of the lateral wall 2*b*. FIG. 14 is a cross sectional view (perspective view) seen from the side of the lateral wall 2*c*.

As shown in FIG. 12 to FIG. 14, the living space 6 is formed inside the room 1. After reconstruction, by partioning the two parallelepiped spaces with the partition 41 and the sliding door 47, the living space 6 is divided into a space having the main room 20 and the internal space 7 and a space having the anteroom 40 and the internal space 57. Furthermore, by providing a panel parallel to the ceiling wall 27 of the room 1 and surrounding the space formed by the ceiling wall 27 and the panel airtightly, an FFU storing part 50 with the FFU 21 and the gas flow path 24 stored in it is formed. And by providing the wall 9*a* parallel to the lateral wall (conventional wall) 2*d* apart from it about 15 cm, the wall 9 that is a hollow wall unifying the lateral wall (conventional wall) 2*d* and the internal wall 9*a* is formed. The wall 9 has preferably the constitution of the wall shown in the first embodiment. Because the thickness of the lateral wall 2*d* is about 10 cm and the thickness of the inner wall 9*a* is about 0.6 cm, the total thickness of the wall 9 that is a double wall having an internal space is about 26 cm. With this constitution, the thickness of the internal space 7, a hollow space that the new wall 9 has, is 15 cm. A space surrounded by the lateral wall 2*b*, the lateral wall (conventional wall) 2*c* having the doorway 8, the lateral wall (conventional wall) 19*b* of the room 1 facing the lateral wall (conventional wall) 2*b*, the partition 41 and the sliding door 47 is divided into the anteroom 40 and the internal space 57 by partitioning with the partition 56. The partition 56 is provided so as to face the lateral wall (conventional wall) 19*b* in the manner such that the partition 56 closes the space between the edge of the lateral wall 2*c* on the side of the doorway 8 and the partition 41. The anteroom 40 is a space that a person enters first when the person enters the room 1 from the outside space. On the other hand, the internal space 57 becomes a space storing the 100% circulation feedback flow path in the anteroom 40.

The sliding door 47 is provided so as to slide on the face of the partition 41. When the sliding door 47 is shut, the space forming the main room 20 and the space forming the anteroom 40 are completely isolated. When the sliding door 47 is opened, it slides to move to the position on the major surface of the partition 41 of the main room 20. The sliding door 47 is constituted so as to keep airtightness of the anteroom 40 when the sliding door 47 is in the shut state. The partition 41 and the sliding door 47 are preferably provided on the same plane as the lateral wall 19*a* so as to make smooth the main room 20 as much as possible because dead space is reduced and the living performance is improved. When both of the doorway 8 and the sliding door 47 are shut, the anteroom 40 becomes the closed state without movement of dust particles. A person can enter the room 1 from the outside by opening the doorway 8. The FFU 44 is provided in the ceiling wall 2*a* in the space 5 between the roof and the ceiling. In the anteroom 40, the opening 46 corresponding to the absorption opening of the FFU 44 is provided at the lowest part of the wall 56. All of gases flowing inside the anteroom 40 from the blow opening of the FFU 44 pass through the opening 46, further pass through the gas flow path 43 communicating the absorption opening of the FFU 44 and the opening 46 airtightly and fed back to the FFU 44, so that the 100% circulation feedback system is constituted.

The inner wall 9*a* is provided parallel to the lateral wall 2*d* of the room 1 a constant distance apart as described above, and the wall 9 encloses the space 7 being in contact with the main room 20 via the gas exchange membrane 26. The wall 9 has the inlet and the outlet for an air current on its edge, and the internal space 7 and the hallway that is the outside space are connected by pipes 55*a* and 55*b*. In this way, because gases can be exchanged between the outside space and the internal space 7, the internal space 7 functions as the space for introducing outside air. The pipe 55*a* is an inlet pipe having the absorption opening 11*c* and the pipe 55*b* is an outlet pipe having the exhaust opening 11*d*. Its diameter is 10 cm. It is desirable to provide, for example, a mechanical ventilation device to the absorption opening 11*c* and/or the exhaust opening 11*d*. Concretely, the mechanical ventilation device has preferably the flow rate generation ability that air inside the main room 20 circulates one turn or more in two hours, for example. One turn per two hours means that all air inside the main room 20 is ventilated in two hours. At least a part of the inner wall 9*a* is constituted by shoji paper that is the gas exchange membrane 26. With this, the main room 20 becomes the enclosed space surrounded by general wall materials or the lateral wall including the gas exchange membrane 26 as a part of it, and gas molecules can be exchanged between the main room 20 and the internal space 7 communicating with the outside without movement of air as the air current between the internal space 7 and the outside space. With this, when there exists the concentration difference in gas constituent constituting air between the main room 20 and the internal space 7 communicating with the outside, there occurs concentration diffusion of gas molecules constituting air or various molecules contained in air inside the room generated during life and activity inside the room and gas constituent constituting air inside the main room 20 moves so that its concentration reaches in equilibrium with that of the outside. That is, if the oxygen concentration inside the main room 20 falls, oxygen is supplied to the main room 20 via the gas exchange membrane 26 from the internal space 7 and if the carbon oxide concentration rises in the main room 20, carbon dioxide is exhausted through the gas exchange membrane 26 from the internal space 7. Furthermore, when various smell and chemical substances are generated in the main room 20, their originating molecules are exhausted to the outer space according to the above mechanism.

The 100% circulation feedback system constituted by the FFU 21 and the airtight gas flow path 24 is connected with the main room 20. The opening 23 that is the absorption opening constituting the 100% circulation feedback system is provided in the inner wall 9*a* separating the main room 20 and the internal space 7. Gases absorbed from the opening 23 enters the absorption opening of the FFU 21 through the gas flow path 24 communicating the opening 23 and the FFU 21 airtightly, then gases are filtered in the FFU 21, further gases are pushed (exhausted) to the main room 20 via the blow opening 22, and this air is returned again to the opening 23 while taking in dust inside the room, so that the 100% circulation feedback system is formed. In the embodiment, the gas flow path 24 is a bellows pipe having a diameter of about 10 cm. Although only a concept is presented and sizes and distances are not shown in the strict scale in the example shown in FIG. 12 to FIG. 14, the gas flow path 24 retreats from the gas exchange membrane 26 about 5 cm and is almost in contact with the wall 2*d*. Furthermore, by constituting at least a part of the inner wall 9*a* separating the main room 20 and the internal space 7 with shoji paper that is an example of the gas exchange membrane 26, gas exchange can be performed between the internal space 7 and the main room 20 by the inner wall 9*a*.

Figure 28:
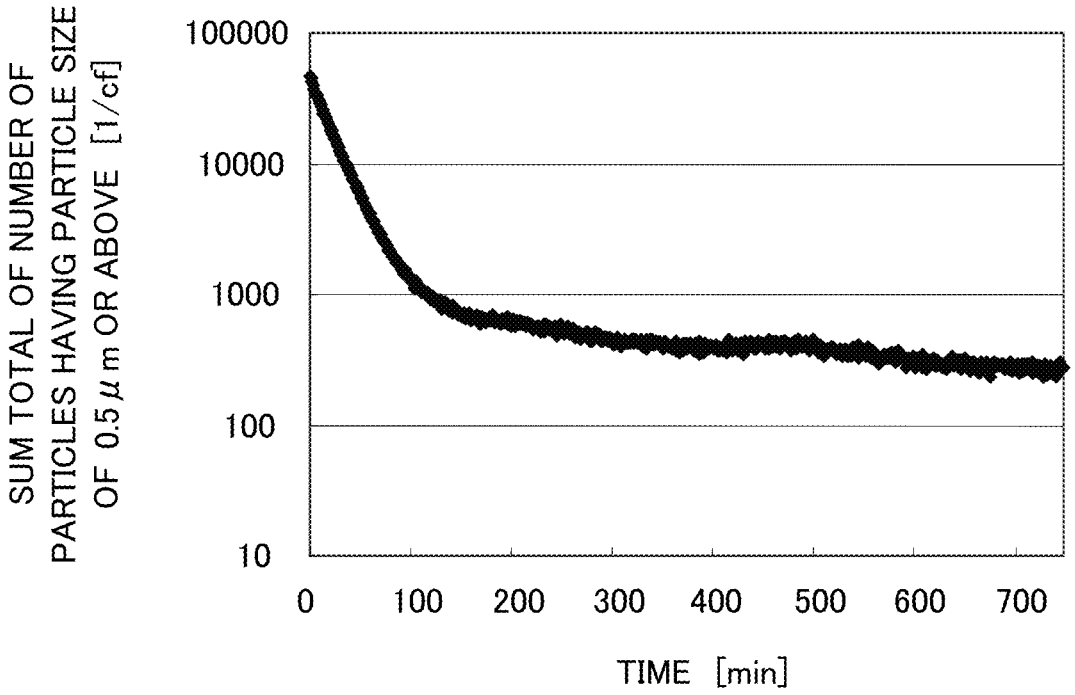
FIG. 28 A schematic diagram showing the total number per cubic feet of dust having the particle size of 0.5[μm] among dust inside the main room shown in FIG. 27.
Figure 29:
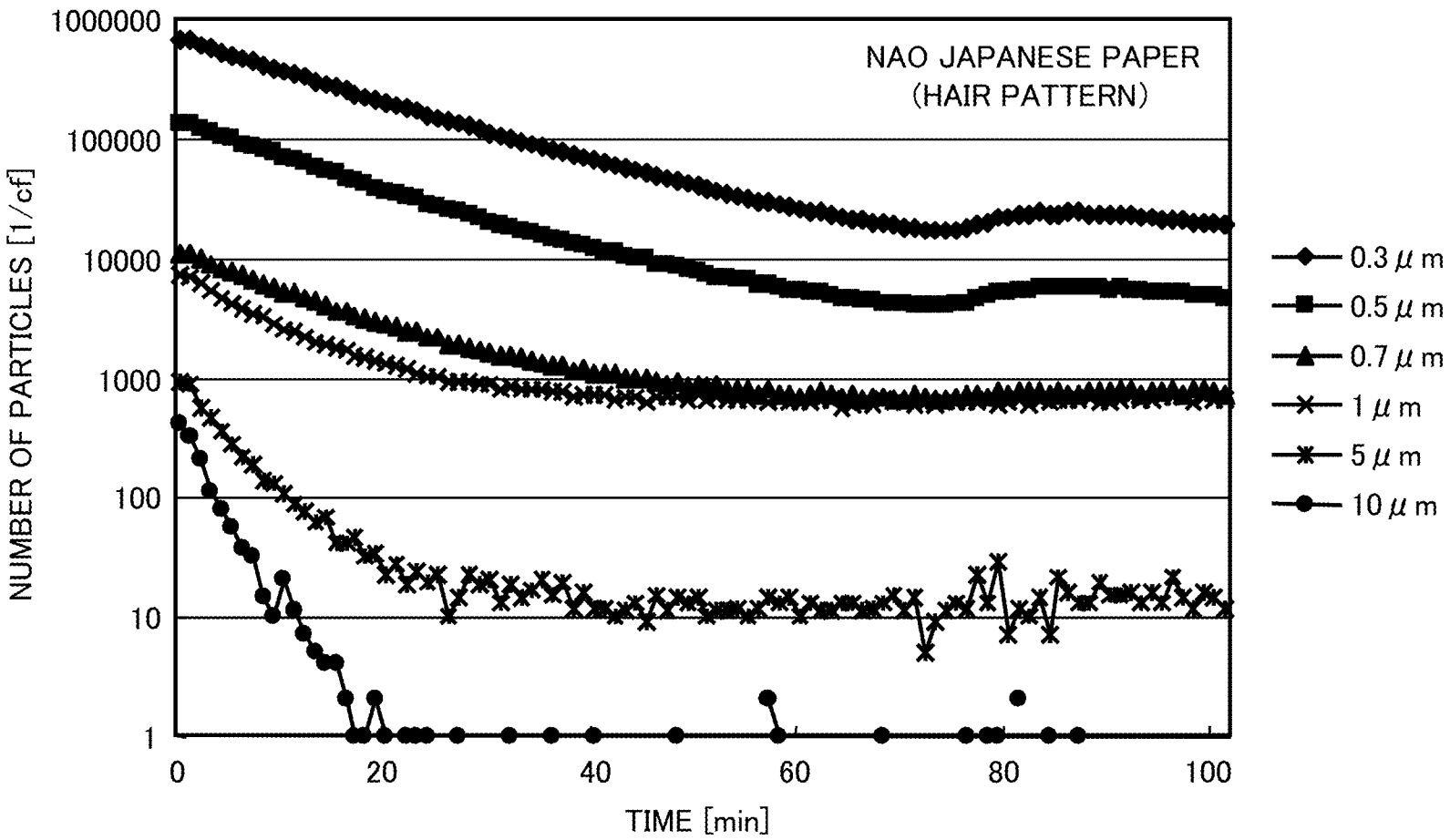
FIG. 29 A schematic diagram showing a time change of the number of dust when Nao Japanese paper is used as the gas exchange membrane.
Figure 30:
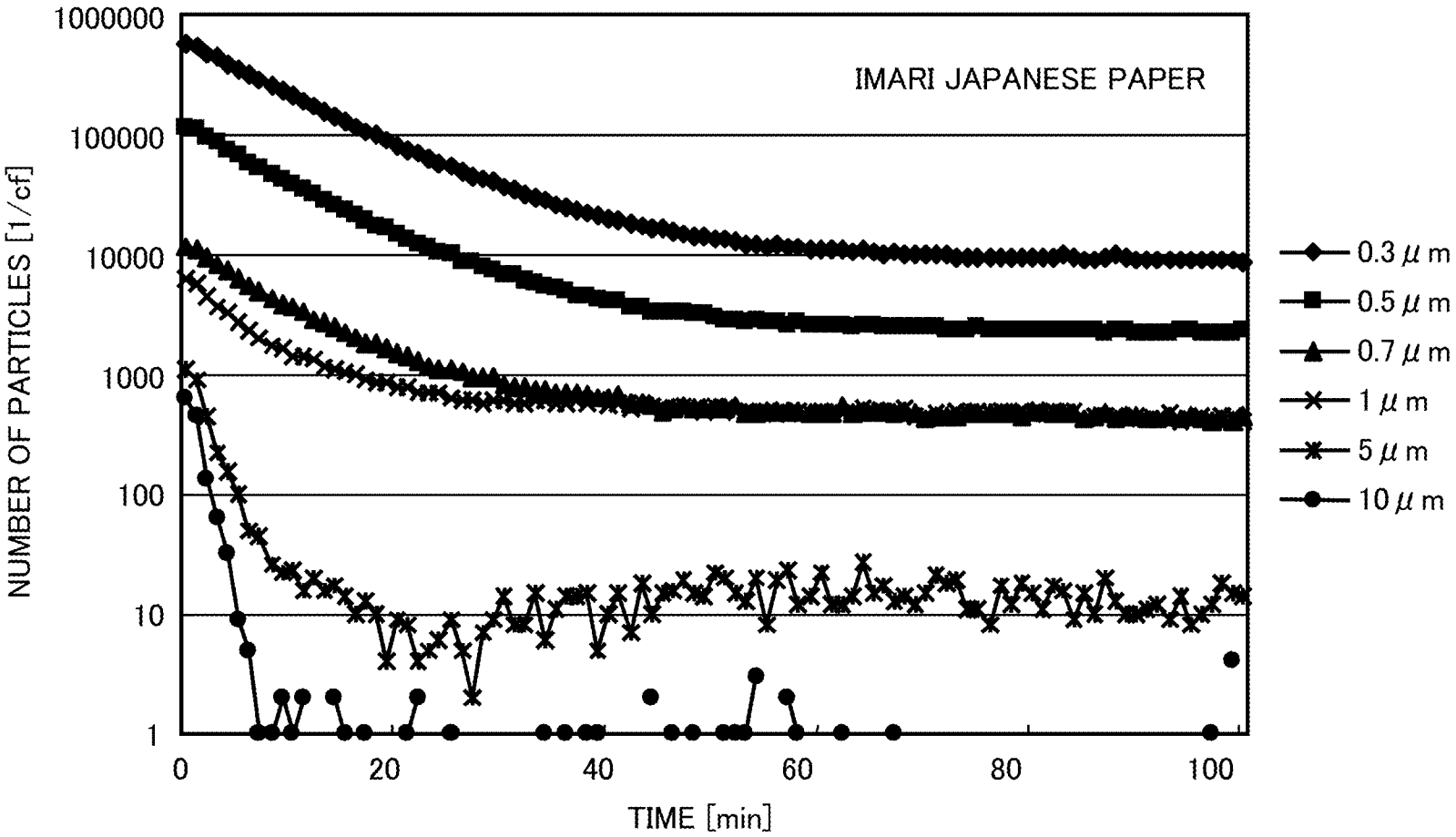
FIG. 30 A schematic diagram showing a time change of the number of dust when Imari Japanese paper is used as the gas exchange membrane.
Figure 31:
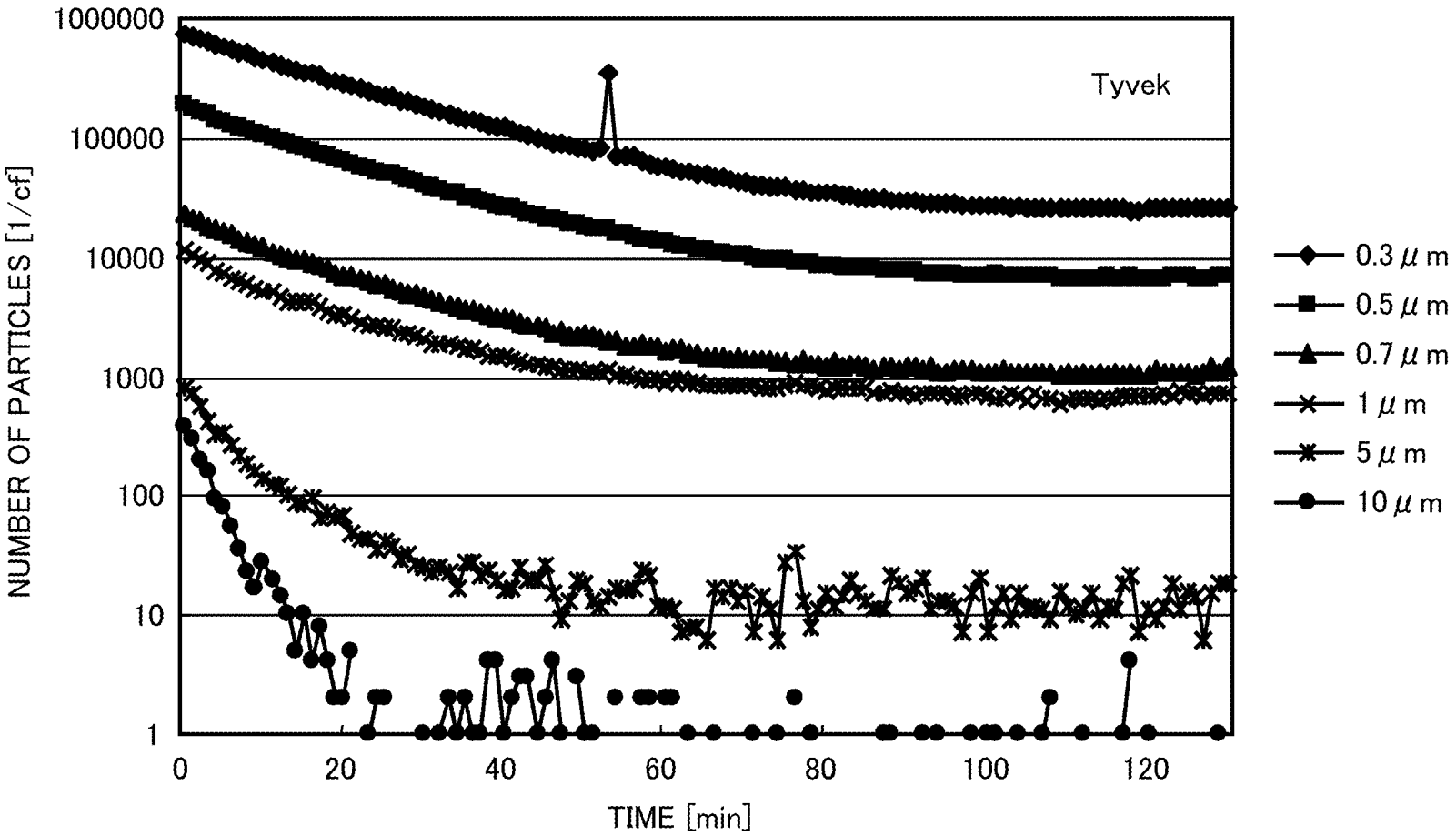
FIG. 31 A schematic diagram showing a time change of the number of dust when Tyvek (cloth like) is used as the gas exchange membrane.

When a person moves between the outside space and the anteroom 40 through the doorway 8, cleaning of air inside the anteroom 40 is performed under the state that both of the doorway 8 and the sliding door 47 are shut. More specifically, after the anteroom 40 is set to be the enclosed space, the 100% circulation feedback system using the FFU 44 described above is operated. As shown in FIG. 28 and FIG. 29 described later, after forty seconds to several minutes have passed from the start of operation of the FFU 44, cleanliness of the anteroom 40 is remarkably improved. Thereafter, by opening the sliding door 47, a person can enter the main room 20 from the anteroom 40. By constituting at least a part of the sliding door 47 with a membrane having the gas exchange ability such as shoji paper etc., even though there occurs no movement of air as the air current between the main room 20 and the anteroom 40, exchange of gas constituent described above can be performed.

Figure 15:
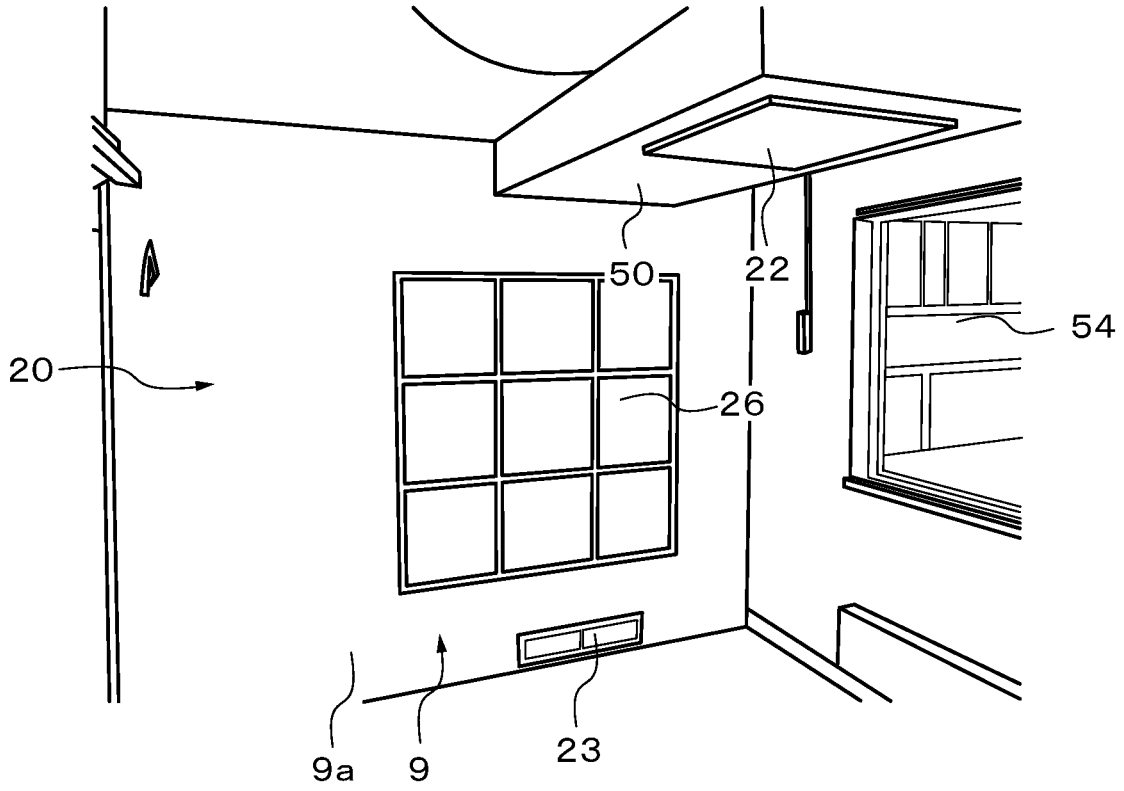
FIG. 15 A substitute picture for a drawing showing a main room, which is a living space, of the room after installing the system of highly clean rooms according to the example.

FIG. 15 is a photograph taken by a digital still camera, showing the complete shape of the system of highly clean rooms 10 according to the example.

As shown in FIG. 15, the wall 9 that is the back wall is the wall 9 shown in the example and the photograph shows inside the main room 20 of the room 1 built in the wall 9 as one lateral wall. The FFU 21 and the gas flow path 24 stored in the storing part 50 are provided in the ceiling part of the room 1 having the window part 54 and clean air is sent downward from the blow opening 22. The wall 9 has the inner wall 9*a* separating the main room 20 and the internal space 7 and the FFU storing part 50 extends to the wall 9*a* and is in contact with it. Apart of the inner wall 9*a* is constituted by the gas exchange membrane 26 having the area of 135 cm×135 cm and is constituted by shoji paper that is the gas exchange membrane 26. The opening 23 that is the absorption opening is provided at the lower edge of the wall 9*a*. A net is provided on the opening 23 to prevent invasion of large dust into the gas flow path 24.

Determination (order estimation) of the area of shoji paper is based on the consideration described below. A shoji paper used as the gas exchange membrane 26 is a commercially available multipurpose one for consumer (plain shoji paper made by ASAHIPEN CORPORATION) and values of its physical properties such as permeability etc. are not presented. Therefore, assuming that the shoji paper to be used has modestly estimated value of permeability [~1 l/(dm$^2$/min)]:200 Pa) among typical values of permeability of filter cloth shown in non-patent literature 9, the shape, the size, etc. of the shoji paper are designed and the area is determined. This is because a person actually enters the main room 20 and experiments are carried out as described later, it is preferable to modestly estimate permeability and set the area A rather largely from the safety aspect. Because the second term of the equation (12) described above denotes the volume F (its unit is [m$^3$/min], for example) occupied by oxygen molecules diffused through the gas exchange membrane per unit time, it is considered as a function of the pressure (partial pressure) difference based on the function of the concentration difference. Based on that permeability is the volume occupied by gas molecules diffused in the pressure difference per unit time and unit area, D/L of the gas exchange membrane appeared in the equation (12) shown above can be calculated from permeability. Setting the target oxygen concentration $\eta$=20.8% from the safety aspect, a condition that the area A of the gas exchange membrane 26 should satisfy is as follows.

$$A \geq \frac{B}{\frac{D}{L}\left(\frac{V_{O_2}}{V} - \eta\right)} \sim \frac{5\ell/\text{min}}{\frac{1\ell/(0.1\ \text{m}^2\text{min})}{\frac{200\ \text{Pa}}{1013\ \text{hPa}}}(20.9\% - 20.8\%)} \sim 1\ \text{m}^2 \tag{17}$$

As shown in the middle equation deriving the equation (17), D/L corresponds to the precoefficient of denominator in the equation (17) and in this time, it is calculated as about 5 [m/min] based on the value of permeability.

Furthermore, by constituting the gas exchange membrane 26 as a shoji window constructed like lattice by a wooden frame, although it is possible to improve remarkably cleanliness inside the main room 20, the main room 20 can produce a Japanese style atmosphere. Connected with the opening 23 provided at the lowest part of the inner wall 9*a* is the gas flow path 24 communicating airtightly the opening 23 and the gas inlet of the FFU21. The gas flow path 24 runs inside the internal space 7. In this way, the system of highly clean rooms 10 can accomplish very high cleanliness while producing a Japanese-style appearance without feeling discomfort compared with the conventional room space.

The above structure connecting the main room 20 and the anteroom 40 is not limited to the above example, but it can be applied to, for example, a Japanese traditional Japanese-style room and rooms of a Japanese-style hotel. Rooms of the Japanese traditional Japanese-style hotel has the so-called alcove (space for taking off shoes and Japanese wooden clogs) that is separated from the back room (the main room 20) by shoji etc. just behind the entrance. The above structure of the anteroom 40 can be introduced to the space. Taking off shoes is just Japanese old wisdom that dust is not brought into the back main room 20, and by adding the cleaning technology of this invention to it, the Japanese-style room shows the highest cleanliness in the world both in name and in reality in the greatest mode in the world without losing the traditional manner at all and the Japanese-style room can be put to practical use. In the Japanese traditional house etc., the outside is used as an air introduction source to the internal space 7 that is an air introduction space, a concrete floor space is used as the anteroom 40 and the back room is used as the main room 20. In the modern room in Japan (rooms in the apartment house etc.) etc., the outside is used as an air introduction source to the internal space 7 that is an introduction space, a front door space (for taking off shoes and Japanese wooden clogs) is used as the anteroom 40 and the back room is used as the main room 20. Furthermore, in the Western detached house, etc., the hallway and the outside are used as an air introduction source to the internal space 7 that is an air introduction space, a front door space (for taking off shoes and Japanese wooden clogs) is newly provided like Japanese-style as the main room 40 and the remaining space of the room is used as the main room 20, so that preventive measures against pollinosis etc. can be taken.

The operation of the system of highly clean rooms according to the example is now described. First, a change of cleanliness of air inside the main room 20 when the FFU 21 provided in the main room 20 is solely operated.

Figure 16:
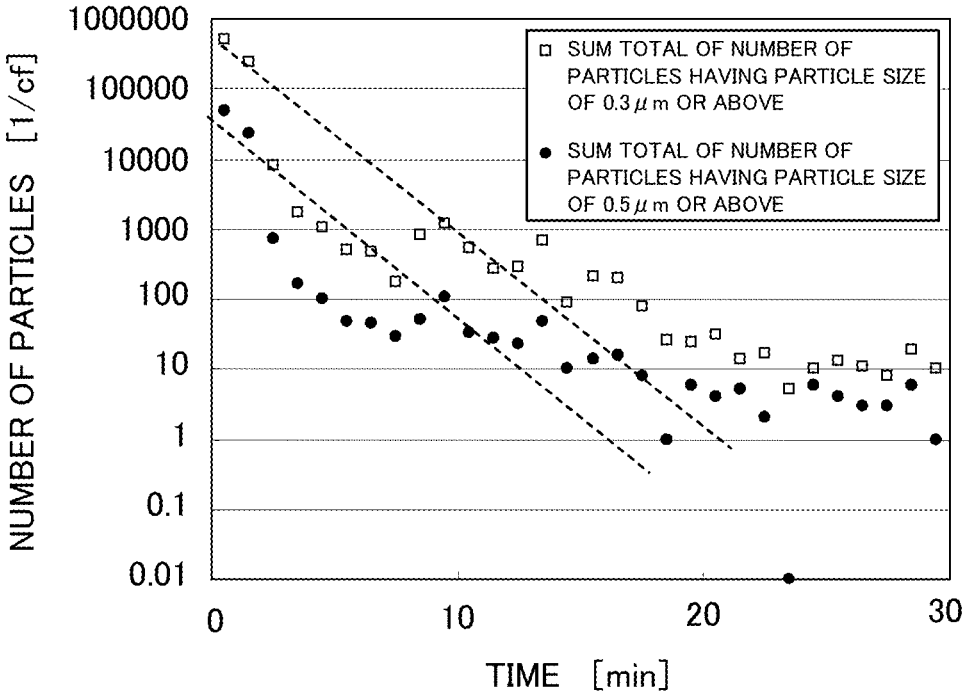
FIG. 16 A schematic diagram showing a change of the number of dust particles inside the main room in a short time when the FFU of the system of highly clean rooms according to the example is operated.
Figure 17:
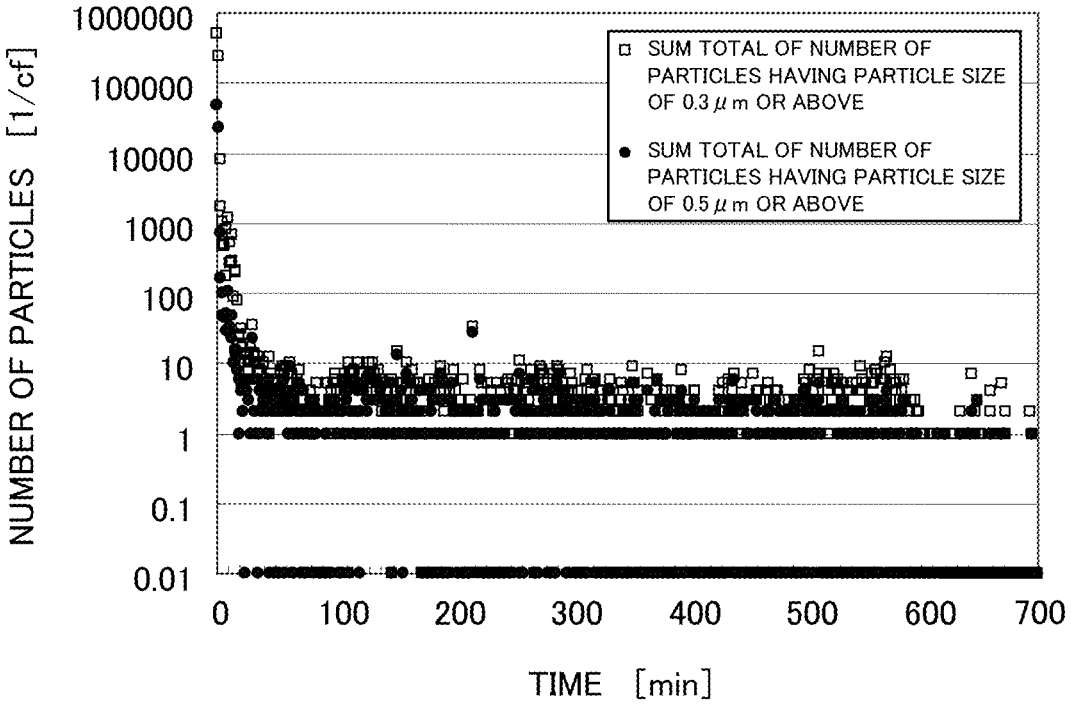
FIG. 17 A schematic diagram showing a change of the number of dust particles inside the main room in a long time when the FFU of the system of highly clean rooms according to the example is operated.

FIG. 16 is a schematic diagram showing a time change of the number of dust particles in a short time scale when the FFU 21 constituting the 100% circulation feedback system provided in the main room 20 is operated, and FIG. 17 is a schematic diagram showing time change in a long time scale.

As shown in FIG. 16 and FIG. 17, at the start of operation of the FFU 21, the sum of the number of dust having the particle diameter equal to or larger than 0.5 μm exceeds a hundred thousand/cubic feet (US 209D class 100000) and the sum of the number of dust having the particle diameter equal to or larger than 0.3 μm exceeds a million per cubic feet. In the environment there are very large number of dust particles and the environment is not definitely clean. After the start of operation of the FFU 21, the number of dust particles in the main room 20 reduces to about ten thousand in an about five minutes from the start of operation and after about ten minutes have passed, good cleanliness having the number of dust particles equal to or less than 100 per cubic feet, i.e., equal to or higher than US209D class 100 is obtained. Furthermore, particularly, as shown in FIG. 17, after about ten hours have passed from the start of operation, not only the sum of the number of dust having the particle diameter equal to or larger than 0.5 μm but also the sum of the number of dust having the particle diameter equal to or larger than 0.3 μm show zero count. Here, the vertical axis of the schematic diagram shown in FIG. 17 is of logarithmic plot, the measured value zero can not be plotted (because the measured value jumps infinitely downward). Therefore, the zero count obtained by measurement was conveniently plotted at 0.01. As apparent from FIG. 17, at a time range after six hundreds minutes (ten hours) have passed from the start of operation, not only the sum of the number of particles having the particle diameter equal to or larger than 0.5 μm but also the sum of the number of particles having the particle diameter equal to or larger than 0.3 μm frequently show zero count and this shows very good cleanliness is obtained. Here, the particle diameter means the average diameter of the primary particles (this is the same hereunder). This result is much higher than cleanliness of US209D class 1 of the super clean room used in a high quality semiconductor factory etc. and cleanliness is accomplished for the first time in the world in a room having appearance like a quite common general home shown in the example. This is extremely meaningful because the visual affinity in a daily life environment and the super clean environment are compatible.

Figure 18:
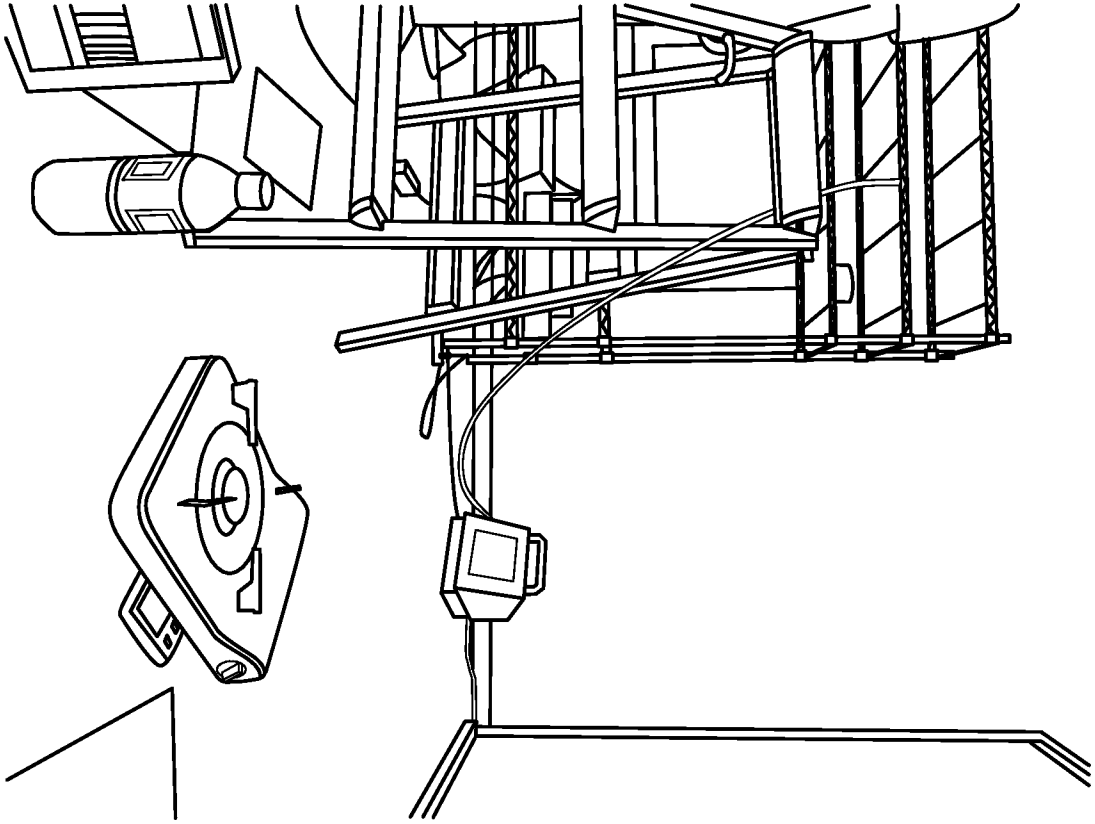
FIG. 18 A substitute picture for a drawing showing a situation carrying out an experiment of consuming oxygen in the main room of the system of highly clean rooms according to the example.

Described now is a case where persons stay in the main room 20, for example, and oxygen is consumed. FIG. 18 is a substitute picture for a drawing showing the scene carrying out the experiment consuming oxygen in the main room 20. As shown in FIG. 18, butane gas is burned by a cassette range in the main room 20, further two persons stay in the main room 20 and the oxygen concentration inside the main room 20 is measured while consuming oxygen in the room.

Figure 19A:
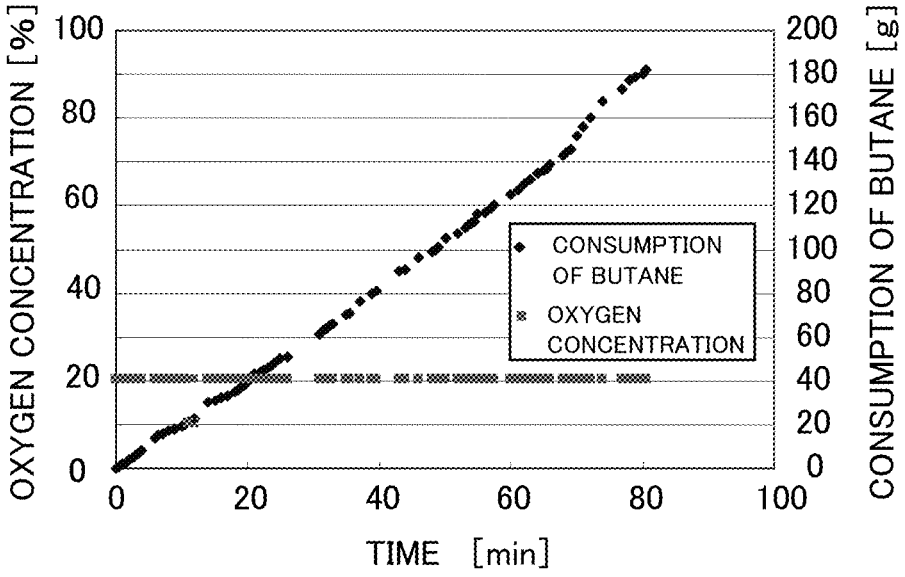
FIG. 19A A schematic diagram showing the quantity of combustion of butane gas and the concentration of oxygen in the main room when an experiment of consuming oxygen is carried out in the main room of the system of highly clean rooms according to the example.
Figure 19B:
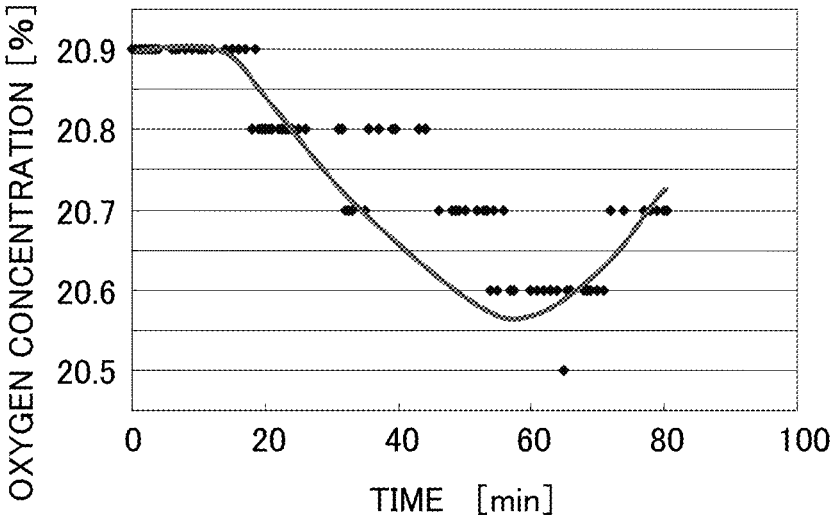
FIG. 19B A schematic diagram showing the quantity of combustion of butane gas and the concentration of oxygen in the main room when an experiment of consuming oxygen is carried out in the main room of the system of highly clean rooms according to the example.

FIG. 19A is a schematic diagram showing the butane ($C_4H_{10}$) gas combustion quantity from the start of the experiment to eighty minutes and the oxygen concentration inside the main room 20. FIG. 19B is a schematic diagram showing the change of the oxygen concentration in the graph of FIG. 19A enlarged in a range near 20%.

$$C_4H_{10}+6.5O_2 \rightarrow 4CO_2+5H_2O \quad (1)$$

From the chemical equation (1), taking into consideration that one mole of butane is 58 g and one mole of oxygen is 32 g, it is understood that the consumption quantity of oxygen when butane gas is burned 2 g per minute is about 5 [l/min.]. This corresponds to the consumption quantity of oxygen by about twenty persons. This number of persons is too many numbers to enter the living space having an area of about a six-tatami of the room 1 and the consumption quantity is enough to watch the oxygen supply ability. The gas range used in the measurement is placed in a position near the middle of the room but offset from the position just below the FFU. The oxygen concentration meter used in the measurement is placed at a position of the wall facing the gas exchange membrane, i.e., the most distant position from the gas exchange membrane.

As shown in FIG. 19A and FIG. 19B, the oxygen concentration inside the main room 20 reduces by about 0.3% from twenty minutes to sixty minutes and reaches 20.6% temporarily, thereafter switches to increase. This shows a good agreement with the value 20.8% that is the target oxygen concentration in the equation (16) described above. Assuming the above oxygen consumption quantity, D/L is calculated as 0.5 m/min to 2.5 m/min from the result of FIG. 12A. Reducing of the oxygen concentration temporarily to a little less than 20.6% is supposed undershooting and is explained as follows. Here, it is assumed that in analysis by the equations (9) to (15), there is no location dependence of the concentration for simplicity, taking into consideration the position of the gas range and the position of the oxygen concentration meter. That is, it is natural that there is a spatial distribution of the oxygen concentration in view of the construction of the main room 20. Here, by the effect of ventilation power of the FFU provided on the ceiling, the equations (9) to (15) were solved based on the approximation that "air in the room is stirred with the enough speed and there is no unequality of the oxygen concentration depending on the position". Therefore, the undershooting is supposed, and the arrival point attained after switching to increase is considered to be 20.8%, which shows that the calculation and the experimental result match well. In this way, with respect to the oxygen concentration inside the main room 20, if the concentration difference occurs between the living space and the internal space 7 of the wall 9 communicating with the outside, concentration diffusion of oxygen occurs to cancel the concentration difference. With this, even though much oxygen is consumed inside the main room 20, it is shown that the oxygen concentration almost near 20.9% based on the equation (15) shown above can be realized. In the main room 20 adjacent to the wall 9 having shoji paper, which is material of the gas exchange membrane 26 having a square shape of 135 cm×135 cm, 22 persons can stay for a long time without a deficiency of oxygen. This shows that shoji paper, which is the gas exchange membrane 26 separating the main room 20 and the internal space 7 of the wall 9, functions well as a membrane balancing various kinds of molecules between outside air introduced into the internal space 7 and gases inside the main room 20.

Based on the experimental result that the oxygen concentration inside the main room 20 begins to reduce and stops to reduce after about forty minutes, D/L can be calculated. That is, the equation (12), which is the differential equation depicting the change of the oxygen concentration of this system has the same form as the differential equation of the equation (3) and its exact solution has the same form as the equation (4) (especially, their time dependence are the same and shows an exponential function like change with respect to t. More specifically, it is enough only to substitute $\gamma F/V$ of the equation (4) for AD/VD of the equation (12) and behavior of the system with respect to time can be understood). An exponential function like behavior becomes steady after the time of about 10 times the inverse of the coefficient of t in the shoulder of the exponential function. From this, based on the result of FIG. 19B, it can be estimated that $\{1/(AD/VL)\}\times 10\sim 40$ min. Because A=1.35 m×1.35 m=1.8 $m^2$, the area is about six-tatami from FIG. 12 and the height of the ceiling is about 2.5 m, the volume V of the main room 20=24 $m^3$, D/L~(24 $m^3$/1.8 $m^2$)·10·(1/[40 min~60 min])~[2.2~3.3] m/min and coincide with D/L~5 m/min and D/L=0.5 m/min~2.5 m/min obtained in the detailed discussion of FIG. 19A and FIG. 19B. That is, according to the system adopting the wall 9 of the invention having the membrane that does not pass through dust particles but allows concentration diffusion of molecules and the internal space being in contact with this membrane and the 100% circulation feedback system, D/L that is an important parameter of the membrane can be obtained by carrying out oxygen consumption experiment (gas combustion experiment) inside. After the value is once obtained, based on the fact that the equation (12) is satisfied in good approximation and the parameter characterizing the system is VL/AD, VL/AD is rewritten as $\{(V/A)/(D/L)\}$. As a result, it is understood that newly presented is a method for designing the room adjacent to the gas exchange membrane (setting of V and A etc.) according to the scaling rule based on the parameter D/L depending only on the property of the gas exchange membrane 26 with very good prospects. That is, obtained here is a ratio of V/A, i.e., depth of the room or "effective aspect ratio" concerning gas exchange to the abstract aspect ratio D/L in "functional space" with respect to gas exchange (according to dimensional analysis, with respect to (V/A)/(D/L), the numerator having the dimension of $m^3/m^2$ is divided by the denominator having the dimension of $m^2/(m/s)$). According to space dimension, by dividing a ratio of 3D (dimension) to 2D by 2D/1D in functional space, space dimension is canceled, so that the remained dimension (1/hour) of the denominator finally gives a quantity having the dimension of time as a whole and this becomes the time constant of gas exchange of the system. By scaling of (V/A)/(D/L) as described above, it is understood that it is effective to equalize air flow sent out from the FFU in the whole surface of the ceiling in view of measures against dust as means for improving the function of the example shown in FIG. 12 (For example, a mesh with fine holes is provided under the FFU and a mesh with large holes is provided at the place apart from the position). Furthermore, it is understood that as an additional improvement in view of gas exchange based on the ratio (V/A)/(D/L), it is better to lay the FFU to the wall facing the wall 9, not to the wall 9 and make "size of the holes of the mesh" larger in the side far from the wall 9 and smaller in the side near to the wall 9. As described above, according to the scaling rule, a new method for designing the room in view of high cleanliness and gas exchange with very good prospects is obtained.

As described above, by using the equation (15), the area of the gas exchange membrane 26 can be calculated regardless of the consumption quantity of oxygen inside the main room 20. With respect to other gas exchange membranes having the same fine structure and the same diffusion constant, even though the gas exchange membrane different in its thickness is used, it is also possible to calculate the appropriate area by the equation (15). Furthermore, even though the performance such as permeability etc. of the gas exchange membrane is not known, by carrying out the experiment described above once based on the area and thickness of the gas exchange membrane, it is possible to know the performance of the gas exchange membrane, calculate its area depending on operations carried out according to various modes, and thereafter design the main room 20 freely. Here, the equation (12) is an equation in the case where rotation of air flow inside the room is enough and it is not necessary to consider space dependence. Therefore, with respect to the room without such a mechanism, or with respect to the case where such a mechanism is provided, but it is stopped, it is necessary to take space dependence into consideration. However, even in such a case, once the experimental value of the oxygen concentration in the room in certain conditions of the area A and the oxygen consumption rate can be obtained by measurement by experiments, thereafter it is possible to obtain the necessary area A of the gas exchange membrane 26 according to L dependence, B dependence and D dependence even under different oxygen consumption situations. This is important. It should be noted that the area A calculated in this way can give the appropriate ability of supplying oxygen to the main room 20 even in the case where the wall 2*d* shown in FIG. 12 is infinitely apart from the gas exchange membrane 26, i.e., the width of the cavity of the double wall 9 is very large, in other words, the gas exchange membrane 26 is substantially in contact with the outside (for example, outdoors and space in the hallway) directly. That is, a case where the gas exchange membrane 26 solely exists at the interface between the main room 20 and the outer space as a case where the thickness of the double wall 9 is substantially infinite is included in the example of the present invention.

Figure 20A:
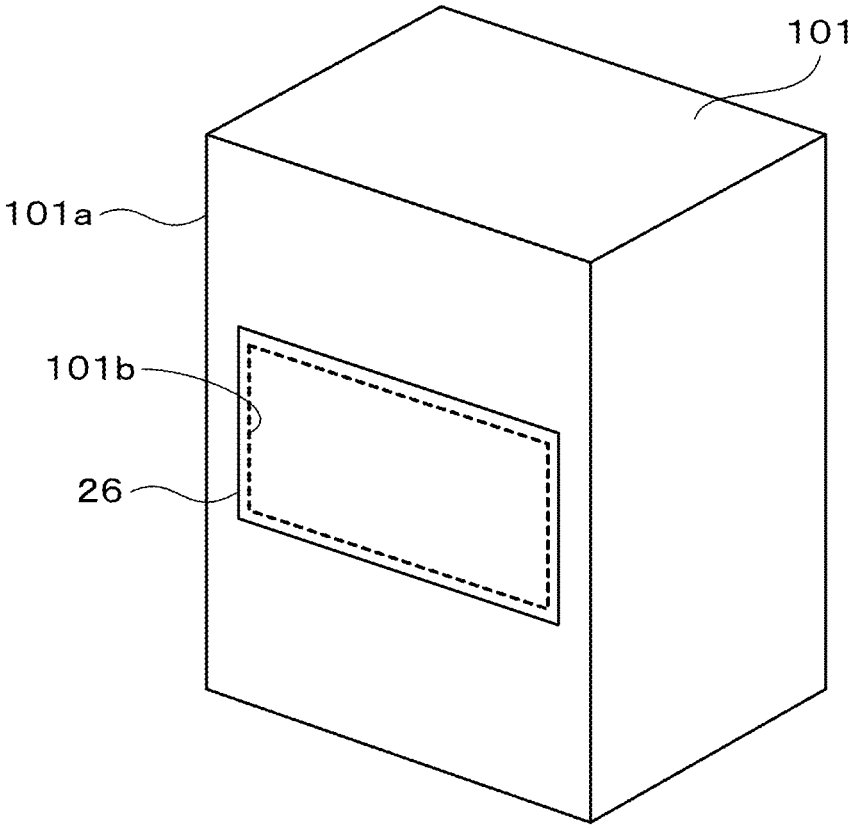
FIG. 20A A perspective view and a rear elevation showing a measurement device of the ability of oxygen penetration used to measure the ability of oxygen penetration of various gas exchange membranes.
Figure 20B:
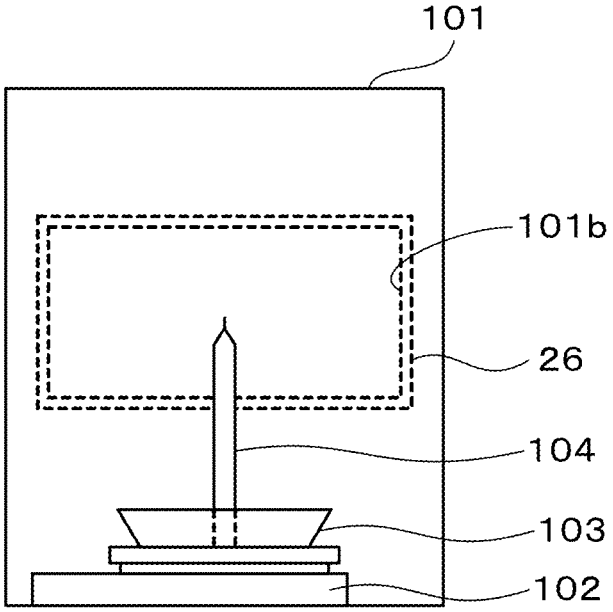
FIG. 20B A perspective view and a rear elevation showing a measurement device of the ability of oxygen penetration used to measure the ability of oxygen penetration of various gas exchange membranes.
Figure 21:
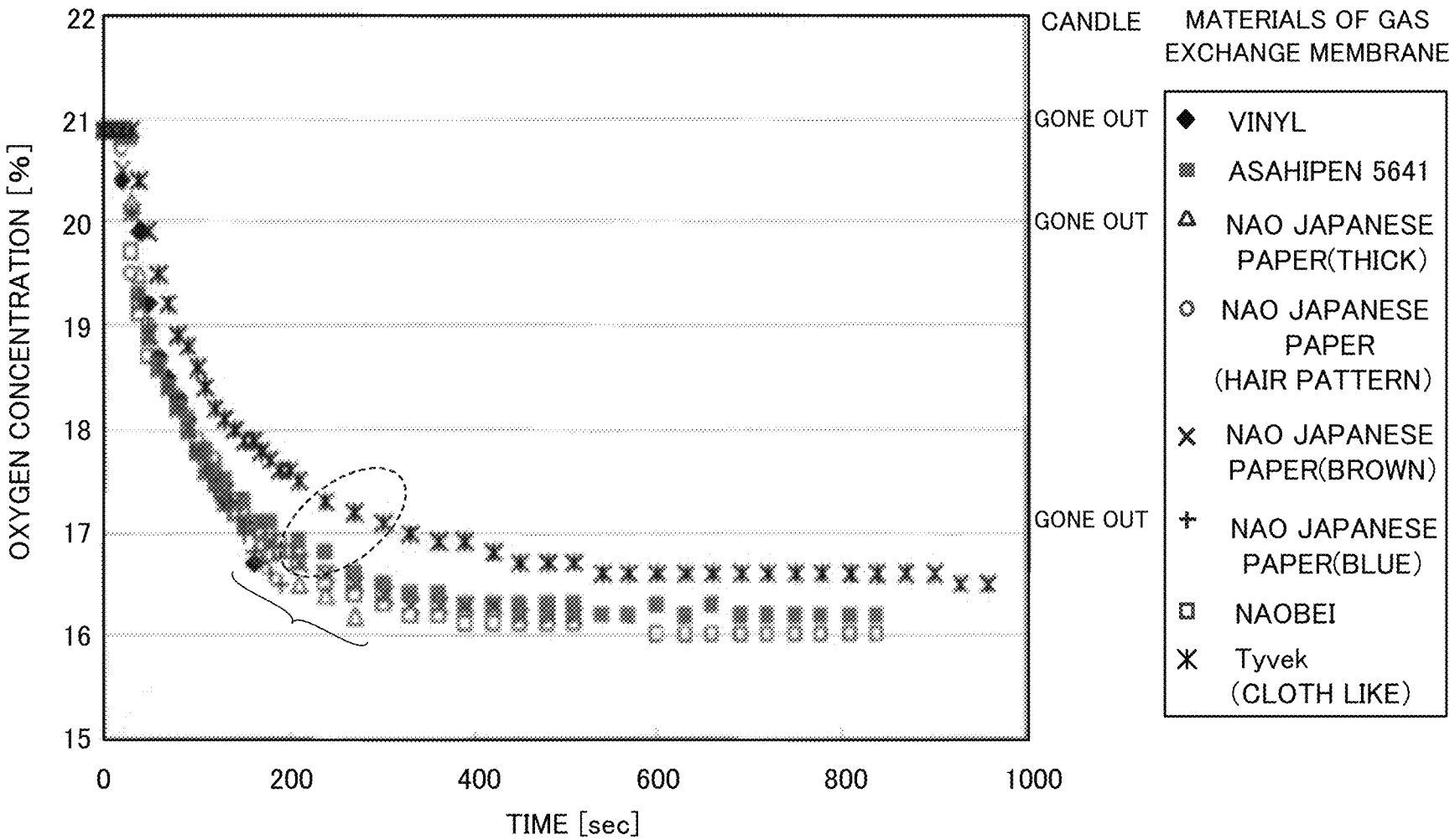
FIG. 21 A schematic diagram showing a result of measuring the concentration of oxygen in a chamber as a function of time using the measurement device of the ability of oxygen penetration shown in FIG. 20A and FIG. 20B.
Figure 22:
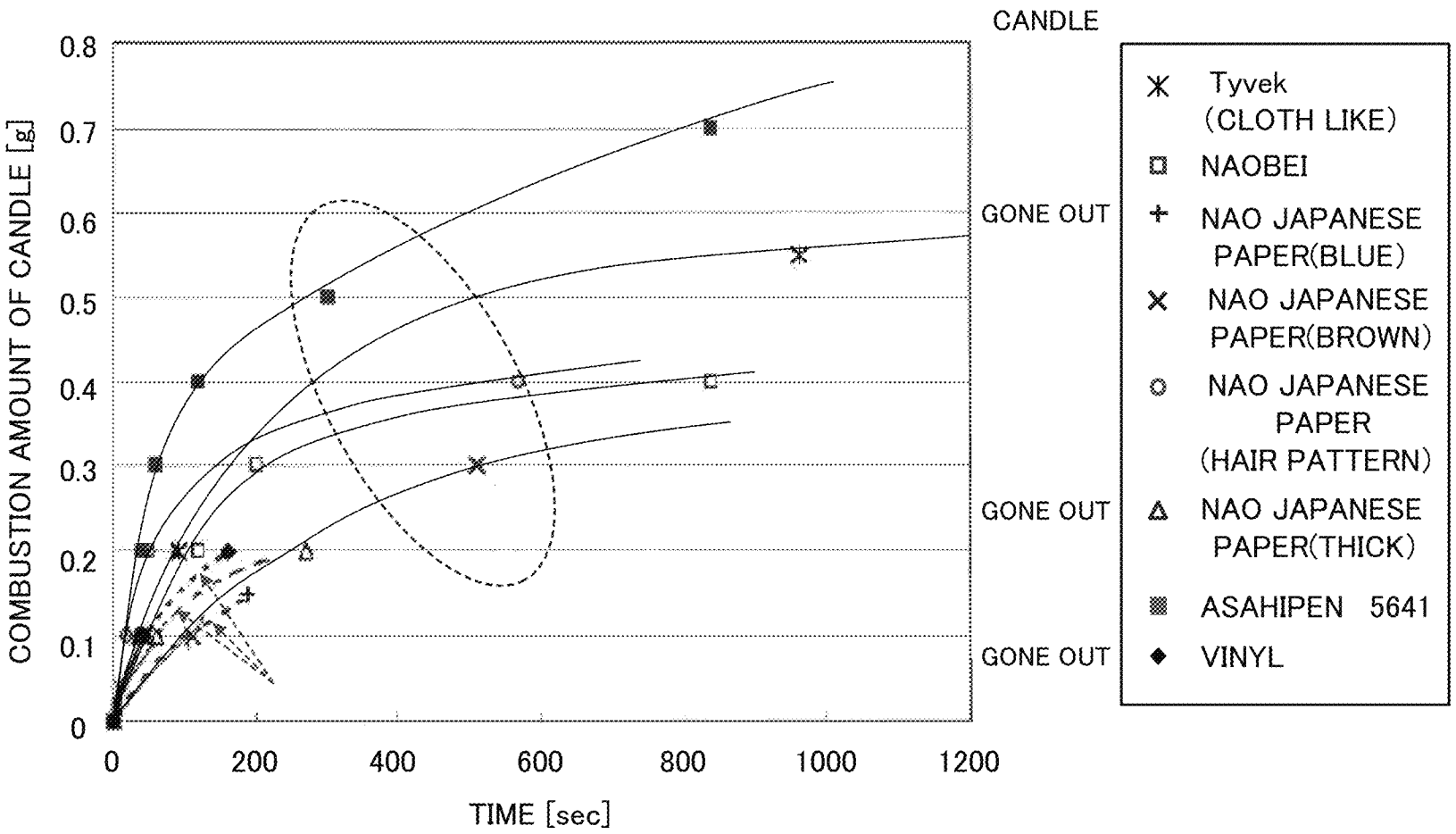
FIG. 22 A schematic diagram showing a result of measuring the quantity of combustion of a candle in a chamber as a function of time using the measurement device of the ability of oxygen penetration shown in FIG. 20A and FIG. 20B.

The value of D/L for the gas exchange membrane 26 to be used can be calculated as follows. For this, oxygen permeability was measured changing kinds of the gas exchange membrane 26. In order to measure the permeability, a measurement device of the ability of oxygen penetration shown in FIG. 20A and FIG. 20B was made. As shown in FIG. 20A and FIG. 20B, a parallelepiped like chamber 101 was made using transparent acrylic plates. The size of the chamber 101 is the width of about 20 cm, the depth of about 15 cm and the height of about 30 cm. A rectangular opening 101*b* was formed at the center of a front wall 101*a* of the chamber 101 and the gas exchange membrane 26 for measuring oxygen permeability was put up from the outside so as to cover the opening 101*b*. Tape etc. were attached so as to seal between the peripheral part of the gas exchange membrane 26 and the wall 101*a*. A commercially available digital platform scale 102 capable of measuring by a unit of 0.1 g was placed on the base of the chamber 101 and a plastic cage 103 was mounted on it. A candle 104 was stood on the base of the cage 103. The candle 104 was lighted and the oxygen concentration inside the chamber 101 and the combustion quantity of the candle 104 (this means the weight of the candle 104 burned and corresponds to the oxygen consumption quantity) was measured as functions of time. As the gas exchange membrane 26, various shoji papers (ASAHIPEN5641 (made by ASAHIPEN CORPORATION), Nao Japanese paper (thick type), Nao Japanese paper (hair pattern), Nao Japanese paper (brown), Nao Japanese paper (blue), and Naobei (registered trademark) that is shoji paper made by ONAO CO., LTD) and cloth like Tyvek (registered trademark) made by Du Pont Kabushiki Kaisha) were used. FIG. 21 shows a time change of the oxygen concentration inside the chamber 101 and FIG. 22 shows the change of the combustion quantity of the candle 104 with respect to time. With respect to the gas exchange membrane included in a part shown by { in FIG. 21, the decrease of the oxygen concentration was rapid and finally the candle 104 went out. That is, in the case of a vinyl film (marked by ♦) (its gas exchange ability is deemed to be almost zero) used as a reference, the candle 104 went out in a little less than three minutes most fast, and in the case of the Nao Japanese paper (blue) made by wax paper (marked by +) and the Nao Japanese paper (thick type) (marked by Δ), the candle 104 went out in about three and a half minutes and four and a half minutes, respectively. In the case of the gas exchange membranes included in a part enclosed by the broken line in FIG. 21 (ASAHIPEN5641; marked by ■, cloth like Tyvek; marked by *, Nao Japanese paper (hair pattern); marked by ○, Nao Japanese paper (brown); marked by x, Naobei; marked by □), the candle 104 essentially did not go out finally, though its flame became small. With respect to the gas exchange membranes shown by broken line arrows in FIG. 22, the oxygen concentration rapidly decreased, finally the candle 104 went out and the combustion quantity was small. On the other hand, in the case of the gas exchange membranes included in a part enclosed by the broken line in FIG. 22 (ASAHIPEN5641; marked by ■, cloth like Tyvek; marked by *, Nao Japanese paper (hair pattern); marked by ○, Nao Japanese paper (brown); marked by x), the candle 104 did not go out finally, though its flame became small. From FIG. 22, it is understood that the ASAHIPEN5641 (marked by ■) has high oxygen permeability because the oxygen concentration is high relative to other shoji papers as shown in FIG. 21, though the combustion quantity is large. The cloth like Tyvek also has a good quality. With respect to paraffin ($C_nH_{2n+2}$, n=24~33), the main constituent of the candle, the same chemical equation as the chemical equation in the detailed discussion of FIG. 19 is obtained. And by calculating the combustion rate B from FIG. 62 and $Vo_2$–η (here, the difference of the oxygen concentration at two different times) from FIG. 63, D/L can be calculated. It can be confirmed by this actual measurement that D/L has values of about 0.01 m/min~0.6 m/min depending on materials of the gas exchange membrane 26. The result almost matched with the result of analysis, the detailed discussion of FIG. 19 and the discussion that follows the detailed discussion of FIG. 19, which is independent from this experiment.

As described above, it is possible to obtain an extremely clean space in the room, in which cleanliness of air is well over US209D class 100 and near to the class 1. At the same time, the room constitutes the Japanese-style space having shoji doors or shoji windows and the room can be kept to be a room accommodating to the conventional Japanese-style construction. Furthermore, when operations or activities consuming a great deal of oxygen, an air environment inside the room can be kept to be favorable for existence of persons. At the same time, as described above, by making the gas exchange membrane 26 by Japanese old shoji papers, it is possible to present again a traditional "Shoin construction" proper appearance while having a modern high clean environment quality, which is suitable for restaurants or bars. Furthermore, it is expected that bad influence of passive smoking can be reduced in the space. It is highly expected to develop such spaces to houses, restaurants, hospitals and nursing institutions in the world and greatly contribute to peace of the future of human beings on the earth.

Figure 23:
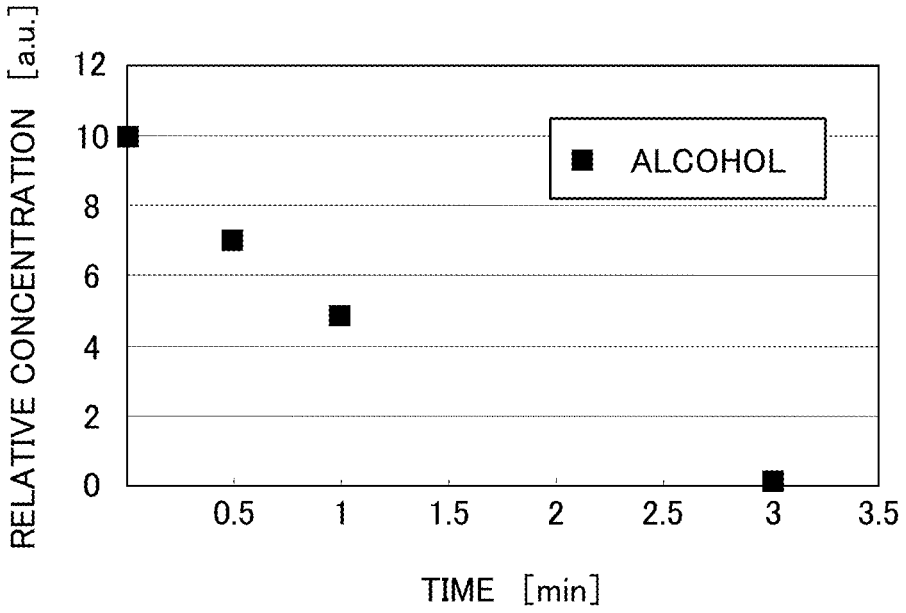
FIG. 23 A schematic diagram showing a change of the concentration of alcohol contained in air inside the main room when a photocatalytic filter is further provided inside a 100% circulation feedback system of the system of highly clean rooms according to the example and the system of highly clean rooms according to the example is operated.

In the system of highly clean rooms 10 according to the example, a photocatalytic filter (photocatalyst deodorizing unit for central air conditioning MKU40; made by NIPPON TOOKAN PACKAGE CORPORATION) was further placed inside the gas flow path 24 on the upper stream side of the FFU 21 in a series connection with it. FIG. 23 is a schematic diagram showing a change of the concentration of alcohol contained in air inside the main room 20 in the case where the fan filter unit 21 was operated at a ventilation quantity of 11 [$m^3$/min.] after a fixed quantity of alcohol was vaporized. As shown in FIG. 23, after one minute from the start of operation of the FFU 21, a stink of alcohol contained in air inside the main room 20, sensed by persons decreased to a half of the quantity before the start of operation and becomes almost zero after three minutes.

Figure 24:
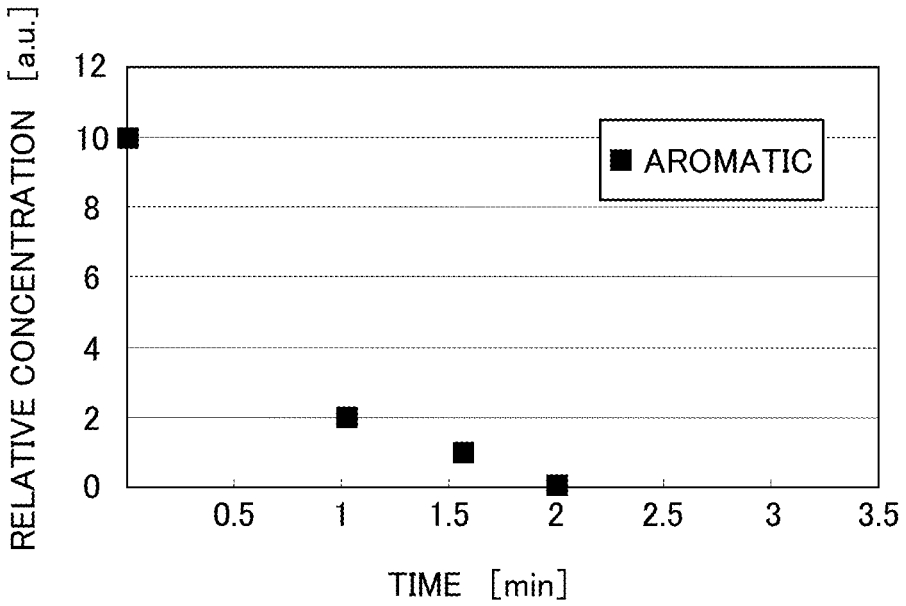
FIG. 24 A schematic diagram showing a change of the concentration of aromatic contained in air inside the main room when a photocatalytic filter is further provided inside a 100% circulation feedback system of the system of highly clean rooms according to the example and the system of highly clean rooms according to the example is operated.

FIG. 24 is a schematic diagram showing the degree of stink by aromatic contained in air inside the main room 20 in the case where the FFU 21 was operated after a fixed quantity of aromatic was vaporized in the main room 20 in the same configuration as the above. As shown in FIG. 24, after one minute from the start of operation of the FFU 21, a stink by aromatic (propylene glycol etc.) contained in air inside the main room 20, sensed by persons decreased to one fifths of the quantity before the start of operation and becomes almost zero after two minutes. In this way, it is possible to decrease the concentration of substances causing a stink in the main room 20 in a very short time.

The results shown in FIG. 23 and FIG. 24 show the outcome of the multiplier effect of the effect obtained by the above equation (3) in which s σ is read as the generation quantity of chemical substances, n is read as the concentration of chemical substances and γ is read as the decomposition efficiency per passage through the photocatalyst, and exponential decrease of the concentration shown by its solution (see the equation (4)) in the situation that the photocatalyst is provided and there is no movement of air inside and outside, and the effect of approaching to the equilibrium state with the outside through the gas exchange membrane 26. This is evidence of the very effective action of the present invention.

As described above, by using the 100% circulation feedback system provided inside with the photocatalyst, it is possible to decrease the concentration of chemical substances generated in the enclosed space and staying inside very quickly. This is originated from the multiplier effect obtained by the photocatalyst and the 100% circulation feedback system that can decrease exponentially the chemical substances in the enclosed space by contacting them with the photocatalyst repeatedly and the gas exchange function of the gas exchange membrane 26. That is, if the photo catalyst is incorporated into a conventional clean unit without the closed circulation feedback system, the photocatalytic effect is small in the open system. On the other hand, in the system of highly clean rooms 10 according to the example, the function of the photocatalyst can be specialized to the primary role of decomposing chemical substances etc. with the decrease of dust by the closed circulation system. With these, the system of highly clean rooms 10 according to the example can realize the long lifetime and the high function for both of the dust filter and photocatalyst.

From the above, by applying the system of highly clean rooms 10 to enclosed space in care homes, nursing homes, sickrooms, etc., it is possible to decompose stinks generated in the room instantly and improve the living environment drastically. Furthermore, even though chemical substances enter from the outside and chemical substances are generated inside, for example, by operating the 100% circulation feedback system after closing the space, it is possible to decrease the concentration of chemical substances inside the enclosed space to almost zero in several minutes. Particularly, according to the example, it is possible to realize the environment free of germs, dust, harmful gases/stinks inside the room 1, especially the main room 20. Therefore, by placing plants with effects favorable for persons such as, for example, small trees, foliage plants, herbs, etc. inside the main room 20, one can experience, for example, the highest class "forest bathing" in the middle of the city regardless of places. Furthermore, by positively introducing scents of aromatic matching with needs of respective users such as lavender etc., the quality of the environment, especially air, which is the greatest luxury for people of today in the future, can be improved to the maximum. As a result, it is possible to enhance the positive effect concerning bodies of people such as relaxation etc. to the maximum. Furthermore, by constructing a part of the inner wall of the closed space with the gas exchange membrane 26, it is possible for patients with irritation for chemical substances arising an allergic symptom for the particular chemical substance and asthmatics to stay in the space for a long time without making seriously asthma and allergic symptoms. In addition, by carrying out "loadless operation" of respiratory organs in the environment free of dust and germs for about eight hours of bedtime per day, it is expected to obtain the same effect as the effect on the respiratory organs obtained by a short time fast. Furthermore, for example, by setting the inside of the living and curing space to a clean space of class 1 to 10, for example, it is possible to administer medicine through respiratory organs, especially lungs in the "low background noise" environment free of dust and chemical substances and cure in the situation that the "S/N ratio" is drastically improved. That is, it is possible to carry out medical processes such as administration etc. without effect of dust exceeding one hundred million of the existing environment. Applications of the system of highly clean rooms 10 to hospitals and home medical care are very promising in Japan with an increasing population of aged persons and respective countries in the world to be predicted to show the same tendency in future.

When the 100% circulation feedback system provided with a photocatalytic filter connected in a series connection in the flow direction with the dust filter provided inside the FFU 21 is connected with the enclosed space and operated, it is possible to improve drastically the decomposing effect of chemical substances in the enclosed space. On the other hand, because the 100% circulation feedback system is provided with the dust filter and the photocatalytic filter in the flow direction in a series connection, the pressure loss for the flow becomes large and the quantity of air that can be supplied inside the enclosed space reduces. To cope with this problem, it is considered to use a high power fan with the large maximum static pressure as the fan of the FFU 21 or decrease the pressure loss of the filter for removing dusts. If possible, it is better not to adopt the former method for the energy saving purpose because costs increase and also the power consumption increases. The latter method reduces the pressure loss by the filter by decreasing the dust collection efficiency of the filter, so that the dust collection performance falls in a conventional air cleaning system depending largely on the dust collection efficiency of the filter. That is, the conventional clean system cannot adopt the latter method. On the other hand, the system of highly clean rooms 10 satisfying the equation (4) can adopt the latter method and demonstrate the high performance.

Figure 25:
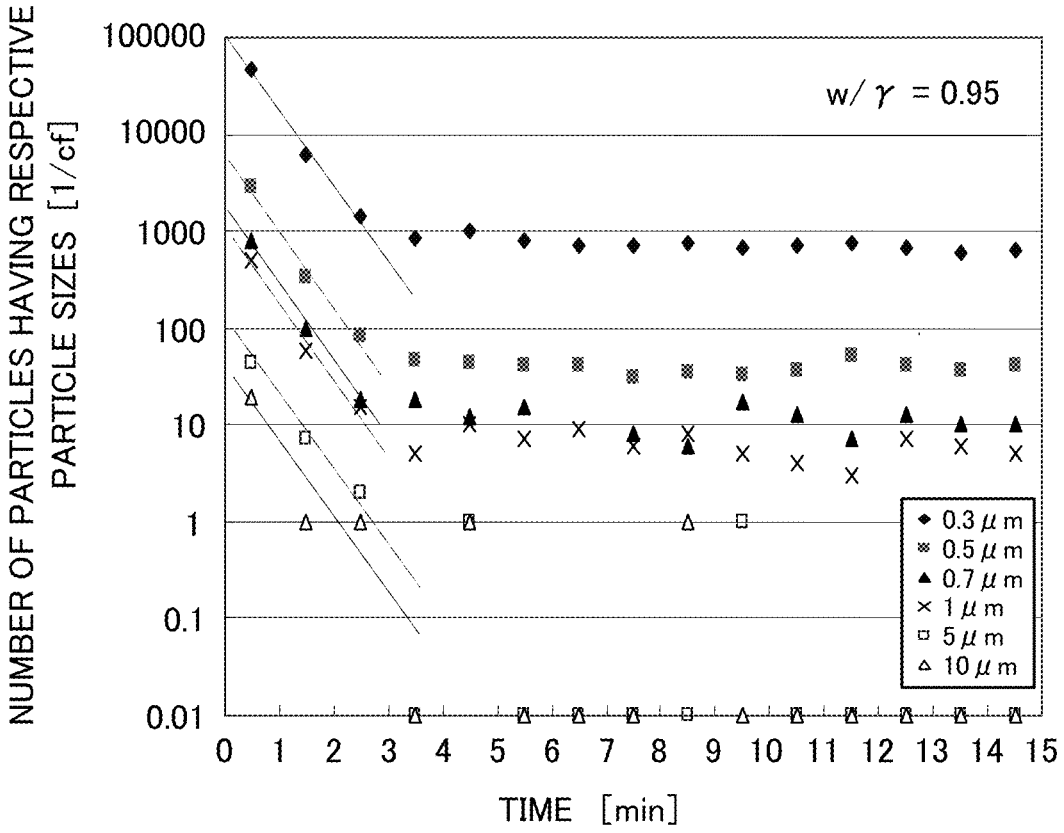
FIG. 25 A schematic diagram showing the number of dust inside the main room for time in the system of highly clean rooms according to the example when the dust filter is operated as a medium performance filter having the dust collection efficiency of 0.95.
Figure 26:
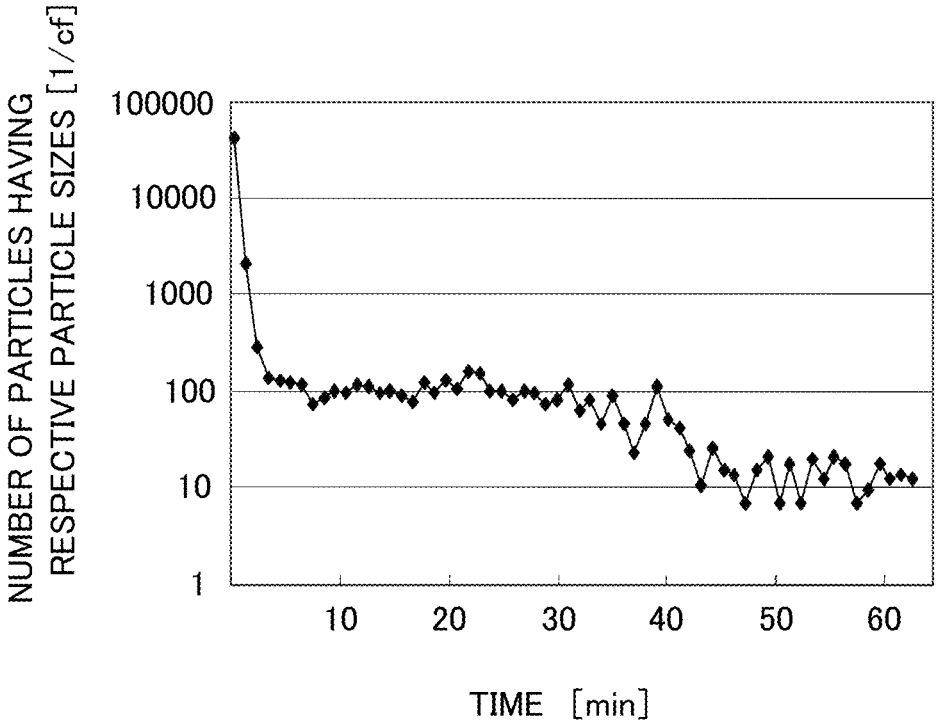
FIG. 26 A schematic diagram showing the total number per cubic feet of dust having the particle size of 0.5 μm or more among dust inside the main room measured and shown in FIG. 25.

FIG. 25 is a schematic diagram showing the number of dust for respective particle diameters in the main room 20 when the dust filter provided inside the FFU 21 is operated as the medium performance filter with the dust collection efficiency γ of 0.95. FIG. 26 is a schematic diagram showing the total number of dust having the particle diameter of 0.5 [μm] or more per cubic feet of dust inside the main room 20 measured in this experiment, and this directly corresponds to cleanliness of the main room 20 evaluated with US FED-STD-209 D standard.

As shown in FIG. 25, with respect to the number of dust inside the main room 20 after four minutes from the start of operation of the FFU 21, the number of dust having the particle diameter of 0.3 [μm] is kept to be below one thousand, whereas the number of dust having the particle diameter of 0.5 [μm] falls well below one hundred and the number of dust having the particle diameter larger than 0.5 [μm] is smaller than ten. With respect to the total number per cubic feet of dust having the particle diameter of 0.5 [μm] or more, as shown in FIG. 26, the total number of dust having the particle diameter of 0.5 [μm] or more per cubic feet begins to decrease below 100 after ten minutes from the start of operation, the total number of dust per cubic feet reaches to about ten after forty minutes from the start of operation, and thereafter the value is kept, so that a space having cleanliness of US209D class 1 can be obtained.

As described above, even though the dust collection efficiency γ is 0.95, the high quality clean environment having cleanliness of US209D class 1 can be obtained. From this, according to the system of highly clean rooms 10, it is possible to lower the level of demand for the dust collection efficiency of the filter "to be near 1" remarkably, and the resultant margin can be used to add value such as photocatalytic function etc. With this, choking of the dust filter becomes hard to occur and its lifetime is drastically extended. In this case, plural 100% circulation feedback systems may be connected with the main room 20. By constituting one of the plural 100% circulation feedback systems as the 100% circulation feedback system having the FFU 21 provided with a filter having the low dust collection efficiency with a photocatalyst, specialized for decomposing chemical substances, and the other as the 100% circulation feedback system having the FFU 21 with a filter specialized for collecting dust, it is possible to make the most of both advantages. Here, the main 100% circulation feedback system is provided with the gas flow path 24 communicating the inlet and the gas flowing opening to the FFU 21 airtightly as described above, and the blow opening 22 and the opening 23 that is an inlet provided on the lower part of the partition are separate. Therefore, if the "subordinate" circulation feedback system going along with the "main" 100% circulation feedback system is strong enough to move air inside the room without "short circuiting" on the whole, it does not always need a strict gas flow path such as the main loop in the 100% circulation feedback system. It is also recommended that an air cleaning device having the same expelled quantity and inhaled quantity is placed in the part inside the room in which air moves by the main circulation system. With this, it is possible to realize high cleanliness that cannot be realized by operating the device in a semiopen space.

Figure 27:
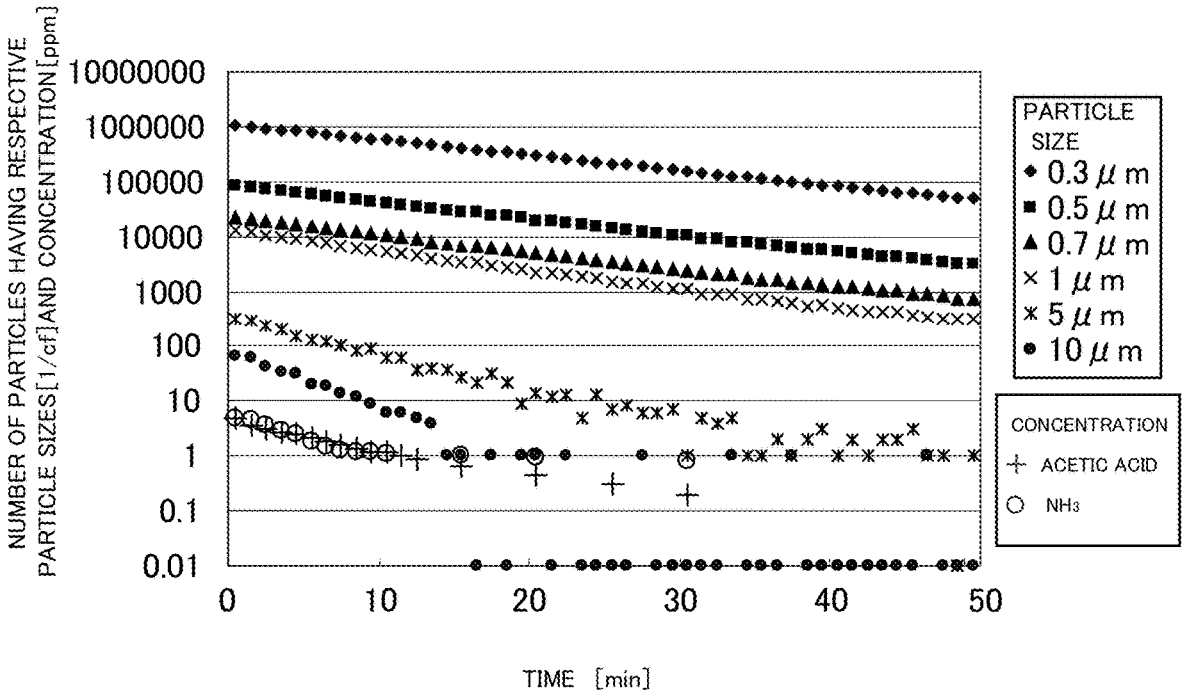
FIG. 27 A schematic diagram showing the number of dust inside the main room for respective particle sizes when a commercially available photocatalytic air cleaning device is placed and operated inside the living space in the system of highly clean rooms according to the example.

FIG. 27 is a schematic diagram showing the number of dust inside the main room 20 for respective particle diameters after the commercially available air cleaning device utilizing photocatalyst and metal radicals (made by FUJIFILM CORPORATION KDP1000) used as the FFU 21 constituting the 100% circulation feedback system provided inside the main room 20 was operated for dozens of minutes. Because zero count jumps to minus infinite, here, it is plotted to 0.01 count for convenience. FIG. 28 is a schematic diagram showing the total number of dust having the particle diameter of 0.5 [μm] or more per cubic feet of dust measured inside the main room 20. The KPP1000 was operated at the flow rate of 0.55[$m^3$/min.].

As shown in FIG. 27, the reduction rate of the number of particles also depends on γ shown in the equation (1). This is apparent from the equation (4). In the drawing, the number of particles rapidly reduces with respect to particles having the large particle diameter of 10 [μm] and γ~1 is satisfied in a good approximation. It is understood that as the particle diameter decreases as 5 [μm], 1 [μm], 0.7 [μm], 0.5 [μm] and 0.3 [μm], the reduction rate of the number of particles becomes smaller. That is, with respect to KPD1000, the collection efficiency γ changes depending on the particle diameter. By comparing the reduction rate of the number of particles obtained by data shown in FIG. 27 and the coefficient multiplied by time t in the exponential part of the equation (4), it is possible to calculate γ with known V and F. With this calculation, it is possible to obtain γ as γ=0.75 for the particle size of 5 [μm], γ=0.37 for the particle sizes of 1 [μm] and 0.7 [μm], γ=0.33 for the partied size of 0.5 [μm] and γ=0.29 for the particle size of 0.3 [μm]. As described above, it is understood that γ for particles having the particle diameter smaller than 1 [μm] is a fraction of γ for the particles having the particle diameter of 10 [μm]. Here, KPD1000 is a filter aiming mainly removal of virus and odor, provided with ostrich egg filter and its dust collection efficiency γ falls fairly below 1 for the small particle diameter. This shows that it is possible to realize relatively good cleanliness of US209D class 200 with a filter having only such a small γ. By incorporating a low cost and accordingly low performance filter and a photocatalyst system into the 100% circulation feedback system in the example, a unique characteristics capable of obtaining the performance equal to the high performance filter is fully demonstrated. Furthermore, by using the 100% circulation feedback system that is a constituent of this invention, based on the measured result of the time change of the number of particles for respective particle diameters (here, the zero count jumps to minus infinity, and therefore it is plotted as 0.01 count for convenience) in the case where Nao Japanese paper (hair pattern), Imari Japanese paper and cloth like Tyvek (registered trademark) as a filter of the FFU, it is possible to obtain the collection efficiency for respective particle diameters similar to the above. This makes it possible to control a microbial environment and realize a new medical and nursing environment.

The calculation method described above can be applied to shoji papers, order estimation of the necessary area of which was carried out in determination of the area of shoji papers, described above. That is, a filter was prepared by folding shoji papers and an FFU incorporated the filter was operated in the 100% circulation feedback mode inside the enclosed space of the constant volume. And by measuring a change of the number of particles for respective particle diameters, it turned out that the same performance as the one shown in FIG. 27 could be obtained, even though the shoji paper filter was used. For example, in the case where the shoji paper "Naobei" made by ONAO CO. LTD. was used as the shoji paper filter, γ was 0.12, 0.14, 0.18, 0.28, 0.56 and ~1 for the particle diameter of 0.3 [μm], 0.5 [μm], 0.7 [μm], 1.0 [μm], 5.0 [μm] and 10 [μm], respectively. In the case where the shoji paper "plain No. 5641" made by ASAHIPEN CORPORATION was used as the shoji paper filter, γ was 0.18, 0.21, 0.24, 0.42, 0.71 and ~1 for the particle diameter of 0.3 [μm], 0.5 [μm], 0.7 [μm], 1.0 [μm], 5.0 [μm] and 10 [μm], respectively. Conventionally, with respect to a low or medium performance filter, the dust collecting efficiency could not be observed in the case where the number of particles decayed and only a weighing method and a colorimetric method were used (Therefore, accurate measurement was impossible). In contrast to this, the method of measuring in combination to the 100% circulation feedback system can provide a new measuring method because the particle diameter can be discriminated while the simultaneous measurement is possible. On the other hand, scaling of a room by (V/A)/(D/L) is a new method that was devised from another point of view, and this method has a great advantage. In future, these two advantages will be combined to result a multiplier effect. Therefore, the system shown in the example will play a great role and have a great significance in developing technology and analyzing a clean environment.

Cleanliness of US209D class 200 described above is a miraculous value as the value obtained by using a filter having the collection efficiency γ much smaller than 1 for 0.5 μm size particles. For example, when the air cleaning device (KPD1000: made by FUJIFILM CORPORATION) is used as in a conventional clean room, the amount of dust reduces only to about half of the number density of dust No of the atmosphere (hundreds of thousands/cubic feet) at most. On the other hand, as apparent from the graph shown in FIG. 28, when the air cleaning device is used in the system configuration of the above example, it is possible to reduce the number density of dust to a value smaller than No by about three orders of magnitude. This is the direct consequence of the equation (5) shown in the above. As shown in FIG. 27, the concentrations of acetic acid and $NH_3$ measured at the same time reduce below 1 ppm after ten minutes from the start of operation. In this way, by operating the air cleaning device and the 100% circulation feedback system at the same time, it is possible to improve the performance of the air cleaning device remarkably.

As described above, in the system of highly clean rooms 10 that is an cleaning system of closed circulation construction, the collection efficiency of dust does not depend on the dust collecting efficiency of a filter largely. Therefore, even if the dust collection efficiency of the filter decreased, no serious decrease of the dust collection efficiency observed in the open type air cleaning system is not observed. According to the system of highly clean rooms 10, the margin obtained as a result that the dust collection efficiency is not necessary to be near 1 can be used for sterilization. It is possible to obtain a highly clean environment only by placing an FFU provided with a ventilation opening and an absorption opening such as a commercially available air cleaning device in the enclosed space to which the 100% circulation feedback system is connected and also lengthen the lifetime of the filter provided in the FFU. It is very effective to provide a commercially available air cleaning device using photocatalyst and metal radicals such as KPD1000 independently inside the main room 20 provided with the 100% circulation feedback system. By providing the above air cleaning device specialized for control of viruses and removal of odor rather than control of dust in a low dust environment, it is possible to reduce deterioration of the performance due to choking of the filter by dust to almost zero and concentrate on the original role of inactivation of viruses, removal of odor, etc. Furthermore, because choking of the filter scarcely occurs, it is possible to obtain the long time reliability. As described above, the system using a commercially available air cleaning device and air conditioning device in addition to the system of the example provided with the 100% circulation feedback system can enhance the performance of cleaning in the mode of not sum but product and keep the initial performance of the system used at the same time semipermanently.

Cleanliness of air inside the anteroom 40 when the FFU 44 (Purespace 1, expelled flow rate=[1 $m^3$/min]: ASONE Corporation) provided inside the anteroom 40 is operated alone is now described.

Figure 32:
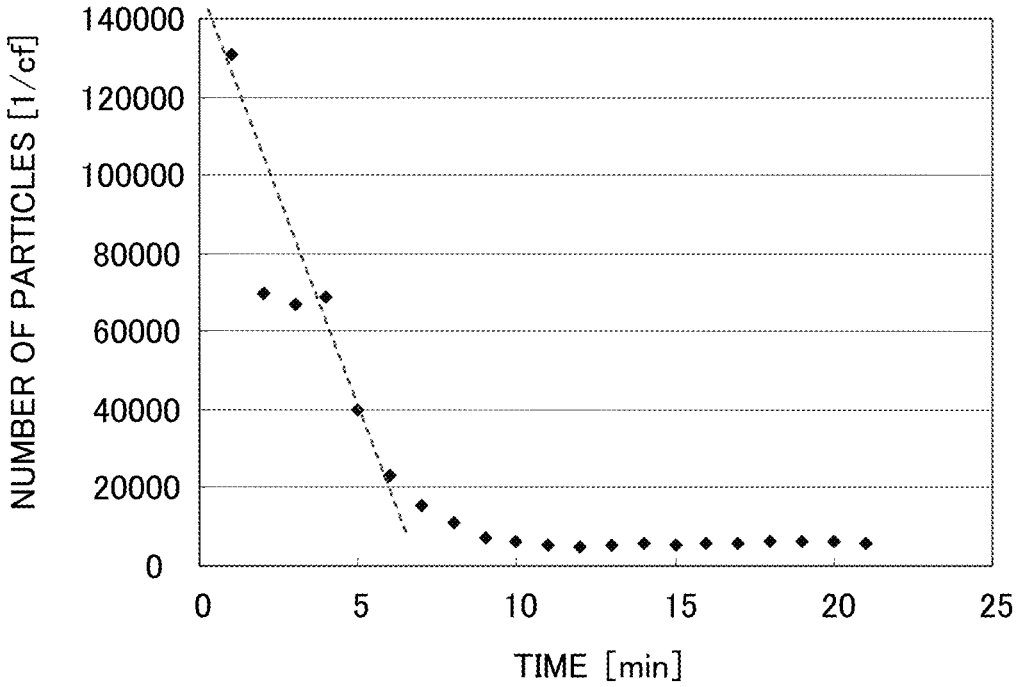
FIG. 32 A schematic diagram showing a change in a short time of the number of dust when the FFU 44 provided in the anteroom is operated in the anteroom.

FIG. 32 is a schematic diagram showing the change of the number of dust in a short time when the FFU 44 constituting the 100% circulation feedback system connected to the anteroom 40 was operated. As shown in FIG. 32, the total number of dust having the particle diameter of 0.5 [μm] or more per cubic feet inside the anteroom 40 was hundreds of thousands before the start of operation of the FFU 44, but after the operation of the FFU 44, it reduced to forty thousands per cubic feet, one third of the initial value in five minutes and to ten thousands per cubic feet after about ten minutes. Thereafter, cleanliness could be kept for a long time. In this way, it is possible to effectively reduce the quantity of dust inside the anteroom 40 in about five minutes from the start of operation of the FFU 44.

Figure 33:
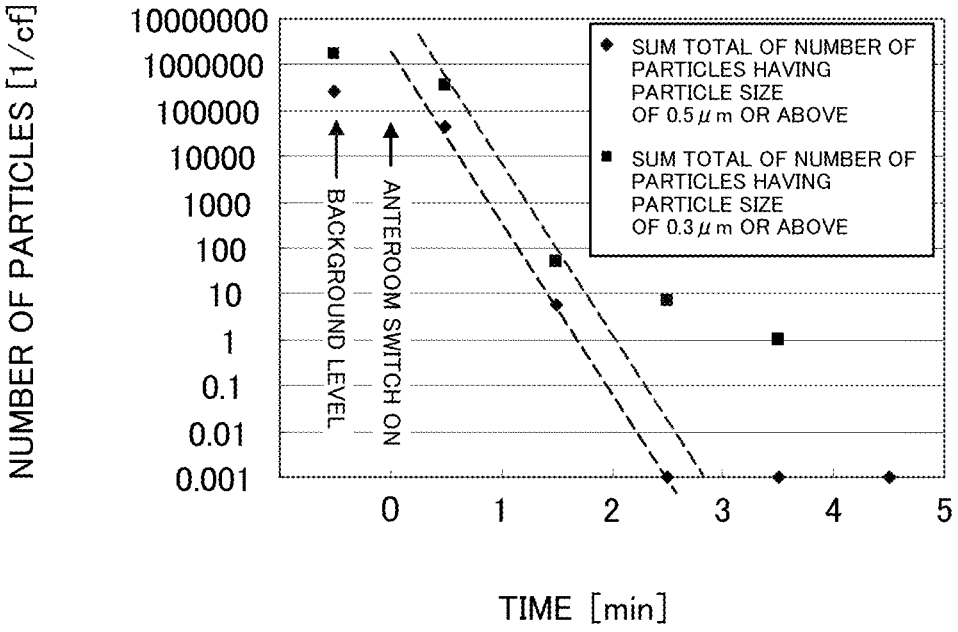
FIG. 33 A schematic diagram showing a change in a short time of the number of dust inside the anteroom when the FFU 44 provided in the anteroom is exchanged for the one having the larger exhaust flow rate and operated.

FIG. 33 is a schematic diagram showing the result obtained when the FFU 44 provided inside the anteroom 40 was changed to purespace 10 (maximum expelled flow rate=11 [$m^3$/min]) made by ASONE Corporation, which is a large capacity FFU and operated in the expelled flow rate=11 [$m^3$/min]. Because zero count jumps to minus infinity, it is plotted here to 0.001 count for convenience. As shown in FIG. 33, the total number of dust particles having the particle diameter of 0.5 [μm] or more of the number of dust particles inside the anteroom 40 was about a million per cubic feet before the start of operation of the Purespace 10, but it reduced to almost zero in two and half minutes from the start of the Purespace 10. Furthermore, the total number of dust particles having the particle diameter of 0.3 [μm] or more was about ten millions per cubic feet before the start of operation of the Purespace 10, but it reduced to less than ten in about two minutes from the start of operation of the Purespace 10. In this way, by designing properly the FFU 44 used according to the volume of the anteroom 40, it is possible to make space inside the anteroom 40 a super high clean environment in a very short time. As described above, it is demonstrated that the anteroom 40 of the system of highly clean rooms 10 according to the example has the very high performance as an anteroom. This shows that for example, when one sits down on "fumikomi" (space for taking off shoes) of a Japanese-style hotel and unties shoe-strings of leather shoes slowly, it is possible to improve cleanliness of the space for taking off shoes (anteroom) to about US209D class 0.1 in a very short time (about one to two minutes) during such actions.

A case where a person enters the main room 20 of the system of highly clean rooms 10 through the anteroom 40 is now described. Before a person enters the main room 20, the doorway 8 and the sliding door 47 are completely shut and the outside, the anteroom 40 and the main room 20 are completely separated. Furthermore, the inside of the main room 20 is kept to be clean beforehand by the 100% circulation feedback system.

When a person enters the anteroom 40 from the doorway 8, shuts the doorway 8 and then operates the 100% circulation feedback system of the anteroom 40, dust inside the anteroom 40 is quickly collected by the filter as described above and cleanliness of the anteroom 40 is rapidly improved. In this time, oxygen in the anteroom 40 is consumed by breathing of the person. However, because the shoji paper is put up on the sliding door 47 as the gas exchange membrane 26 and oxygen is supplied by the gas exchange function, the person can stay inside the anteroom 40 without any trouble.

As described above, by waiting for about two minutes in the anteroom 40 in the stare that the doorway 8 and the sliding door 47 are shut, thereafter opening the sliding door 47 and entering the main room 20, it is possible for persons etc. to move in the main room 20 from the outside without deteriorating cleanliness of the main room 20.

Figure 34:
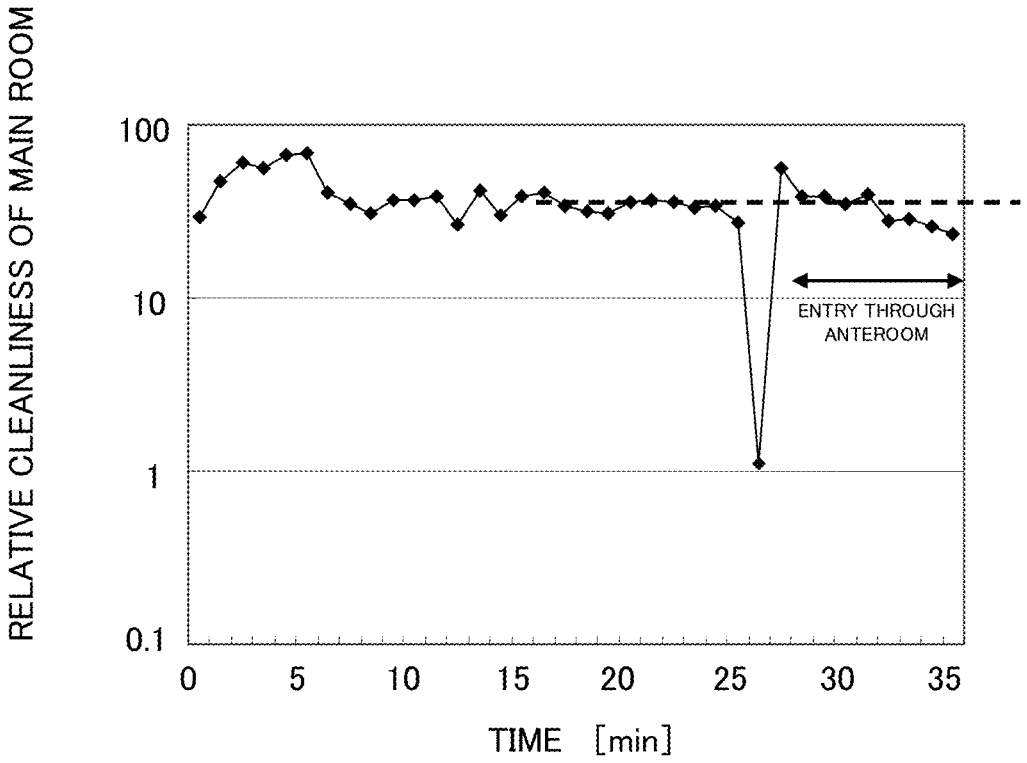
FIG. 34 A schematic diagram showing a change of relative cleanliness of the main room when a person enters the main room from the anteroom.

FIG. 34 is a schematic diagram showing the change of the relative cleanliness of the main room 20 when a person entered the main room 20 from the anteroom 40 through the sliding door 47. As shown in FIG. 34, it was demonstrated that there was no change of cleanliness of the main room 20 before and after the person entered the main room 20 from the outside space through the doorway 8, the anteroom 40 and the sliding door 47. Because the doorway provided between the anteroom 40 and the main room 20 is constituted of the sliding door 47, there is no volume change when the sliding door 47 is opened or shut, and therefore there is no pressure change and air pushing effect (piston effect). As a result, when a person moves in the main room 20, there is no movement of air as an air current for the main room 20. Therefore, there is no inflow of outside fresh air with plenty of dust and this shows that cleanliness of the main room 20 can be always kept well. As described above, by constituting the system of highly clean rooms 10 by the anteroom 40 and the main room 20 and using the sliding door 47 as a doorway separating the anteroom 40 and the main room 20, it is possible to move between the main room 20 and the outside while keeping cleanliness inside the main room 20. Although it is possible to keep the doorway 8 to be a door in order to hold remodeling to a minimum, it is more preferable to use a sliding door as the doorway 8 in order to avoid the pressure generation and the air pushing effect (piston effect), avoid a collision of persons passing through a hallway and a wheelchair in hospitals, special nursing homes, etc. and make the doorway 8 in a new house. Other than those of the above is the same as the first or second embodiment.

According to the third embodiment, the same advantages as the first and second embodiments can be obtained. In addition, the living space 6 is divided into the anteroom 40 and the main room 20 by the sliding door 47 and the doorway 8 for moving of persons etc. from the outside is provided on the side of the anteroom 40. Therefore, persons etc. that enter through the doorway 8 from the outside space once wait in the anteroom 40 for dozens of seconds to two minutes, and thereafter open the sliding door 47 and enter the main room 20, so that the persons can reach the main room 20 from the outside space without deteriorating cleanliness inside the main room 20. Furthermore, by putting up the gas exchange membrane 26 such as shoji papers etc. on the sliding door 47, it is possible to add the gas exchange function, creating appearance of Japanese old shoji. As described above, by constituting the gas exchange membrane 26 forming a part of the wall 9 constructing the room 1 by shoji like filter paper or shoji paper and using a sliding door as a doorway and a partition between the main room and the anteroom (fumikomi), it is possible to construct the living space 6 in Japanese style and refine style cultivated by history for over a thousand and several hundred years of Japan through the modern technology and the equations (1) to (17), theoretical analytic equations. As a result, it is possible to revive in our time the best air environment, i.e., further clean air environment, which existed generally in ancient Japan, as the one capable of savoring in daily life, beyond the concept of long-term excellent houses and energy management. Furthermore, it is possible to realize again the Japanese old life style such as shoji, fusuma, sliding door, etc. as natural and necessary preparation and procedure, not forced, through the present invention. As a result, it is possible to present a sliding door style Japanese-style room with walls having a shoji paper gas exchange membrane and an internal space and the 100% circulation feedback system all over the world as the most advanced 21th century excellent living space. Furthermore, because dusts generated inevitably in general living space can be actively removed by dust filters etc., it is possible to make the inside of the room remarkably highly clean compared with the conventional clean room etc. that only push out dust generated in the room to the outside and keep the high cleanliness, though dust is generated inside.

4. The Fourth Embodiment

Figure 35:
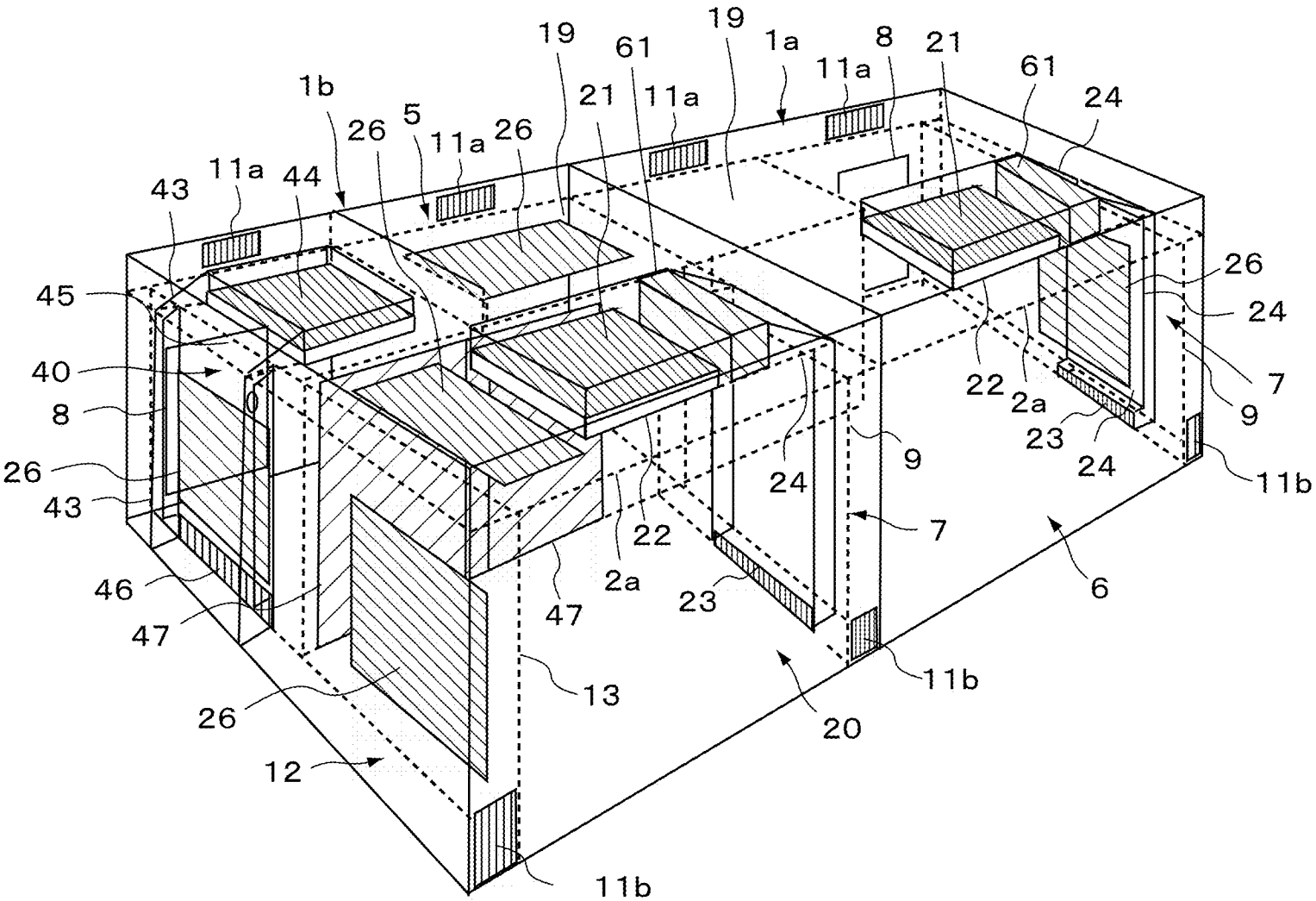
FIG. 35 A perspective view showing a system of highly clean rooms according to the fourth embodiment.

FIG. 35 shows the system of highly clean rooms 10 according to the fourth embodiment. In the drawing, broken lines show walls such as partition, ceiling wall, etc. provided inside the room 1*a* and 1*b* and other constructions inside the room 1*a* and 1*b* are shown by solid lines.

As shown in FIG. 35, the system of highly clean rooms 10 is constructed by two independent rooms that are different and adjacent to each other. In the drawing, on the right side of the rooms being adjacent to each other the room 1*a* in the second embodiment is provided and on the left side of the rooms the room 1*b* in the third embodiment is provided. The utility space 19 of each room is placed in the position of line symmetry with respect to the wall 9 separating the room 1*a* and the room 1*b*. Because the utility space 19 is placed in this way, this configuration can be used in not only a hospital and a nursing home but also a hotel and an apartment house. Therefore, the system of highly clean rooms 10 can be easily applied to existing structures. This configuration works very well in all structures in which entry and exit are carried out in two steps. This configuration can be applied to existing structures such as, for example, the body care industry like a public bath house, a pool, a porcelain tile bath, a bedrock bath, a nail salon, etc., nursing homes, special nursing homes, hospitals, kindergartens, schools, etc.

As described above, by incorporating the above system into an apartment house, a care home, a hospital, etc. having many rooms as necessary, it is possible not only to obtain a low dust space easily but also to obtain a superhigh clean space that can decompose chemical substances, odor, etc. in an instant. It is also possible to connect the internal space 7 of the wall 9 of the room 1 to form a common space. This configuration will be described in detail in the eleventh embodiment described later. It is also possible to clean plural rooms together by a central system in which the plural rooms 1 are connected and one or a few FFUs 21 are placed in the part communicating with air of the plural living space or the main room. That is, plural gas flow paths 24 provided in each room 1 are connected airtightly and clean air is supplied to the plural rooms 1 by one or a few FFUs 21. This connection can be done by, for example, duct, etc. For example, the internal space 7 of the wall 9 of each room 1 is connected in turn and the FFU 21 is connected, and thereafter respective ventilators provided in the room 1 are connected so that the living space 6 or the main room 20 of each room 1 is ventilated. This configuration will be described in detail in the eleventh embodiment described later. Other than those is the same as any one of the first to third embodiments.

According to the fourth embodiment, the same advantages as the first to third embodiments can be obtained. In addition, it is possible to obtain the system of highly clean rooms 10 that can be easily applied to existing structures.

5. The Fifth Embodiment

Figure 36:
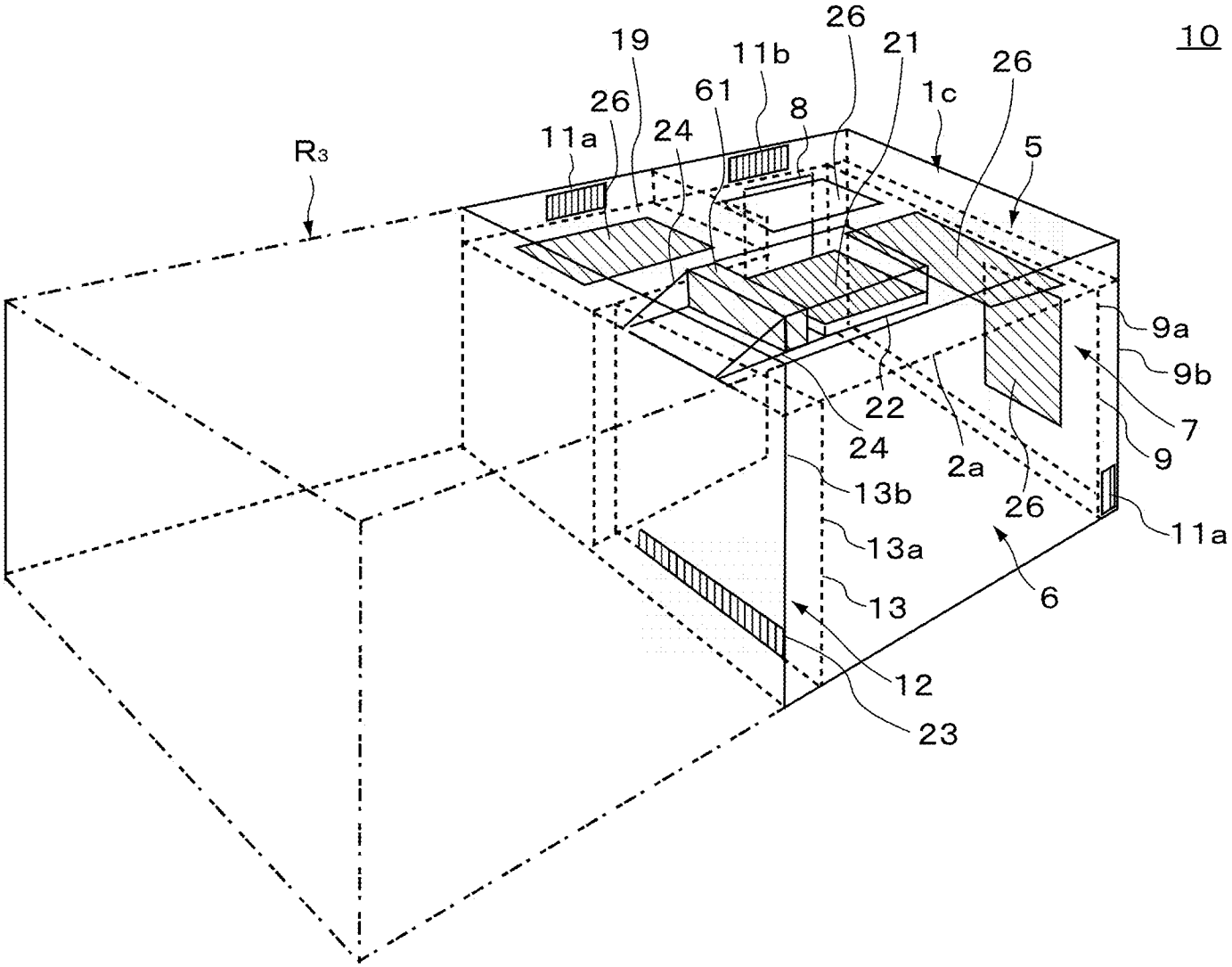
FIG. 36 A perspective view showing a system of highly clean rooms according to the fifth embodiment.

FIG. 36 shows the system of highly clean rooms 10 according to the fifth embodiment.

As shown in FIG. 36, the system of highly clean rooms 10 is constructed by two independent rooms that are different and adjacent to each other. In the drawing, on the right side of the rooms being adjacent to each other the room 1*c* is provided and on the left side of the rooms the room $R_3$ is provided. In the drawing, the room $R_3$ shown by dot and dash lines is a virtual room and its construction is not limited as far as it has a construction independent from the room 1*c*. In the drawing, parts shown by dotted lines show walls such as a partition, a ceiling wall, etc. provided inside the room 1*c* and other constructions inside the room 1*c* are shown by solid lines.

In the room 1*c*, the wall 9 on the right side in the drawing of the room 1*a* shown in the second embodiment is constructed as a wall specialized in only gas exchange. More specifically, an opening communicating the internal space 7, which is the first internal space, and the living space 6 is provided in a part of the inner wall 9*a* of the wall 9 and the gas exchange membrane 26 is provided so as to cover the opening completely, so that one internal space is constructed so as to specialize in only gas exchange. The internal space 12 formed by the wall 13 that is the lateral wall provided facing the wall 9, which is the second internal space, is completely separated from the space 5 between the roof and the ceiling and the outside. By providing the opening 23 in the inner wall 13*a* of the wall 13 and connecting the internal space 12 and the inlet of the FFU 44 airtightly by the gas flow path 24, the whole internal space 12 is constructed as a part of the gas flow path 24 and one internal space is constructed so as to specialize in for only 100% circulation feedback. For example, the width of the opening 23 may be arbitrary within the range from one side to the other side of the wall 9. By increasing the width of the opening, it is possible to absorb the whole air inside the living space 6 uniformly. By constructing like this, the construction can be simplified. Furthermore, by constructing the whole wall as a circulation path, it is possible to absorb air flow from the lower part of the lateral wall uniformly and feed back, so that uniform cleaning of the whole living space 6 is possible. As described above, by not providing one internal space with both functions of gas exchange and 100% circulation feedback but separating the functions, it is possible to increase drastically the cross sectional flow rate of the circulation path, increase conductance of flow, improve gas exchange efficiency, etc. Other than those is the same as any one of the first to fourth embodiments.

According to the fifth embodiment, the same advantages as the first to fourth embodiments can be obtained. In addition, by not providing one internal space with both functions of gas exchange and 100% circulation feedback but separating the functions, it is possible to increase drastically the cross sectional flow rate of the circulation path, increase conductance of flow, improve gas exchange efficiency, etc.

6. The Sixth Embodiment

Figure 37:
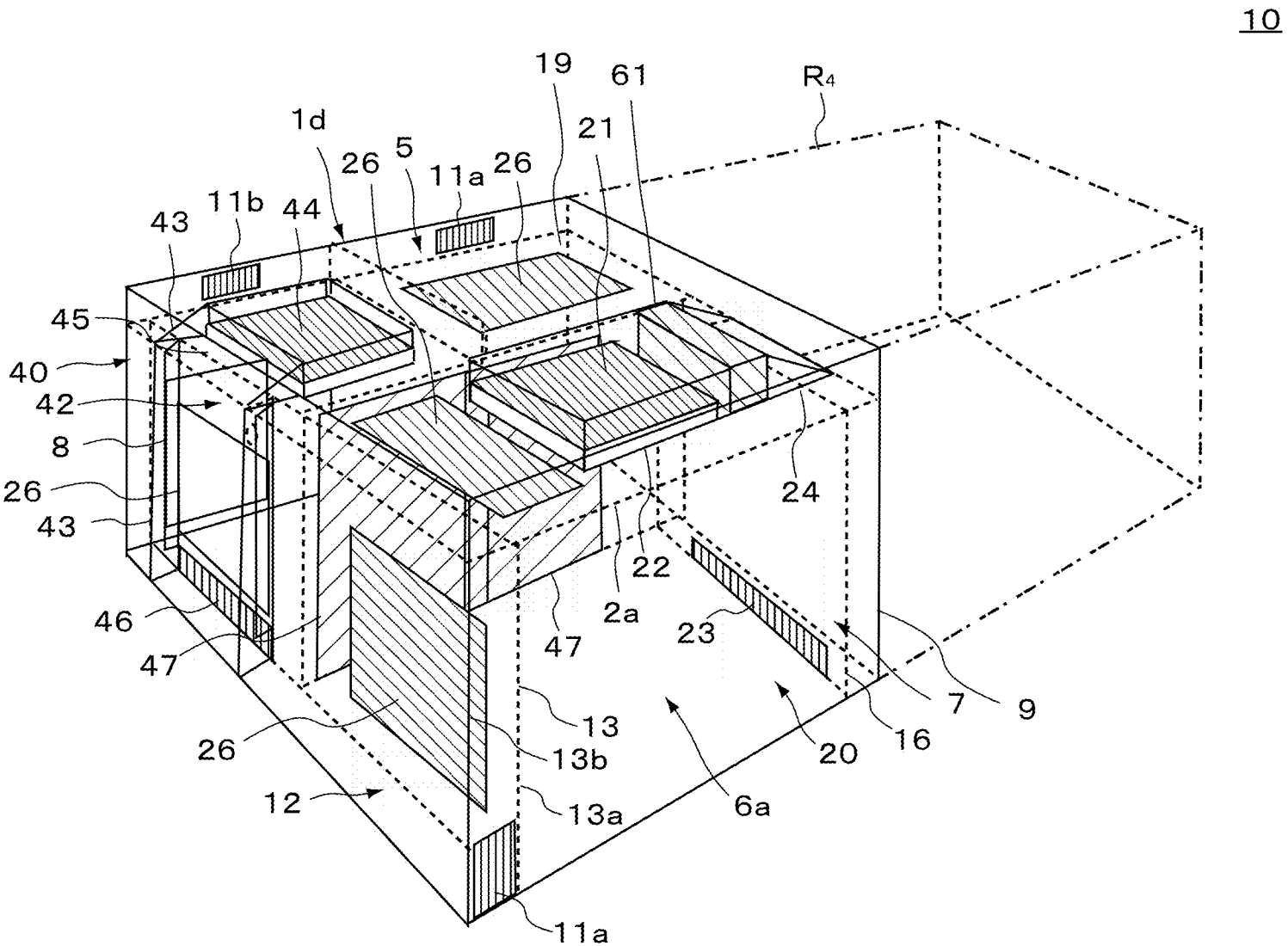
FIG. 37 A perspective view showing a system of highly clean rooms according to the sixth embodiment.

FIG. 37 shows the system of highly clean rooms 10 according to the sixth embodiment.

As shown in FIG. 37, the system of highly clean rooms 10 is constructed by two independent rooms that are different and adjacent to each other. In the drawing, on the left side of the rooms being adjacent to each other the room 1*d* is provided and on the right side of the rooms the room $R_4$ is provided. In the drawing, the room $R_4$ shown by dot and dash lines, which are virtual lines, is a virtual room and its construction is not limited as far as in has a construction independent from the room 1*d*. In the drawing, parts shown by dotted lines show walls such as a partition, a ceiling wall, etc. provided inside the room 1*d* and other constructions inside the room 1*d* are shown by solid lines.

In the room 1*d*, the wall 9, which is the lateral wall, on the right side in the drawing of the room 1*b* shown in the third embodiment and the internal space 7, which is the first internal space, formed by the wall 9 have the same construction as the wall 13 provided in the room 1*c* shown in the fifth embodiment and the internal space 12, which is the second space, formed by the wall 13. With this, the whole internal space 7 is constructed a part of the gas flow path 24 and one internal space is constructed so as to specialize in for only 100% circulation feedback. By constructing like this, the construction can be simplified and the whole wall can be constructed as a circulation path. Furthermore, it is possible to absorb air flow from the lower part of the lateral wall uniform and feed back, so that uniform cleaning of the whole living space 6 is possible. Other than those is the same as any one of the first to fifth embodiments.

According to the sixth embodiment, the same advantages as the first to fifth embodiments.

7. The Seventh Embodiment

Figure 38:
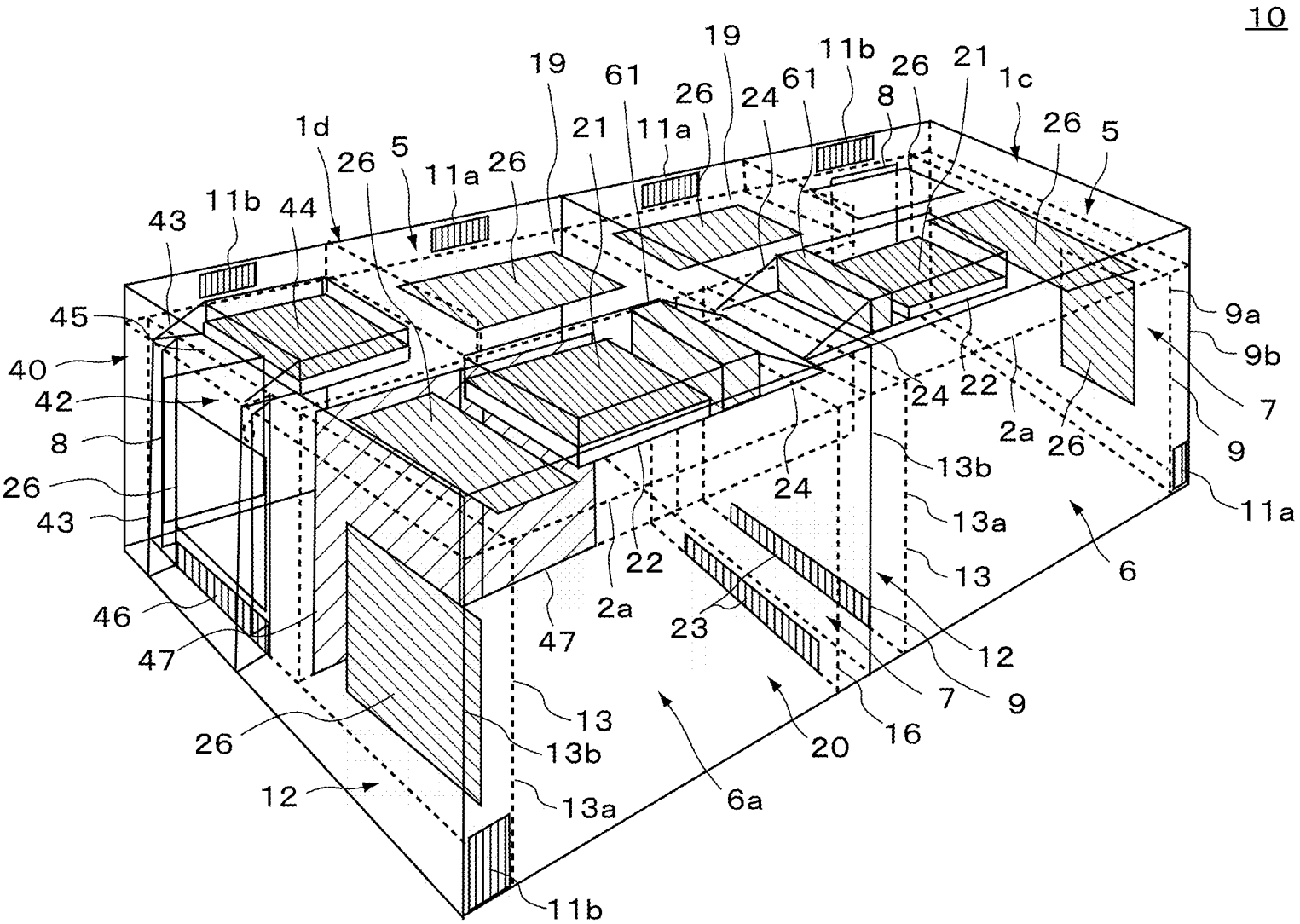
FIG. 38 A perspective view showing a system of highly clean rooms according to the seventh embodiment.

FIG. 38 shows the system of highly clean rooms 10 according to the seventh embodiment. In the drawing, parts shown by dotted lines show walls such as a partition, a ceiling wall, etc. provided inside the rooms 1*c* and 1*d* and other constructions inside the rooms 1*c* and 1*d* are shown by solid lines.

As shown in FIG. 38, the system of highly clean rooms 10 is constructed by two independent rooms that are different and adjacent to each other. In the drawing, on the right side of the rooms being adjacent to each other the room 1*c* shown in the fifth embodiment is provided and on the left side of the rooms the room 1*d* shown in the sixth embodiment is provided so that the gas flow path 24 is placed in line symmetry with respect to the wall separating both rooms.

Figure 39:
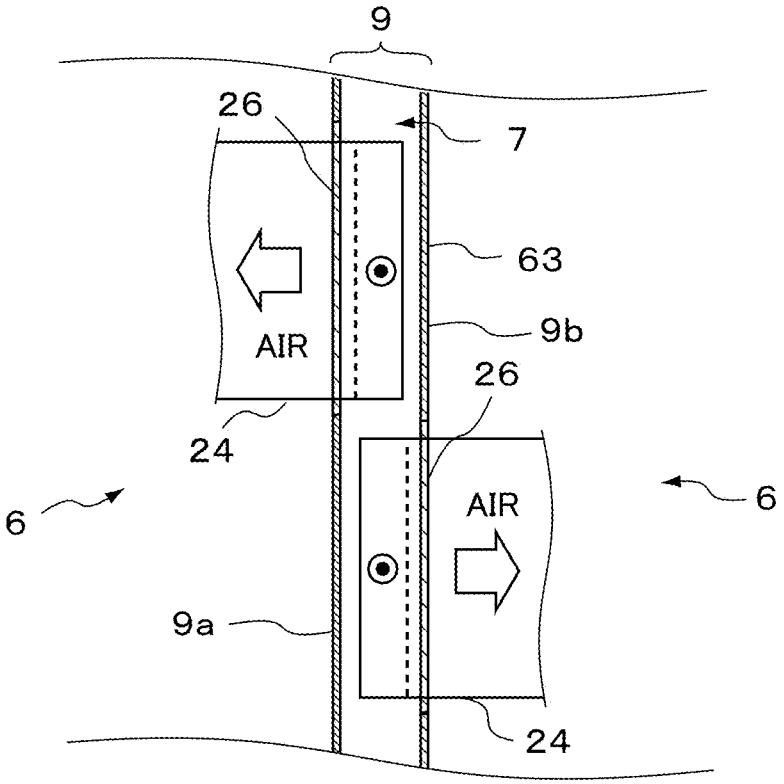
FIG. 39 A cross sectional view showing a circulation path of two-duct wall buried type that is a modification of the system of highly clean rooms according to the seventh embodiment.

FIG. 39 is a schematic drawing showing a circulation path of two-duct wall buried type, which is a modification of the embodiment.

As shown in FIG. 39, the internal space 7 of the room 1*d* has a common space with the internal space 12 of the room 1*c* and the two gas flow paths 24 provided in the room 1*c* and the room 1*d*, respectively are stored inside the internal space 12. In this case, the wall 9 has the function of partition wall and the wall 9 is constructed by the two inner walls 9*a* facing each other. A symbol of a double circle having a central black circle shows that an air current flows upward direction from the surface of the paper. As described above, the gas flow path 24 is stored in the internal space 7, one fitting inside another, for example, so that the 100% circulation feedback system is constructed. A part of the wall material 63 to which the gas flow path 24 is provided is constructed by the gas exchange membrane 26, so that gas exchange is possible between the living space 6 of the room 1*c* and the living space 6 of the room 1*d*, which are space separated by the gas exchange membrane 26. When gases are made to flow in the internal space 7, it is possible to make highly clean the living space 6 of both of the room 1*c* and the room 1*d* all at once. This is possible without narrowing both rooms. That is, this structure is the ultimate structure capable of suppressing narrowing of the room to a limit. It is possible to make additional volume consumed to zero in the structure of the existing room and keep the living space 6 of the room 1 in extremely high cleanliness without reducing the floor area and the volume ratio of the clean living environment space (room) to the whole structure and causing emission of dust to the outside space from the clean living room. It is possible to replace the living space 6 with the main room 20, the anteroom 40, etc. in the embodiment.

For example, it is possible to connect an outside air introduction space of the internal space 7 of the wall 9 of the room adjacent to each other and make them a common space. It is possible to clean the plural rooms 1 together by the central system in which one or a few FFUs 21 are placed at both edges or midway of the gas flow path 24 connecting the plural rooms 1 and connecting parts communicating air with the plural living space 6, that is, one plane being in contact with the living space 6 and the opening 23, which is another plane satisfying the above condition. This configuration works very well in all structures in which entry and exit are carried out in two steps, such as the structure constituted by the anteroom 40 and the main room 20. This configuration can be applied to the body care industry such as a public bath house, a pool, a bedrock bath, a nail salon, a massage room, etc., nursing homes, special nursing homes, hospitals, kindergartens, schools, etc. Other than those is the same as any one of the fourth to sixth embodiments.

According to the seventh embodiment, the same advantages of fourth to sixth embodiments can be obtained. In addition, by constructing the gas flow path 24 provided back to back in the rooms 1 adjacent to each other by the circulation path of two-duct wall buried type, it is possible to make additional volume consumed to zero in the structure of the existing room and keep the internal space of the room in extremely high cleanliness without reducing the floor area and the volume ratio of the clean living environment space (room) to the whole structure and causing emission of dust to the outside space from the clean living room.

8. The Eighth Embodiment

Figure 40:
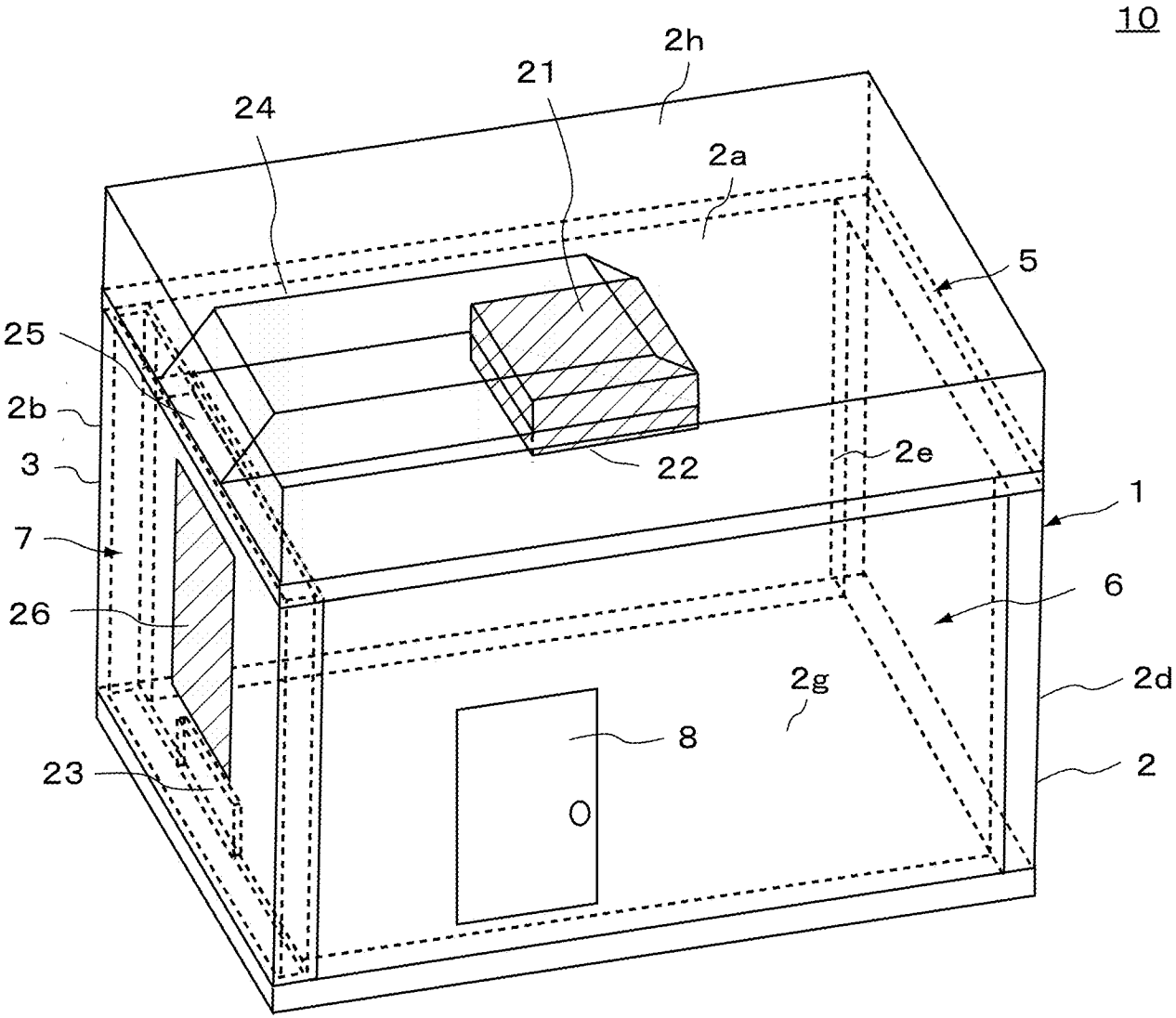
FIG. 40 A perspective view showing a system of highly clean rooms according to the eighth embodiment.

FIG. 40 is a perspective view showing the system of highly clean rooms 10 according to the eighth embodiment. In the drawing, hatched parts are shown to make clear the structure of the system of highly clean rooms 10 and they do not show the cross section. In the drawing, parts shown by dotted lines show walls such as a partition, a ceiling wall, etc. provided inside the room 1 and other structures inside the room 1 are shown by solid lines.

As shown in FIG. 40, the system of highly clean rooms 10 is constructed by incorporating a 100% circulation feedback system in the closed parallelepiped room 1. The hollow wall 3 is formed integrally with the wall 9 having the inner wall 9*a* and the outer wall 9*b* in the above embodiments and the internal space 7 formed by the hollow wall 3 is completely hollow. The room 1 is constructed by closing and surrounding by the wall 2. More specifically, the room 1 is constructed by closing and surrounding by the ceiling wall 2*a*, the floor wall 2*g* and the plural lateral walls 2*b* to *e*. At least one of the lateral walls 2 constructing the room 1 is constructed by the hollow walls 3. The hollow wall 3 has a cylinder shape having the rectangular hollow cross section. The hollow wall 3 and the lateral wall 2*b* are provided so as to be sandwiched between the ceiling wall 2*a* and the floor wall 2*g*. That is, the lateral wall 2*d* facing the lateral wall 2*b* is provided in contact with the major surface of the ceiling wall 2*a* and the major surface of the floor wall 2*g*, respectively. The hollow wall 3 is provided so that its bottom surface and top surface become the openings of the cylinder. By closing those two openings by the major surface of the ceiling wall 2*a* and the major surface of the floor surface 2*g*, respectively, a closed space is formed. The room 1 forms the living space 6, which is the enclosed space closed by being enclosed by the plural walls in this way. The internal space 7 is constructed by a space formed by the hollow wall 3, the ceiling wall 2*a* and the floor wall 2*g*. The doorway 8 through which persons can enter from the outside and exit is provided in the room 1. The top surface of the room 1 is constructed by the top wall 2*h* and a space sandwiched by the ceiling wall 2*a* and the top wall 2*h* of the room 1 forms the space 5 between the roof and the ceiling.

The FFU 21 shown by hatching in the drawing is provided on the ceiling wall 2*a* inside the space 5 between the roof and the ceiling. An opening corresponding to the blow opening of the FFU 21 is provided and the opening and the blow opening of the FFU 21 are connected airtightly, so that the blow opening 22 for exhausting air inside the living space 6 is formed. It is also possible to use the blow opening of the FFU 21 as the blow opening 22 by placing the FFU 21 on the side of the living space 6 of the ceiling wall 2*a*. An opening 23 for collecting air inside the living space 6 is provided on the surface of the hollow wall 3 on the side of the living space 6. The opening 23 is preferably provided on the lowest part of the surface of the hollow wall 3. The inlet of the gas flow path 24 provided inside the space 5 between the roof and the ceiling is connected airtightly with the top part of the hollow wall 3 and the outlet of the gas flow path 24 is connected airtightly with the absorption opening of the FFU 21. Furthermore, by providing an opening 25 on the ceiling wall 2*a* closing the opening of the hollow wall 3, the internal space 7 and the gas flow path 24 are inserted airtightly and the opening 23 and the absorption opening of the FFU 21 are airtightly connected. In this case, by constructing the internal space 7 as a part of the gas flow path 24, the 100% circulation feedback system is formed for the living space 6. The FFU 21 and the gas flow path 24 connected to it may be provided on the ceiling wall 2*a* on the side of the living space 6. In this case, an opening is provided on the surface of the hollow wall 3 on the side of the living space 6 and the gas flow path 24 is connected airtightly with the opening. As a result, the internal space 7 and the gas flow path 24 are inserted. In the case where the FFU 21 is provided inside the living space 6, it is provided in an FFU storing unit constructed to be closed, for example.

The living space 6 is an enclosed space in which persons etc. stay, etc. The doorway 8 provided on the lateral wall constituting the room 1 is provided so that persons etc. can move in the living space 6 from the outside. When the doorway 8 is shut, the living space 6 is completely closed from the outside. Airtightness of the doorway 8 for entering the living space 6 is improved. As a result, the living space 6 has an airtight structure without an outflow and an inflow (air communication between the inside and the outside of the living space 6) other than direct outflow and inflow of air through the doorway 8. It is preferable to make the doorway 8 as the sliding door 47. With this, it is possible to minimize pressure variation between the outside and the living space 6 due to opening and shutting of the doorway 8. As described above, because the living space 6 is completely closed from the outside space when the doorway 8 is shut, a mechanism for supplying oxygen to the living space 6 is necessary. Therefore, at least a part of the surface being in contact with the outside space of the hollow wall 3 is constituted by the gas exchange membrane 26 shown by hatching in the drawing. With this, exchange of gas molecules is performed between the internal space 7 and a space constituting the hallway 33. For example, exchange of oxygen, carbon dioxide, etc. is performed between the living space 6 and the outside space.

The gas flow path 24 and the internal space 7 are connected airtightly and the opening 23 is provided on the surface of the hollow wall 3 on the side of the living space 6, so that all gases exhausted from the blow opening 22 pass through the fan filter unit 21 via the opening 23, the internal space 7 and the gas flow path 24 and air is exhausted again to the living space 6. With this, the 100% circulation feedback system is formed as described above. In this way, by forming the 100% circulation feedback system for the living space 6 and operating the fan filter unit 21 constituting the 100% circulation feedback system, cleanliness of air inside the living space 6 is drastically improved. As described above, by constructing the room 1 so that a part of the gas flow path 24 is constructed by the internal space 7 formed by the hollow wall 3 etc., the system of highly clean rooms 10 can be constructed without narrowing compared with the room 1.

Photocatalyst is provided inside the flow path of the gas flow path as necessary. The flow path of the gas flow path includes the inside of the internal space 7 and the flow path of the gas flow path 24. A location of providing a photocatalytic filter is not essentially limited, but the location is preferably a location capable of receiving light. For example, it is preferable to construct the surface of the wall constituting the gas flow path 24 by a transparent body made by transparent materials. As materials of the transparent body, transparent inorganic materials such as glass etc., transparent resin materials, etc. are exemplified. The transparent body provided in the room 1 is a bow window etc., for example. It is possible to supply light to the photocatalytic filter by using a waveguide such as lens, prism, optical fiber, etc., for example. It is also preferable to use tungsten oxide-based materials capable of utilizing visible light, for example.

The shape of the gas flow path 24 is not essentially limited as far as it has a construction completely closed from the outside capable of exhausting all gases introduced from the internal space 7 from the blow opening 22, but it has preferably a shape with small loss of flow. Concretely, the shape of the gas flow path 24 is preferably a cylinder shape having the cross sectional shape such as a rectangular shape, a square shape, a circular shape, an elliptic shape, etc. The gas flow path 24 may be constructed by combining the plural gas flow paths 24 having these shapes. The cylinder shape is preferably a shape of a cylinder extending like a straight line, for example. The gas flow path 24 may be constructed by placing the plural gas flow paths in parallel. The gas flow path 24 has preferably the same shape as the cross section of the hollow wall 3, for example.

The location of providing the gas exchange membrane 26 is not essentially limited, but it is preferable that the location of connecting with the internal space 7 is the central region of the opening of the hollow wall 3. Concretely, the gas flow path 24 is provided on the ceiling wall 2*a* on the side of the space 5 between the roof and the ceiling so as to extend parallel to one side of the surface of the ceiling wall 2*a* and connected airtightly with the internal space 7, so that the gas flow path 24 having a right-angle bent part is constituted. By constituting like this, the gas flow path 24 is completely separated from the internal space 7. For example, the gas flow path 24 is preferably provided so that the position of the blow opening 22 is parallel to the position of the opening 23.

The location of providing the gas exchange membrane 26 is not essentially limited, but may be the position constituting at least apart of the wall constituting the room 1. The location is preferably a place without the influence by rain, wind, etc. In the case where the gas exchange membrane 26 constitutes at least apart of the surface being in contact with the outside space of the hollow wall 3, it is preferable to provide a mechanism that can equalize the direction and velocity of the flow of gases on both sides of the gas exchange membrane 26. Concretely, gases are flow in the region facing the internal space 7 with respect to the gas exchange membrane 26 so that the direction and velocity of the flow of gases are the same as those of gases flowing in the internal space 7. By constituting the gas exchange membrane 26 constituting a part of the surface of the inner wall of the room 1 like shoji, for example, it is possible to construct the living space 6 as a Japanese-style room. Here, the doorway 8 may be constituted by a shoji door as a sliding door.

When oxygen is supplied to the living space 6 from the outside space such as a hallway etc. through the internal space 7, the gas exchange membrane 26 does not pass through dust inside the internal space 7. Because the internal space 7 and the gas flow path 24 are formed to be closed and further the internal space 7 and the gas flow path 24 are airtightly connected, outside air introduced inside the space 5 between the roof and the ceiling etc. does not go into the gas flow path 24. As a result, even though oxygen is supplied inside the living space 6, dust is not supplied inside the living space 6 and therefore cleanliness is kept.

Shapes of the opening 23 and the blow opening 22 are not essentially limited, but they are preferably a rectangular shape, a square shape, a circular shape, an elliptic shape, etc., for example. The location of providing the opening 23 is not essentially limited as far as it is a part of the hollow wall 3. The opening 23 is preferably provided in the position as near to the floor wall 2*g* as possible. The location of providing the blow opening 22 is not essentially limited. The blow opening 22 is preferably provided on the position as high as possible. The blow opening 22 is also preferably provided as near to the central part of the ceiling wall 2*a* as possible. The opening 23 and the blow opening 22 are preferably provided in the positions parallel to each other, as described above.

The distance between the opening 23 of the gas flow path 24 and the blow opening 22 is preferably an enough distance. The distance between the opening 23 and the blow opening 22 is preferably set so that the longest distance x of the distribution of the distance between the opening 23 and the blow opening 22 is selected for the distance X of the living space 6 in the direction defining x such that there is at least one direction in which the ratio x/X is larger than 0.3, preferably the ratio x/X is equal to or larger than 0.35, most preferably the ratio x/X is equal to or larger than 0.4 and equal to or smaller than 1.0.

The volume of the internal space 7 is not essentially limited, but it is preferably as small as possible. In the case where the hollow wall 3 is constructed by walls having the rectangular hollow cross section, the length (thickness) of the short side of the hollow part of the cross section is preferably 5 cm or more and 40 cm or less, typically about 8~20 cm. It is desirable that braces or steels having the C-shape cross section is used for a part adjacent to the hollow part to give the strength as walls. The thickness of the internal space 7 is preferably the minimum thickness necessary to support the structure of the room 1, but not limited to this.

The gas exchange membrane 26 may be provided in any position essentially as far as it constitutes at least a part of walls constituting the system of highly clean rooms 10. For example, the gas exchange membrane 26 is preferably provided on a wall of walls constituting the system of highly clean rooms 10 other than outside walls to be exposed to wind and rain and preferably provided near the airway 11, for example. Furthermore, the gas exchange membrane 26 is preferably provided in the position that flow of outside air introduced from the airway 11 is not obstructed by the gas flow path 24.

The shape of the gas exchange membrane 26 is not essentially limited, but preferably square, rectangular, etc., for example. The size of the gas exchange membrane 26 is not essentially limited, but a sheet of the gas exchange membrane 26 has preferably a size of 135 cm×135 cm. The total area of parts of the gas exchange membrane 26 being in contact with the living space 6 for a person staying in the living space 6 is preferably equal to or larger than 500 $cm^2$/person, more preferably equal to or larger than 700 $cm^2$/person and most preferably equal to or larger than 900 $cm^2$/person.

The gas exchange membrane 26 is not essentially limited as far as it has the function that dust particles are not exchanged but gas molecules are exchanged in both spaces separated by the gas exchange membrane 26. For example, the gas exchange membrane 26 has preferably the oxygen molecule diffusion ability equal to or larger than 0.25 L/min when there occurs the oxygen concentration difference between spaces separated by the gas exchange membrane 26. Concretely, the gas exchange membrane 26 is preferably cloth, nonwoven fabric, shoji paper, Japanese paper, etc., for example. In the case where the gas exchange membrane 26 is constituted by shoji paper, it can be made as a shoji window that is a shoji-like window combined with timbering lattice. By constituting like this, it is possible to construct the hallway 33 in Japanese style. It is also possible to provide a shoji window in a part of walls constituting the room 1 and decorate the inside of the room 1 in Japanese style.

The doorway 8 is not essentially limited as far as persons can move between the outside space and the living space 6 and further it has the function of blocking both spaces. As the doorway 8, it is possible to use the one selected from doorways exemplified above. The doorway 8 is preferably a sliding door that has a small pressure difference between both spaces when it is opened and shut. For example, the sliding door can be made as a shoji door by combining with shoji paper as the gas exchange membrane 26.

Figure 41A:
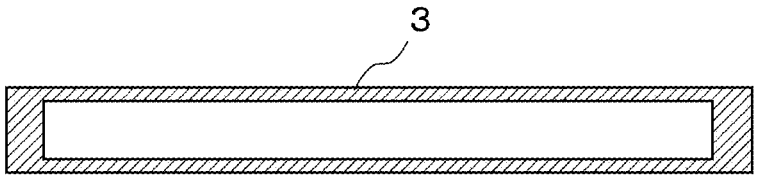
FIG. 41A A cross sectional view showing an example of the hollow wall used in the system of highly clean rooms according to the eighth embodiment.
Figure 41B:
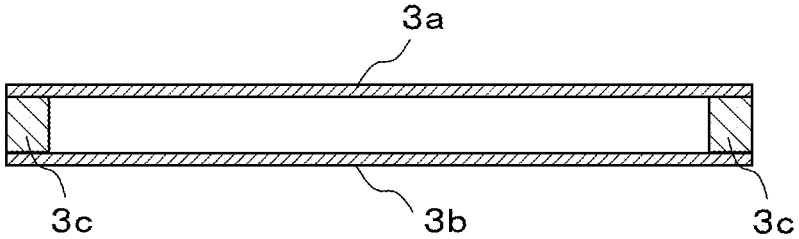
FIG. 41B A cross sectional view showing another example of the hollow wall used in the system of highly clean rooms according to the eighth embodiment.
Figure 41C:
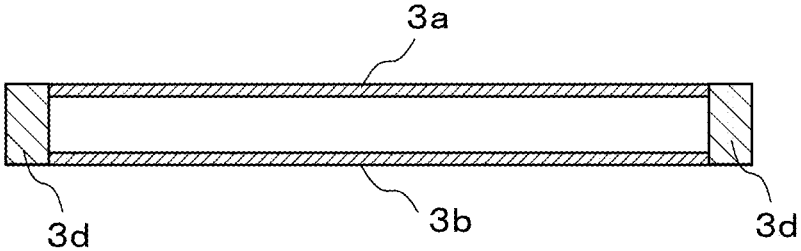
FIG. 41C A cross sectional view showing still another example of the hollow wall used in the system of highly clean rooms according to the eighth embodiment.

FIG. 41A, FIG. 41B and FIG. 41C are cross sectional views showing examples of the hollow wall that is a wall enclosing an internal space, used in the system of highly clean rooms 10.

As shown in FIG. 41A, the hollow wall 3 is formed as a body and has a cylinder shape having the rectangular cross section. As shown in FIG. 41B, the hollow wall 3 is made as a wall having a hollow part by providing two studs 3*c* between the inner wall 3*a* and the outer wall 3*b* provided facing each other a constant distance apart. For example, the two studs 3*c* are provided so that they constitute sides facing each other of the hollow wall 3. As shown in FIG. 41*c*, openings of both sides of the hollow wall 3 are closed by providing pillars 3*d* on the both sides facing each other of the inner wall 3*a* and the outer wall 3*b* provided facing each other with a constant distance apart. In this way, it is possible to construct the hollow wall 3 by not only using a single material but also combining plural materials. It is also possible to construct the hollow wall by providing new partitions on the lateral wall 2 of the room 1 a constant distance apart. In this case, openings of both sides are closed by being provided on the both sides with walls such as the ceiling wall, the floor wall, etc. In this way, for example, when a new house is built, the system of highly clean rooms 10 can be constructed by constituting partitions etc. constituting a room by hollow walls and constituting the internal space 7. Partitions dividing a room do not need high strength and they may be the hollow wall 3 without reinforcements inside. For example, when an existing house is remodeled, it is possible to construct the system of highly clean rooms 10 by constructing hollow walls by replacing existing walls or adding panels to existing walls and constituting the internal space 7.

Figure 42:
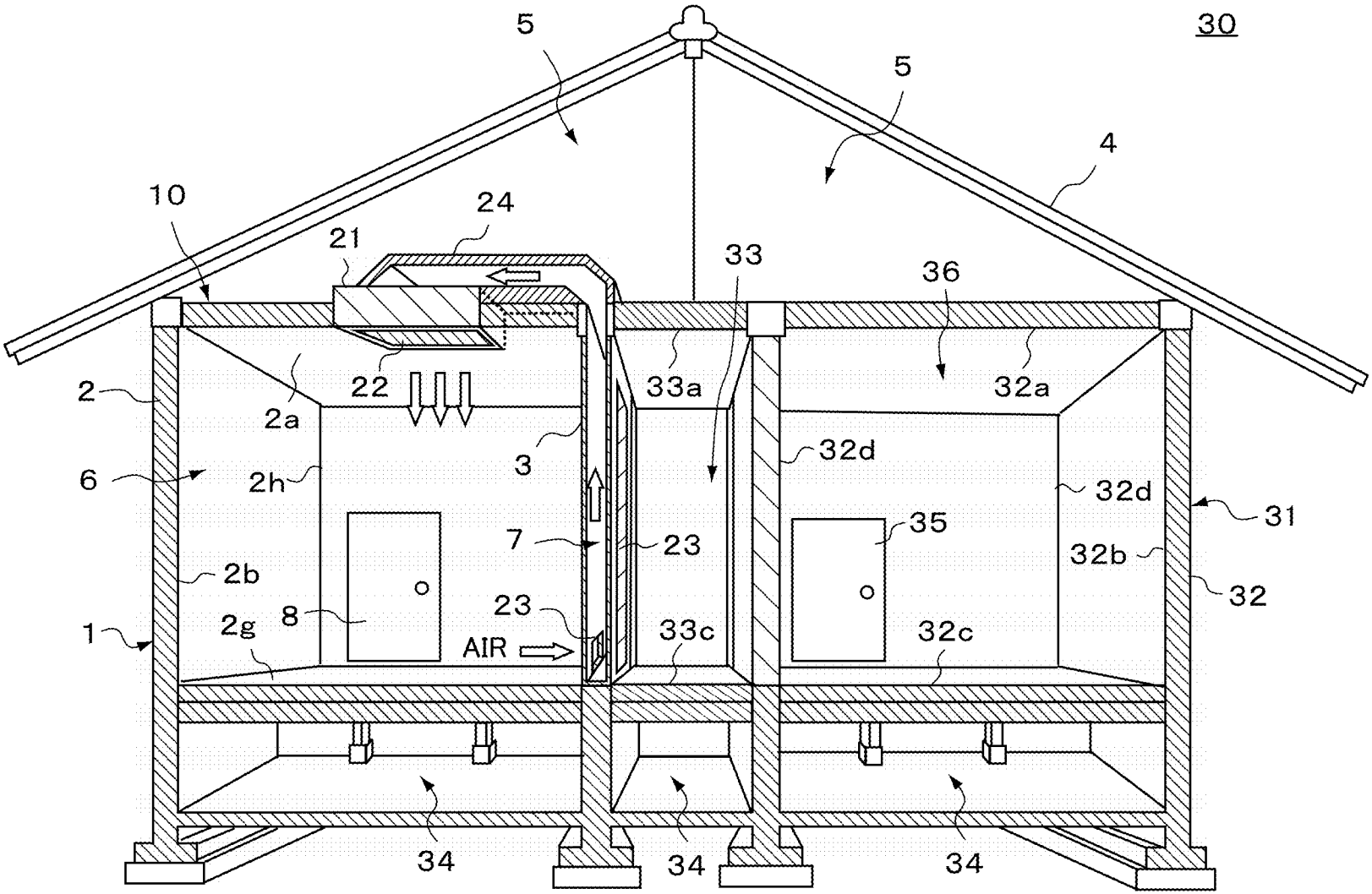
FIG. 42 A perspective view showing a house to which the system of highly clean rooms according to the eighth embodiment is applied.

FIG. 42 is a cross sectional perspective view showing a house to which the system of highly clean rooms 10 according to the eighth embodiment is applied.

As shown in FIG. 42, the house 30 has the system of highly clean rooms 10, a room 31 that is an existing room and a space 34 under the floor and it has the hallway 33 between the system of highly clean rooms 10 and the room 31.

The room 1 constitutes an enclosed space surrounded by the wall 2 as the same as the one shown in FIG. 40. The room 1 is constituted by surrounding by the lateral wall 2*b*, the lateral wall 2*c* (not shown), the partition wall 2*i*, the hollow wall 3, the ceiling wall 2*a* and the floor wall 2*g*. The partition wall 2*i* is a wall provided to form the room 1 inside the house 30 and it is constructed so as to have the doorway 8. The partition wall 2*i* is constructed by a solid wall. The hollow wall 3 is also provided as a partition wall. The partition wall 2*i* and the hollow wall 3 are provided facing a hallway 33.

The room 31 is constituted by surrounding by the wall 32. Concretely, the room 31 is constituted by surrounding by the ceiling wall 32*a*, the floor wall 32*c*, the two lateral walls 32*b* and the two partition walls 32*d*. The partition wall 32*d* is constructed by a solid wall as the same as the partition wall 2*i*. The doorway 35 is provided in one partition wall 32*d* of the two partition walls 32*d*. The room 31 has a structure essentially as the same as the room 1 except that it does not have the hollow wall 3 in its structure.

The hallway 33 is a space through which persons can move. The hallway 33 has a space surrounded by the hollow wall 3 constituting the room 1, the partition wall 32*d* constituting the room 31, the ceiling wall 32*a* and the floor wall 32*c*. The hallway 33 has a space surrounded by the partition wall 2*i*, the ceiling wall 32*a* and the floor wall 32*c*. The hallway 33 further has a space surrounded by the partition wall 32*d* having the doorway 35, the ceiling wall 32*a* and the floor wall 32*c*. By forming the hallway 33 like this, persons etc. can move between the hallway and respective rooms through the doorway 35. The gas exchange membrane 26 is provided on the surface of the hollow wall 3 forming the hallway 33.

The space 34 under the floor is a space formed under the room 1, the room 31 and the hallway 33 via the floor wall. For example, the space 34 under the floor is formed by surrounding by outer walls, etc. of the house 30. Outside air introduction openings for introducing outside air etc. are provided on the outer walls. The space 5 between the roof and the ceiling is a space formed above the room 1, the room 31 and the hallway 33 via the ceiling wall. The space 5 between the roof and the ceiling is formed by sandwiching the roof 4 that is a top wall and the ceiling wall 2*a* and surrounding by outer walls of the house. Outside air introduction openings are also provided on the outer walls similarly. The room 1 and the space 34 under the floor and the space 5 between the roof and the ceiling are separated, and there is no direct exchange of air between the space 34 under the floor and the space 5 between the roof and the ceiling and the room 1. On the other hand, for example, outside air is introduced into the room 31 and the hallway 33 from the space 5 between the roof and the ceiling, the space 34 under the floor, etc. as necessary.

The system of highly clean rooms 10 is constructed by applying a 100% circulation feedback system as the same as the one shown in FIG. 39. The FFU 21 is provided on the ceiling wall 2*a* of the room 1 constituting the system of highly clean rooms 10. An opening corresponding to the blow opening of the FFU 21 is provided on the ceiling wall 2*a*. The opening and the blow opening of the FFU 21 are airtightly connected, so that the blow opening 22 for exhausting air inside the living space 6 is formed. The opening 23 for collecting air inside the living space is provided on the surface of the hollow wall 3 on the side of the living space 6. The opening 23 is preferably provided on the lowest part of the surface of the hollow wall 3 on the side of the living space 6. The inlet of the gas flow path 24 provided inside the space 5 between the roof and the ceiling is airtightly connected with the lateral wall of the uppermost part of the hollow wall 3 and the outlet of the gas flow path 24 is airtightly connected with the blow opening of the FFU 21. Furthermore, by forming an opening in the lateral wall of the uppermost part of the hollow wall 3, the hollow part of the hollow wall 3 and the gas flow path 24 are airtightly connected, and the opening 23 and the absorption opening of the FFU 21 are airtightly connected. In this way, by constituting the hollow wall 3 as a part of the gas flow path 24, the 100% circulation feedback system is formed for the living space 6. At least a part of the surface facing the hallway 33 of the hollow wall 3 is constituted by the gas exchange membrane 26 and gas molecules are exchanged between the hollow part of the hollow wall 3 and a space constituting the hallway 33. With this, oxygen, carbon dioxide, etc. are exchanged between the living space 6 and the corridor 33 that is the outside space. It should be noted that the gas exchange membrane 26 shown in FIG. 42 is directly in contact with the outer space (in this case, the hallway space), which structure is understood as an example that the gas exchange membrane 26 is directly in contact with the outer space. That is, the present invention includes the case where one of surfaces sandwiching the space of the hollow wall exists at infinity (i.e., the case where the gas exchange membrane is directly in contact with the outer space while having a predetermined area).

Figure 43:
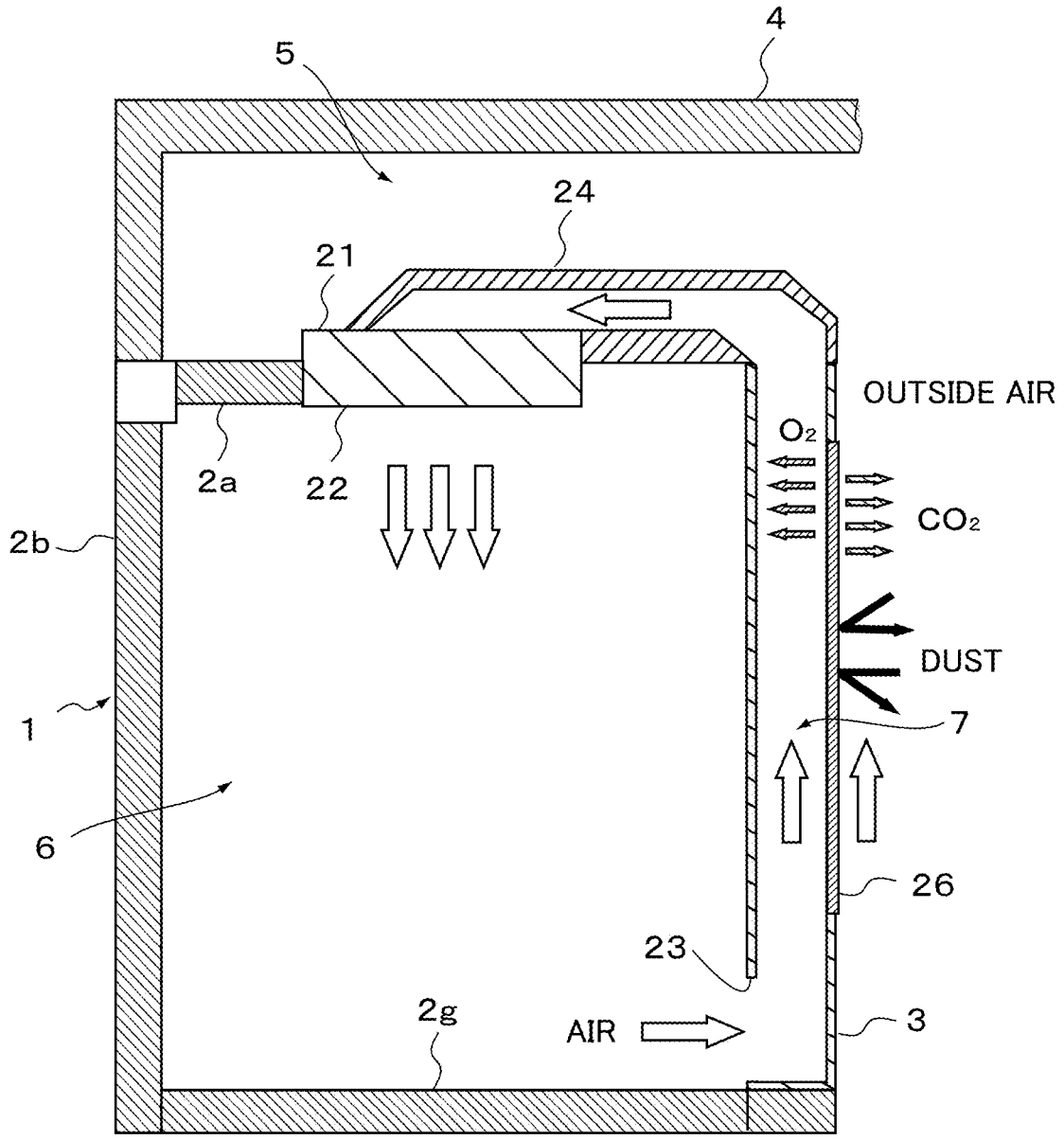
FIG. 43 A cross sectional view showing operation of the system of highly clean rooms according to the eighth embodiment.

FIG. 43 is a cross sectional view showing the operation of the system of highly clean rooms 10 according to the eight embodiment.

As shown in FIG. 43, in the system of highly clean rooms 10, air inside the living space 6 is absorbed from the opening 23. Then air reaches the inside of the gas flow path 24 through the internal space 7, and further air filtered by the FFU 21 is exhausted inside the living space 6 from the blow opening 22. Air exhausted inside the living space 6 is absorbed again from the opening 23. By repeating this circulation, cleanliness inside the living space 6 is drastically improved as described above. At least a part of the surface being in contact with outside air of the hollow wall 3 is constituted by the gas exchange membrane 26. With the gas exchange membrane 26, gases are exchanged between the outside space and the internal space 7. More specifically, oxygen is supplied inside the internal space 7 and carbon dioxide inside the internal space 7 is exhausted outside. When gases are exchanged, dusts do not enter from the outside space. Oxygen supplied inside the internal space 7 is supplied to the living space 6 by air flowing inside the internal space 7. Carbon dioxide absorbed from the living space 6 and passing through the internal space 7 is exhausted to the outside space by the gas exchange membrane 26. Other than those is the same as any one of the first to seventh embodiments.

According to the eighth embodiment, the same advantages as the first to seventh embodiments can be obtained. In addition, because a room is constructed as a closed room and the 100% circulation feedback system is provided in the living space 6 formed by the closed room 1, it is possible to keep the living space 6 to be a highly clean environment. Furthermore, because at least a part of walls constituting the room 1 is constituted by the gas exchange membrane 26, it is possible to keep the oxygen concentration inside the living space 6 to be a constant value. The FFU 21 and the gas flow path 24 connected with it are provided on the ceiling wall 2*a* inside the space 5 between the roof and the ceiling, and further at least one of the walls constituting the room 1 is made by the hollow wall 3 and the 100% circulation feedback system is constituted using the hollow part of the hollow wall 3 as a part of the gas flow path 24. In this way, by using a part of the structure of the room 1, the very compact 100% circulation feedback system can be constructed. As a result, it is possible to keep the living space 6 to be a highly clean environment without narrowing the room 1 and making dwellers feel somewhat out of place.

9. The Ninth Embodiment

Figure 44:
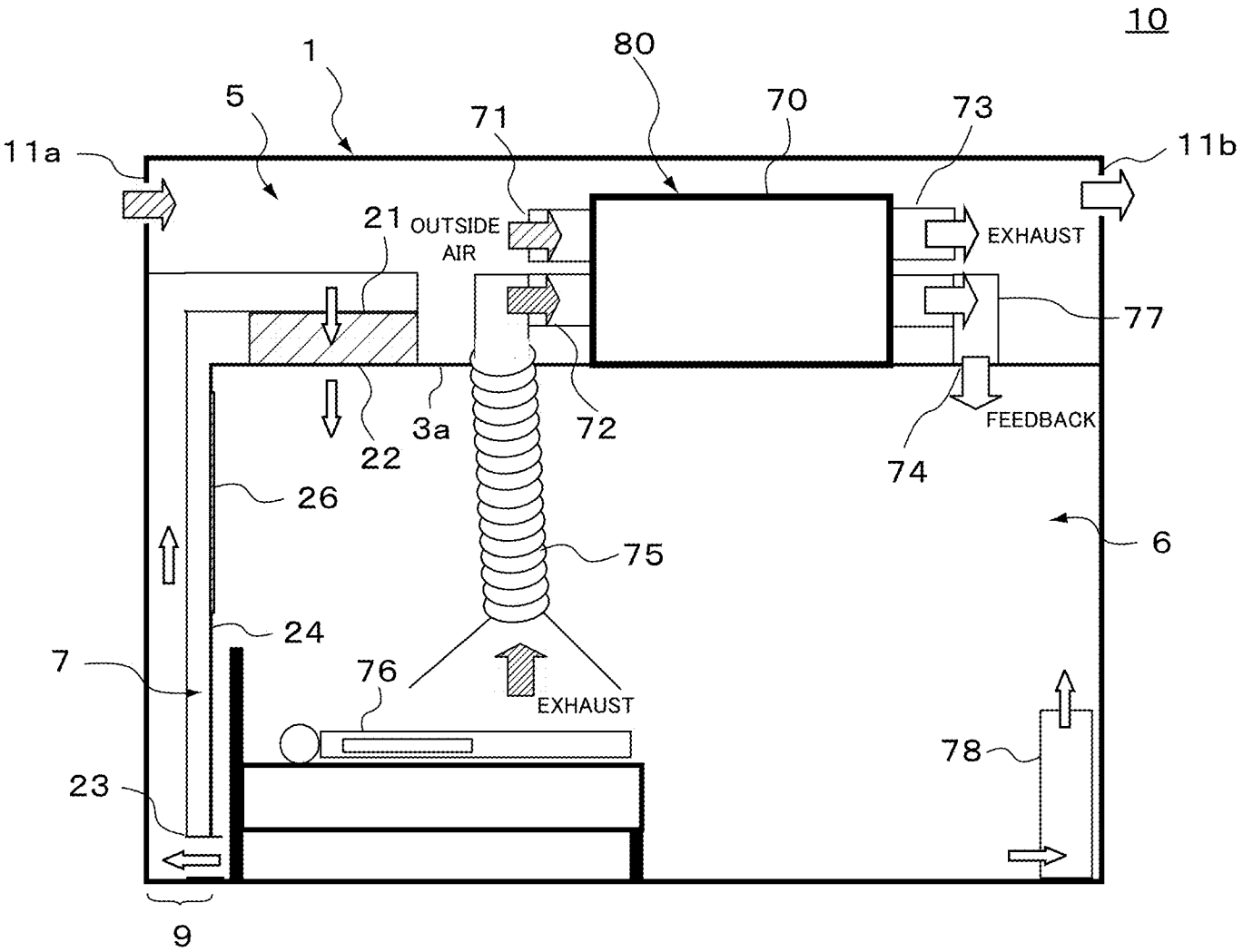
FIG. 44 A cross sectional view showing the system of highly clean rooms according to the ninth embodiment.

FIG. 44 shows the system of highly clean rooms 10 according to the ninth embodiment.

As shown in FIG. 44, the system of highly clean rooms 10 corresponds to the system of highly clean rooms 10 according to any of the first to the eighth embodiments provided with a gas exchange device 80 having two systems of a ventilation fan inside the internal space 7 or the space 5 between the roof and the ceiling. The internal space 7 and the space 5 between the roof and the ceiling have a constitution communicating air. The gas exchange device 80 has an outside air introduction opening 71 and an inside air collection opening 72 on one side of a gas exchange part 70 and has an exhaust opening 73 and a return opening 74 on the other side. The outside air introduction opening 71 introduces outside air introduced from the airway 11*a* into the internal space 7 into the gas exchange part 70. Also, the inside air collection opening 72 is connected with an absorption tube 75 and the absorption tube 75 reaches inside the living space 6 by passing through the ceiling wall 2*a* airtightly. And from an opening provided at the tip part of the absorption tube 75, air with strong smell given off by people 76 etc. and polluted air inside the living space 6 are collected. Respective openings of the absorption tube 75 and the return opening 74 connected to the gas exchange device 80 are provided inside the living space 6 in pairs. The exhaust opening 73 returns cleaned air having the low concentration of odor molecules etc. obtained by the gas exchange device 80 in which only the gas constituent comes close to an equilibrium state with outside air without exchanging particles such as dust, germs, etc. to the inside space 7. Also, a nozzle 77 is connected with the return opening 74 and the nozzle 77 is connected with an opening provided in the ceiling wall 2*a* corresponding to the outlet of the nozzle 77 airtightly. And air cleaned by the gas exchange device 80 is returned inside the living space 6. Also, a stand-alone air cleaning device 78 or a photocatalyst deodorization device is installed inside the living space 6. In this case, because choking of the air cleaning device 78 does not occur, it is possible to extend the lifetime of the stand-alone air cleaning device and improve the ability of the filter more than 1000 times than the original ability. That is, when the dust collection efficiency $\gamma=0.5$, by the rubbish density $n=(1-0.5)\times N_0$, it becomes about $n=3\times10^5$. On the other hand, as shown in FIG. 27, the stand-alone air cleaning device attained class 300. Therefore, the ratio is $3\times10^5$/300~1000. Also, as substitute for the gas exchange device 80, for example, an air filter or an air cleaning device may be installed with the similar constitution.

FIG. 45~FIG. 48 are the perspective views showing examples of the gas exchange device 80.

As shown in FIG. 45~FIG. 48, by providing the plural gas exchange membranes 26 inside the gas exchange device 80, dirty air inside the room 1 including air of which oxygen decreases, air of which carbon dioxide increases, or odor and chemical substances are subjected to gas exchange and mutual concentration diffusion of molecules with outside air, and its concentration of molecules is returned to a value very close to the concentration of molecules of outside air, which is returned inside the room 1. At this time, because there is no exchange of the net air flow, there is no incorporation of dust from outside air and air is cleaned only for molecular components. That is, outside air introduced from the introduction opening 71 and gases inside the room 1 introduced from the inside air collection opening 72 exchange gas constituents through the multiple gas exchange membranes 26, and the gas constituents of the inside air becomes almost equal to the gas constituents of the outside air, and the resultant air returns inside the room again.

Figure 45:
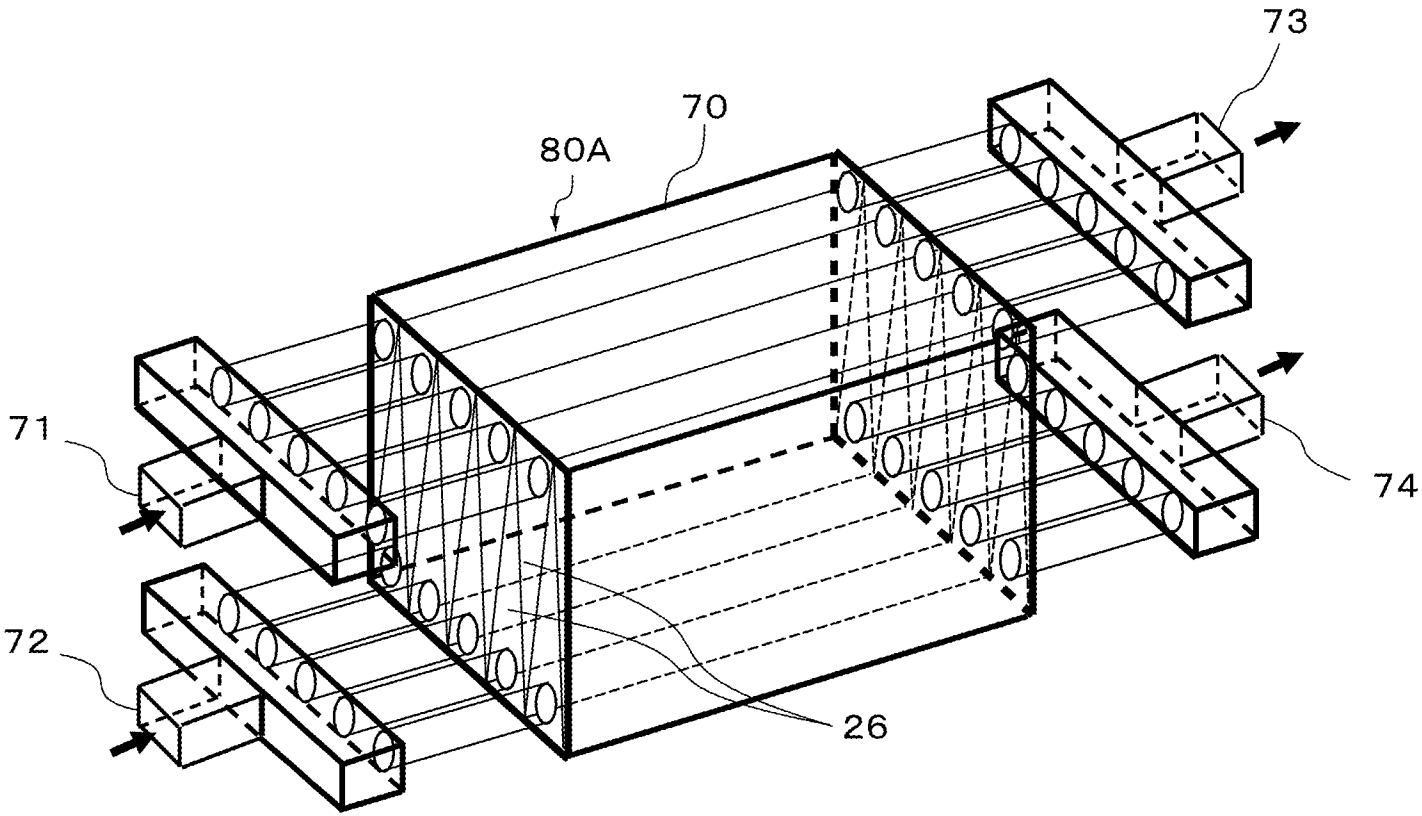
FIG. 45 A perspective view showing an example of the gas exchange device used in the system of highly clean rooms according to the ninth embodiment.
Figure 46:
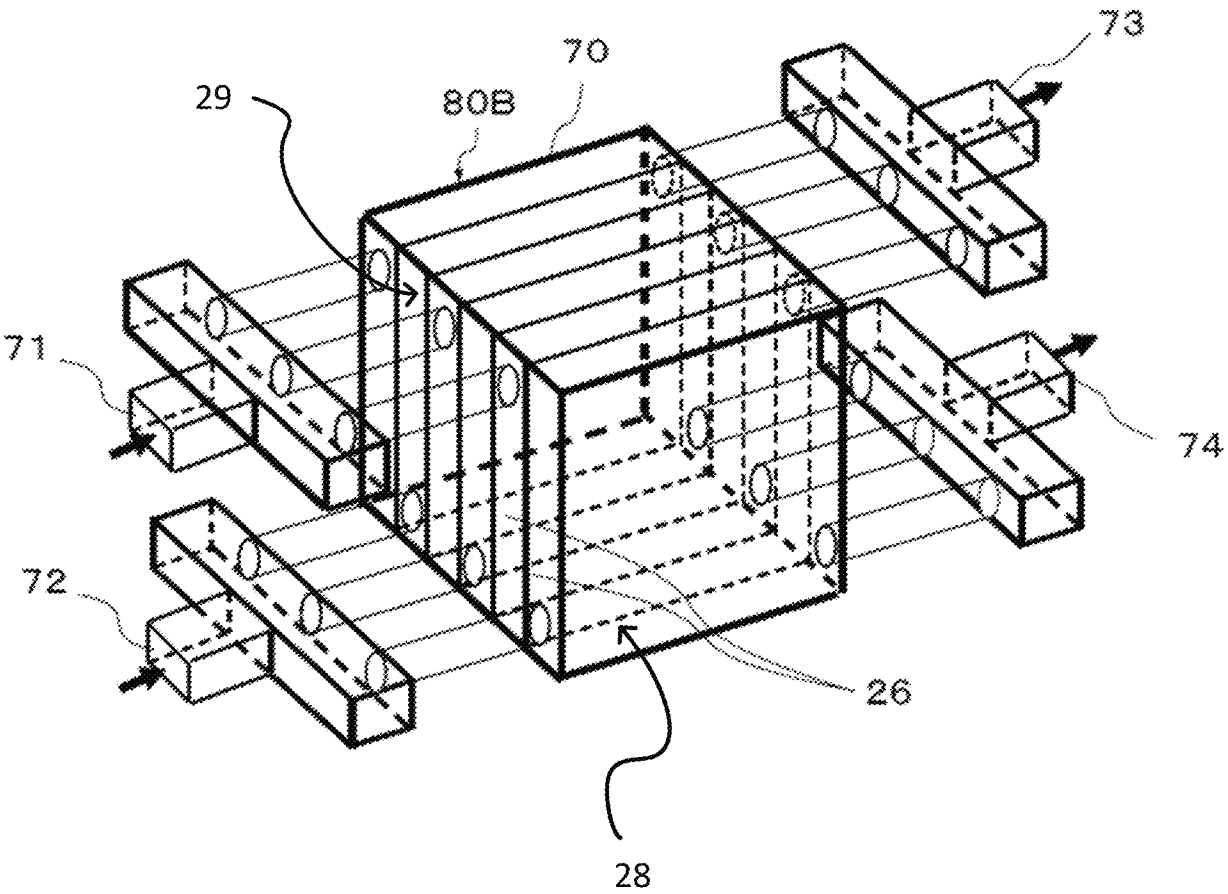
FIG. 46 A perspective view showing another example of the gas exchange device used in the system of highly clean rooms according to the ninth embodiment.
Figure 47:
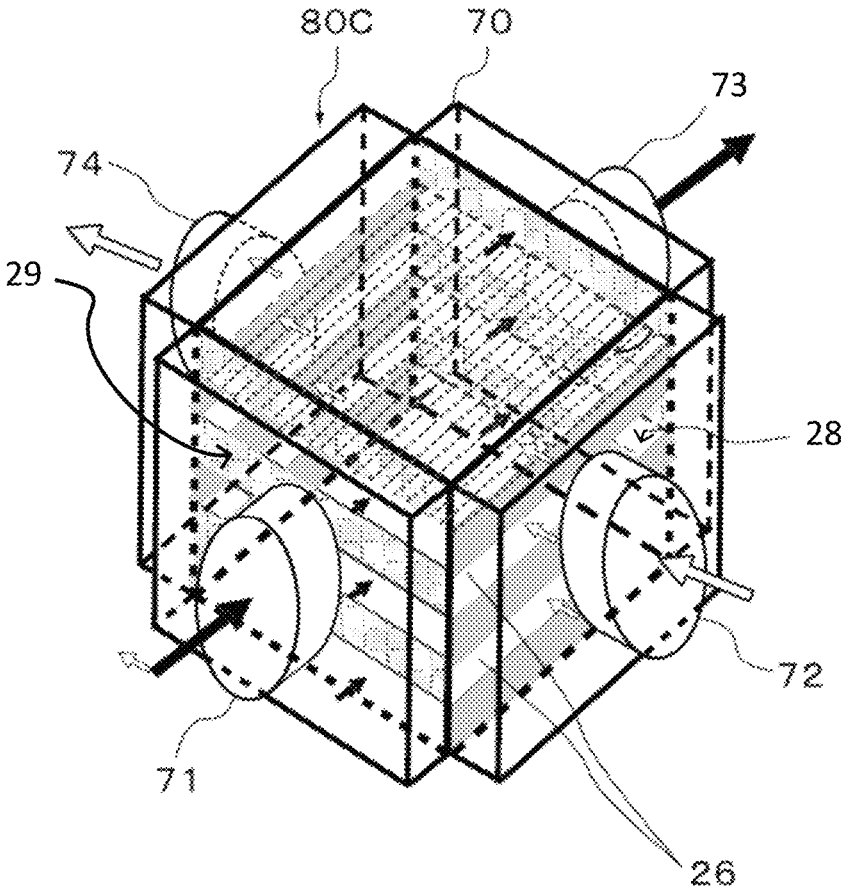
FIG. 47 A perspective view showing still another example of the gas exchange device used in the system of highly clean rooms according to the ninth embodiment.
Figure 48:
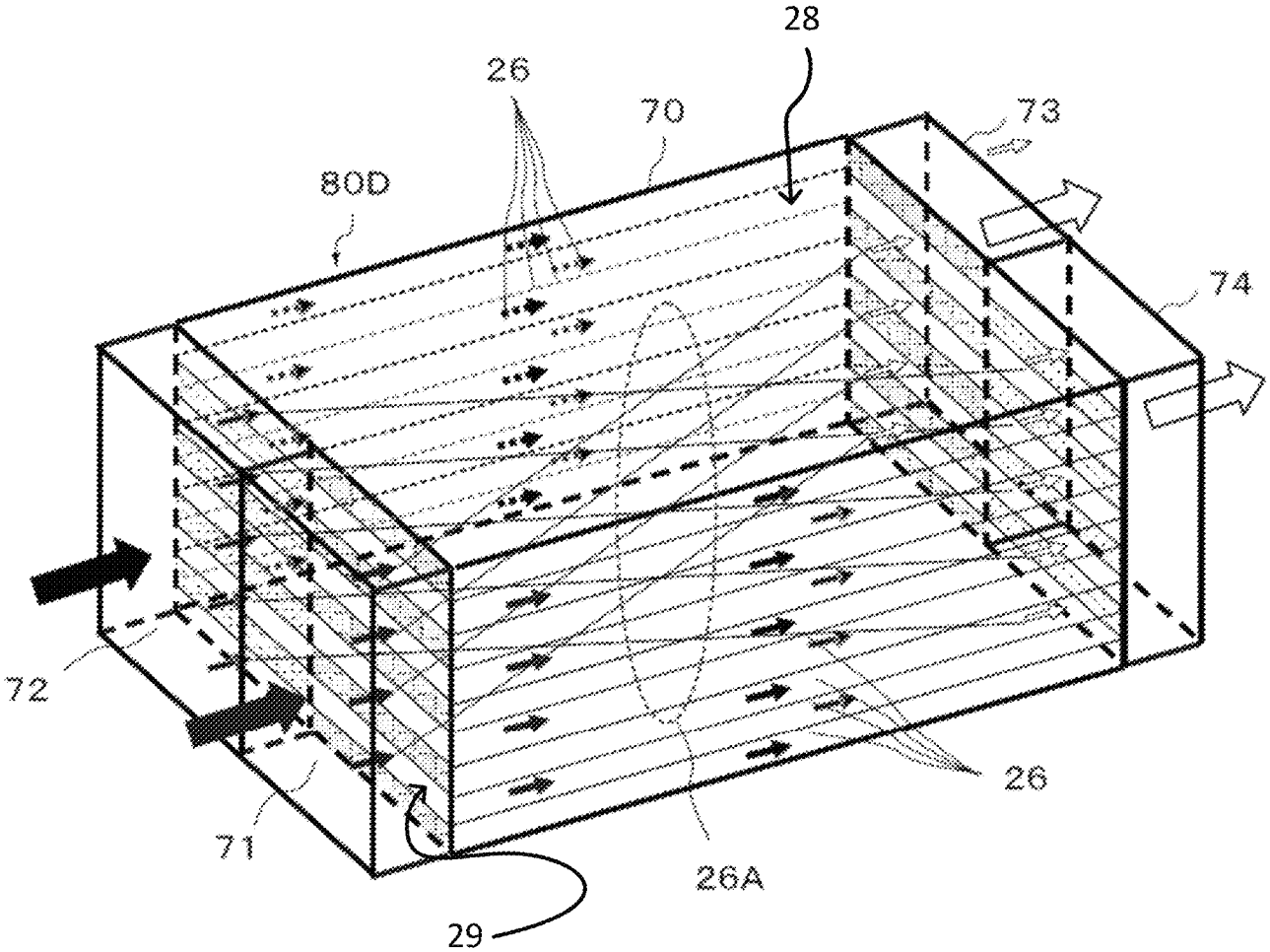
FIG. 48 A perspective view showing a further example of the gas exchange device used in the system of highly clean rooms according to the ninth embodiment.

The gas exchange devices 80 will be explained respectively. As shown in FIG. 45, the gas exchange device 80A is a type in which the handling of the air current is easy because the outside air and the inside air are introduced and sent in parallel. This type of the gas exchange device 80A has a merit that the gas exchange membrane 26 can be constituted with a single-membrane because the gas exchange membrane 26 is arranged in a box in a zigzag manner and unicursal way. Also, as shown in FIG. 46, the gas exchange device 80B has a constitution which introduces and sends the inside air and the outside air in parallel as the same as the gas exchange device 80A, further, is a type that arranges many gas exchange membranes 26 stacked in parallel with the two largest faces 28 parallel to the direction of airflow and coplanar edge faces 29, which are bounded on two sides by a smallest dimension corresponding to a thickness of each of the membranes, perpendicular to the direction of airflow, and introduces the outside air and the inside air separately parallel to each membrane. Being constituted like this, there is a merit that the distance of the surface of the gas exchange membrane 26 can be made constant and there is less stagnant layer in the air current. Also, as shown in FIG. 47, the gas exchange device 80C is also a type that arranges many gas exchange membranes 26 stacked in parallel, but by making the introduction direction of the outside air and the inside air perpendicular to each other, the introduction openings 71 can be gathered together and the constitution can be simplified, again with the two largest faces 28 parallel to the direction of airflow and coplanar edge faces 29, which are bounded on two sides by a smallest dimension corresponding to a thickness of each of the membranes, perpendicular to the direction of airflow. Also, as shown in FIG. 48, the gas exchange device 80D is the one in which the advantages of the constitution of the gas exchange devices 80B and 80C are combined and there is a merit that the introduction and sending of the outside air and the inside air can be done in parallel, again with the two largest faces 28 parallel to the direction of airflow and coplanar edge faces 29, which are bounded on two sides by a smallest dimension corresponding to a thickness of each of the membranes, perpendicular to the direction of airflow, and the introduction openings of the outside air and the air inside the room 1 can be gathered together. The size of the gas exchange part 70 of the gas exchange device 80D is specifically, for example, about 45 [cm] in height, 90 [cm] in width, and 180 [cm] in length, and the gas exchange membrane 26 is stretched, for example, with the clearance d of about 3 [mm] or more and 60 [mm] or less. By this, it is possible to exchange gases in the very large effective area of 12 [m2] or more and 240 [m2] or more. However, d is not limited to this, 1~2 [mm] is also very effective for shortening the gas exchange time. Therefore, the gas exchange device 80D has an ability more than dozens of times to hundreds of times of the gas exchange ability of the gas exchange membrane 26 shown in FIG. 18. As described above, because the gas exchange device 80D is provided with two-system ventilation fan for outside air and air returned to the room (inside air), which sends air actively, it is possible to improve the gas exchange ability to about ten times taking further velocities of the two air currents on both sides of the gas exchange plane into consideration.

If the total area of the gas exchange membrane 26 in the gas exchange device 80 satisfies at least the equation (15), enough oxygen density for people to act inside is secured. And the larger the area is, in addition to this, the higher the functions of deodorizing and harmful gas exhaust become. That is, the scaling by (V/A)/(D/L) also can be applied to the "unit cell" having the repeat structure of "gas exchange membrane/inside air/gas exchange membrane/outside air", which the gas exchange part 70 of the gas exchange device 80 has. For example, in the case of the system of highly clean rooms 10 shown in FIG. 15 or FIG. 18, while about V(~24 [$m^3$])/A(~1.8 [$m^2$])~13 [m], the clearance d of the surface of the gas exchange membrane 26 of the gas exchange device 80 shown in FIG. 44~FIG. 48 is typically a few [mm] order, so V (=A×d)/A=d~3 [mm]. Because the ratio of the both is 13 [m]/3 [mm]~4000 [mm], it is known that from the quantity of the "forty minutes" order observed in FIG. 19B, the time constant of the gas exchange of the gas exchange device 80 is, for example, only 1/4000 of it, that is, the time of about less than one second order. For example, for the living space of volume 30 [$m^3$], the flow rate of the outside air and the inside air flowing into the gas exchange device 80 is about 0.25 [$m^3$/min]~several dozen [$m^3$/min] (the value scales for the volume of the room) depending on the steady situation or emergency situation. Therefore, considering the typical size (0.45×0.9×1.8 [$m^3$]~0.8 [$m^3$]) of the gas exchange device 80, the time while the air current passes through inside the device becomes a few second~about one minute. Because this is more than several times of the time constant of gas exchange of the gas exchange device 80, it is known that the outside air and the inside air fully make gas exchange during flowing inside the gas exchange device 80, and at the outlet both air can reach an almost equilibrium state. As described above, according to the gas exchange of the outside air with the air inside of the room 1, the mutual concentration diffusion of molecules can be made effectively between the two air current flowing on both sides of the central part of each gas exchange plane. It is preferable that for the flow rate of the inside air flowing into the gas exchange device 80, the flow rate of the outside air flowing into the gas exchange device 80 is made to be equal or more than that. Preferably, for the flow rate of the inside air flowing in the gas exchange device 80, the flow rate of the outside air flowing into the gas exchange device 80 is made to be several times to 10 times or more. In this case, it is preferable to make the pressure difference via the gas exchange membrane almost zero according to the Bernoulli's theorem by adopting the arrangement with the large parallel components in the velocity vector of the two air currents of the inside air and outside air flowing on both sides of the gas exchange membrane 4 at the same time. It is the best that the velocity vector of the two air currents is perfectly parallel with each other, but next to this, it is very effective to make cross diagonally on both sides of the plane at the central part of each gas exchange plane. For this, it is important to make the cross-sectional area of the flowing part of the outside air larger than that of the inside air so as to cancel with the above ratio of the flow rate. That is, it is preferable to make the ratio of the outside air flow rate/the inside air flow rate in the gas exchange device 80 equal to the ratio of the gas exchange membrane clearance in the outside air flow path/the gas exchange membrane clearance in the inside air flow path. Also, in the case where air currents on both sides of the gas exchange membrane 26 is in parallel or in subparallel, it is effective to make the cross section of the gas exchange membrane 26 cut by the plane vertical to the flowing direction a zigzag shape (mountain fold, valley fold) and increase effective area and thereby enhance gas exchange ability.

Figure 49A:
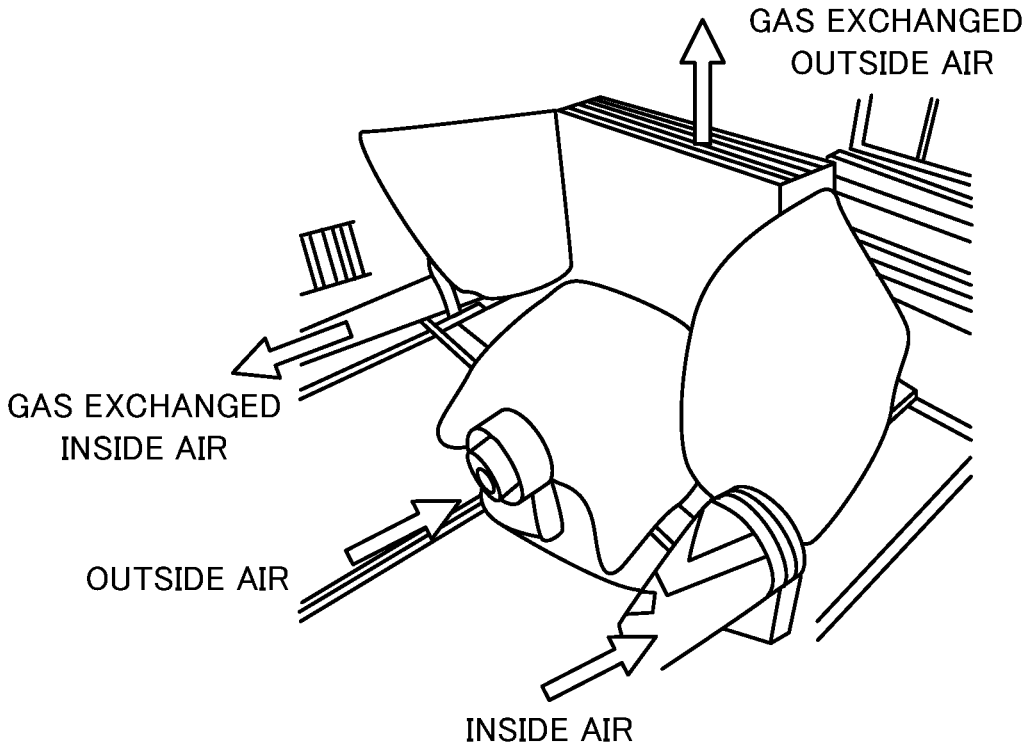
FIG. 49A A substitute picture for a drawing showing the trial product of the gas exchange device.
Figure 49B:
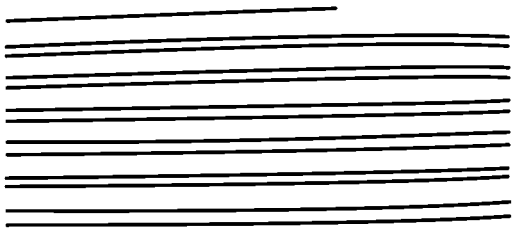
FIG. 49B A substitute picture for a drawing showing the filter part of the trial product of the gas exchange device.
Figure 50:
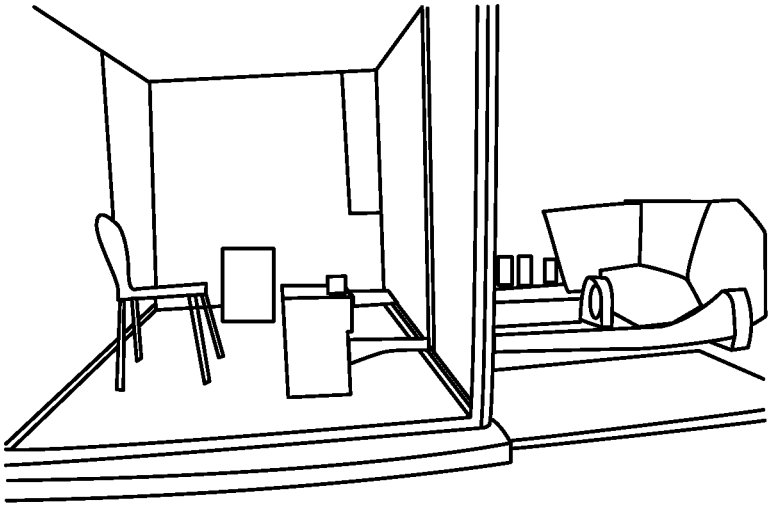
FIG. 50 A substitute picture for a drawing showing an example that the gas exchange device shown in FIG. 49A
Figure 51:
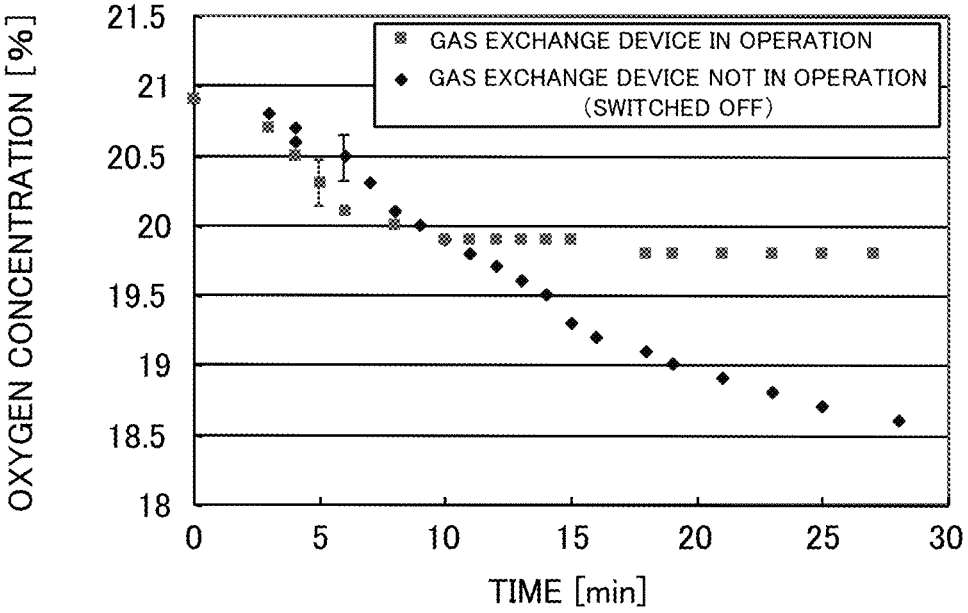
FIG. 51 A schematic diagram showing the result of an experiment of consuming oxygen carried out inside the completely closed room of the system of highly clean rooms shown in FIG. 50.

FIG. 49A shows the actual device (test device) of the gas exchange device shown in FIG. 47, and FIG. 49B is the top view of the filter part of the gas exchange device shown in FIG. 49A. FIG. 49A shows the arrangement of air flow of the gas exchange device. The length of the gas exchange device is about 90 cm, the width is about 60 cm, and the total thickness of the multi-layer membrane structure is about 20 cm. The clearance of the gas exchange membrane interleaving the flowing part of the inside air is about 5 mm, and the clearance of the gas exchange membrane interleaving the flow part of the outside air is about 25 mm, and the actual device corresponds to the case where the flow rate ratio explained in the above paragraph is set to 5. FIG. 50 is an example in which the gas exchange device shown in FIG. 49A is incorporated into the room of the system of highly clean rooms 10, and the example corresponds to the system of highly clean rooms 10 shown in FIG. 44 realized by the actual device. In the parallelepiped room on the left side in FIG. 50, the five planes among the six planes is made by vinyl for and the rest one plane is made by Tyvek, and the space is completely sealed. Then, oxygen is consumed by lighting a fire in a gas range inside the room. Under the circumstances, the oxygen concentration in the enclosed space with or without the operation of the gas exchange device was measured. Its result is shown in FIG. 51. As shown in FIG. 51, when the gas exchange device was not operated, the oxygen concentration continued to decline under 19%. However, when the gas exchange device was operated, the oxygen concentration of the inside stopped to fall and became constant at less than 20%. It is proved that the gas exchange device has excellent gas exchange ability. Based on the D/L obtained by the method described earlier, according to the prescription and the equation 17, by setting the size of the gas exchange membrane, the total number of the membrane and the flow rate of air flowing, the target oxygen concentration can be realized. Because the gas exchange device can be considered as the utmost limits in the case where V/A of the room of the present invention is small from the understanding by the above analysis. Therefore, the gas exchange device can be considered as the limit form of the hollow wall provided with the gas exchange membrane of the present invention. Thus, this gas exchange device can alternate the hollow wall provided with the gas exchange membrane of the present invention according to usage.

Also, for example, when the gas exchange device 80D is used as the gas exchange device 80 to be provided in the system of highly clean rooms 10 shown in the embodiment, the gas exchange membrane 26 provided inside the gas exchange part 70 of the gas exchange device 80D lines vertically for the ceiling wall 2*a*. That is, a normal vector of the plane of the gas exchange membrane 26 lies at right angles to the direction of gravitational force. Therefore, various dust included in the outside air does not fall on to the plane of the gas exchange membrane 26 but remain on the wall constituting the gas exchange part 70, for example, on the front plane in FIG. 49. Therefore, the gas exchange ability of the gas exchange membrane 26 of the gas exchange device 80D is remarkably relieved from the issue of clogging.

By constituting the system of highly clean rooms 10 as described above, it is possible to realize the system of highly clean rooms 10 with a local exhaust system. For example, by using the system of highly clean rooms 10 when a local exhaust is desirable at the diaper-changing time at the nursing homes, it is possible to deal with the generation of the local nasty smell without sacrificing cleanliness inside. Also, the system of highly clean rooms 10 can make the painting process using solvent etc. safe, maintaining clean environment. The others are the same as the system of highly clean rooms 10 of any of the second to the eighth embodiments.

According to the ninth embodiment, the same advantages as the first to the eighth embodiments can be obtained and further the system of highly clean rooms 10 with the local exhaust system can be realized. For example, when a local exhaust is desirable at the diaper-changing time at the nursing homes, by using the system of highly clean rooms 10, it is possible to deal with the generation of the local nasty smell without sacrificing cleanliness inside. Also the system of highly clean rooms 10 can make the painting process using solvent etc. safe, maintaining clean environment.

The Tenth Embodiment

Figure 52:
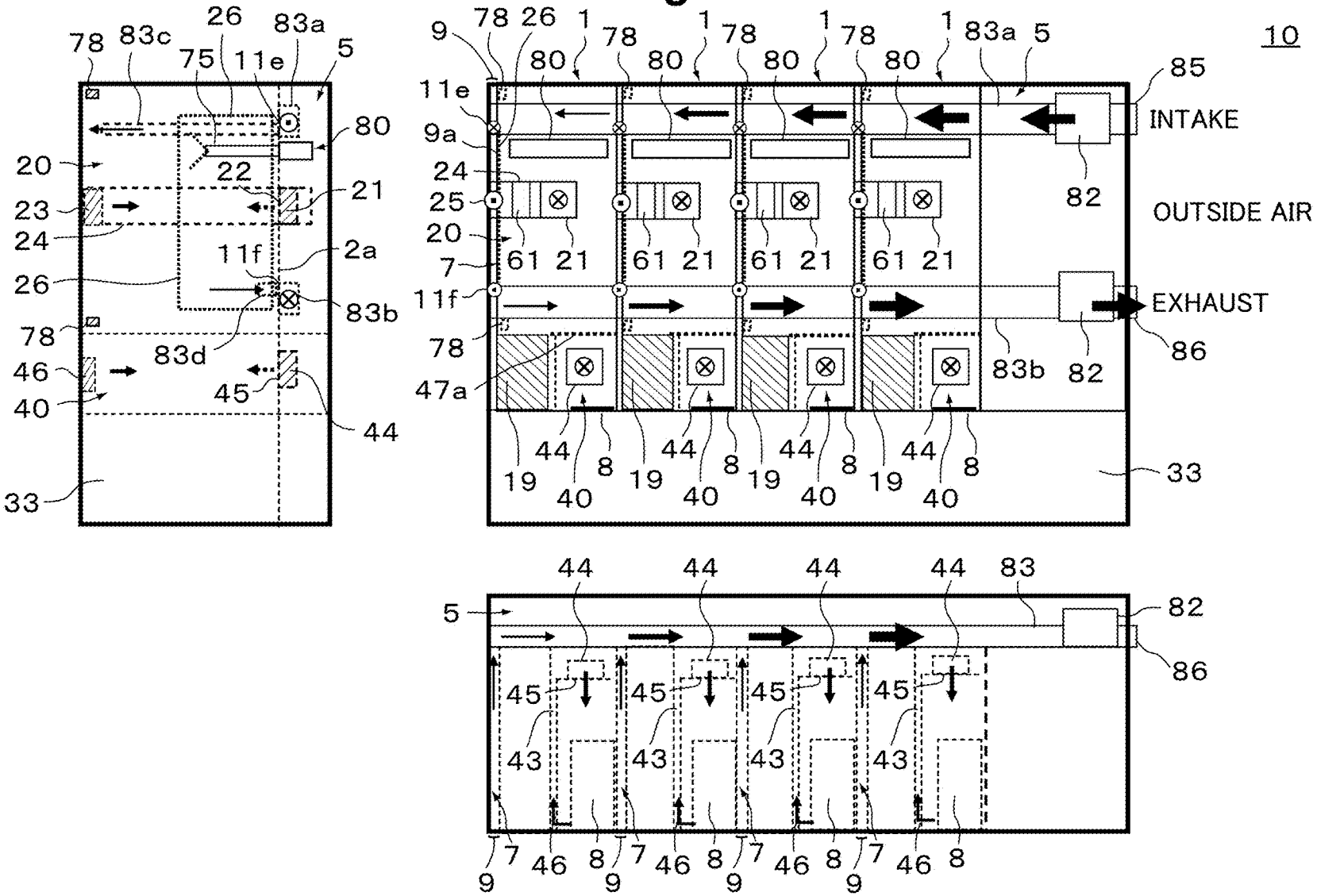
FIG. 52 A trihedral view showing an example of the sickroom and the nursing home (high grade type) including the system of highly clean rooms according to the tenth embodiment.

FIG. 52 shows the system of highly clean rooms 10 according to the tenth embodiment. The system of highly clean rooms 10 has a configuration in which plural rooms 1 are connected as the same as the system of highly clean rooms 10 shown in the fourth embodiment. As shown in FIG. 52, in the system of highly clean rooms 10, four rooms 1 having the main room 20 and the anteroom 40 are connected along the hallway 33, but the coupling number is not limited to four, can be selected appropriately. The lateral wall of the left side of the room 1 is the wall 9 having the structure that encloses the internal space. Also, each room 1 is provided with the anteroom 40, so persons can move in the main room 20 without breaking cleanliness of the main room 20.

The room 1 has the anteroom 40 and the main room 20. The anteroom 40 has the doorway 8 at the lateral wall facing the hallway 33 and is in contact with the utility space 19 such as the prefabricated bath etc., and is formed by partitioning the inside of the room 1 by the shoji door 47*a* which is provided facing the doorway 8 each other. The lateral wall of the left side in FIG. 52 of each room 1 has the structure of the wall 9 shown in the first embodiment. Also, as understood from the structure shown in FIG. 52, the wall 9 used here is the type of FIG. 8B moving fresh air to the internal space 7 along the gravitation direction. And the outside air introduction opening 11*e* and the inside air exhaust opening 11*f* are provided at the top plane of the wall 9 and the top plane of the wall 9 is provided to be on the same plane with the ceiling wall of the 2*a*. As the constitution of the anteroom 40, it is possible to select the constitution of the anteroom 40 shown in the third embodiment appropriately. Because parts of the constitution of the inside of the room 1 other than the anteroom 40 constitute the main room 20, by providing the anteroom 40 inside the room 1, persons can move in the main room 20 without deteriorating cleanliness of the main room 20. The constitution of the main room 20 has the same constitution as the room 1 (the living space 6) according to the ninth embodiment shown in FIG. 44 and, for example, the photocatalyst 61 is further provided inside the gas flow path 24. Whether or not installing the photocatalyst can be selected appropriately according to the usage of the main room 20. With respect to the constitution of the main room 20 on the side of the room 1, specifically, the FFU 21 is provided in the space 5 between the roof and the ceiling of the main room 20 so that air can be blown into the main room 20, a part of the wall 9*a* separating the main room 20 from the internal space 7 is constituted of the gas exchange membrane 26 and air inside the internal space 7 and air inside the main room 20 can be exchanged.

An outside air introduction duct 83*a* and an exhaust duct 83*b* are provided on the ceiling wall 2*a* on the side of the space 5 between the roof and the ceiling in the main room 20. The outside air introduction duct 83*a* is provided traversing the four connected rooms 1. An outside air absorption opening 85 which is the other end of the outside air introduction duct 83*a* has a ventilation mechanism 82 such as a sirocco fan etc. The exhaust duct 83*b* is provided as the same as the outside air introduction duct 83*a* and an exhaust opening 86 which is the end of the exhaust duct 83*b* on the side of the outside air absorption opening 85 has the ventilation mechanism 82 such as a sirocco fan etc. Also, the outside air introduction duct 83*a* and the exhaust duct 83*b* are provided in parallel a constant distance apart. The outside air introduction duct 83*a* is provided so as to connect together the outside air introduction opening 11*a* of each room 1 airtightly in order and the tube 83*c* for introducing outside air into the internal space 7 is connected with the outside air introduction opening 11*e* of each room 1. Also, the exhaust duct 83*d* is provided so as to connect together the inside air exhaust opening 11*f* of each room 1 airtightly in order and the tube 83*d* for exhausting gases from the internal space 7 is connected with the inside air exhaust opening 11*f* of each room 1. By constituting like this, outside air absorbed from the air absorption opening 85 passes through the outside air introduction duct 83*a* and is introduced into the internal space 7 of the wall 9 of each room 1 through the outside air introduction opening 11*e* in order. The inside air exhausted via the inside air exhaust opening 11*f* from the internal space 7 of the wall 9 of each room 1 is exhausted in order, and exhausted from the exhaust opening 86 through the exhaust duct 83*b*. Also, the tube 83*c* is constituted so that the end opening to be the outside air introduction opening is in the vicinity of the floor of the room 1, and the tube 83*d* is constituted so that the end opening to be the inside air exhaust opening is in the vicinity of the ceiling wall 2*a*. For example, when air introduced from the outside air absorption opening 85 is warm in summer etc., the constitution enhances the air circulation efficiency. In addition, for example, by reversing the length of the tube 83*c* and the length of the tube 83*d*, it is possible to obtain the structure capable of enhancing the air circulation efficiency when air introduced from the outside air absorption opening 85 is cold in winter etc. Specifically, the latter is the recommended arrangement because the parallel component of the velocity vector of the two air currents on both sides of the gas exchange membrane 26 becomes large. The outside air introduction part and the exhaust part inside the internal space 7 are selected at least a part from the region in which the gas flow path 24 is not formed inside the internal space 7.

Figure 53:
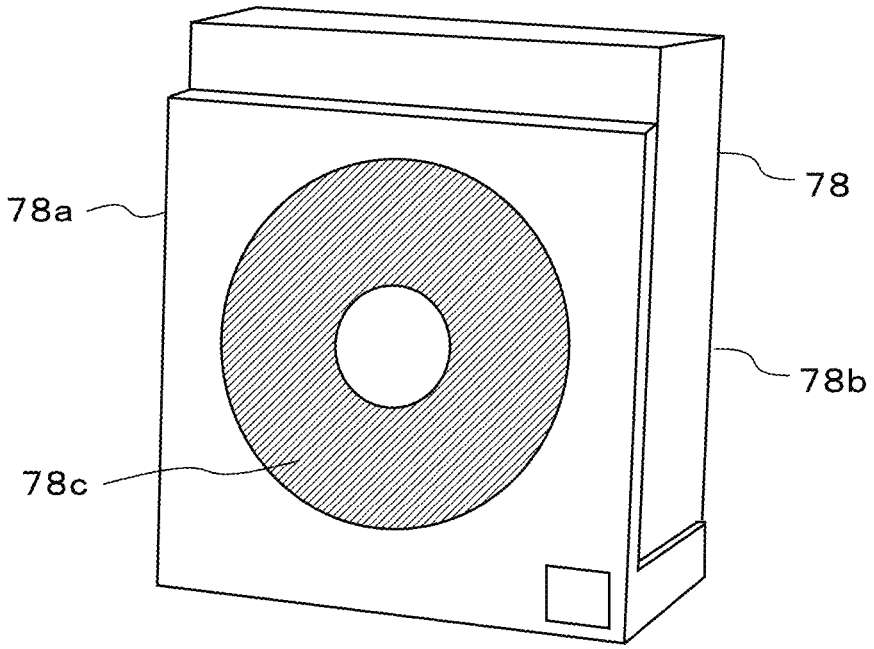
FIG. 53 A perspective view showing an example of the low flow rate FFU.

The two FFUs 78 are placed at the two places of the corner on the internal wall 9*a* inside the main room 20. The FFU 78 is not essentially limited as far as its flow rate is smaller than at least a few of the flow rate of the FFU 21, preferably less than a single digit and it has the dust removal ability and the ventilation ability. For example, denoting the volume of the main room 20 as V, it is preferably equal to or more than V/2 h [$m^3$/h], and it is preferable to be a small flow FFU of which air supply amount is 15 [/h] or more and 66 [m/h] or less. As the small flow FFU, for example, the Blueair Mini (the name of article) made by Blueair Ltd. is preferable. FIG. 53 is the perspective view showing the overview of the small flow FFU. The small flow FFU is constituted by combining the filter part 78*b* to the main part 78*a* and a ventilation mechanism is provided inside the main part 78*a* so that air absorbed from the back part of the filter part 78*b* is made to blow out from the front surface of the main part 78*a*. The small flow FFU has the outer size 160 [mm] in width, 95 [mm] in depth, 190 [mm] in height, 0.7 kg (including a filter) in weight, the sound upon operation is 44 [dB], the supply amount of clean air is 29 [$m^3$/h] and the rated consuming power is 5 [W]. Also, it is possible to change the installation position of the small flow FFU inside the main room 20. Also, by installing the two FFUs 78 on the border of the internal space 7 and the main room 20 and by installing one FFU 78 so as to introduce outside air and the other FFU 78 so as to exhaust inside air, it is possible to realize a ventilation mechanism between the main room and the outside. In this case, because one of the two FFUs 78 absorbs the outside air and the other exhausts the inside air, it is possible to improve the lifetime and the efficiency of the FFU 78 for inside air exhaust more than several hundreds times compared with the case of using it in the open system. Also, the two FFUs 78 may be installed between the main room 20 and a hallway, the outdoor, etc. By this, for example, "the rotary exchange" of the exchange of these small flow FFUs after time has passed is possible. That is, it is recommended to replace the aged ventilation mechanism 82 of the outside air absorption opening 85 side with the FFU 78 which is used for inside air exhaust until then and install the new FFU 78 for the inside air exhaust. The others are the same as any of the first to the ninth embodiments.

According to the tenth embodiment, the same advantages as any of the first to the ninth embodiments can be obtained. In addition, because the plural rooms 1 are connected, the outside air introduction part of each room 1 is connected by a duct, the exhaust part of each room 1 is connected by another duct and a ventilation mechanism is provided to each duct, the air introduction to the connected plural rooms 1 and the inside air exhaust can be made collectively. Also, for the apartment houses, nursing homes, hospitals, or paint factories which have many rooms 1, as necessary, by selecting the constitution of the system of highly clean rooms 10 appropriately, further by installing the gas exchange device 80, it is possible not only to obtain a lower dust space easily, but also to obtain a super highly clean space that can exhaust and decompose chemical substance, bad-smelling organic solvent particles, etc. in a short time. By constituting the system of highly clean rooms 10 like this, it is possible to speed up the restoration of health of patients in hospitals, or to reduce the risk of getting cancer of the bile duct etc. of people who engage in painting works etc.

The Eleventh Embodiment

Figure 54:
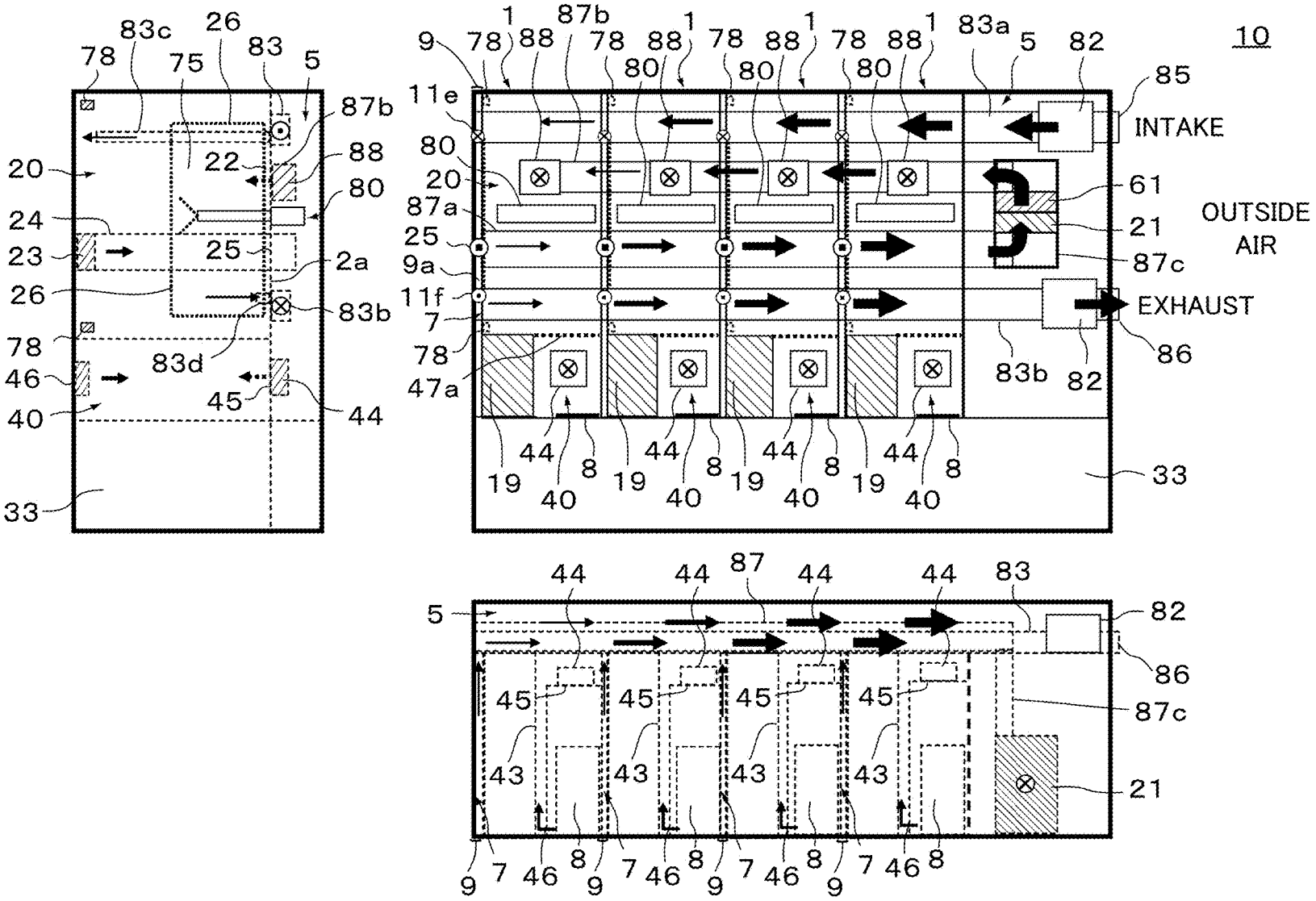
FIG. 54 A trihedral view showing an example of the sickroom and the nursing home (medium grade type) including the system of highly clean rooms according to the eleventh embodiment.

FIG. 54 shows the system of highly clean rooms 10 according to the eleventh embodiment. The system of highly clean environment 10 is a central system in which the living spaces of the connected plural rooms 1 of the system of highly clean rooms 10 shown in the tenth embodiment communicate, and one or a few FFUs 21 are arranged at the connected part.

As shown in FIG. 54, the system of highly clean environment 10 is constituted of the connected four rooms 1 each of which has the main room 20 and the anteroom 40, and has basically the same constitution as the system of highly clean environment 10 shown in FIG. 43. On the ceiling wall 2*a* on the side of the space 5 between the roof and the ceiling, a connection duct 87*c* which connects an absorption side duct 87*a* and a blow side duct 87*b* are further installed. The absorption side duct 87*a* and the blow side duct 87*b* are provided facing each other a constant distance apart, and provided in the region sandwiched between the outside air introduction duct 83*a* and the exhaust duct 83*b*. In this case, the absorption side duct 87*a* and the blow side duct 87*b* are preferably provided away from the outside air introduction duct 83*a* and the exhaust duct 83*b*, but it is not limited to this.

The blow opening 22 which is the opening provided in the ceiling wall 2*a* is provided inside the internal space 7 of the wall 9 of each room 1, and the absorption side duct 87*a* is provided so as to connect the blow opening 22 of each room 1 in order. Also, it is also possible to provide a ventilation part 88 every each room 1 in the upstream part of the blow opening 22 so as to send air to the room 1, and in that case, the absorption side duct 87*a* connects the ventilation part 88 of each room 1 airtightly in order. Also, in the top wall of the wall 9 constituting each room 1, in addition to the outside air introduction opening 11*e* and the inside air exhaust opening 11*f*, the opening 25 is provided. The opening 25 is provided between the outside air introduction opening 11*e* and the inside air exhaust opening 11*f*, and the opening 25 and the opening 23 provided in the inner wall 9*a* are connected by the gas flow path 24 airtightly. The absorption side duct 87*a* is provided so as to connect the opening 25 of each room 1 in order. The downstream side end of the absorption side duct 87*a* and the upstream side end of the blow side duct 87*b* are connected by the connection duct 87*c* provided outside the room 1, and the photocatalyst 61 and the FFU 21 are provided inside the connection duct 87*c*. The FFU 21 is constituted, for example, of a central air filtering device, a central air cleaning device, etc., however, for example, it is preferable to use the gas exchange device 80. With respect to the photocatalyst 61, for example, a filter using photocatalytic materials, an air cleaning device using the filter are preferable. Also, the FFU 21 is preferably, for example, a large capacity FFU, and for example, in the case of the main room 20 having the volume of 45 m3, it is preferable that the air supply rate is 4 [$m^3$/min] or more and 22 [$m^3$/min] or less. Also, air is sent in order to the absorption side duct 87*a* through the gas flow path 24 stored in the wall 9 provided at the end of each room 1, then air is sent out inside the duct 87*a* from the all rooms 1 to join together, and therefore enters inside the connection duct 87*c* and changes its direction to 90 degrees. After entering inside the connection duct 87*c*, air passes through the FFU 21 and the photocatalyst 61 in order, enters inside the blow side duct 87*b*, further changes its direction to 90 degrees, and gases are sent to each main room 20 from the blow opening 22 provided in each room 1. At this time, the gas flow path 24 to be connected to the upstream end of the absorption side duct 87*a* and the blow opening 22 to be connected with the downstream end of the blow side duct 87*b* are provided inside the same main room 20. And in each room 1, the opening 23 at the lower end of the gas flow path 24 for introducing the inside air of the room and the blow opening 22 for returning again all of the absorbed air after cleaning and subsequent processing by the FFU 21 and the photocatalyst 61 as a pair and the room 1 as a whole is constructed to be closed. By constituting like this, the opening 23 at the lower end of the gas flow path 24 which is an absorption opening provided in each room 1 respectively and the blow opening 22 communicate with the FFU 21 provided outside the room 1. From this, the 100% circulation feedback system can be provided to the four rooms 1 with one FFU 21 at the same time, and the one FFU 21 can supply clean air to the plural rooms 1.

Figure 55:
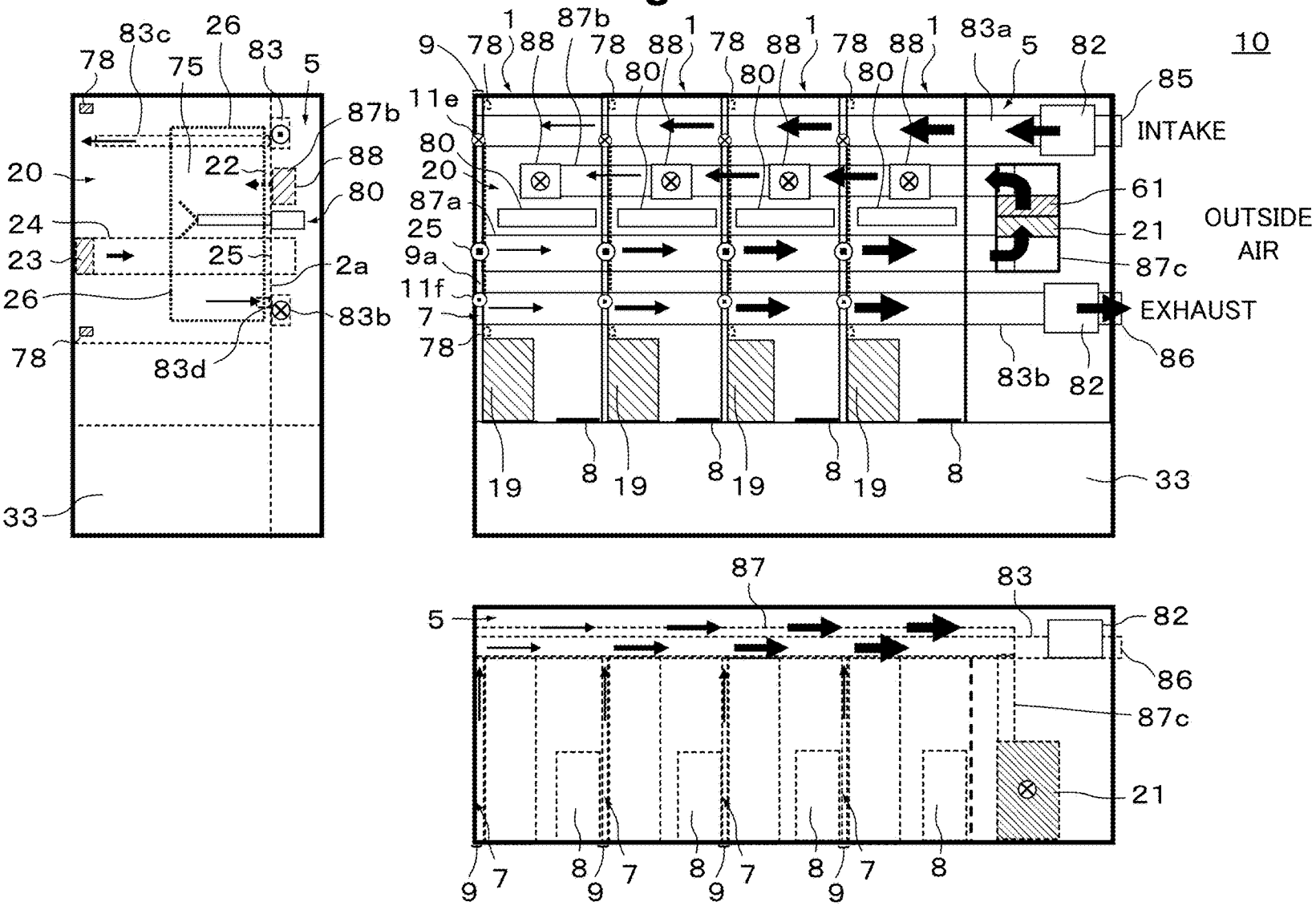
FIG. 55 A trihedral view showing an example of the sickroom and the nursing home (entry type) including a modification of the system of highly clean rooms according to the eleventh embodiment.

FIG. 55 shows a modification of the system of highly clean rooms 10 according to the eleventh embodiment. The system of highly clean rooms 10 corresponds to the system of highly clean rooms 10 shown in FIG. 54 in which the constitution of the anteroom 40 is omitted. The other structure can be constituted as the same as the system of highly clean rooms 10. The configuration is a suitable system when the frequency of moving in the room 1 is small and the time of stay inside the living space is relatively long. The others are the same as any of the first to the tenth embodiments.

According to the eleventh embodiment, the same advantages as any of the first to the tenth embodiments can be obtained. In addition, it is possible to provide the 100% circulation feedback system in the plural rooms 1 with one FFU 21 at the same time and supply clean air to the plural rooms 1 by the one FFU 21 and it is possible to make cleaning of the plural rooms 1 all together by the central system.

The Twelfth Embodiment

Figure 56A:
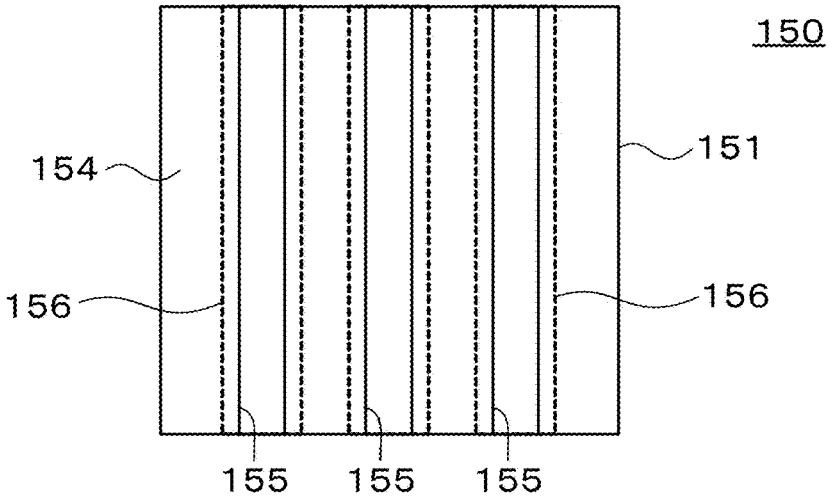
FIG. 56A A top view showing an FFU capable of coping with radioactive substance and radiation used in the system of highly clean rooms according to the twelfth embodiment.
Figure 56B:
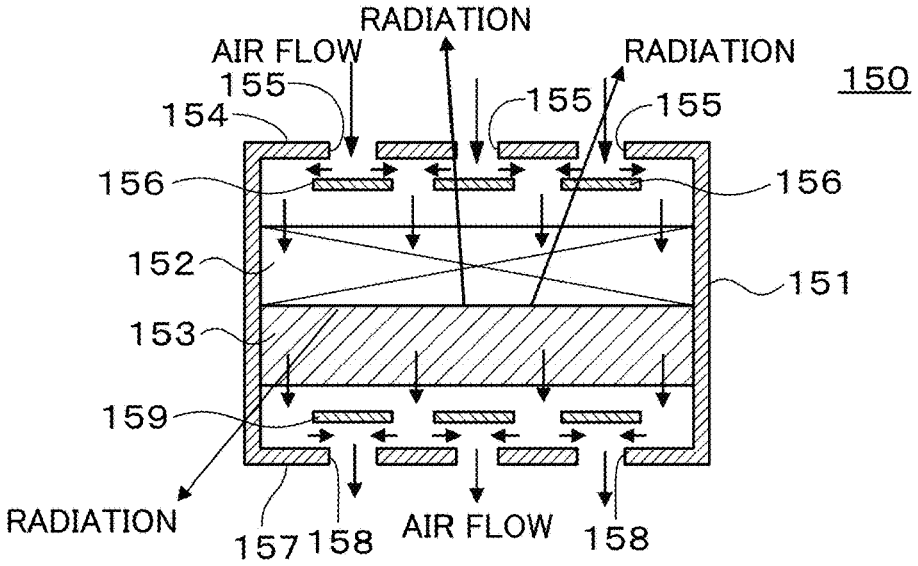
FIG. 56B A front view showing the FFU capable of coping with radioactive substance and radiation used in the system of highly clean rooms according to the twelfth embodiment.
Figure 56C:
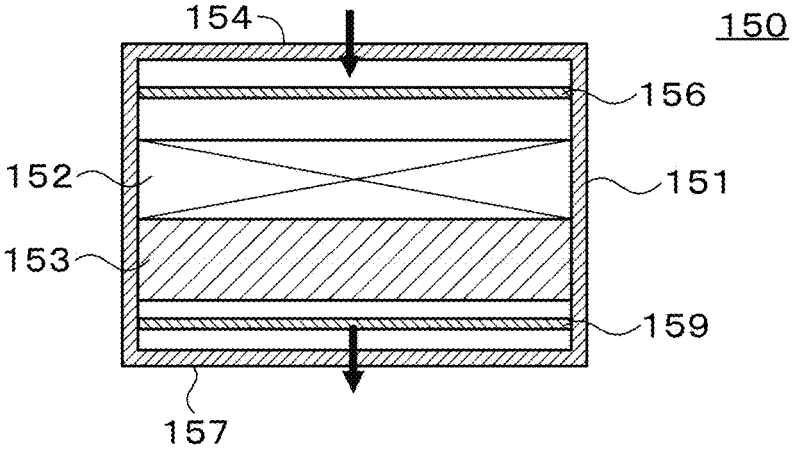
FIG. 56C A right side view showing the FFU capable of coping with radioactive substance and radiation used in the system of highly clean rooms according to the twelfth embodiment.

According to the twelfth embodiment, as the FFU 21 of the system of highly clean rooms 10, an FFU 150 capable of coping with radioactive substance and radiation shown in FIG. 56A, FIG. 56B and FIG. 56C is used. Here, FIG. 56A is the top view, FIG. 56B is the front view and FIG. 56C is the right side view.

As shown in FIG. 56A, FIG. 56B and FIG. 56C, the FFU 150 capable of coping with radioactive substance and radiation has a parallelepiped box shaped case 151. The case 151 is made of radiation shielding materials. A ventilation fan 152 and a dust filter 153 are provided inside the case 151. As the dust filter 153, for example, other than the HEPA filter, the ULPA filter, etc., a filter of which collection efficiency of dust particles is lower than these HEPA filter and ULPA filter, for example, the collection efficiency is equal to or less than 99%, or further equal to or less than 95% may be used. Plural slit-like rectangular openings 155 are provided in parallel to each other on an upper wall 154 of the case 151. In the space between the upper wall 154 of the case 151 and the ventilation fan 152, a rectangular slit-like radiation shielding member 156 which is larger than each opening 155 is provided so as to face the opening 155. The radiation shielding member 156 is provided so that when looking at each opening 155 from the vertical direction to the upper wall 154, the inside of the case 151 cannot be seen. Similarly, plural rectangular slit-like openings 158 are provided in parallel to each other on a lower wall 157 of the case 151 and a rectangular slit-like radiation shielding material 159 which is larger than each opening 158 is provided in the space between the lower wall 157 of the case 151 and the dust filter 153 so as to face each opening 158. The radiation shielding material 159 is provided so that when looking at each opening 158 from the vertical direction to the lower wall 157, the inside of the case 151 cannot be seen. In this case, the radiation shielding members 156 and 159 are formed so that the radiation radiated from the radioactive substance and/or radioactive substance containing particles collected at any position of the dust filter 153 does not directly go outside from each opening 155 and 158 of the case 151. Also, the thickness of the wall of the case 151 and the radiation shielding members 156 and 159 is set so that with respect to the straight line toward in any direction from the radioactive substance and/or radioactive substance containing particles collected at any position of the dust filter 153, the total distance which the straight line traverses the wall of the case 151 and/or the radiation shielding members 156 and 159 becomes more than the biggest between the maximum range or the absorption length of a group of radiations radiated from the radioactive substance and/or the radioactive substance containing particles. A radiation monitor such as a CsI (T1) scintillator, a NaI (T1) scintillator, a $Bi_4Ge_3O_{12}$ scintillator, a Si/CdTe Compton camera, etc. is preferably provided inside the case 151 in the vicinity of the dust filter 153. By the radiation monitor, the accumulation quantity of the radioactive substance on the dust filter 153 can be monitored. Also, it is desirable to use the materials of the elements which has no unstable radioactive isotopes for the case 151 of the FFU 15 capable of coping with radioactive substance and radiation, the outer frame of the dust filter 153, or those surface coating materials. It is desirable that materials that constitute the case 151 are not naked, but the surface protection is carried out by coating of polytetrafluoroethylene (PTFE) etc. or painting etc. Also, although not shown in FIG. 56A, FIG. 56B and FIG. 56C, it is desirable to place a radiation monitor similar to the above at the outside vicinity of the case 151 of the FFU 15 capable of coping with radioactive substance and radiation and monitor constantly that the FFU 15 capable of coping with radioactive substance and radiation is normally operating.

The structure of the case 151 of the FFU 150 capable of coping with radioactive substance and radiation is devised based on that the radiation goes straight ahead as far as there is no scattering and the direction of the air current can be controlled along the flow path. With respect to shielding, based on the consideration regarding the range of the radiation to be considered, it is understood that it is necessary to control γ rays (about a few hundreds keV~2 MeV energy) than β rays. The γ rays of the energy range loses the energy by the Compton scattering. Its scattering cross section is known. Therefore, it is possible to design such that γ rays traverses the wall of the case 151 or the radiation shielding members 156 and 159 at a sufficiently high possibility (almost 100%), even though the direction of movement changes by the scattering. That is, in the case 151, air that enters from each opening 155 of the upper wall 154 enters the dust filter 153 through the ventilation fan 152 after its flow path is repeatedly curved in the horizontal direction and vertical direction by the radiation shielding member 156, as shown by the arrow in FIG. 56B. And, air that goes out from the dust filter 153 goes outside from each opening 158 of the lower wall 157 after its flow path is repeatedly curved in the horizontal direction and vertical direction by the radiation shielding material 159. The overlapping length of the radiation shielding member 156 with the upper wall 154 is set so that the ratio of the overlapping length to the clearance of the radiation shielding member 156 becomes preferably 1 or more, for example about 3. Similarly, the overlapping length of the radiation shielding material 159 with the lower wall 157 is set so that the ratio of the overlapping length to the clearance of the radiation shielding material 159 becomes preferably 1 or more, for example about 3. Here, the areas and positions of the opening 155 of the upper wall 154, the radiation shielding member 156, the opening 158 of the lower wall 157 and the radiation shielding material 159 are selected so that air that enters from the opening 155 of the upper wall 154 flows smoothly and enters the ventilation fan 152 and air that goes out from the dust filter 153 flows smoothly and goes out from the opening 158 of the lower wall 157. Also, the radiation radiated from the radioactive substance and/or radioactive substance containing particles collected in the filter material (filtering media) of the dust filter 153, even the radiation radiated in any direction, is securely shielded by hitting the wall made of the radiation shielding material of the case 151 and/or the radiation shielding members 156 and 159, and is not radiated to the outside the case 151.

Specific examples of radiation shielding materials which constitute the case 151 and the radiation shielding members 156 and 159 will be described. For example, regarding the radioactive isotope to be radiated outside with a reactor accident, the process of the decay (β decay, γ decay) is identified including the energy.

For example, in case of iodine 131 ($^{131}I$), β decay occurs at about 90% to radiate 606 keV β rays, γ decay occurs to radiate 364 keV γ rays, and β decay occurs at about 10% to radiate 334 keV β rays, thereafter γ decay occurs to radiate 637 keV γ rays. On the other hand, in case of cesium 137 ($^{137}Cs$), β decay occurs at about 95% to radiate 512 keV β rays, γ decay occurs to radiate 662 keV γ rays, β decay occurs at about 5% to radiate 1.17 MeV β rays.

Following is the description especially about iodine 131 and cesium 137. However, based on the knowledge of the relation between the energy of β rays radiated from various radioactive isotopes and the absorption coefficient, by taking into consideration the energy of the decay process, it can be applied to the other radioactive isotopes.

As described above, for the β decay of iodine 131 and cesium 137, by shielding the 606 keV β rays, it is possible to shield β rays 100% in case of iodine 131, and 95% in case of cesium 137. Further, by shielding 1.17 MeV β rays, it is also possible to shield β rays of cesium 137 100%.

From the relation between the energy of β rays and the maximum range R, the maximum range of about 640 keV β rays is known about 250 mg/cm$^2$. Using lead (Pb) as the radiation shielding materials, for example, its density is 11.3 g/cm$^3$, so if the thickness is about 0.3 mm, it is known that it is possible to fully shield the 640 keV β rays. In order to shield the 1.2 MeV β rays, because the maximum range is about 500 mg/cm2, the thickness of 0.6 mm is enough. Because strontium 90 ($^{90}Sr$) has excess neutron, yttrium 90 ($^{90}Y$) is generated by the β decay. Because the half-life of yttrium 90 is sixty four hours and is unstable, further β decay occurs, then becomes the stable zirconium 90 ($^{90}Zr$). The half-life of $^{90}Sr$ is 28.79 years, the energy of β decay of $^{90}Y$ is 2279.783±1.619 keV, which is substantially higher than the energy of β decay of $^{90}Sr$ which is 545.908±1.406 keV, but because the range is about 1.3 g/cm$^2$, shielding can be made by using the 1.5 mm thick lead. Like this, with respect to the electron (β rays) which is a charged particle, generally, the electromagnetic interaction becomes larger compared with photons (γ rays) which is neutral in charge, accordingly the range becomes small. Therefore, it is possible to control by the thinner shielding materials (Metal plates, reinforced concrete slabs, etc.).

On the other hand, for the γ decay of iodine 131 and cesium 137, by shielding 662 keV γ rays, it is possible to shield the γ rays 100% in case of iodine 131, and also 100% in case of cesium 137.

From the relation between the energy of the γ rays, that is, the energy of photons and the absorption length of γ rays of various materials, the absorption length of the 662 keV γ rays is about 9 g/cm$^2$. Even taking into consideration cesium 137 and cesium 134 as the radioactive substances, if the absorption length of the wall of the case 151 and radiation shield members 156 and 159 is equal to or more than 10 g/cm$^2$, it is possible to shield the γ rays from these cesium 137 and cesium 134. Using, for example, lead (Pb) as the radiation shielding material, because its density is 11.3 g/cm$^3$, in case about (9/11.3) cm≈8 mm, it is known that it is possible to fully shield the γ rays from iodine 131, cesium 137 and cesium 134.

Taking into consideration the serial characteristic that after β decay, the γ decay occurs, it is use a 0.6 mm+8 mm~9 mm thick lead plate. Especially, in the photon energy versus the absorption length plot, for the photon energy of 600 keV to 1 MeV, the absorption length converges to a narrow range for the elements except for hydrogen. Therefore, with respect to the materials other than lead, if its density is small, by making the thickness inversely large, it is possible to use them as a substitute for the lead plate. For example, for the use of the lateral wall of a room, the concrete may be acceptable, and the density of the concrete is 2.3 g/cm$^3$, so making its thickness to 9 mm×(11.3/2.3)~5 cm may work.

From the aging variation of the residual radiation after the Chernobyl nuclear plant accident occurred in 1986, after 100 days from the accident, iodine 131 does not remain. Therefore, after the three years, only the influence of β rays and γ rays radiated from the cesium 137 and cesium 134 may be considered.

The contribution from cesium 134 relatively decreases over 600 days~800 days after the accident, but it is preferable to control the contribution. From cesium 134, γ rays of higher energy (796 keV, 802 keV, 1.365 MeV) than γ rays from cesium 137 come out. To control these γ rays, it is better to use a shield plate with an absorption length of 20 g/cm$^2$. In case of lead, the thickness is about 18 mm. Especially, in the photon energy versus the absorption length plot, for the photon energy from 600 keV to 1 MeV, the absorption length almost agrees with 15~30 g/cm$^2$ for the elements except for hydrogen. Therefore, for controlling the γ rays of energy less than 2 MeV, the absorption length (except for hydrogen) becomes the universal value regardless of elements.

The operation of the FFU 150 capable of coping with radioactive substance and radiation will now be described. Here, at first, it is supposed that air in the environment around the system of highly clean rooms 10 contains radioactive substance and/or radioactive substance containing particles, and air inside of the room 1*a* of the system of highly clean rooms 10 also contains radioactive substance and/or radioactive substance containing particles and its cleanliness is low as an ordinal room environment.

Starting up the operation of the FFU 150, as shown by an arrow in FIG. 56B, air inside the room 1*a* enters the inlet of the FFU 150. Air that enters inside the FFU 150 is sent to the dust filter 153 by the ventilation fan 152, and by passing through the dust filter 153, the radioactive substance and/or radioactive substance containing particles are removed. Air thus removed the radioactive substance and/or radioactive substance containing particles goes out from the exit of the FFU 150, then flows downwards. Air that flows downward again enters the inlet of the FFU 150, and repeats the above process. By repeating the above, the radioactive substance and/or radioactive substance containing particles are removed from air inside the room 1*a*, and air is cleaned.

Also, at this time, as already described, in the course of the cleaning, the radiation radiated from the radioactive substance and/or radioactive substance containing particles collected in the filter materials of the dust filter 153 is prevented from radiating outside the case 151.

As described above, according to the twelfth embodiment, because the FFU 150 is covered by the case 151 of which wall is constituted of the radiation shielding materials, and the radiation shielding members 156 and 159 constituted of radiation shielding materials, the radiation to be radiated from the radioactive substance and/or radioactive substance containing particles collected in the dust filter 153 can be securely prevented from radiating inside the room 1*a*. Also, as described above, the dust collection efficiency γ of the dust filter 153 is, for example, not necessary to be more than 99.99% as the HEPA filter, for example, in case even about 95%, sufficiently high cleanlinessup can be obtained. For example, as the dust filter 153, a medium performance filter (using the gas exchange membrane made of shoji paper) with γ=95% can be used. Like this, even if a medium performane filter with γ=95% is used as the dust filter 153, good cleanliness lower than Class 100 can be obtained. Therefore, it is possible to use non-glass fiber materials like resin, or as a flame, wood, etc. which are easy to dispose can be used as the filer materials (filtering media) of the dust filter 153, for example. By this, with respect to the HEPA filter using glass fiber as filter materials, when disposing it, handling such as landfill etc. is required, and when a large amount of waste result, the handling is practically impossible. In contrast to this, the dust filter 153 using non-glass fiber materials like resin as the filter materials, and wood etc. as frames are easy in waste handling and collectively incinerating filters and frlmes after use, which have the profound effect for efficiency improvement of venous industrially aspects which is disposal of waste. Also, by using the dust filter 153 with the small dust collection efficiency γ of about 95%, for example, it is possible to obtain an advantage that choking of the dust filter 153 does not occur compared to the HEPA filter and the dust filter 153 can be used for a long time.

The Thirteenth Embodiment

Figure 57A:
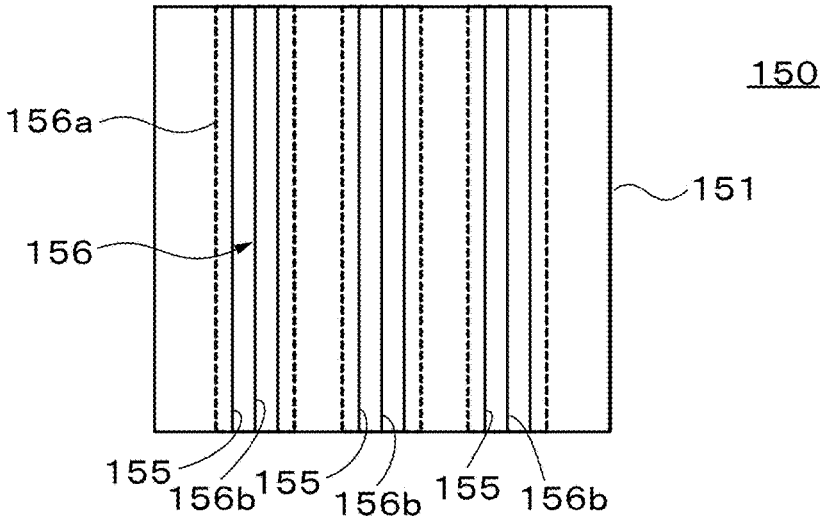
FIG. 57A A top view showing an FFU capable of coping with radioactive substance and radiation used in the system of highly clean rooms according to the thirteenth embodiment.
Figure 57B:
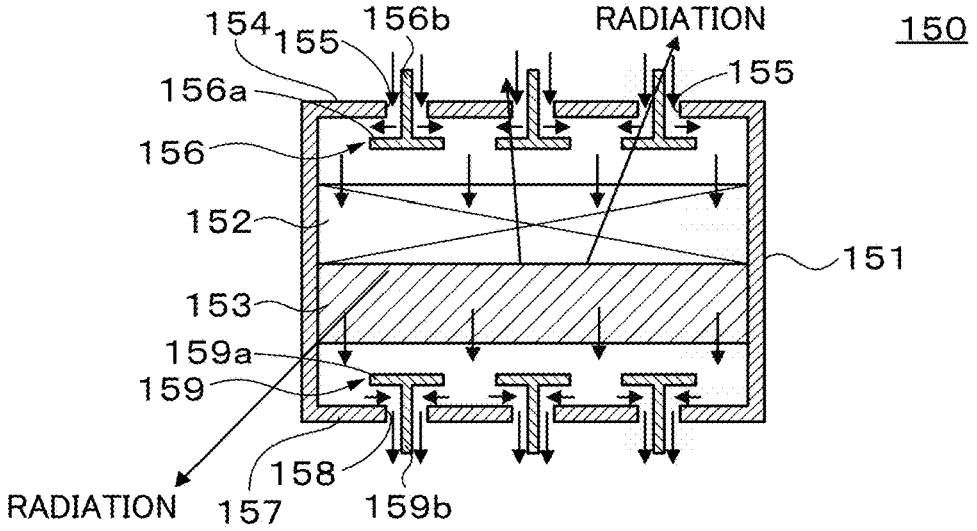
FIG. 57B A front view showing the FFU capable of coping with radioactive substance and radiation used in the system of highly clean rooms according to the thirteenth embodiment.
Figure 57C:
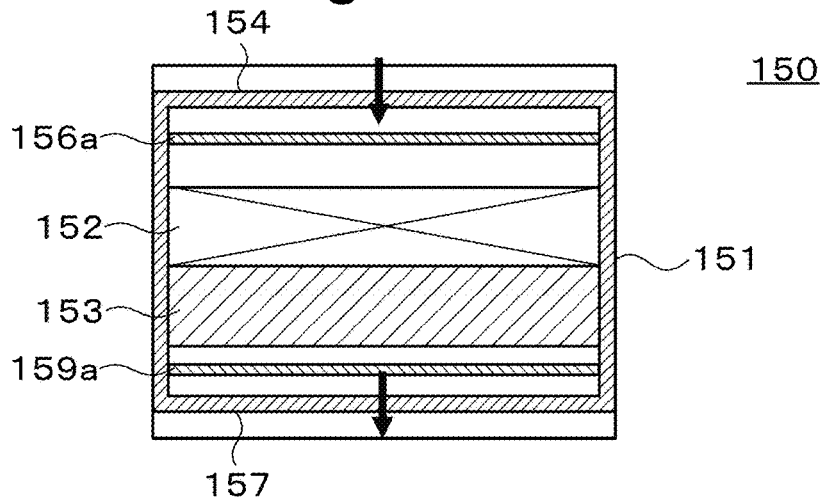
FIG. 57C A right side view showing the FFU capable of coping with radioactive substance and radiation used in the system of highly clean rooms according to the thirteenth embodiment.

The thirteenth embodiment differs from the twelfth embodiment in that the FFU 150 capable of coping with radioactive substance and radiation shown in FIG. 57A, FIG. 57B and FIG. 57C is used as the FFU 21 of the system of highly clean rooms 10. Here, FIG. 57A is the top view, FIG. 57B is the front view and FIG. 57C is the right side view.

As shown in FIG. 57A, FIG. 57B and FIG. 57C, the FFU 150 capable of coping with radioactive substance and radiation has the parallelepiped box shaped case 151. The case 151 is made of radiation shielding materials. The ventilation fan 152 and the dust filter 153 are provided inside the case 151. Plural slit-like rectangular openings 155 are provided in parallel to each other on the upper wall 154 of the case 151. In the space between the upper wall 154 of the case 151 and the ventilation fan 152, provided is the radiation shielding member 156 having the cross sectional shape of an inverted T shape composed of a horizontal part 156*a* with a long, thin, rectangular and planar shapes larger than each opening 155 and a vertical part 156*b* vertical to the horizontal part 156*a* so as to face each opening 155. The vertical part 156*b* of the radiation shielding member 156 is provided passing through the opening 155 of the upper wall 154 of the case 151, and divides the flow path of gases entering into each opening 155 into both sides. Similarly, at the lower wall 157 of the case 151, plural rectangular slit-like openings 158 are provided in parallel to each other, in the space between the lower wall 157 of the case 151 and the dust filter 153, the radiation shielding material 159 having the cross sectional shape of an inverted T shape composed of the horizontal part 156*a* with a long, thin, rectangular and planar shapes larger than each opening 158 and the vertical part 159*b* vertical to the horizontal part 159*a* so as to face each opening 158. The vertical part 159*b* of the radiation shielding material 159 is provided passing through the opening 158 of the lower wall 157 of the case 151, and divides the gas flow path that enters each opening 158 into the both sides. In this case, the radiation shielding members 156 and 159 are formed so that the radiation radiated from radioactive substance and/or radioactive substance containing particles collected at any position of the dust filter 153 does not go out directly from each opening 155 and 158 of the case 151. Also, the thickness of the wall of the case 151 and the radiation shielding members 156 and 159 is, most simply, set to the range or the absorption length of the radiation with the maximum penetrating power. As a result, with respect to the straight line toward in any direction from the radioactive substance and/or radioactive substance containing particles collected at any position of the dust filter 153, the total distance which the straight line traverses the wall of the case 151 and/or the radiation shielding members 156 and 159 becomes more than the biggest between the maximum range or the absorption length of a group of radiations radiated from the radioactive substance and/or the radioactive substance containing particles. For example, for cesium 137 of the residual radioactive substance after 3000 days from the accident, to control the 661 keV γ rays, in case of lead, about 9 mm thick plate is suitable. Here, it is desirable to set the overlapping length of the horizontal part 156*a* of the radiation shielding member 156 with the upper wall 154 so that the ratio of the overlapping length to the width of the flow path (clearance of the horizontal part 156*a*) becomes preferably 1 or more, for example about 3. For example, in case the width of the flow path is about 5 mm (1 cm), the overlapping length is about 5 mm~15 mm (1 cm~3 cm). When forming the opening 155 by the structure, referring to FIG. 71B showing a case of three columns, for example, when the 65 cm square dust filter 153 is used and the width of the flow path is 5 mm, the opening 155 of at most 650 mm/(5 mm+5 mm+5 mm+5 mm+5 mm+5 mm)~20 columns can be provided. When the width of the flow path is 1 cm, the opening 155 of at most 65 cm/(1 cm+1 cm+1 cm+1 cm+1 cm+1 cm)~10 columns opening 155 can be provided. Before the 3000 days after the accident, the capability of preventing γ rays from the cesium 134 must be hold. So, in order to prevent 1.365 MeV γ rays, a shielding plate with a 20 g/cm2 absorption length may be used. Incase of lead the thickness is about 18 mm. As the absorption length to prevent 1~2 MeV γ rays converges to 20 g/cm2 regardless of materials of carbon (C), silicon (Si), iron (Fe), tin (Sn), lead (Pb), etc., though the thickness varies in materials for the difference of density, the necessary thickness can be obtained universally as a value which divides the absorption length by the density of the materials. Also, the areas and positions of the opening 155 of the upper wall 154, the radiation shielding member 156, the opening 158 of the lower wall 157 and the radiation shielding material 159 are selected so that air that enters from the opening 155 of the upper wall 154 flows smoothly, and enters the ventilation fan 152, and air that goes out from the dust filter 153 flows smoothly, then goes out from the opening 158 of the lower wall 157. Also, the radiation radiated from the radioactive substance and/or radioactive substance containing particles collected in the filter materials (filtering media) of the dust filter 153, even the radiation radiated in any direction, is securely shielded by hitting the wall made of the radiation shielding material of the case 151 and/or the radiation shielding members 156 and 159, and is not radiated to the outside the case 151.

According to the thirteenth embodiment, the same advantages as the twelfth embodiment can be obtained. In addition, by using the FFU 15 shown in FIG. 57A, FIG. 57B and FIG. 57C, the following advantages can be obtained. That is, the radiation shielding member 156 provided facing the opening 155 of the upper wall 154 has the vertical part 156*b* protruding from the opening 155, similarly the radiation shielding material 159 provided facing the opening 158 of the lower wall 157 has the vertical part 158*b* protruding from the opening 158, so the radiation radiated toward the openings 155 and 158 from the radioactive substance and/or radioactive substance containing particles collected in the filter materials of the dust filter 153 can be securely shielded by the horizontal parts 156*a* and 159*a* or the vertical parts 156*b* and 159*b* of the radiation shielding members 156 and 159.

The Fourteenth Embodiment

Figure 58A:
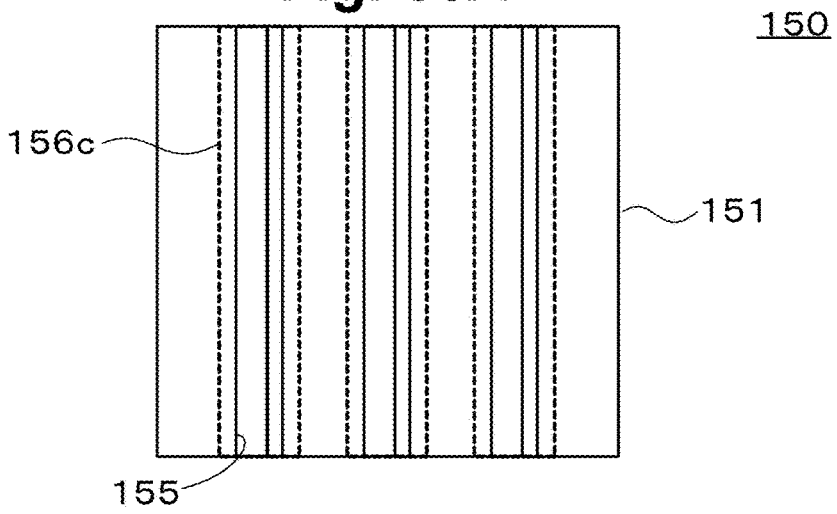
FIG. 58A A top view showing an FFU capable of coping with radioactive substance and radiation used in the system of highly clean rooms according to the fourteenth embodiment.
Figure 58B:
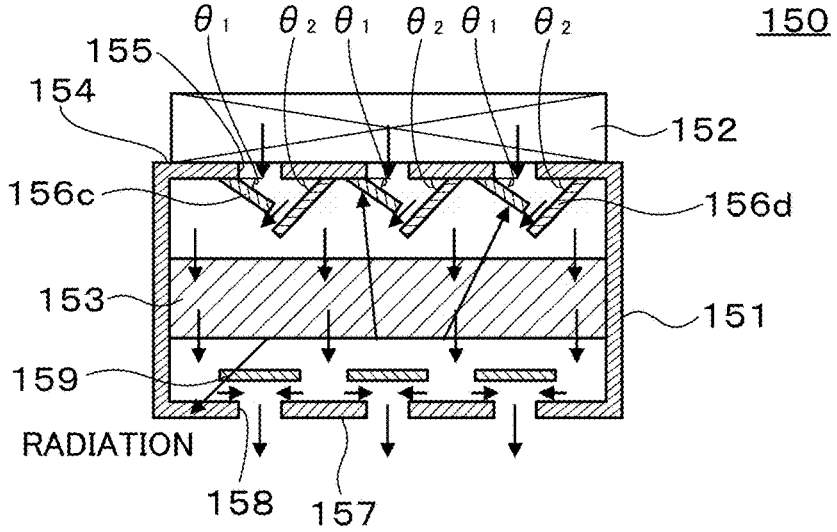
FIG. 58B A front view showing the FFU capable of coping with radioactive substance and radiation used in the system of highly clean rooms according to the fourteenth embodiment.
Figure 58C:
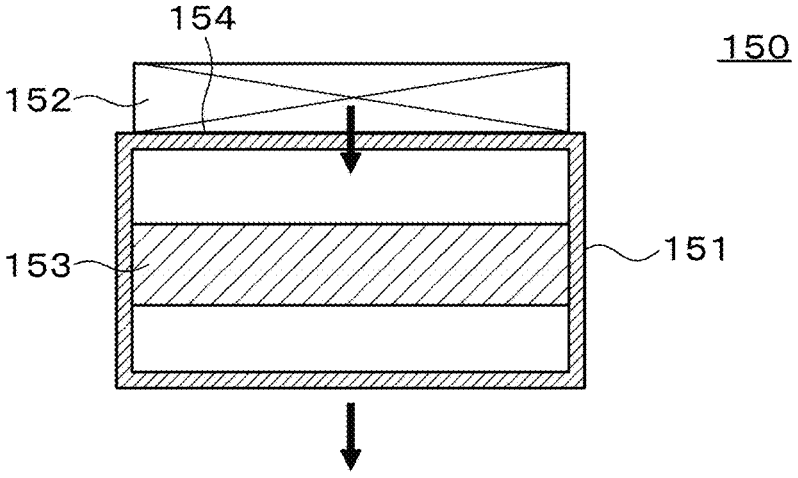
FIG. 58C A right side view showing the FFU capable of coping with radioactive substance and radiation used in the system of highly clean rooms according to the fourteenth embodiment.

The fourteenth embodiment differs from the twelfth embodiment in that the FFU 150 capable of coping with radioactive substance and radiation shown in FIG. 58A, FIG. 58B and FIG. 58C is used as the FFU 21 of the system of highly clean rooms 10. Here, FIG. 58A is the top view, FIG. 58B is the front view and FIG. 58C is the right side view.

As shown in FIG. 58A, FIG. 58B and FIG. 58C, the FFU 13 capable of coping with radioactive substance and radiation has the parallelepiped box shaped case 151. The case 151 is made of radiation shielding materials. The dust filter 153 is provided inside the case 151, but the ventilation fan 152 is provided on the upper wall 154 of the case 151 not inside the case 151. Plural slit-like rectangular openings 155 are provided in parallel to each other on the upper wall 154 of the case 151. In the space between the upper wall 154 of the case 151 and the dust filter 153, the rectangular radiation shielding members 156*c* is provided extending in the direction tilted an angle $\theta_1$ for the upper wall 154 toward the center of each opening 155 inside one side part of each opening 155 of the upper wall 154, and the rectangular radiation shielding member 156*d* is provided extending in the direction tilted an angle $\theta_2$ for the upper wall 154 toward the center of each opening 155 inside the other side part of each opening 155. Here, in order to allow the case 151 to be easily curved for the vertical direction pressure at the time of volume reduction, $\theta_1$ and $\theta_2$ are set to be 30° or more and 60° or less, but not limited to these. Also, the width of the radiation shielding member 156*d* is set to be larger than the width of the radiation shielding member 156*c* so that the radiation shielding member 156*d* does not come in contact with the radiation shielding member 156*c* and the flow path of air along the radiation shielding member 156*d* between the tip of the radiation shielding member 156*c* and the radiation shielding member 156*d* is formed. Also, on the lower wall 157 of the case 151, plural rectangular slit-like openings 158 are provided in parallel to each other, and in the space between the lower wall 157 of the case 151 and the dust filter 153, the horizontal radiation shielding material 159 is provided facing each opening 158. In this case, the radiation shielding members 156*c*, 156*d* and 159 are formed so that the radiation radiated from the radioactive substance and/or radioactive substance containing particles collected at any position of the dust filter 153 does not go out directly from each opening 155 and 158 of the case 151. Also, the thickness of the wall of the case 151 and the radiation shielding members 156*c*, 156*d* and 159 is set so that with respect to the straight line toward in any direction from the radioactive substance and/or radioactive substance containing particles collected at any position of the dust filter 153, the total distance which the straight line traverses the wall of the case 151 and/or the radiation shielding members 156*c*, 156*d* and 159 becomes more than the biggest between the maximum range or the absorption length of a group of radiations radiated from the radioactive substance and/or the radioactive substance containing particles. Also, the areas and positions of the opening 155 of the upper wall 154, the radiation shielding member 156, the opening 158 of the lower wall 157 and the radiation shielding material 159 are selected so that air that enters the opening 155 of the upper wall 154 flows smoothly, enters the ventilation fan 152, and air that goes out from the dust filter 153 flows smoothly and goes out from the opening 158 of the lower wall 157. Also, the radiation radiated from the radioactive substance and/or radioactive substance containing particles collected in the filter materials (filtering media) of the dust filter 153, even the radiation radiated in any direction, is securely shielded by hitting the wall made of radiation shielding material of the case 151 and/or the radiation shielding members 156 and 159, and is not radiated outside the case 151.

According to the fourteenth embodiment, the same advantages as the twelfth embodiment can be obtained. In addition, after using the system of highly clean rooms 10 for the predetermined period, it is only required that the case 151 including the dust filter 153 is dismounted from the FFU 150 and volume reduction of the case 151 is done by the volume reduction system. Therefore, it is possible to lower the resistance at the time of volume reduction and reduce the volume of the object to be subjected to volume reduction compared with the case where volume reduction of the case 151 including the whole FFU 15 including the ventilation fan 152 and the dust filter 153 is done, and also compared to the H-shape construction materials and T-shape construction materials including the right angle part.

The Fifteenth Embodiment

Figure 59:
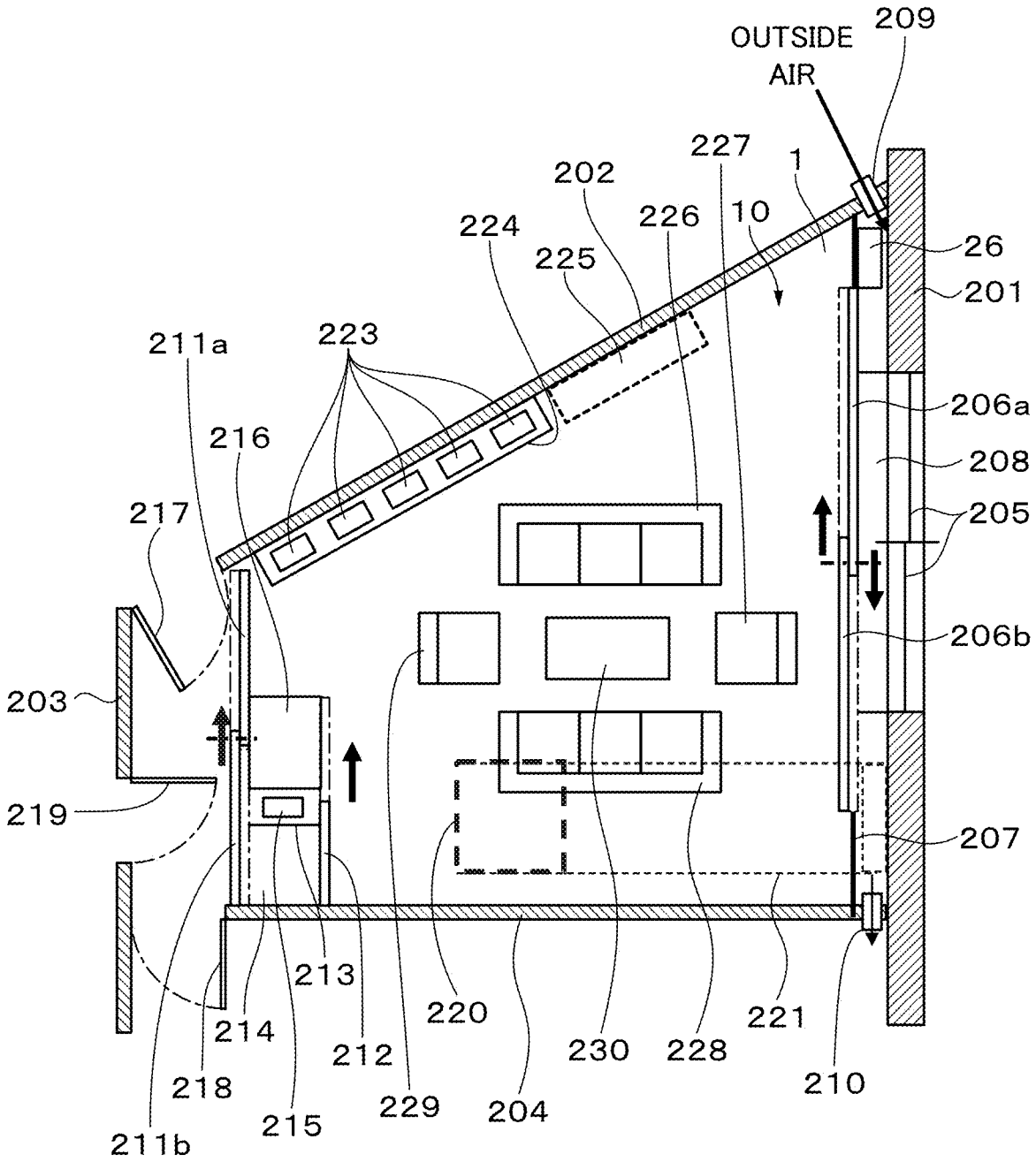
FIG. 59 A top view showing a system of highly clean rooms according to the fifteenth embodiment.
Figure 60:
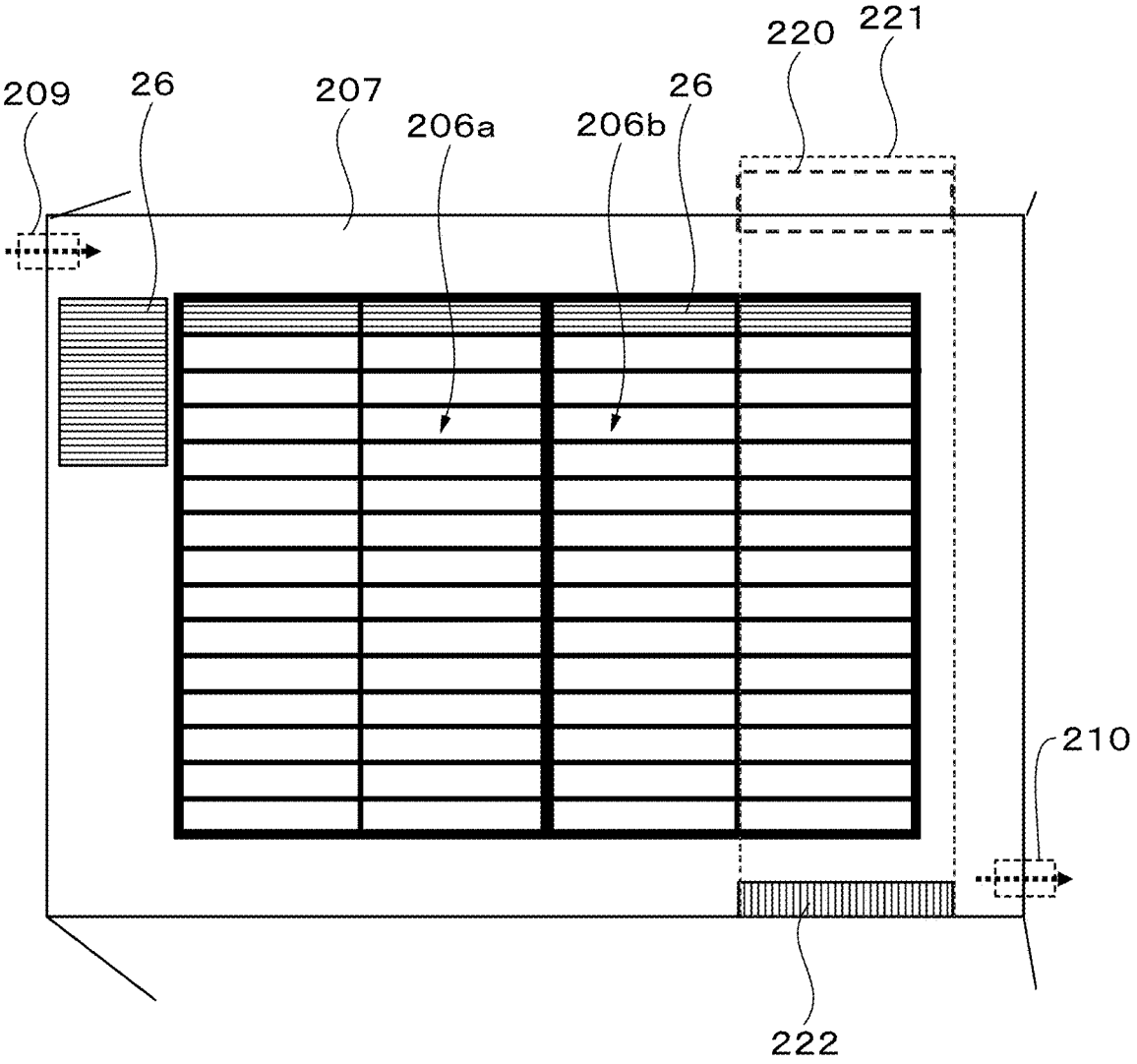
FIG. 60 A view of the room of the system of highly clean rooms according to the fifteenth embodiment sent from the inside.

FIG. 59 is the top view showing the system of highly clean rooms 10 according to the fifteenth embodiment. As shown in FIG. 59, the system of highly clean environment 10 has a room 1 of which planar shape is trapezoidal shape surrounded by walls 201~204. In FIG. 59, on the right lateral wall 201 of the room 1, an window 205 capable of opening and shutting is installed. In front of the window 205, a back-side shoji sliding door 206*a* and a front-side shoji sliding door 206*b* made of gas exchange membranes (or shoji papers) are installed at a partition wall 207, which plays a role of a double wall as described. These shoji sliding doors 206*a* and 206*b* are capable of opening and shutting as shown by an arrow in FIG. 59. These shoji sliding doors 206*a* and 206*b* face the window 205, and also plays a role of a fanlight (indirect lighting). The width of a space 208 surrounded by the window 205 and the shoji sliding doors 206*a* and 206*b* is, for example, about 15~30 cm. On the upper wall 202 in FIG. 59 of the space 208, a ventilation fan 209 for introducing outside air and on the lower wall 204 in FIG. 59, a ventilation fan 210 for exhausting air inside the room 1 outside are installed respectively. As these ventilation fans 209 and 210, for example, a ventilation fan capable of ventilating a two times volume of air of the volume of the trapezoidal shape room 1 in two hours may be used. FIG. 60 shows a drawing looking at the sides of the shoji sliding doors 206*a* and 206*b* from the inside of the room 1 of FIG. 59. As shown in FIG. 60, the upper parts of the shoji sliding doors 206*a* and 206*b* consist of the folded gas exchange membrane 26 which can be obtained by doing the flat gas exchange membrane mountain fold and valley fold, not a simple flat gas exchange membrane. The folded gas exchange membrane 26 like this can increase its surface area and therefore increase the gas exchange ability remarkably. The folding width of the folded gas exchange membrane 26 is preferably the width of a bar of a shoji or so (for example, about 10 mm). Based on the idea, at the partition wall 207 of the upper left side part of the shoji sliding door 206*a*, the folded gas exchange membrane 26 is provided. The folding width of the folded gas exchange membrane 26 is, for example, 10~30 cm. The mountain-valley structure being folded has a structure like the gas exchange membrane 26 shown in FIG. 45, but the edge of folding is treated so that inside air of the room 1 and air inside the double wall do not mix. The ridge direction of the gas exchange membrane 26 being done mountain fold and valley fold is set to conform air flow in the space of the double wall, by this the effect enhances (in the event of a power failure) and is reassured (the structure and distribution of the gas exchange membrane done mountain fold and valley fold are preferable for using in the gas exchange membrane 26 of the ceiling surface shown in FIG. 10, FIG. 35~FIG. 38). At the left side in FIG. 59, the wide sliding doors 211*a* and 211*b* are installed between the wall 202 and the wall 204. For example, generally the sliding door 211*a* is shut, and people move by opening and shutting the sliding door 211*b*. The sliding door 211*a* is opened and shut when a large-size package etc. is carried out from the room 1 or carried into the room 1. Also, at the predetermined position from these sliding doors 211*a* and 211*b*, a single swing sliding door 212 is installed in parallel to the sliding doors 211*a* and 211*b*. The sliding door 212 can be pulled until it comes to the wall 204. A part of the sliding door 212 is constituted of the gas exchange membrane 26. A partition wall 213 is provided in parallel to the wall 204 so as to divide the space between the sliding door 211*b* and sliding door 212. And an anteroom 214 is constituted by the space surrounded by the sliding door 211*b*, the sliding door 212, the partition wall 213 and the partition wall 204. The size of the anteroom 214 is, for example, the size that one person can enter, the area of the base is about 1 m2, for example, about 90 cm in width×about 60 cm in depth. The anteroom 214 is installed so that air inside it is interchanged in one~a few minutes by the FFU. An air cleaning device 215 is installed behind the partition wall 213 of the anteroom 214. The space behind the air cleaning device 215 is a utility space 216 for setting a rocker, a coatrack, etc. The sliding door 212 can cover the utility space 216 when the sliding door 212 is pulled most distant from the partition wall 204. A rotary door 217 is installed between the wall 202 and the wall 203, and people can move in the space between the sliding doors 211*a*, 211*b* and the wall 203 by opening and shutting the door 217. Also, a rotary door 218 is installed between the wall 204 and the wall 203, and people can move the space between the sliding doors 211*a*, 211*b* and the wall 203 by opening and shutting the door 218. Also, a rotary door 219 is provided on the wall 203, people can move the space between the sliding doors 211*a*, 211*b* and the wall 203 by opening and shutting the door 219. The PURESPACE10 as the main FFU 220 is provided on the ceiling of the room 1 and a 100% circulation feedback system is made together with a feedback path 211 which is a gas flow path connected with the PURESPACE10 provided in the space between the roof and the ceiling. An absorption opening 222 (refer to FIG. 60) is provided at the lower part of the partition wall 207 of the room 1 on the side of the wall 204. Plural air cleaning devices 223 are placed in front of the lower part of the wall 202 of the room 1. These air cleaning devices 223 are stored inside a storing part 224 of which upper part is open. These air cleaning devices 223 constitute a system attached to the 100% circulation feedback system by the main FFU 220 and contribute to improve cleanliness of the room 1 as a group of the FFUs which assist the 100% circulation feedback system. As the air cleaning devices 215 and 223, for example, the F-PDF 35 made by Panasonic Corporation can be used. Also, an air conditioner 225 is installed on the upper part of the wall surface of the wall 202. As an example, a reception set consisting of sofas 226~229 and a table 230 is placed inside the room 1.

According to the fifteenth embodiment, the same advantages as the second to the ninth embodiments can be obtained.

The Sixteenth Embodiment

Figure 61:
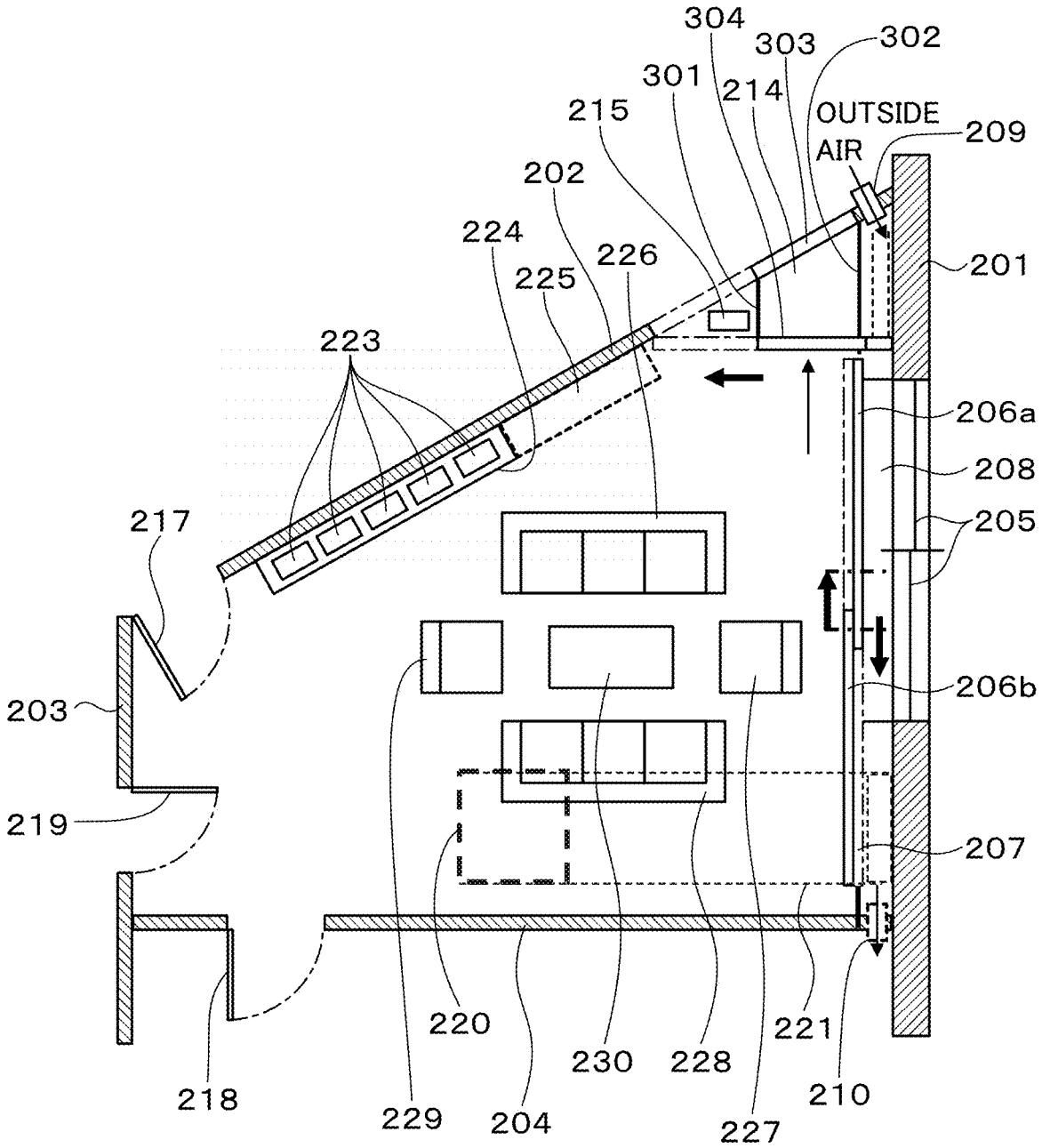
FIG. 61 A top view showing a system of highly clean rooms according to the sixteenth embodiment.
Figure 62:
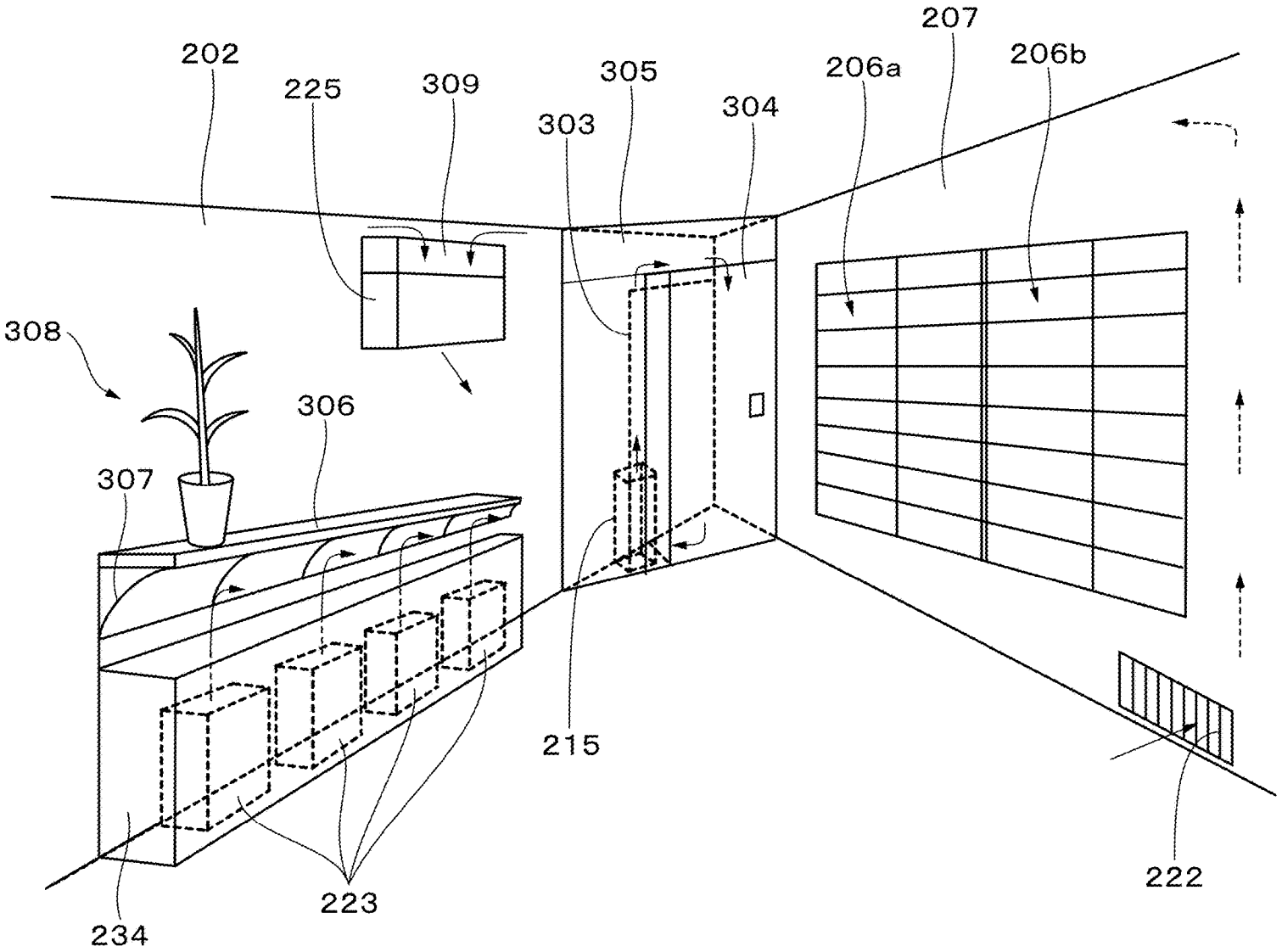
FIG. 62 A view of the room of the system of highly clean rooms according to the sixteenth embodiment seen from the inside.
Figure 63:
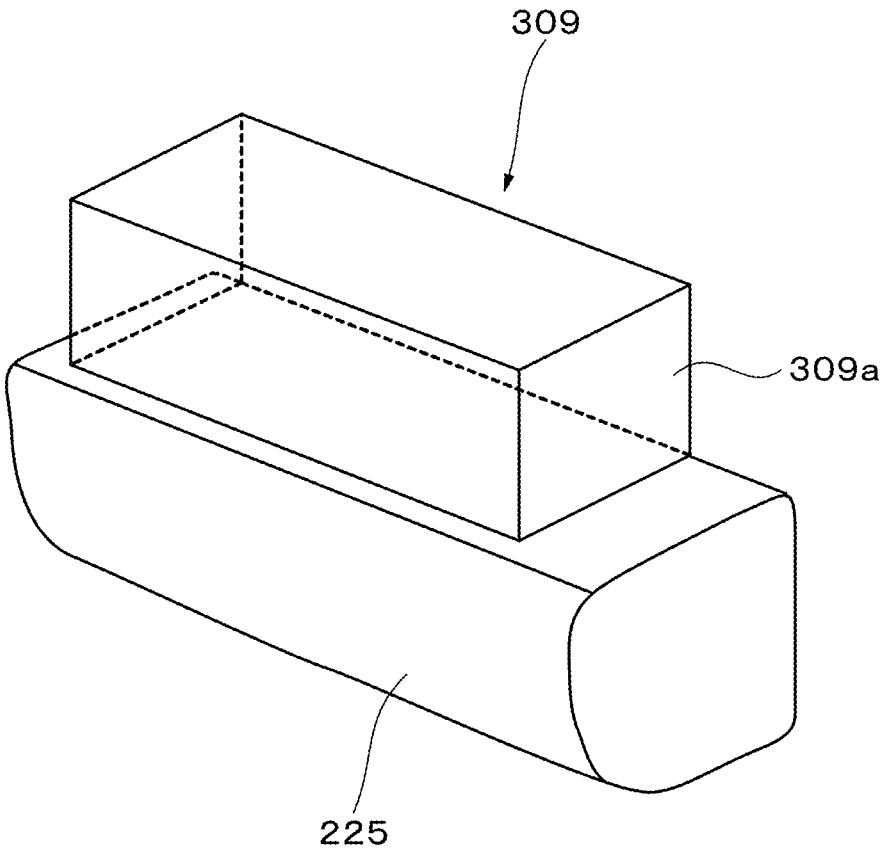
FIG. 63 A perspective view showing the air conditioner attached to the wall of the room in the system of highly clean rooms according to the sixteenth embodiment and the prefilter thereon.
Figure 64:
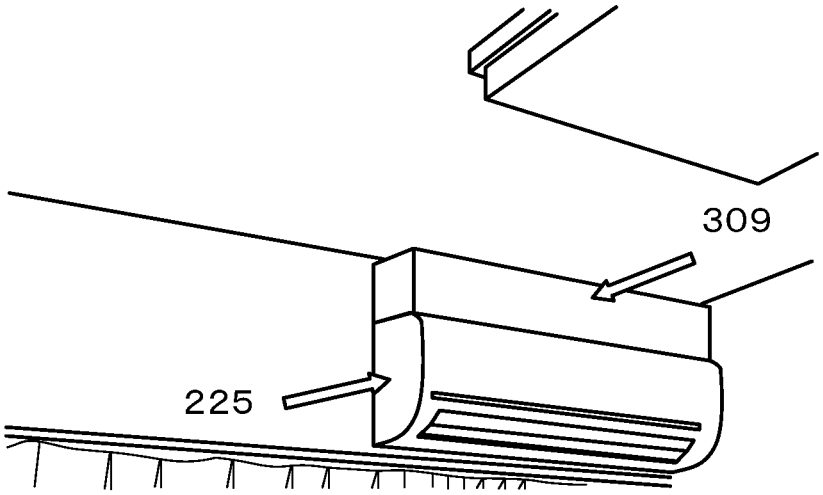
FIG. 64 A substitute picture for a drawing showing an example of the air conditioner attached to the wall of the room in the system of highly clean rooms according to the sixteenth embodiment and the prefilter thereon.
Figure 65:
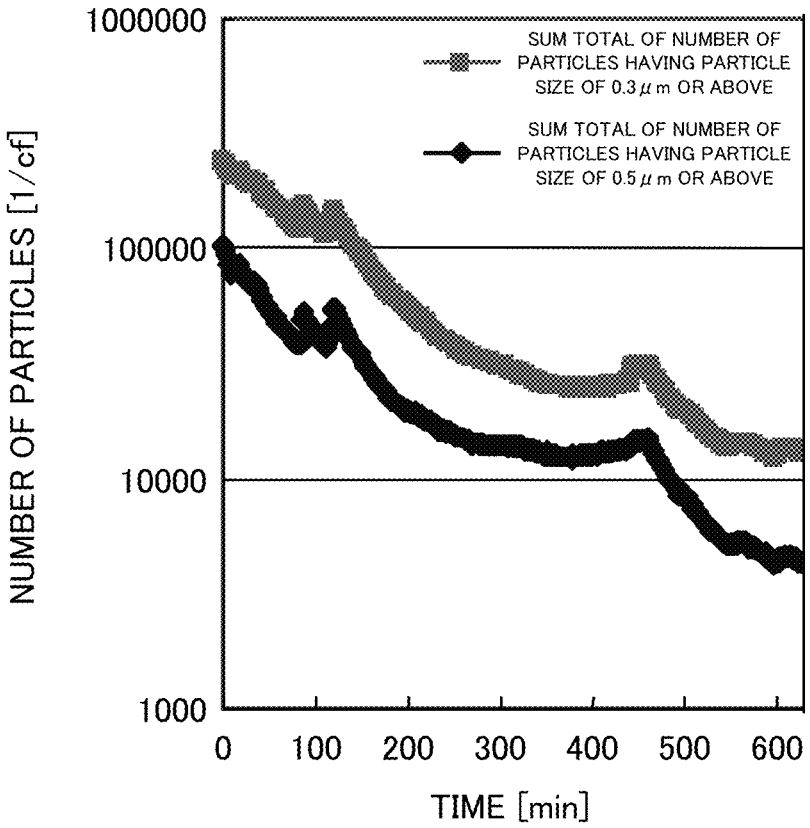
FIG. 65 A schematic diagram showing the result of measurement of a time change of the density of dust particles when the room is cleaned by the air conditioner attached to the wall of the conventional common room and the prefilter thereon.
Figure 66:
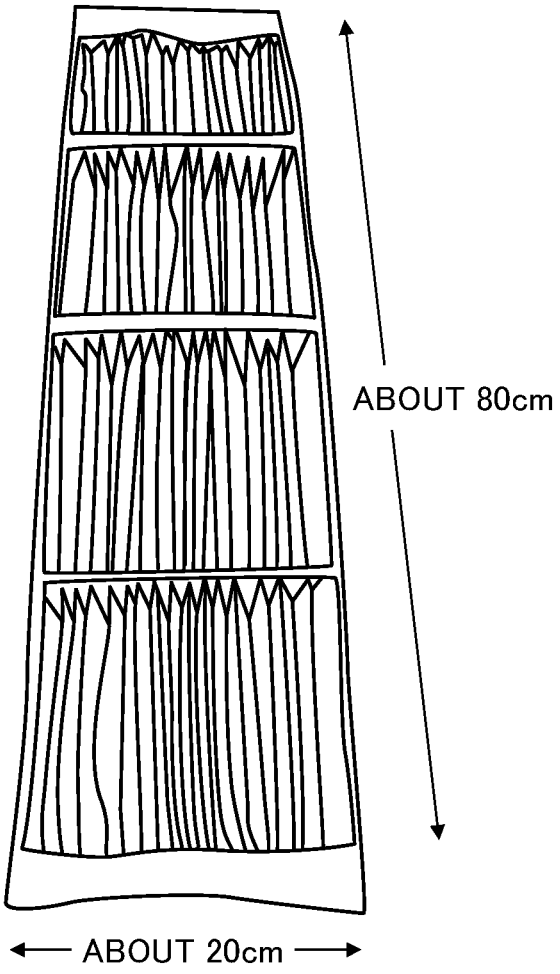
FIG. 66 A substitute picture for a drawing showing a prefilter used in an experiment of measuring a time change of the density of dust particles shown in FIG. 65.

FIG. 61 is the top view showing the system of highly clean rooms 10 according to the sixteenth embodiment. As shown in FIG. 61, in the system of highly clean environment 10, the position in the room 1 in which the anteroom 214 is installed is different from the system of highly clean environment 10 according to the sixteenth embodiment. That is, as shown in FIG. 61, the anteroom 214 is installed at the triangle part formed by the wall 201 and the wall 202. Partition walls 301 and 302 are installed on the both sides of the anteroom 214. A single swing sliding door 303 is installed on the wall 202 in the vicinity of these partition walls 301 and 302. Also, a single swing sliding door 304 is installed between the anteroom 214 and the inside of the room 1. The air cleaning device 215 is installed in the triangle space surrounded by the wall 202, the partition wall 301 and the movement space of the sliding door 304. The sliding doors 211*a*, 211*b*, 212, the utility space 216, etc. that are installed in the system of highly clean rooms 10 according to the sixteenth embodiment are not installed. FIG. 62 shows a sketch of the inside of the room 1 (a drawing looking at the sides of the wall 202, the wall 207 and the sliding door 304 from the inside of the room 1). In FIG. 62, the reference numeral 305 shows the wall installed the sliding door 304, and the reference numeral 306 shows the shelf installed on the wall 202. The shelf 306 is installed on the wall 202 by a fixing member 307 with a smooth curved plane. The shelf 306 may be used as a space to place things, here, as an example, a flower vase 308 is placed. Plural air cleaning devices 223 are installed in front of the lower part of the wall 202 of the room 1. These air cleaning devices 223 are stored inside the storing part 234 of which upper part is open, installed under the curved plane of the fixing member 307. The air cleaning devices 223 are attached to the 100% circulating feedback system by the main FFU 220, and contribute to improve cleanliness of the room 1 as a system which has an opening for taking in inside air of the room and a blow opening for returning again all of absorbed air after cleaned inside the room as a pair. A prefilter 309 is fixed at a ventilation opening of the upper part of the air conditioner 225 installed on the wall surface of the wall 202. FIG. 63 shows the air conditioner 225 and the prefilter 309 fixed on it. The prefilter 309 has a structure that mountain-folded and valley-folded filter materials are stored inside a box 309*a* of which bottom surface and upper surface are open. An example that the air conditioner 225 and the prefilter 309 are actually installed on the wall of a room is shown in FIG. 64. Air coming from a ventilation opening at the upper part of the air conditioner 225 enters inside the prefilter 309 from the bottom surface of the prefilter 309, is filtered by the filter materials, and filtered air comes out from the top surface of the prefilter 309. Shown in FIG. 65 is the result of measurement of the time change of the density of dust particles inside a room when the air conditioner 225 installed the prefilter 309 is operated in an existing general room with the high density of dust particles. Here, RAS-KJ22B (W) made by Hitachi, Ltd. is used as the air conditioner 225 and the prefilter 309 has a structure that mountain-folded and valley-folded filter materials are stored inside a box with width of about 20 cm and length of about 80 cm as shown in FIG. 66. As the filter materials, ASAHIPEN shoji paper No. 5641 of which measured values of the collection efficiency for respective particle diameters mentioned in the discussion of FIG. 27 is used because of the good workability. As shown in FIG. 65, before starting the operation of the air conditioner 225 fixed the prefilter 309, cleanliness of the room is US 209D class 120000 and there are a lot of dust, but after starting the operation the density of dust particles begins to reduce rapidly, and after ten hours have passed, the density of dust particles reduces to about one thirty, which corresponds to US 209D class 4000. That is, (although the collection efficiency $\gamma$ of the filter materials used this time is not high enough), it is known that according to the equation (5) described above, good cleanliness can be attained. By using materials that have the collection efficiency $\gamma$ closer to 1 and low pressure loss and are capable of attaining the flow rate as the materials of the prefilter 309, according to the equation (5), it is possible to realize remarkably good cleanliness in a shorter time. Similar to the air cleaning device 223, the air conditioner 225 fixed the prefilter 309 works as a system attached to the 100% circulation feedback system by the main FFU 220 and assists the 100% circulation feedback system. Other than those of the above is the same as the system of highly clean rooms 10 according to the eleventh embodiment.

As described above, FIG. 61 shows a system comprising: at least one of the walls constituting a room being constituted of a wall with an internal space capable of introducing air for the room, airways communicating the outside and the internal space being provided on the edge of the wall, at least one of major surfaces forming the internal space being made of a membrane not passing through dust particles but passing through gas molecules, the room being provided inside with a living space as an enclosed space, wherein the room is provided inside with an opening for absorbing air inside the room and a blow opening for returning again all of the absorbed air after cleaning inside the room as a pair and three systems of the device having the pair of the opening for absorbing air and the blow opening are provided in parallel. It is dominant to simultaneously operate the three systems (or two of them), and to obtain high cleanliness at the fastest (or in a relatively short time). However, by switching from the "rough" mode to "fine" mode making use of the three systems characteristics like "the vacuum chamber" described below, high cleanliness can be attained and maintained more elegantly.

According to the sixteenth embodiment, the same advantages as the second to the ninth embodiments can be obtained.

The embodiments and examples of the present invention have been explained specifically. However, the present invention is not limited to these embodiments and examples, but various changes and modifications based on the technical idea of the present invention are possible. For example, the wall 9 shown in the embodiments is not necessarily limited to the lateral wall of the room 1, but may be a part of the ceiling wall or the floor wall. Also, the wall 9 may constitute a part of the multiple structure of a gas exchange device.

Figure 67A:
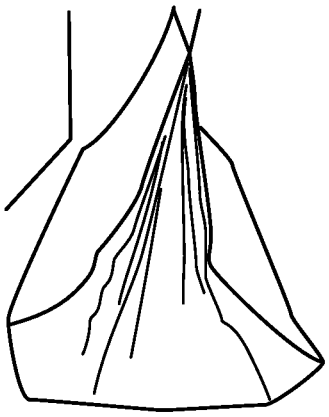
FIG. 67A A substitute picture for a drawing showing a tent like structure made of the gas exchange membrane.
Figure 67B:
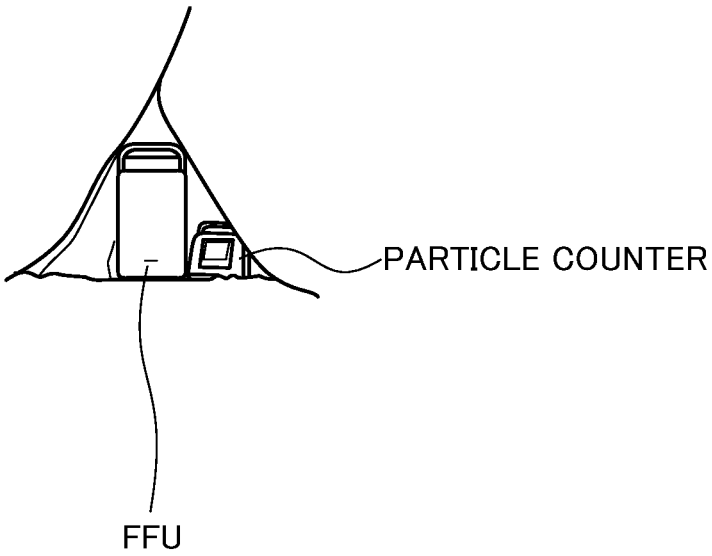
FIG. 67B A substitute picture for a drawing showing a tent like structure made of the gas exchange membrane.
Figure 68:
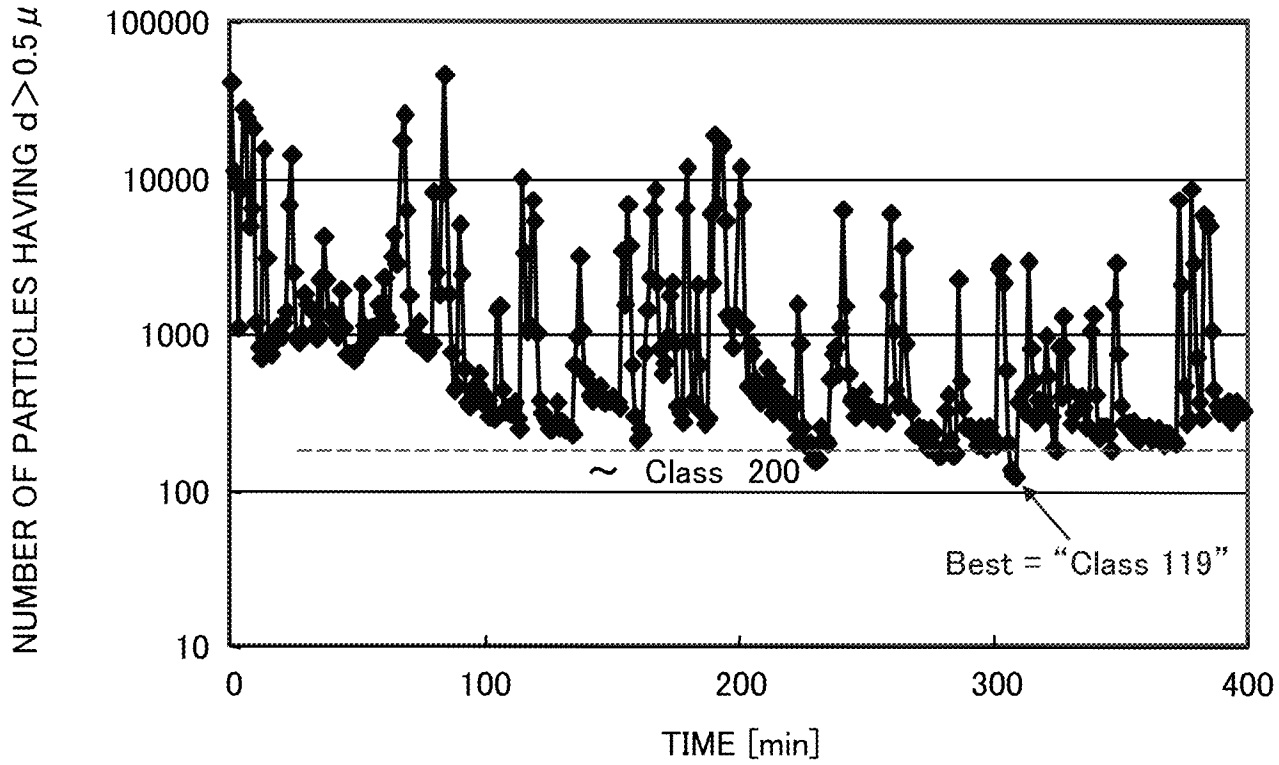
FIG. 68 A schematic diagram showing the result of measurement of a time change of the total number of dust particles having the particle size of 0.5 μm or more inside the tent like structure shown in FIG. 67A and FIG. 67B.

Also, in the case where the area A of the gas exchange membrane 26 calculated like this has the value giving oxygen supply ability suitable for the main room 20, the gas exchange membrane 26 may be directly in contact with the outer space (for example, outdoors, space of a hallway, or a room itself in which a tent is placed in the case of the tent structure consisting of the gas exchange membrane shown in FIG. 67A and FIG. 67B [the areas of the gas exchange membrane occupying a corner or all of the side surface and the surface of the ceiling satisfies the condition of the above necessary area] the room itself to be placed the tent). In this case, maintaining the favorable oxygen concentration with the sufficient ability of oxygen penetration, at the time of about seven hours sleep as shown in FIG. 68, it is possible to obtain good sleep in a good clean environment better than class 1000 on average (about class 100 especially during deep sleep without turning over). The spikes seen in FIG. 68 result from dust flying when turning over etc., but from the frequency spectrum of the spike sequence, a sleeper's health condition etc. can be presumed. In the case where the system of highly clean rooms 10 is applied to a special nursing home for the aged etc., it is possible not only to confirm the safety of the user of the system of highly clean rooms 10, but also to monitor plural persons under medical treatment from a distant place with high accuracy with respect to the change from the characteristic during general sleep etc. (not analysis based on the image information etc., so covering appropriate consideration on the privacy).

It may be possible to introduce air after dust is removed by the FFU with the HEPA filter etc. in advance inside the room 1 in a low flow rate capable of rotating air inside the room 1 one time in about two hours and blow the same volume from the room 1 outside by another FFU of the same model.

It is also possible to obtain a gas exchange mechanism by connecting the outside air introduction opening 71 of the gas exchange device 80 shown in the above with, for example, the outside air absorption opening 85 of the system of highly clean rooms 10 shown in FIG. 52, FIG. 54 and FIG. 55 and by connecting the exhaust opening 73 of the gas exchange device 80 with the exhaust opening 86 of the system of highly clean rooms 10. In this case, it is preferable to set the flow rate of the inside air flowing in the gas exchange device 80 at least equal to or larger than the flow rate capable of rotating air inside the living space 6 one time in two hours. Also, the room 1 constituting the system of highly clean rooms 10 is provided inside with the circulation feedback mechanism in which the opening for absorbing air inside the room and the blow opening for returning again all of the absorbed air after cleaning inside the room are provided as a pair. Like this, it is effective that the system of highly clean rooms 10 has at least one living space (highly clean room) characterizing in having two elements of the gas exchange mechanism and circulation feedback mechanism. This is understood that in the room 1, the trilaminar structure of the "outside air/membrane/inside air" in which the internal space 7 communicating with the outer space of the wall 9 is in contact with the living space 6 via the gas exchange membrane 26 is "cut" and "pasted" on another place such as the space between the roof and the ceiling through the absorption tube 75 and the gas flow path 83, etc. It is desirable to make the ratio of the area and the volume (the total area of the membrane/the volume of the device) of the trilaminar structure large as much as possible. Also, the position of "the pasting place" or "the destination" of the functional part relative to the living space 6 does not matter as far as the inside air feedback path (for example, the gas flow path 24) communicates with the living space 6 and the outside air absorption and exhaust opening (for example, the outside air absorption opening 85 and the exhaust opening 86). That is, unless otherwise existing the gas exchange ability, the existing place itself of the trilaminar structure of "outside air/membrane/inside air" does not need to be existed in contact with the living space 6 at the outer edges of the living space 6 and the place can be moved at any place and be set through the air flow tube (for example, the absorption tube 75, the gas flow path 83, etc.) as far as the gas exchange ability is ensured. The total area of the gas exchange membrane 26 in the gas exchange device 80 secures the enough oxygen concentration for persons to act inside by satisfying the equation (15) at the very least and further, by making the area as large as possible, in addition to the above, deodorizing and the harmful gas exhaust function can be enhanced. Also, with respect to the opening for absorbing air inside the living space 6 and the blow opening for returning again all of the absorbed air after cleaning inside the living space 6, for example, it is effective to have the structure of the absorption opening 23 and the blow opening 22 in the system of highly clean rooms 10 shown in FIG. 12~FIG. 14, or FIG. 52, FIG. 54 and FIG. 55, or, most simply, by installing the gas exchange device 80 communicating with the inside of the living space 6 and further placing an air conditioner fixed on the wall, a stand-alone air cleaning device or a photocatalyst deodorization device for filtering all of the absorbed air and blowing it again from the air flow emission opening inside the living space 6 and operating them.

Also, for example, it is possible to provide a first-class ventilation facility by installing an air supply device (machine) with a high cleanliness filter which is effective for ventilation and an exhaust device (machine) in a living space as a structure of a full-time mechanical ventilation equipment. Also, in each system of highly clean rooms 10 shown in the above, a low flow rate FFU with the HEPA filter having the exhaust flow rate that does not nearly affect the system in its flow rate, as shown in FIG. 52, FIG. 54 and FIG. 55 may be installed as a mechanical ventilation between the main room and the hallway or between the main room and the outside in pair at the absorption side (in) and the exhaust side (out).

Also, the internal space of the room 1 described as a living space assuming the daily life is not limited to mere living and it is needless to say that the internal space can be used as a high quality operation space such as a dust-free lacquering space or a high quality painting space including lacquering without worrying about low yield ratio by dust, etc. Especially, in the case of painting operation, when using especially harmful organic solvent etc., it is desirable to use a local exhaust system by the gas exchange device exchanging only gas constituent but not passing through dust for safety and health maintenance of workers.

Also, in order to pass all of gases flowing from the blow opening of the FFU 21 through the opening 23 provided in a part of the inner wall 9*a* and return them to the FFU 21 through the gas flow path 24 communicating the opening 23 and the gas flow opening airtightly, if the space of the room may be reduced, it may be possible to use the duct installed later such as bellows etc. fixed along the inner wall 9*a*. It is also possible to use the outside space adjacent to the main room 20 as an outside air introduction space. That is, by constituting the lateral wall 2 of the main room 20 by the gas exchange membrane 26, the main room 20 can be directly connected with an outdoor space (outside space) via the gas exchange membrane 26. In this case, the outside air introduction space is a semi-infinite open space.

Also, it is also possible to install the two FFUs with the HEPA filter for the inlet and the outlet respectively in the main room 20 with the flow rate capable of circulating air inside the main room one time in two hours.

By constructing the room 1 with a partition wall that partially includes the gas exchange membrane 26, it is possible to make a complete enclosed space for the outer space and further build in a fail-safe mechanism regarding the maintenance of cleanliness and sterility at the time of loss of power because there is no pressure difference between the inside and the outside of the room 1.

The FFU 21 is preferably used for the interface between the main room 20 or the living space 6 and the internal space 7, but if permitting to sacrifice attainable cleanliness a little, it is not necessary to apply this configuration. That is, if the structure that a part of the partition wall provided between the internal space 7 and the main room 20 or the living space 6 is constituted by the gas exchange membrane and fresh air is taken in the internal space 7, it is possible to use the existing air conditioner fixed on the wall as it is as the main FFU 21.

As described above, whereas conventional ventilation of air exchanges a part of air inside the room with outside air as it is (that is, liken to the blood donation, extracting and donating the whole blood), the present invention is constituted so that while leaving the base part of air as it is, a treatment is made only for the part of increase and decrease by consumption and generation (again, liken to the blood donation, corresponds to the element blood donation and blood transfusion supplying only necessary element). And, the numerals, structures, constitutions, figures, materials, etc. described in the embodiments and examples are only examples, and as necessary, different numerals, structures, constitutions, figures, materials, etc. may be used.

Also, according to the present invention, by using the numerals, structures and constitutions described in the above embodiments and examples, it is possible to control the microbial environment of activity environment and living environment of people to the desired environment by making the airborne microbes once zero in a predetermined space (the "vacuum" equivalent state in the microbial environment is realized) in a similar way that the vacuum technology and vacuum chamber is used to make the inside of the vacuum chamber to vacuum once and set the inside gas environment freely, or make use the vacuum environment in thin-film growth and manufacturing the materials and devices. Under the conditions, by positively introducing better microbes, or introducing gas phase medicinal products, aroma, etc., it is possible not only to realize the new medical environment, techniques and the nursing environment, but also to create and develop the new medical treatment, medical treatment technique, services (for example, refer to safety confirmation methods and analysis method of health condition described in the discussion of FIG. 68. Especially, in the case of dosing medicines for lungs, dosing can be done with high quality air under favorable "S/N ratio", that is, with no "noise" like dust, germs, etc. (the elements other than medicine is almost zero). As necessary, different numerals, structures, constitutions and methods may be used.

EXPLANATION OF REFERENCE NUMERALS

1 room
1*a* room
1*b* room
2 wall
3 hollow wall
4 roof
5 space between the roof and the ceiling
6 living space
7 internal space
8 doorway
9 wall
10 system of highly clean rooms
11 airway
19 utility space
21 FFU
22 blow opening
23 opening
24 gas flow path
26 gas exchange membrane

The invention claimed is:

1. A system of highly clean rooms, comprising:

at least one room including a closed activity space; and a gas exchange device connected to the at least one room, the gas exchange device comprising membranes stacked in parallel spaced from 3 mm to 60 mm apart with coplanar edge faces wherein each of the edge faces is bounded on two sides by a smallest dimension, wherein the membranes do not pass dust particles but do pass gas molecules, the gas exchange device being connected to or having an outside air introduction opening, an inside air collection opening, an outside air after gas exchange exhaust opening and an inside air after gas exchange exhaust opening, each opening oriented to generally provide airflow parallel to a largest face of each of the membranes, wherein outside air introduced into the gas exchange device from the outside air introduction opening and gases inside the closed activity space collected in the gas exchange device from the inside air collection opening are both subject to exchange of the gas molecules that they both contain through the membranes, and wherein the membranes have a combined area A set so that {(V/A)/(D/L)} is no greater than a specified time governed by an oxygen consumption rate inside the closed activity space, where V is a volume of the closed activity space, A is the combined area of the membranes, L is a thickness of a membrane, and D is a diffusion constant of oxygen in the membranes, the combined area A of the membranes being set so as to satisfy at least $$A \geqq \frac{BL}{D\left(\frac{V_{O_2}}{V} - \eta\right)} \tag{15}$$

so that there is no net air flow between the closed activity space and the outside, resulting in reduced need for ventilation power, where B is the oxygen consumption rate inside the closed activity space, $Vo_2$ is a volume of oxygen inside the closed activity space in equilibrium state with the outside air when there is no oxygen consumption in the closed activity space and η is a target oxygen concentration inside the closed activity space, where η is greater than 0.18.

2. The system of highly clean rooms according to claim 1 further comprising a fan filter unit having a blow opening or outlet with which clean air is fed to the closed activity space so that all gases which flow inside the closed activity space from the blow opening or outlet are returned to an inlet of the fan filter unit.

* * * * *